United States Patent [19]

Butler

[11] 4,085,438

[45] Apr. 18, 1978

[54] DIGITAL SOOTBLOWER CONTROL SYSTEMS AND METHODS THEREFOR

[75] Inventor: Robert Gerald Butler, Erie, Pa.

[73] Assignee: Copes-Vulcan Inc., Lake City, Pa.

[21] Appl. No.: 741,136

[22] Filed: Nov. 11, 1976

[51] Int. Cl.[2] ..... G06F 15/46; F23J 1/00

[52] U.S. Cl. ..... 364/107; 15/316 A; 122/392; 364/300; 364/505

[58] Field of Search ..... 235/151; 444/1; 445/1; 122/390, 391, 392; 15/316 A, 317, 318

[56] References Cited

U.S. PATENT DOCUMENTS

| | | | |
|---|---|---|---|
| 2,825,922 | 3/1958 | Murray, Jr. | 15/316 A |
| 2,948,013 | 8/1960 | Bearer, Jr. | 15/316 A |
| 3,137,278 | 6/1964 | Cantieri et al. | 122/392 |
| 3,257,993 | 6/1966 | Kochey, Jr. | 122/392 |

OTHER PUBLICATIONS

Control Soot Blowers with Microprocessors, Electrical World, Apr. 15, 1976, p. 45.

Barnich: Soot Blowers Respond to Orders of CPU Chip., Electronics, June 24, 1976, pp. 115, 116.

Cantieri et al: The Boiler Cleaning Control Sub Loop, Combustion, Nov. 1962.

*Primary Examiner*—Felix D. Gruber

*Attorney, Agent, or Firm*—Marn & Jangarathis

[57] ABSTRACT

Digital sootblower control systems and methods therefor are provided in accordance with the teachings of the present invention. In the digital sootblower control systems provided within the present invention, a programmable controller is interconnected to a scanner, a display panel, sootblower drivers, sootblower signal receivers, and information input panels. The information input panels are capable of designating sootblowers within the system, sootblowing program routines to be established and sequences of program routines to be initiated. The programmable controller is provided with an executive program which is determinative of system parameters to be monitored as well as limits upon sootblowing program routines to be established. Once a sootblowing program routine has been initiated by an operator, the programmable controller issues orders to the sootblower drivers to start an initial sequence of sootblowers defined in the inititated sootblowing program routine. Thereafter, the scanner cyclically addresses all sootblowers so that the inactive or active state thereof is supplied by the sootblower signal receiver to the display panel which provides indicia as to the state of the system and to the programmable controller for monitoring purposes. Should problems develop with sootblowers in service being monitored by the controller, the problem area and malfunctioning sootblower are indicated at the display and when appropriate, the unit is returned to an inactive state. If the controller malfunctions, sootblower operation may be manually initiated by an operator from the information input panel despite the malfunctioning of the programmable controller.

110 Claims, 24 Drawing Figures

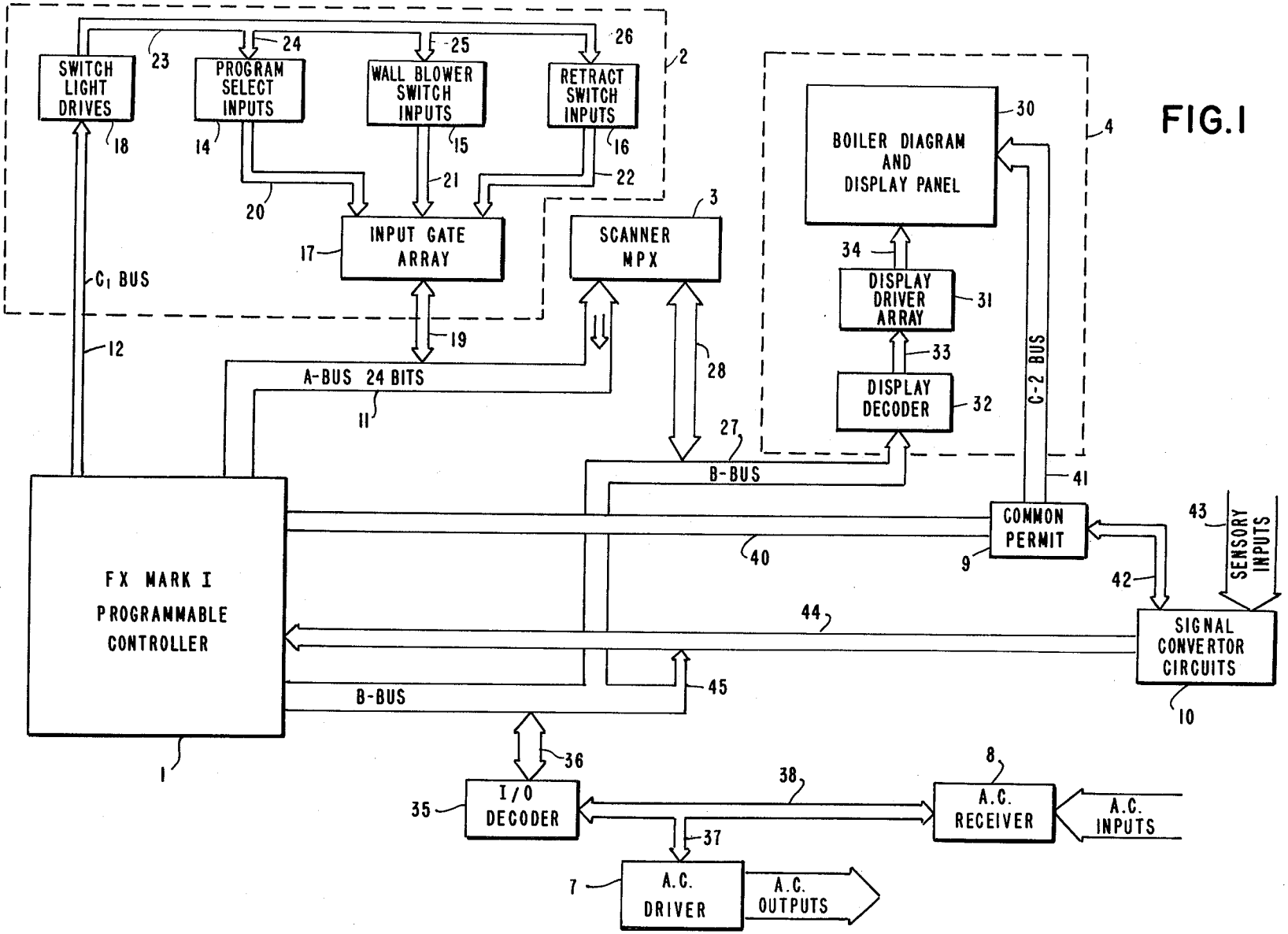
FIG. 1
SENSORY INPUTS
SIGNAL CONVERTOR CIRCUITS
COMMON PERMIT
G-2 BUS
BOILER DIAGRAM AND DISPLAY PANEL
DISPLAY DRIVER ARRAY
DISPLAY DECODER
A.C. INPUTS
A.C. RECEIVER
A.C. OUTPUTS
A.C. DRIVER
I/O DECODER
B-BUS
SCANNER MPX
RETRACT SWITCH INPUTS
WALL BLOWER SWITCH INPUTS
INPUT GATE ARRAY
PROGRAM SELECT INPUTS
SWITCH LIGHT DRIVES
A-BUS 24 BITS
G1 BUS
FX MARK I PROGRAMMABLE CONTROLLER

Figure 7:
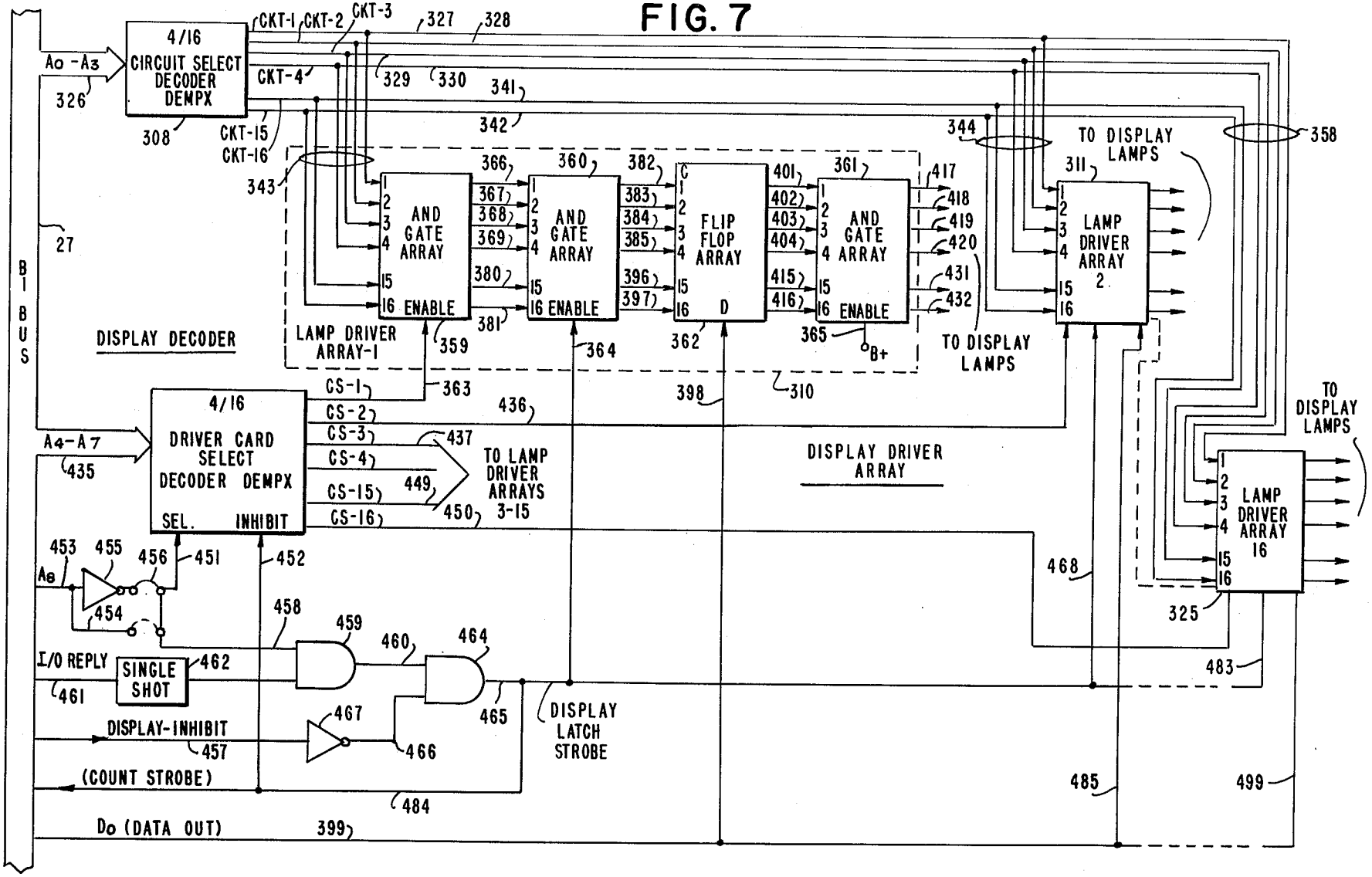
Figure 9:
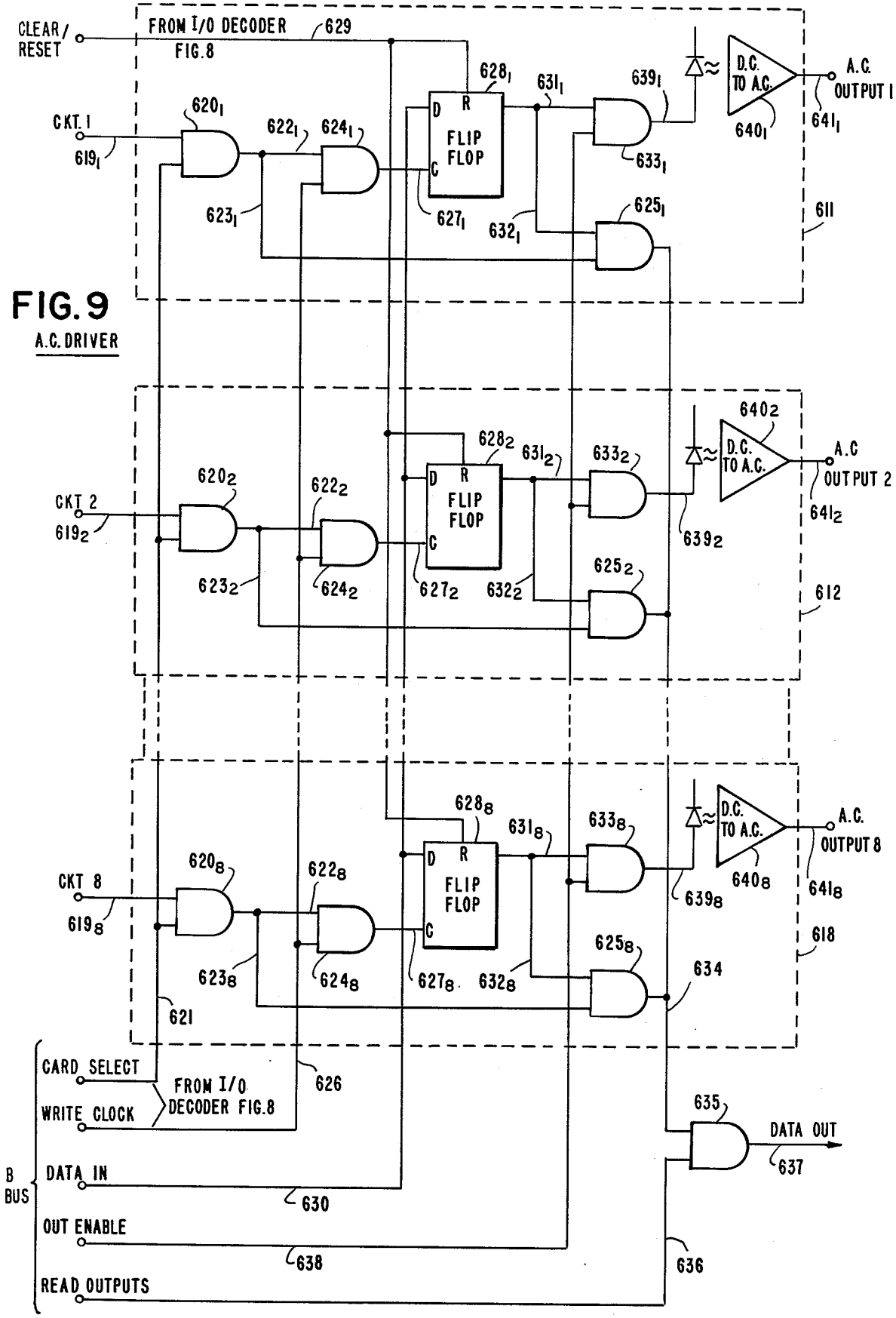
Figure 10:
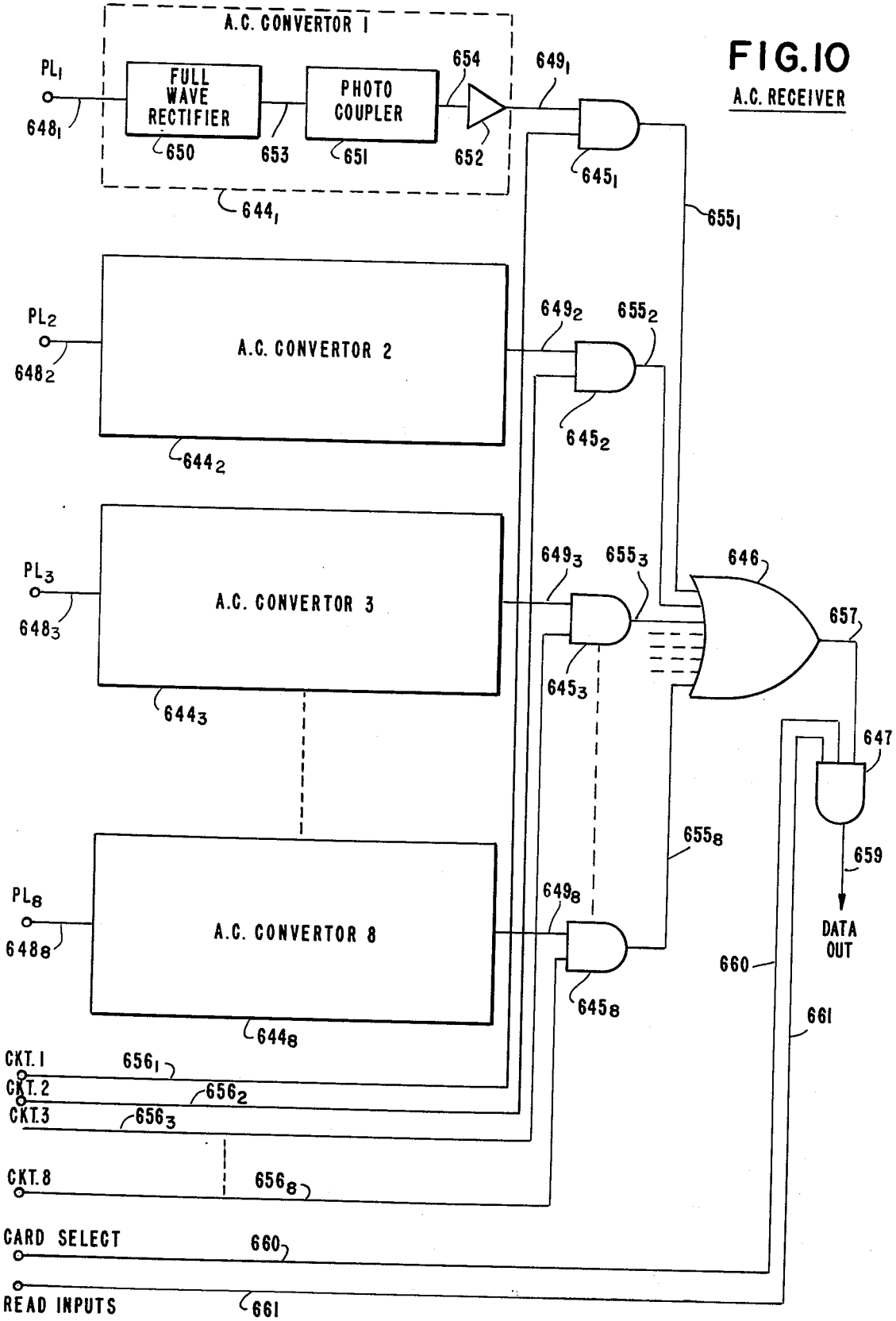

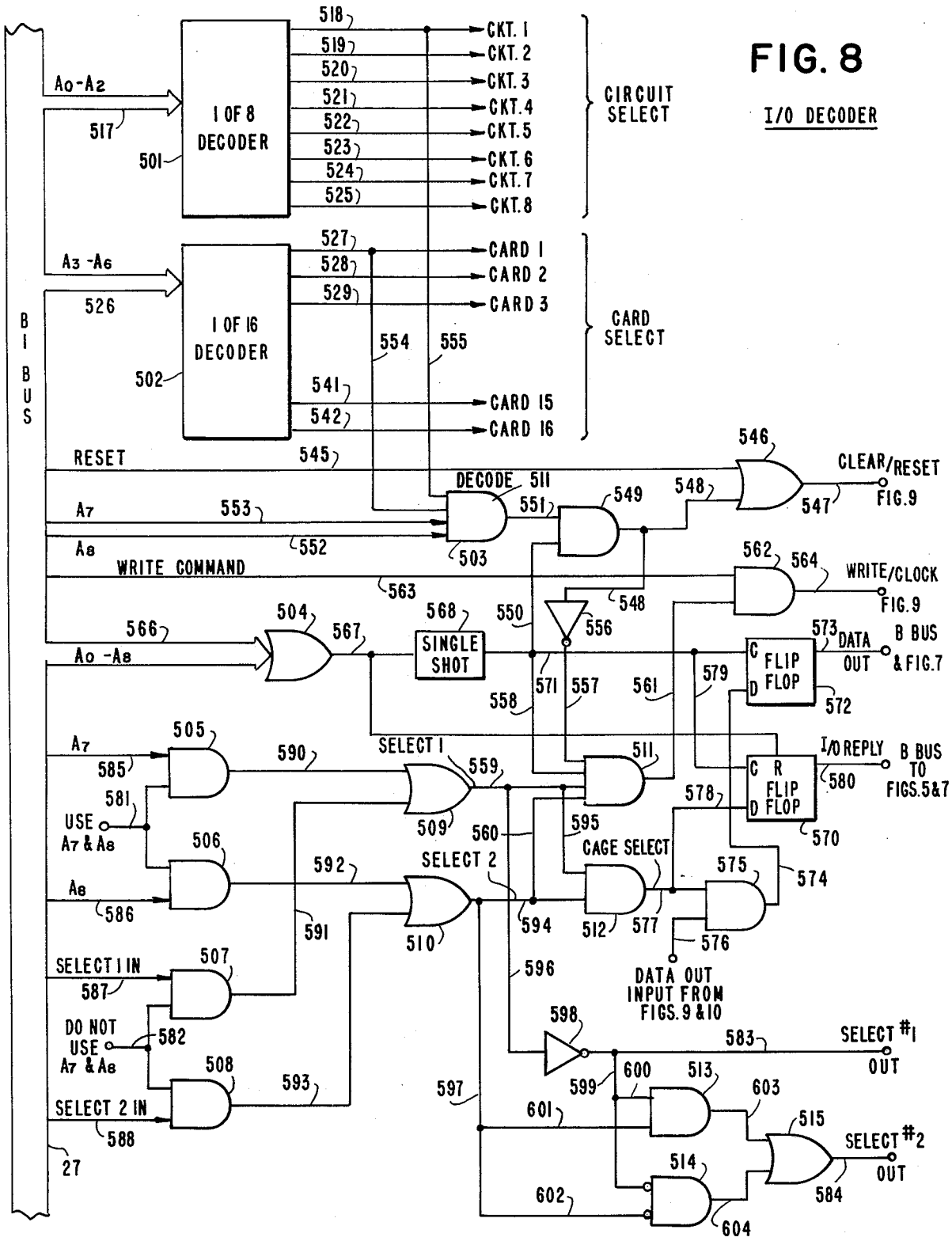
FIG. 8
I/O DECODER
A0-A2
517
501
1 OF 8 DECODER
518
519
520
521
522
523
524
525
CKT. 1
CKT. 2
CKT. 3
CKT. 4
CKT. 5
CKT. 6
CKT. 7
CKT. 8
CIRCUIT SELECT
A3 -A6
526
502
1 OF 16 DECODER
527
528
529
541
542
CARD 1
CARD 2
CARD 3
CARD 15
CARD 16
CARD SELECT
554
555
B I B U S
RESET
545
546
CLEAR/RESET
547
FIG.9
DECODE
511
A7
553
A8
552
503
551
549
548
WRITE COMMAND
563
562
564
WRITE/CLOCK
FIG.9
550
556
548
566
504
567
568
SINGLE SHOT
A0 -A8
571
557
558
561
579
573
DATA OUT
B BUS & FIG.7
C
D
FLIP FLOP
572
A7
505
585
590
SELECT 1
559
511
I/O REPLY
B BUS TO FIGS.5&7
580
581
USE A7 & A8
509
560
595
578
570
506
592
SELECT 2
CAGE SELECT
575
574
A8
586
591
510
594
512
577
576
SELECT 1 IN
507
587
596
DATA OUT INPUT FROM FIGS. 9 & 10
598
DO NOT USE A7 & A8
582
583
SELECT #1 OUT
508
593
597
599
600
513
603
SELECT 2 IN
588
601
515
SELECT #2 OUT
27
514
602
584
604

A.C. DRIVER

A.C. RECEIVER

SIGNAL CONVERTOR

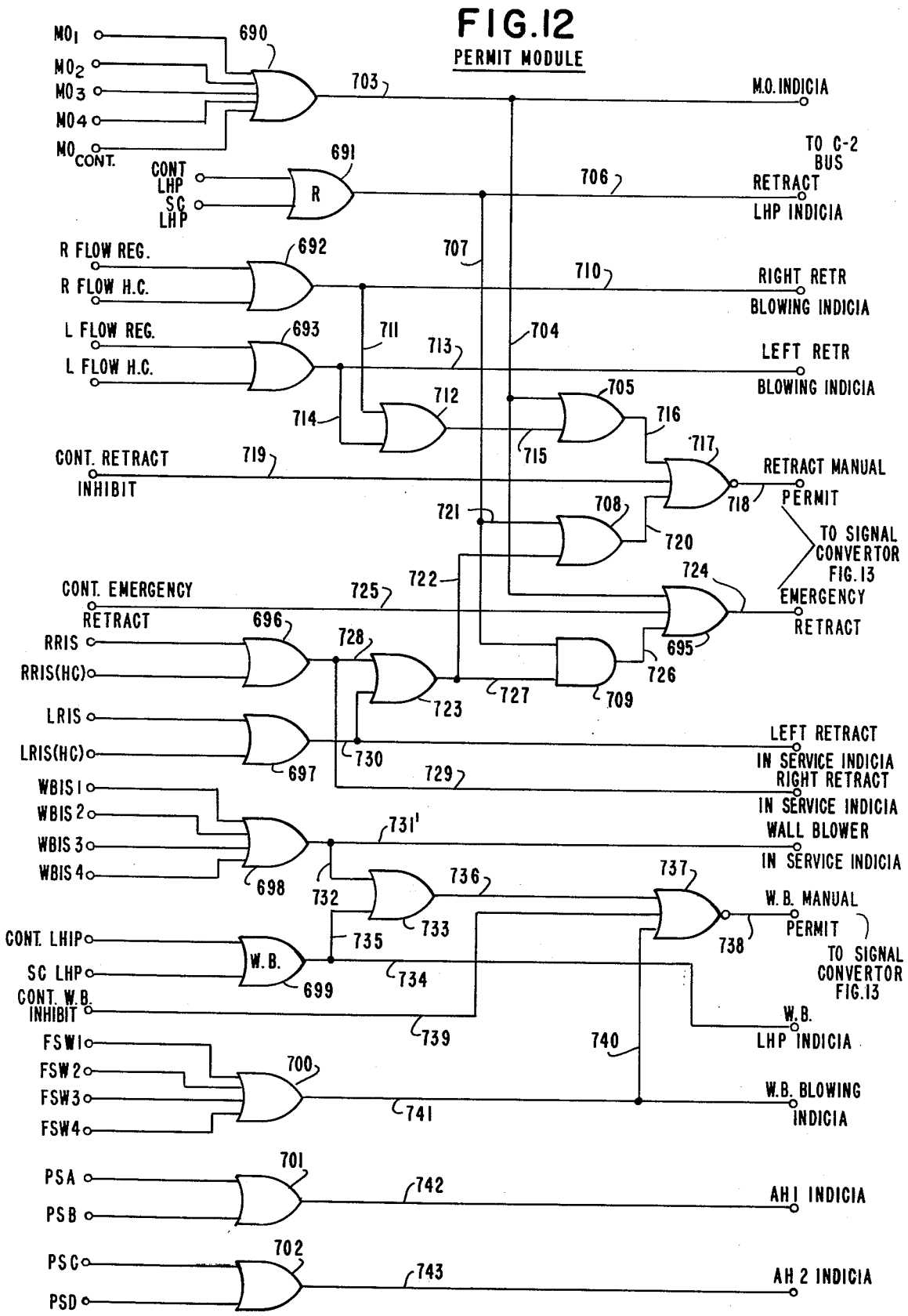
FIG.12
PERMIT MODULE
MO1
MO2
MO3
MO4
MO CONT.
690
703
M.O. INDICIA
CONT LHP
SC LHP
691
R
706
TO C-2 BUS
RETRACT
LHP INDICIA
R FLOW REG.
R FLOW H.C.
692
707
710
RIGHT RETR
BLOWING INDICIA
L FLOW REG.
L FLOW H.C.
693
711
713
704
LEFT RETR
BLOWING INDICIA
712
705
714
716
715
717
CONT. RETRACT INHIBIT
719
RETRACT MANUAL
PERMIT
718
721
708
720
TO SIGNAL CONVERTOR FIG.13
CONT. EMERGENCY RETRACT
725
722
724
EMERGENCY RETRACT
RRIS
RRIS(HC)
696
728
723
727
709
726
695
LRIS
LRIS(HC)
697
730
LEFT RETRACT IN SERVICE INDICIA
729
RIGHT RETRACT IN SERVICE INDICIA
WBIS 1
WBIS 2
WBIS 3
WBIS 4
698
731'
WALL BLOWER IN SERVICE INDICIA
732
736
733
737
W.B. MANUAL PERMIT
738
TO SIGNAL CONVERTOR FIG.13
CONT. LHIP
SC LHP
W.B.
699
735
734
CONT. W.B. INHIBIT
739
740
W.B. LHP INDICIA
FSW1
FSW2
FSW3
FSW4
700
741
W.B. BLOWING INDICIA
PSA
PSB
701
742
AH1 INDICIA
PSC
PSD
702
743
AH 2 INDICIA

MONITOR LOOP PART I

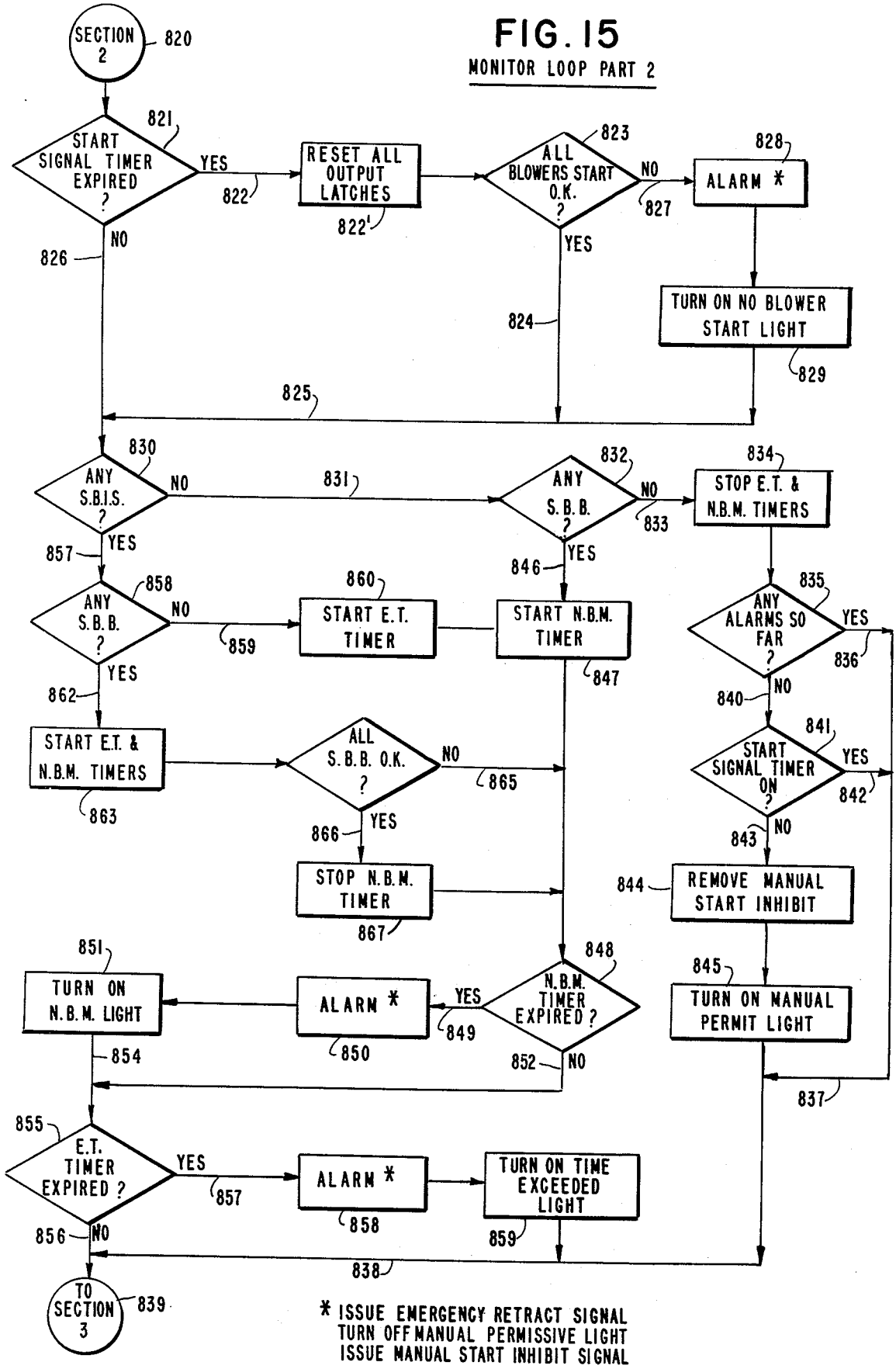
FIG. 15
MONITOR LOOP PART 2
SECTION 2
820
START SIGNAL TIMER EXPIRED ?
821
YES
822
RESET ALL OUTPUT LATCHES
822'
ALL BLOWERS START O.K. ?
823
NO
827
ALARM *
828
YES
824
TURN ON NO BLOWER START LIGHT
829
NO
826
825
ANY S.B.I.S. ?
830
NO
831
ANY S.B.B. ?
832
NO
833
STOP E.T. & N.B.M. TIMERS
834
YES
857
YES
846
ANY S.B.B. ?
858
NO
859
START E.T. TIMER
860
START N.B.M. TIMER
847
ANY ALARMS SO FAR ?
835
YES
836
NO
840
YES
862
START E.T. & N.B.M. TIMERS
863
ALL S.B.B. O.K. ?
NO
865
YES
866
STOP N.B.M. TIMER
867
START SIGNAL TIMER ON ?
841
YES
842
NO
843
REMOVE MANUAL START INHIBIT
844
TURN ON MANUAL PERMIT LIGHT
845
N.B.M. TIMER EXPIRED ?
848
YES
849
ALARM *
850
TURN ON N.B.M. LIGHT
851
NO
852
854
837
E.T. TIMER EXPIRED ?
855
YES
857
ALARM *
858
TURN ON TIME EXCEEDED LIGHT
859
NO
856
838
TO SECTION 3
839
* ISSUE EMERGENCY RETRACT SIGNAL
TURN OFF MANUAL PERMISSIVE LIGHT
ISSUE MANUAL START INHIBIT SIGNAL

MONITOR LOOP PART 3

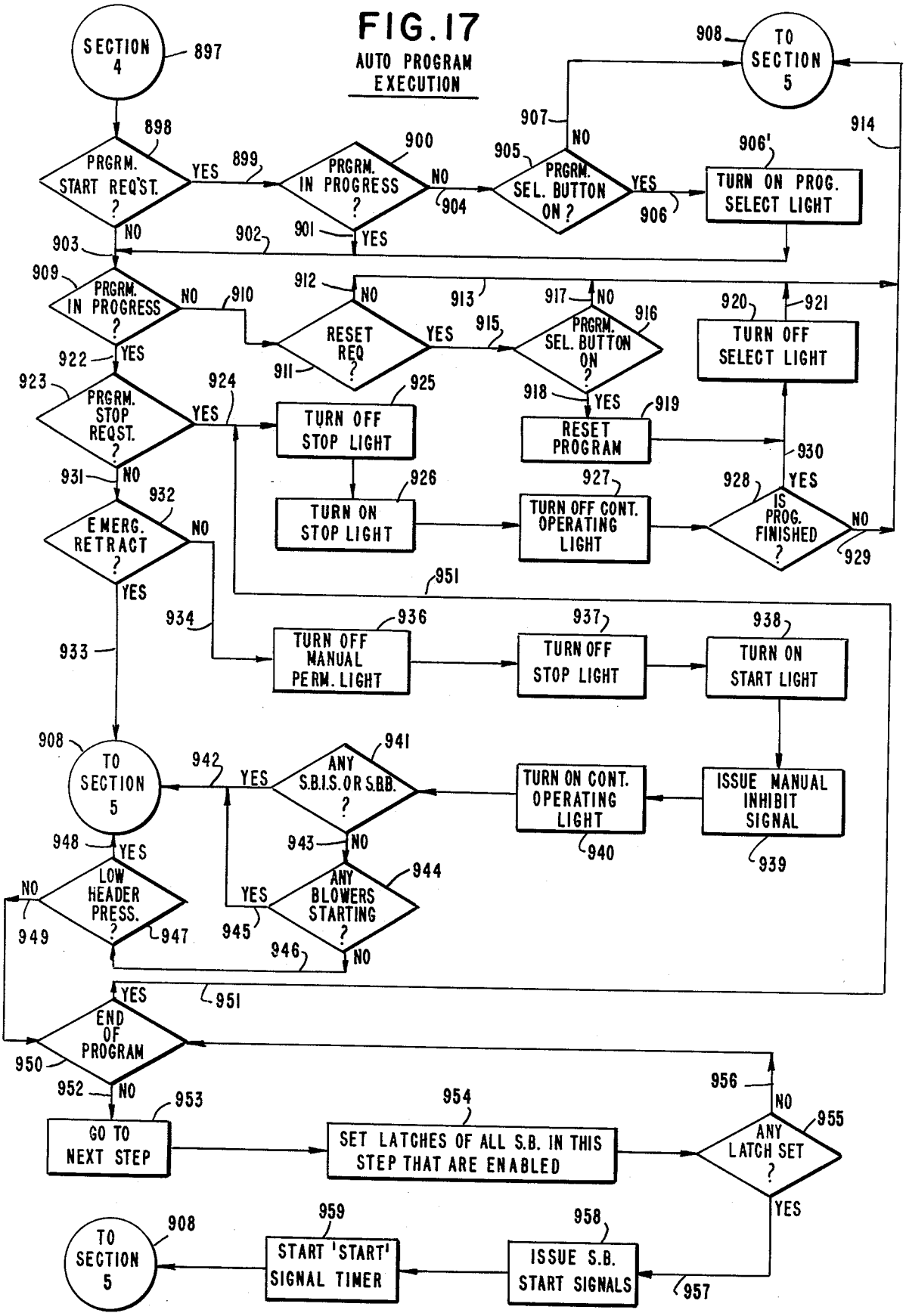
FIG. 17
AUTO PROGRAM EXECUTION
SECTION 4
897
PRGRM. START REQ'ST. ?
898
YES
NO
899
PRGRM. IN PROGRESS ?
900
NO
904
YES
901
902
PRGRM. SEL. BUTTON ON ?
905
NO
907
YES
906
TURN ON PROG. SELECT LIGHT
906'
TO SECTION 5
908
914
903
PRGRM. IN PROGRESS ?
909
NO
910
YES
922
RESET REQ ?
912
NO
911
YES
913
PRGRM. SEL. BUTTON ON ?
915
917
NO
916
YES
918
TURN OFF SELECT LIGHT
920
921
PRGRM. STOP REQST. ?
923
YES
924
NO
931
TURN OFF STOP LIGHT
925
RESET PROGRAM
919
930
TURN ON STOP LIGHT
926
TURN OFF CONT. OPERATING LIGHT
927
IS PROG. FINISHED ?
928
YES
NO
929
EMERG. RETRACT ?
932
NO
YES
933
934
951
TURN OFF MANUAL PERM. LIGHT
936
TURN OFF STOP LIGHT
937
TURN ON START LIGHT
938
ISSUE MANUAL INHIBIT SIGNAL
939
TURN ON CONT. OPERATING LIGHT
940
ANY S.B.I.S. OR S.B.B. ?
941
YES
942
NO
943
TO SECTION 5
908
LOW HEADER PRESS. ?
948
YES
NO
949
947
ANY BLOWERS STARTING ?
944
YES
945
NO
946
951
END OF PROGRAM
950
YES
952
NO
GO TO NEXT STEP
953
SET LATCHES OF ALL S.B. IN THIS STEP THAT ARE ENABLED
954
ANY LATCH SET ?
955
956
NO
YES
ISSUE S.B. START SIGNALS
958
957
START 'START' SIGNAL TIMER
959
TO SECTION 5
908

BLOWER ENABLE/DISABLE

STEP CHECK & MANUAL START

CHECK ROUTINE

PROGRAM PANEL REMOVE ROUTINE

INSERT ROUTINE

DIGITAL SOOTBLOWER CONTROL SYSTEMS AND METHODS THEREFOR

This invention relates to digital control systems and more particularly to digital systems for controlling the cleaning of fossil fuel boilers through the selective operation of sootblowing apparatus.

In fossil fuel boilers fly ash accumulations act to clog gas flow paths. In addition, heat absorption areas must be maintained at optimum efficiency through the removal of ash and slag deposits which adhere to the boiler walls and to the sides of the tubes therein. The removal of ash and slag deposits is typically achieved through the selective actuation of wall blower and retract equipment of variable capacity disposed in a predetermined relationship to sections of the boiler walls or tubes to be cleaned so that upon the actuation thereof selected equipment will be extended into the boiler or through a selected tube to blow off accumulated deposits of ash and slag and hence act to keep the gas flow paths free. Because the rate of accumulation of ash and slag at various locations in the gas flow paths, on the boiler walls and within the tubes therein is not uniform, the actuation of various wall blowing and retract equipment within the boiler is normally a function of the rate at which a wall section or tube assigned to a given wall blower or retract becomes dirty since the blowing of clean sections produces little in the way of affirmative results and can cause excessive section wear while the blowing time employed therefor could be better utilized elsewhere. Furthermore, since the rate of accumulation of ash and slag in particular locations within the boiler is rarely predictable as a function of the construction of the boiler, operator experience with that boiler in operation is frequently the best parameter for gauging the blowing patterns to be relied upon during the course of operation. Thus, typically as the boiler equipment breaks in, an operator will learn the most effective blowing patterns or sequences thereof to be employed for selected periods of operation as well as for certain conditions which periodically arise and will cause their initiation upon a periodic or continuous basis.

Heretofore, systems for controlling the operation of sootblower equipment employed relay actuated systems or static logic devices which were often complemented by large plug board arrays to initiate the operation of selected sootblowers in desired orders and sequences to achieve specified blowing patterns in desired sequences and having a selected periodicity. These systems, when utilized in conjunction with substantial utility boilers were large and unwieldly in size and since programming of operation was implemented through hard wiring techniques, tended to be rather limited in their flexibility and adaptability with respect to optimum cleaning of the boilers and their ability to meet specialized or unusual conditions encountered during operation.

Coal fuel utility boilers have not only grown in steam output in the past several years, but the quality of coal burned has generally decreased which further increases the rate at which ash and slag deposits accumulate. Thus, units in the 500 MW range and larger are currently under design and these units are intended to burn western subbituminous coals and lignites. The trend toward larger boilers and lower quality of coal continues, requiring larger and more complex sootblowing systems. Therefore, it is clearly to be anticipated that within the near future it will not be uncommon to encounter a requirement to operate 200 – 400 sootblower units in various blowing patterns and sequences to maintain large utility boilers coming into service and sootblowing systems of this nature must operate in a highly efficient and automatic manner and exhibit a capability to initiate operation of a large number of selectable blowing patterns in a multitude of sequences while displaying sufficient flexibility to meet the varied and changing demands imposed on the system by changing or specialized conditions which periodically occur.

Historically, design requirements for sootblower control systems in the early 1960's required only the blowing of each sootblower, one blower at a time, in some predetermined operating sequence. Since each blowing cycle could be started manually by the operator or automatically by a 24 hour clock; only a simple sequencing device similar to a telephone type stepping switch was required to start each blower. Later in 1960's and early 1970's such electro-mechanical sequencing systems were replaced by transistorized logic elements, hardwired into unique control circuits. Essentially the control was still a sequencing system, but many additional functions were added as necessitated by more complex boiler cleaning requirements. These control systems were severely limited by the inability of the logic therein to perform more complex operations while still retaining the form of an economic, relatively small package designed for high reliability.

Due to the large number of sootblowers in typical systems, it was also necessary to operate several types of sootblowers simultaneously. The most common requirement, was the need to operate the furnace cleaners, wallblowers, together with the superheater and reheater blower retracts. In addition to operating the wallblowers and retractables simultaneously, multiple blowing of each type of sootblower was also incorporated into the control system. To additionally complicate parameters with which the control system or operator must deal, it is frequently desirable to operate a maximum number of sootblowers nd variable capacity retracts are often employed to implement optimum cleaning conditions. This often means that if a system has the header capacity to operate 8 wallblowers at once, with no retracts in service, the combination of only four wallblowers with 2 medium capacity retracts or no wallblowers with two high capacity retracts in service may also comprise system limitations and, as will be apparent to those of ordinary skill in the art, the operating time of wall blowers and retracts are substantially different so that sequencing of different types of units need not occur at the same time. Thus, with the increasing size of utility boilers and the current, attendant decrease in the quality of the fossil fuels destined to be employed therein, conventionally available sootblower control systems can not be readily designed to operate the multiplicity of sootblowers employed in appropriate combinations using the maximum number of units and at sufficiently frequent intervals and in varying sequences to maintain essential boiler cleanliness.

Furthermore in large utility boilers, it has been found that effective operation requires that the various heat transfer surfaces of the steam generator must be kept in proper balance. Thus, the control of fireside deposits on these surfaces has a direct effect upon boiler performance. For this reason sootblowers are frequently divided into blowing groups to enable the effective control of boiler cleaning in a manner related to each type of heat transfer surface. In addition, not only is the ability to control groups of sootblowers important, but in addition thereto it has been found that the frequency and order of operations of the designated groups of sootblowers or at least selected ones of the sootblowers therein also has a pronounced effect on the cleaning ability of the sootblowing system. This too adds to the resulting complexity of operation with which a sootblower control system must deal and further complicates the control parameters within which operation must take place.

While the overall boiler cleaning requirements can often be predicted, actual slagging patterns which occur in practice and the resulting cleaning needs of each boiler section are highly unpredictable. Additionally, fuel characteristics for each boiler design and the various operating modes therein can develop widely varying cleaning requirements. Due to these factors, it is sometimes necessary to add additional sootblowers to the system in the field to achieve a proper cleaning of the boiler. The accommodation of such modifications present extensive sootblower control system design problems, which often result in a compromised control system.

From the foregoing it will be appreciated that as the size of utility boilers continues to increase and the trend of industry to utilize fossil fuels of lower quality and hence of higher slagging content proliferates, the complexity of operation of sootblower control systems will continue to magnify not only due to an increase in the number of sootblowers employed but also due to the frequency with which they must operate and the parameters imposed by both the cleaning requirements of the boiler and the sootblowers employed. Ideally, modern sootblower control systems should be able to respond automatically to conditions associated with load, temperature, pressure and fuel to provide condition responsive control and cleaning associated with slagging patterns and the build up of ash and slag therein to provide highly efficient boiler operation in an automatic manner. However, because of the substantial number of input variables, the questionable validity of the signals received from sensors therefor and the complexity of process manipulation, this has been technically unfeasible to date. Therefore, as the operator of the system must still be employed as the decision maker in regard to what blowing patterns and sequences thereof are most effective in promoting highly efficient boiler operation, the next best approach is to minimize necessary operator functions by designing sootblower control systems which perform all functions associated with the operation, control and monitoring of the system except for the designation of blowing patterns and the sequences with which they are employed. Furthermore, even in areas left to the operator's discretion, thorough before the fact previewing of defined operations and system operating conditions together with a high degree of operational flexibility should also be present in the system and since operation must continue should automatic operations terminate, such a control system should include a bypass mode enabling manual operation and a high degree of monitoring by the operator since cleaning operations may not be allowed to terminate. Thus, while solid state logic circuitry is available to perform highly specialized switching, control and decisional functions within hardwired control networks, the very number of sootblowers to be controlled and the conditions which must be monitored makes the design of such hardwired sootblower control systems a burgeoning task which inevitably results in a control system which can be difficult to manage and has insufficient flexibility.

Therefore, it is an object of this invention to provide digital sootblower control systems whrein the initiation and monitoring of selected sootblowers are achieved through software techniques.

It is a further object of this invention to provide digital sootblower control systems wherein a plurality of blowing patterns may be established by an operator and automatically initiated under program control in a desired sequence.

It is an additional object of this invention to provide digital sootblower control systems wherein a plurality of programs for a plurality of blowing patterns may be established by an operator and automatically and selectively initiated under program control in a preselected sequence.

It is another object of this invention to provide digital sootblower control systems which permit a previewing of blowing patterns which have been selected for operation.

It is a further object of this invention to provide digital sootblower control systems which provide visual inidicia of the operational status of sootblowers being controlled thereby.

It is an additional object of this invention to provide digital sootblower control systems exhibiting a by-pass mode of operation wherein automatic control features are by-passed and selected sootblowers may be manually started while the operational status thereof is indicated.

It is another object of this invention to provide digital sootblower control systems capable of selectively indicating the status of all of the sootblowers controlled thereby.

It is a further object of this invention to provide digital sootblower control systems capable of automatically starting any sootblower in the system.

It is an additional object of this invention to provide digital sootblower control systems capable of cancelling the operation of any sootblower in the system.

It is another object of this invention to provide digital sootblower control systems capable of monitoring and displaying the operation of each sootblower in the system.

It is a further object of this invention to provide sootblower control systems capable of monitoring principle essentials of the sootblowing system and prevent continued sootblower operation if the system is not functioning properly and abort the operation of any sootblower if a malfunction occurs.

It is an additional object of this invention to provide digital sootblower control systems capable of selecting various blowing pattern sequences as required by boiler cleaning requirements.

It is another object of this invention to provide digital sootblower control systems capable of altering blowing routines.

It is a further object of this invention to provide digital sootblower control systems capable of previewing the programmed operating sequence of each blowing routine.

It is an additional object of this invention to provide digital sootblower control systems having the ability to initiate the operation of a plurality of sootblowers in a substantially simultaneous manner.

which defines a specific sootblower whose operation is to be initiated, or whose status is being monitored. This information is supplied through the B bus to the sootblower driver means 7 for sootblower initiation purposes, and to the sootblower receiver means 8 for the purposes of monitoring. Similarly, the address generated is forwarded to the display means 4 where the same is to be decoded and the address light therein is either illuminated or non-illuminated depending upon the state of the sootblower which is being monitored. The address information present on the B bus may be originated at either the programmable controller means 1 or the scanner multiplexer mens 3. Typically, when a sootblower is to be started under program control, the address thereof is generated and the nine bits of information is applied to the B bus from the programmable controller 1.

During monitor modes, the sequential generation of addresses by the scanner multiplexer means 3 occurs on a periodic basis and each nine bit address generated thereby is applied from the scanner multiplexer 3 through the multiconductor cable 28 to the nine appropriate conductors therefor within the B bus 27. In addition, whenever a manual starting mode in emergency override is initiated at one of the wallblower switch inputs 15 or the retract switch input 16, the nine bits of address information generated thereby, in a manner to be described hereinafter, is gated through the input gate array means 17 and through the multiconductor cable 19, the A bus 11, the scanner multiplexer means 3 and the multiconductor cable 28 to the B bus 27 where the same is processed in a similar manner as if the address had been generated in an automatic mode by the programmable controller. In this manner, a manual bypass mode is implemented and since the scanner multiplexer means 3 is provided with a separate power supply, manual starting of sootblower equipments using the generalized organization of the instant invention is available even if the programmable controller 1 should go down. Thus, generalized address information in the form of nine bits of parallel information may be generated by either the programmable controller, the wallblower switch input means 15, the retract switch input means 16 or the scanner multiplexer means 3 and applied to the B bus as nine bits of parallel information for ultimate use by the display means 4 and either the sootblower driver means 7 or the sootblower receiver means 8.

In addition to the address information, eight bits of control information are carried on eight parallel conductors designated the C1 - C8 conductors within the B bus 27. This control informtion is generated and employed by various ones of the peripherals included within the digital control system according to the instant invention in a manner which shall become more apparent hereinafter. However, here it is sufficient to appreciate that the control conductors C1 - C8 carry the binary control inputs thereon in the following manner:

| | |
|---|---|
| C1 | Read Enable |
| C2 | Reset |
| C3 | I/O Reply |
| C4 | Write |
| C5 | Latch Enable |
| C6 | Count Strobe |
| C7 | Display Enable |
| C8 | Read Outputs |

Because a plurality of the C conductors within the B bus 27 have control commands thereon which are only used by specialized peripherals and/or generated by specialized peripherals, it will be appreciated that if it is desired to deviate from a generalized bus arrangement, such specialized control conductors may originate at the generating peripheral and terminate at the destination peripheral and hence not be supplied to the overall length of the B bus 27. Such a technique may be particularly advantageous for controlling inputs which do not originate at the program controller and hence may reduce the number of outputs required therefrom and hence, the output terminals required thereby. The address conductors and control conductors $A_0 - A_8$ and $C_1 - C_8$ make up seventeen of the twenty-seven cables within the B bus 27. The remaining ten cables are as follows: cables $D_0$ and $D_1$ are employed for gating data out and data in information and hence has the typical control functions associated with the acquisition or reading of information within a data processing arrangement as well as providing enabling and timing information for selected peripherals at which a reading or writing function is to take place. The $E_0 - E_2$ conductors within the B bus 27 are specialized signals which are supplied from the programmable controller to the scanner multiplexer means 3. These three signal levels are decoded at the scanner multiplexer means 3 in a manner to be described in greater detail in conjunction with FIGS. 5 and are thereater employed to supply gating information to the input gate array 17 which gate information is applied thereto through the A bus 11 and the multiconductor cable 19.

Two select conductors SEL-1 and SEL-2 are also present in the B bus 27. These cables are employed strictly for the purpose of enabling ones of the decoders employed for the sootblower driver means and the sootblower receiver means in a manner which is decribed in greater detail in conjunction with FIG. 8. The select signals obtained are decoded, as shall be seen hereinafter, as a function of address bits which are also conveyed through conductors $A_0 - A_8$ and therefore, should it not be desired to retain a generalized bus structure these select conductors may be limited to association with the IO decoders employed for the sootblower driver means and sootblower receiver means 7 and 8 and hence need not require that programmable controller outputs be devoted thereto. The remaining three conductors within the B bus 27 are associated with an emergency retract level generated by the programmable controller 1 and supplied to the scanner multiplexer means 3 in a manner to be described in greater detail in conjunction with FIG. 5. A power on level conductor which is enabled when the system is energized and is employed to generate certain initial conditions within the system, and a 5 volt DC maintenance level conductor which is serially applied to each peripheral in the system and employed to ensure that voltage levels for appropriate logical levels are present on each peripheral card utilized within the instant invention. Since both the power on conductor and the 5 volt DC maintenance level conductors are conventional in use and employed for general housekeeping operations, they are not further discussed hereinafter.

The B bus 27 is connected in the manner illustrated in FIG. 1 to the display means indicated by the dashed block 4. The display means indicated by the dashed block 4 comprises, as indicated in FIG. 1, a boiler and display panel 30, a display driver array 31 and a display decoder 32. The boiler diagram and display panel is illustrated and described in much greater detail in conjunction with FIG. 6. Therefore, it is here sufficient to appreciate that in essence, the boiler diagram and panel 30 is basically a depiction of the interior section of the boiler laid flat having a plurality of indicators thereon which correspond to the location of sootblowers and the like within the boiler. Each of these sootblower indications is numbered in a manner to correspond to the sootblower which may be dialed up at the wallblower switch input means 15 or the retract switch input 16 and whenever the same is operating, the indicia is illuminated while when the same is not operating, the indicia is deenergized. In addition, as will be seen in greater detail in conjunction with FIG. 6, a plurality of sootblower conditions are listed and should operation be occurring or a malfunction be associated therewith these condition indicia are also illuminated to advise the operator of conditions which obtain within the system. As will be appreciated by those of ordinary skill in the art, various other conditions within the system may be monitored and advisory indications provided thereat to apprise the operator of all necessary system conditions which are monitored within the digital sootblower control system according to the instant invention.

The display decoder 32 is connected at the input thereof to the B bus 27 and receives therefrom address information and data information defining a sootblower whose condition is being addressed as well as the operative or inoperative state thereof. This information is decoded by the display decoder 32 and forwarded through the multiconductor cable 33 to the display driver array 31. The decoded information here is latched within lamp driver arrays so the same may be continuously or periodically displayed and thereafter raised to appropriate output levels for driving individual ones of the indicia within the boiler diagram and display panel 30. This information is thereafter supplied through the multiconductor cable 34 to the boiler diagram and display panel 30 so that the operator is continuously apprised of operating conditions within the system. Address information is supplied to the boiler diagram and display panel typically as a function of what is transpiring in the system rather than as a function of what has been ordered so that when the operation of a sootblower is initially ordered, a visual indication that that sootblower is operating results from a sampling thereof and hence such display in effect is an acknowledgement that the order has been properly carried out. Thus typically, when the controller is ready to output operate instructions to certain sootblowers to start them, the scanner is inhibited as is the display and thereafter the display and scanner are released so that subsequent illumination of the indicia thereon operate to provide a report back as to system operation rather than what order has been issued. The display means indicated by the dashed block 4 is also employed to provide a visual indication as to sootblowers which are enabled or disabled in the various checks which may be initiated at the wallblower switch input means 15 and the retract switch input means 16 so that the operator may be visually advised as to the status of sootblowers in the system with respect to current modes of operation, his ability to output them and their presence or absence within sequences of program blowing routines. Furthermore, as shall be seen hereinafter, should a malfunction occur with regard to sootblowers ordered into operation or in operation, the nature of the malfunction is indicated on the boiler diagram and display panel and the sootblower which is experiencing the malfunction is indicated by a flashing of the indicia associated therewith to advise the operator both as to the nature of the malfunction and the sootblower which is malfunctioning so that the same may be corrected or disabled until correction can be achieved.

The sootblower driver means 7 and the sootblower receiver means 8 are also connected to B bus through the IO decoder means 35. The function and structure of the IO decoder means 35 will be described in great detail in conjunction with FIG. 8. Here, it is therefore sufficient if the general functions of the IO decoder means 35 are outlined in connection with the control functions exercised thereby over the sootblower driver means 7 and the sootblower receiver means 8. In essence, a specified circuit within the sootblower driver means 7 and the sootblower receiver means 8 is connected to each sootblower which is controlled in accordance with the teachings of the instant invention under conditions wherein circuits present within the sootblower driver means 7 act to initiate the operation of the sootblower connected thereto while corresponding circuits within the sootblower receiver means 8 act to receive signal information from the sootblower connected thereto which signals are indicative of whether or not that sootblower is operative. Thus, both the sootblower driver means 7 and the sootblower receiver means 8 each have a designated circuit therein which is uniquely connected to a given sootblower being controlled in such manner that whenever that circuit is energized either a sootblower will be started in response to the action of the sootblower driver means 7 or the operative condition of such sootblower will be indicated at a corresponding circuit within the sootblower receiver means 8. The IO decoder means 35 is connected to the B bus 27 and hence receives all of the address information therefrom as well as certain of the control commands which are present. The address information received by the IO decoder is appropriately decoded so that a unique circuit in the sootblower driver means 7 or the sootblower receiver means 8 is enabled and such enabling is applied thereto through the multiconductor cables 37 and 38. In addition, write or read information is received from the B bus 27 by the IO decoder means 35. This signal level is employed by the IO decoder to generate either a write clock which is employed to actuate the address circuit within the sootblower driver means 7 or else a read level is developed whereupon the addressed level is supplied to the sootblower receiver means 8. Additional typical handshaking signals are also developed by the IO decoder means 35 in a manner to be described hereinafter.

When a selected circuit within the sootblower driver means 7 is enabled and a write clock is presented by the actions of the IO decoder means 35 as applied to the sootblower driver means 7 through the multiconductor cable 37, the AC driver, which is described in greater detail in conjunction with FIG. 9 acts in a manner to be further described below, to supply an AC starting signal to the sootblower which has been addressed and for which a start command has been issued.

Conversely, when a specified circuit within the sootblower receiver means 8 is addressed, the condition of the sootblower connected thereto is monitored by sampling the condition of an AC signal applied thereto by such sootblower. This AC signal is transduced into an appropriate logical level and returned to the B bus through the IO decoder means 36 to thus indicate the cient to appreciate that the wallblower switch input means 15 and the retract switch input means 16 are employed, respectively, to initiate programs which have already been loaded into the programmable controller 1 with respect to wallblowers and retracts. In addition, the wallblower switch input means 15 may be employed to initiate through a manual start up procedure the operation of selected wallblowers, acts as an indicia to display the program currently in operation and is additionally capable of initiating program sequences of operation which display wallblowers which are currently enabled and/or disabled from the standpoint of possible operation, those which have been selected for operation in programs which have been selected and this form of indicia may be selectively provided either on a sequential, i.e., per program sequence in totality to illustrate the total numbers of wallblowers which will be initiated. Similarly, the retract switch input means 16 provides similar functions to the wallblowers switch input means 15 with respect to the retractable sootblower units employed or controlled within the instant invention. In addition, an emergency retract switch is provided should an emergency condition arise. The wallblower switch input means 15 and the retract switch input means 16 are additionally provided with appropriate switch inputs to start the program, stop the program, and cause a resetting to be initiated under program control.

Any switch information generated at the program select input means 14, the wallblower switch means 15, the retract switch input means 16 or any other input means employed are applied through the input gate array 17 and the multiconductor cable 19 to the A bus 11. The input gate array 17 is discussed in greater detail in conjunction with FIG. 4. Here, however, it is sufficient to appreciate that the input gate array 17 receives individual ones of the switch inputs through the multiconductor cables 20–22 from respective ones of the program select input means 14, the wall blower switch input means 15 and the retract switch input means 16 and when the input gate array means 17 is enabled supplies such information as is applied thereto to either the programmable controller 1 or the scanner multiplexer means 3 through the A bus 11 on a selective basis. Although this is explained in greater detail in conjunction with FIG. 4, the reader may be given a greater appreciation for the data flow path involved if it is understood at this juncture that in essence, whenever the programmable controller 1 is effecing automatic operation, all program select input information from the program select input means 14 as well as wallblower and retract switch input information from the wallblowers switch input means and the retract switch input means 15 and 16 are supplied through the A bus 11 to the programmable controller 1 which then stops the action of the scanner multiplex means 3 and issues start instructions to the selected blowers. However, when a manual operation is initiated at the wallblower switch input means 15 or the retract switch input means 16 the blower information defined thereby is supplied through the A bus to the scanner multiplex means 3 where the same is effectively employed as an address to start the appropriate wallblower unit defined. Any time a switch is depressed at one of the program select input means 14, the wallblower switch input means 15 or the retract switch input means 16, and that information is forwarded through the appropriate one of the multiconductor cables 20 – 22 through the input gate array 17 and to the programmable controller through the A bus 11, an acknowledgement for the switch input defined is forwarded through the C1 bus 12 to the switch light driver 18 whereupon the acknowledgement signal is decoded through a coding technique corresponding to the switch depressed, and the resulting signal is raised through conventional techniques to an appropriate level to illuminate the light switch which was depressed. This signal is then forwarded through one of the multiconductor cables 23 – 26 to the initiating one of the program select input means 14, the wallblower switch input means 15 or the retract switch input means 16 whereupon the switch depressed is illuminated and this report back approach is employed to assure the operator that the information input has been appropriately received at the programmable controller 1.

The switch light driver means 18 may take any conventional form of decoding network which has sufficient amplification or driver stages at the outputs thereof to raise the resulting decoded signal to the necessary level appropriate to drive an illuminated switch. The decoding technique employed in the switch light driver means 18 may take any of the well known decoding techniques such as those employing AND gates to achieve this conventional result. It should additionally be noted that should any of the program inputs supplies from the program select input means 14 be incapable of implementation by the program controller 1 either due to the basic nature thereof or because the same violates the constraints imposed by the system as established in the executive program, an error light will be illuminated at the program select input means 14 in the manner described more in detail in conjunction with FIG. 2A. It may also be noted that while the wallblower switch input means 15 and the retract switch input means 16 are open panels generally available to all operators, the program select input means 14 is typically a locked panel so that only the shift foreman or similar personnel has ready access thereto. Thus, using this approach, the shift foreman will typically establish program blowing routines which may be run while the operator will initiate the same in the course of daily operation. Furthermore, as shall be rendered more apparent below, once the program block routines have been established through the operation of the program select inputs 14, large strings of programs may be initiated at both the wallblower switch inputs 15 and the retract switch inputs 16 so that the operation of the digitally controlled sootblower system according to the instant invention is entirely automatic unless an emergency or a malfunction arises. Furthermore, should an emergency or malfunction occur, the system will in most cases, indicate the nature of the malfunction or emergency and attempt to correct the condition involved. This is typically done by timing sootblower units which are operating and if the appropriate duty cycle therefor is exceeded, indicia indicating a prolonged duty cycle is provided and in the case of retract units an emergency retract signal is supplied. The unit involved is then plainly indicated at the display means 4 so that the same may be removed from service. A plurality of other operating conditions are also monitored by the program controller through sensory inputs supplied thereto and should malfunctions occur, these too are plainly indicated in the display in a manner to be further described in conjunction with FIG. 6. Such malfunctions which are monitored also extend to a failure in the controller whereupon manual operation may be initiated by the operator at the wallblower and retract switch inputs 15 and 16 which then operate in conjunction with remaining portions of this invention to effectively bypass the programmable controller 1 while using the remaining portions of the system so that the operator is able to dial up selected sootblowers, initiate the operation thereof while the operation of the system in its current state is promptly displayed at the display means indicated by the dashed block 4.

The scanner multiplexer means 3 generally acts in a cyclic manner to address each sootblower within the system on a periodic basis so that the state thereof may be indicated on the display means indicated by the dashed block 4. The scanner multiplexer means is described in greater detail in conjunction with FIG. 5. However, at this juncture, to provide the reader with the nature of the data flow taking place, it should be appreciated that when the operation of the system is being controlled by the programmable controller 1, the actual starting of selected sootblowers is initiated by the programmable controller 1 and during this time, the scanner multiplexer means 3 is inhibited. Once start up signals have been issued, however by the programmable controller 1, the inhibit on the scanner multiplexer which is supplied from the B bus is released and each sootblower in the system is addressed by the scanner multiplexer 3 in a periodic manner. As each sootbllower is addressed, the operative or inoperative state thereof is displayed at the display means indicated by the dashed block 4 and the periodicity with which the scanner multiplexer sequences through all the addresses of the sootblowers in the system provides a continuous, updated display indicating the operational status of all sootblowers in the system.

In an emergency override mode, where a manual starting operation has been initiated from the wallblower switch input means 15 or the retract switch input means 16 on a priority basis, the sootblower defined has its address gated through the A bus and the scanner multiplexer means 3 wherein the same is applied to the B bus and is employed to initiate the operation of a selected sootblower. The scanner multiplexer means 3 is provided with a separate power supply so that the same remains operative even when the programmable controller 1 goes down and it is connected to the B bus 27 through a multiconductor cable 28.

Figure 5:
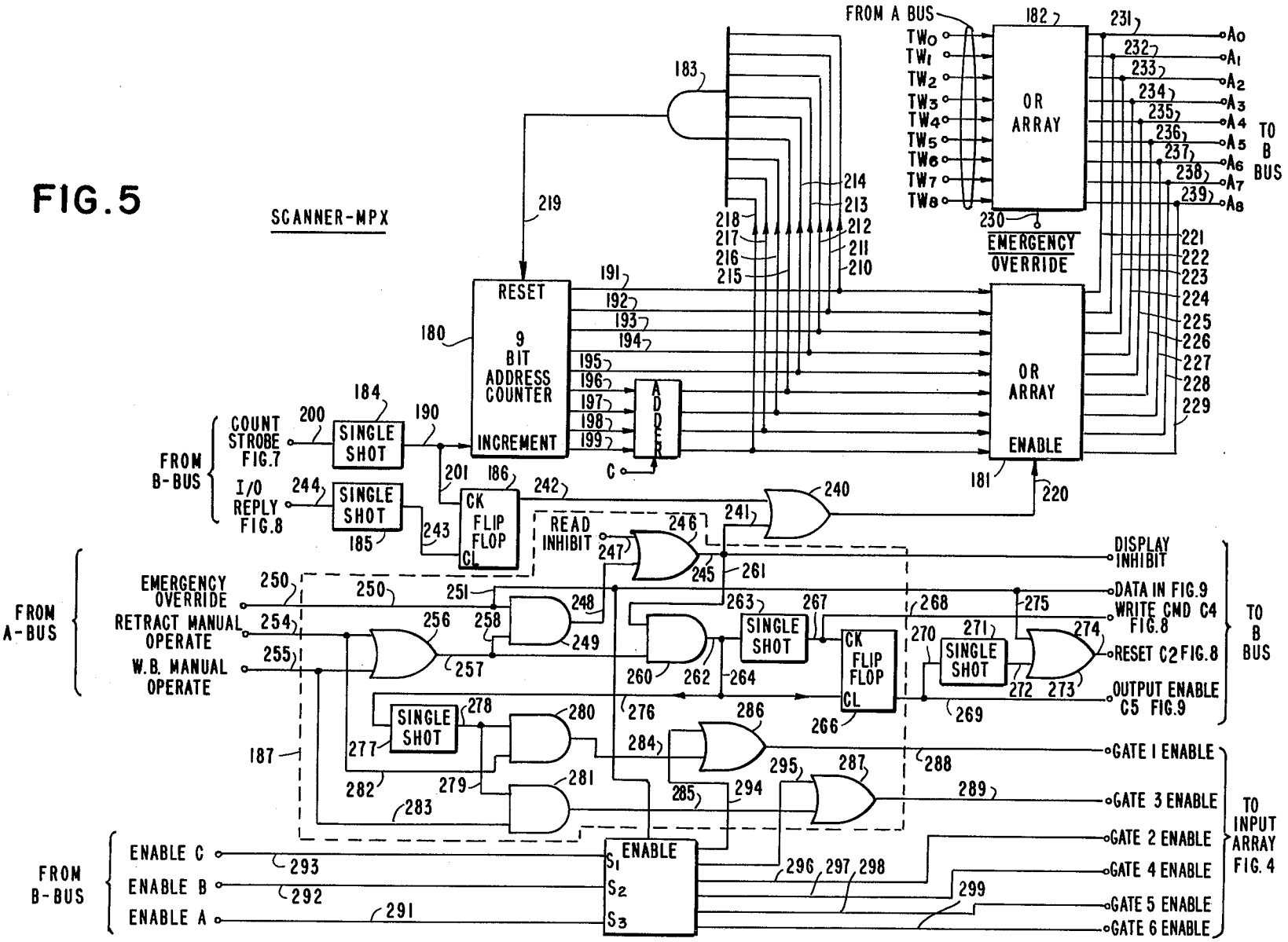

In addition to the addressing function performed in a sequential manner by the scanner multiplexer means 3, the scanner multiplexer means 3 additionally acts, in a manner to be described in greater detail in conjunction with FIG. 5 to receive manual operate instructions in the form of emergency override commands from the A bus 11 as initiated by either the wallblower switch input means 15 or the retract switch input means 16 to enable address information, also supplied from the A bus to be employed as an address while providing additional enabling information to achieve the appropriate function. Additionally, gate information obtained from the B bus 27 is decoded in the scanner multiplexer means 3 and supplied through the A bus to the input gating array 17 to cause the appropriate enabling of particular ones of the gates therein. The scanner also acts, as shall be described more in detail hereinbelow, to perform all sequence, enable and disable checks which are operations, to be further detailed below, wherein a check operation is initiated at one of the wallblower or retract switch inputs 15 and 16 to cause all sootblowers which are established in a sequence, enabled for an operation or generally enabled or disabled for a given operation or generally to be disabled to be displayed at the display means indicated by the dashed block 4. Thus, in general, during automatic operation, sootblowers are initiated in operation by the programmable controller 1 while the scanner multiplexer means 3 functions to sequence through the system on a periodic basis to cause the state of all the sootblowers therein to be displayed and such sequential scanning keeps occurring regardless of what is occurring unless controller shut down takes place or a specific check sequence is initiated. Accordingly, when the programmable controller 1 is ready to output or start some sootblowers, the scanner multiplexer means 3 is stopped, the selected blowers are initiated in a manner to be described below and the operation of the scanner multiplexer 3 is reinitiated so that the status of the system is displayed at the display means indicated by the dashed block 4. Once the selected blowers are in operation, the reinitiation of the scanner multiplexer means 3 thus re-establishes a mode where sequential scanning of the operational status of all sootblowers in the system is continued and displayed so that a plain indicia as to the status of the system is provided to the operator. Also, the operation of a started blower is confirmed through the report back nature of the display when the address thereof is scanned.

The B bus which is connected to the scanner multiplexer means 3 through the multiconductor cable 28 is the main data and control information bus through which information is conveyed about the digital control sootblower system according to the instant invention. Thus, while the C1 bus 12 and the A bus 11 and the remaining buses which are hereinafter discussed are somewhat specialized in function, the B bus 27 acts to convey the majority of data which is transmited through the embodiment of the invention illustrated in FIG. 1. More particularly, while it will be recalled that the A bus 11 principally acts to communicate switch information from the program select inputs 14, the wallblower switch input means 15 and the retract switch input means 16 to the programmable controller 1 as well as implementing minor functions with respect to the interchange of information between the input gate array 17 and the scanner multiplexer means 3, and the C1 bus 12 acts to convey light driver information from the programmable controller to illuminate depressed switches at the program select input means 14, the wallblower switch input means 15 and the retract switch input means 16; the B bus 27 is a general purpose bus having a plurality of functions and a large number of specially dedicated conductors. While the nature of the B bus and more particularly data on particular ones of the conductors therein is discussed in conjunction with all remaining figures, such discussion proceeds with specific focus directed to the nature of particular ones of the conductors within the B bus 27 and particularly to the manner in which information on such conductor serves as an input to the peripheral which is considered in a given function and/or information generated at the peripheral which is applied as an output therefrom to the B bus for further processing. Therefore, since the B bus is treated in a highly specific manner hereinafter, a generalized discussion thereof is here viewed as appropriate. The B bus includes 27 individual conductors which may be classified as a function of the information conveyed thereby. More particularly, of these 27 conductors 9 conductors, as hereinafter described as conductors A0 – A8 are devoted to address information operative or inoperative state of the sootblower which has been addressed. While a detailed discussion of the operation of the sootblower receiver means 8 will be set forth in conjunction with FIG. 10, it should here be appreciated that while a start command is issued by the sootblower driver means 7 to a particular sootblower as start commands are typically issued, the actual condition of that sootblower in response to the start command which has been issued is detected by the sootblower receiver means 8 and supplied to the B bus 27 for the purposes of presentation at the display means 4. This means, that the indication provided with respect to a successful starting up operation for the sootblower addressed and issued a start command is obtained through answer back techniques similar to those employed with respect to the switch inputs associated with the information input means capable of designating sootblowers within the system as indicated by the dashed block 2.

The manual permit circuit means 9 acts to receive indicia information from the programmable controller 1 and/or the signal converter circuit means 10 and is responsive thereto to provide additional indicia information to the boiler diagram and display panel 30 as well as selective permit information to the signal converter circuits 10. The actual operation and construction of the permit circuit means 9 is set forth in great detail in conjunction with FIG. 12 and for this reason, specific description thereof will be reserved until a discussion of FIG. 12. Here, however, the basic functions of the common permit circuit means 9 are detailed to provide the reader with an appropriate appreciation of the sensory inputs which are received thereby and the indicia and permit outputs generated. Specifically, the common permit circuit means 9 receives a plurality of inputs from the programmable controller 1 through the multiconductor cable 40. The multiconductor cable 40 may take the conventional form of a fifteen bit cable containing fifteen parallel wires. Each wire within the multiconductor cable 40 is, in this case, connected to the permit circuit means 9 wherein the logic levels supplied by the programmable controller are either employed for the purposes of logical processing within the permit circuit means 9, in a manner to be illustrated in detail in conjunction with FIG. 12, or directly supplied to the boiler diagram and display panel 30 for actuation of selected indicia thereon.

The (15) logic levels supplied by the programmable controller 1 to the permit circuit means 9 through the multiconductor cable 40 are as follows:

1 — Controller Operating-Retracts
2 — Controller Operating-Wallblowers
3 — Controller Power Failure
4 — No Blower Start-Retracts
5 — No Blower Start-Wallblowers
6 — No Blower Air-Retracts
7 — No Blower Air-Wallblowers
8 — Time Exceeded Retracts
9 — Time Exceeded Wallblowers
10 — Inhibit Retract Start
11 — Inhibit Wallblowers Start
12 — Motor Overload
13 — Emergency Retract
14 — Low Header Pressure Retract
15 — Low Header Pressure Wallblowers Of the controller outputs listed above and supplied to the multiconductor cable 40, the outputs associated with conductors 1 – 9 are directly applied by the permit circuit means 9 to the multiconductor cable 41 which is annotated C2 bus. These logic levels as applied to the C2 bus 41 are directly employed at the boiler diagram and display panel to illuminate correspondingly annotated indicia thereon in a manner to be seen more clearly in conjunction with FIG. 6. While utilization could be made of the logical levels 4 and 5 listed above, as applied to the multiconductor cable 40, blower start indicia are not provided for the boiler diagram and display panel 30 utilized in this embodiment of the instant invention and thus these logical levels are not further utilized herein. The logical levels on conductors 10 – 15, as listed above, as applied from the programmable controller 1 to the multiconductor cable 40 are directly employed by the permit circuit means 9, in a manner which will be described in greater detail in conjunction with FIG. 12 for the generation of additional signals most of which are further applied to the C2 bus 41 for direct illumination of indicia on the boiler diagram and display panel 30. However, in addition thereto, certain of these logical levels as will be seen in greater detail in connection with FIG. 12, are further processed by the permit circuit means 9 and emergency retract, wallblower manual permit and retract manual permit signals are developed therefrom and are applied to the signal converter circuit means 10 through the bi-directional multiconductor cable 42. Additionally, as shall be seen in greater detail in connection with FIGS. 12 and 13, a plurality of sensory inputs are developed by the signal converter circuit means 10 are supplied through the bidirectional multiconductor cable 42 to the permit circuit means 9 where the same are further processed and the resulting signals are forwarded through the C2 bus 41 to control the energized or de-energized state of associated indicia at the boiler diagram and display panel 30 and the permit status of the manual start indicia at the switch inputs 15 and 16, not shown.

The signal converter circuit means 10 acts to receive a plurality of sensory inputs from the field and to convert such sensory inputs into DC logic levels which may be logically processed within the instant invention. The nature of the signal converter circuits means 10 will be described in greater detail in conjunction with FIG. 13 and hence, at this juncture, within the instant specification, it is sufficient to appreciate that AC field sensed inputs such as wallblower or retract in service signals, pressure switches associated with the headers, flow switches associated with the outputs of sootblowers and motor overload switches which serve to monitor the conditions of various motors, as strategically located in the field, are supplied as AC levels to the signal converter circuit means 10 in the manner indicated by the input 32 annotated Sensory Inputs. Each of these inputs are then converted to an appropriate DC logic level suitable for application to both the permit circuit means 9 and the programmable controller 1. The signals developed by the signal converter circuit means 10 which are employed by the permit circuit means 9 are supplied thereto through the multiconductor cable 42 where the same are further processed and the resultant signals achieved are supplied through the C2 bus 41 for application to the boiler diagram and display panel where the same are utilized to illuminate specified indica thereon. All the signal information developed by the signal converter circuits 10 are supplied through the multiconductor cable 44 as discrete inputs to the programmable controller 1 where the same are utilized in the monitoring functions maintained therein under program control and may additionally be employed for the purposes of data logging which may be implemented within the digital sootblower control system according to the instant invention. The signal converter circuit also receives permissive logic functions from the permit module and converts these logic signals to an AC level for field manual start signals.

The multiconductor cable 44 has an input from the B bus 27 as indicated by the multiconductor cable section 45. The multiconductor cable section 45 may comprise a four bit cable which serves a cable transfer function so that information applied to the B bus from sources other than the controller may be supplied as inputs to the controller and in this manner, the logical processing carried out by the controller is maintained apprised of what has occurred. In essence, the multiconductor cable section 45 comprises a four bit cable which provides data out, IO reply, power on, and emergency retract information to the multiconductor cable 44 so that the programmable controller may manipulate data which is introduced onto the B bus by other peripherals within the instant invention. While the operation of the embodiment of the digital sootblower control system illustrated in FIG. 1 is described in great detail in conjunction with the succeeding figures, and particularly those associated with the program flow charts set forth herein, a brief description of the general modes of operation and the attendant data flow which occurs within the exemplary embodiment of the invention illustrated in FIG. 1 is here viewed as appropriate to acquaint the reader with the manner in which data is propagated within FIG. 1 as well as the various modes of control which may be exercised by the instant embodiment of the present invention. The programmable controller 1 is initially loaded with an executive program which is generally non-alterable in the field and is protected so that the same may not be accidentally lost. The executive program, as shall be discussed in greater detail below, governs the overall operation of the programmable controller 1 and hence all modes of operation within the instant embodiment of the present invention wherein the programmable controller 1 is active. This means that for all operations with the exception of the manual bypass modes of operation which may be implemented from the wallblower switch input means 15 and the retract switch input means 16, as shall be described in conjunction with FIGS. 2B and 2C, control of the operation of the digital sootblower control system illustrated in FIG. 1 is governed by the executive program loaded into the programmable controller 1.

The executive program loaded into the programmable controller 1 acts to govern the number of operations of each sootblower per programmable blowing routine as well as the number of sootblowers operating from a given header during a given step of a given programmable blowing routine. Additionally, the executive program controls the type of sootblowers permitted per step of a programmed blowing routine and in this regard will indicate through an error indication when an operator is exceeding limitations in the executive program with regard to the number of blower units assigned during a given sequence or step of a given program blowing routine. Thus, for instance, when two high capacity retracts have been selected, no wallblower units may be operated while if medium capacity retracts have been selected only four wallblower units may be operated therewith, and when low capacity retracts are selected, eight wallblower units may be selected. Thus, in this manner, the maximum flow capabilities of the system are never allowed to be exceeded by the establishment of a given sequence in a program blowing routine. Similarly, the executive program monitors the system during operation to ascertain whether a given sootblower has been enabled or disabled, has been started during a given sequence, has been started during a given program, is currently in service, is currently in trouble, the number of times the unit has been in service, whether a retractable is on the left or right side of the system and if a selected retractable is a low, medium or high blowing medium user. With the FX controller specified for the embodiment of the invention illustrated in FIG. 1 and described hereinafter, an expansion capacity of controlling up to 512 sootblowers is available without the addition of logic, wiring or hardware. Furthermore, all sootblowers available in the system may be easily programmed to boiler cleaning requirements, the programmed and sequential routines within a program may be readily changed without adding or changing hardware and with the addition of memory capability in the manner readily available to the FX system herein specified, expanded alarm, monitor, and display capabilities are readily available and may be combined with data logging capabilities so that the programmable sootblower control system according to the instant invention may store operating history for each sootblower to be employed for an effective preventive maintenance program. Thus for example, the number of times each sootblower is operating could be stored and printed out on a regularly scheduled basis and certain maintenance functions such as lubrication checks, packing replacement, valve seat grinding and the like could be prescheduled on the basis of this use information. Furthermore, record keeping of this sort could also be implemented under program control so that the controller could automatically provide signal indicia as to when maintenance is required for a given sootblower. These same data logging features can also be relied upon to provide information in regard to the history of use of the sootblowers relative to boiler performance so that possibly more efficient and effective use of the sootblower equipment may be implemented. Should such data logging approaches be employed, it may also be desirable to keep a record of sootblowing medium useage, sootblower availability and the length of maintenance down time for each sootblower or group of sootblowers on a regularly scheduled basis. Furthermore, the programmable controller 1 could also be integrated or interfaced with a site computer should it be desirable to pursue some form of automatic sootblower operation based on boiler slagging conditions. It should also be appreciated that through the use of software control as exercised by the programmable controller 1, fewer components are employed due to the repetitive use of logic elements and this means faster trouble shooting, less down time and lower power consumption as well as a reduction of internal wiring. Furthermore, this is attended by a reduction in the size and bulk of the control panel and various alternatives to the mode of display, such as a substitution of a CRT may be readily implemented under software control. In addition, the use of the programmable controller is here highly advantageous in that the executive program concept can be readily changed by re-inputting a new program tape while with controllers such as the FX controller here under discussion, the core memory employed renders the memory permanent during power failures and the like. Should it be desirable to add data logging features to the instant invention, it should be noted that an A–D converter is readily available from FX for addition to the instant programmable controller as is a printer. Therefore, analog inputs may be obtained from readily available sensors to monitor such characteristics as the flow and these analog inputs can be digitized and if desired, printed data which had been logged on a monthly, daily or yearly basis may be printed out to provide a permanent record.

Figure 2A:
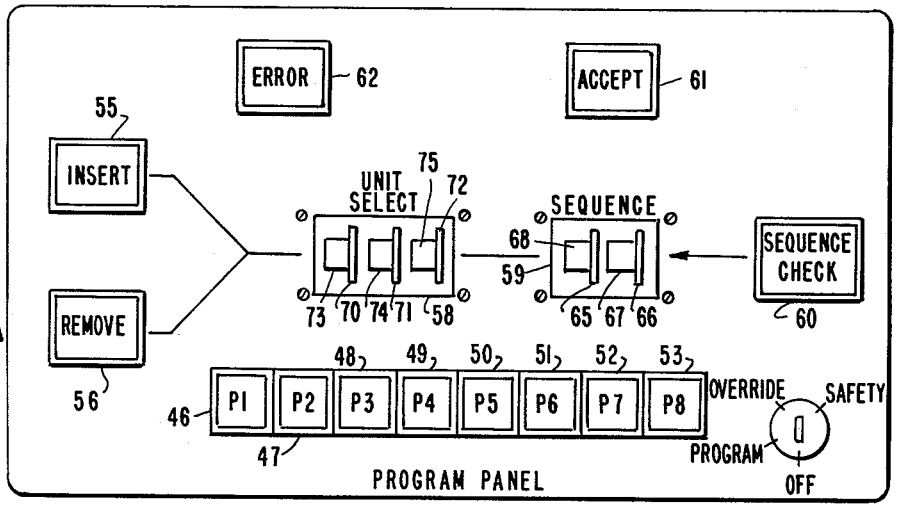

Through operation of the program select inputs 14, as shall be discussed in greater detail in conjunction with FIG. 2A, a plurality of programs will have been established wherein each program may have any number of sequences desired up to the limit established in the executive program each sequence defining a number of sootblowers for simultaneous operation up to the maximum allowed by the executive programming. Thus, for instance, a typical program might have 10 sequences associated with wallblowers wherein each sequence defines 8 wallblowers for simultaneous operation. Similarly, retract programs may have any number of sequences wherein a sequence is defined as a given number of retracts operating simultaneously. In the case of retracts, and more particulary due to the header assignment thereof, only two retracts would be employed for a given sequence one being disposed on each side (right and left) of the boiler. It should also be noted that within the instant embodiment of the present invention, operating programs for retracts and wallblowers are separately established and selected by the depression of select buttons by the operator and should programs of each type be selected, the merger of such programs to cause the simultaneous blowing of retracts and wallblowers is achieved by the programmable controller 1 under the control of the executive program in such manner that the executive program will modify the sequence of wallblowers assigned so that the number operated simultaneously does not violate the total header requirements when the same are combined with the retract program. However, as a readily available alternative, one skilled in the art could enable programs to be established for combinations of retracts and wallblowers and under these conditions, the executive would impose constraints to see that header blowing medium availability was not exceeded. With this alternative, the wallblower switch input means 15 and the retract switch input means 16 would be combined to provide a single input means for the initiation of previously programmed blowing sequences.

In any event, as programmed blowing sequences and programmed routines are established by the operator at the program select inputs means indicated by the dashed block 14, each sequence and program established is encoded and forwarded through the multiconductor cable 20 to the input gating array means 17. Thereafter, the information associated therewith is supplied through the multiconductor cable 19 and the A bus 11 to the programmable controller 1 for storage in the memory thereof in a program blower queue. Furthermore, as program and sequence information is inserted at the program select input means 14, the receipt of this information is acknowledged by the programmable controller 1 and an acknowledgement signal is forwarded therefrom through the C1 bus 12, and the switch light driver means 18 as well as multiconductor cables 23 and 24 to illuminate the program and sequence buttons which have been depressed. This thus provides an acknowledgement to the operator that the program and sequence being defined has in effect been received by the controller and is being acted upon.

In typical modes of automatic operation, an operator will depress a series of program keys at the wallblower switch input means 15 and the retract switch input means 16 defining one or a series of sootblowing programs which are to be automatically implemented under program control. As each program key is depressed, information associated therewith is supplied through the multiconductor cables 21 and/or 22 to the input gating array means 17 and thereafter is selectively gated from the input gating array means 17 through the multiconductor cable 19 and the A bus 11 to the programmable controller 1. Upon receipt of this information, the programmable controller 1 acts in response to the executive program to cycle through the sootblower control tables contained therein to ascertain enabled sootblowers which are assigned to the programs selected at the wallblower and retract switch input means 15 and 16. The enabled sootblowers which are assigned to these programs are then established in a queue and in addition an acknowledgement is supplied from the programmable controller 1 through the multiconductor cable 12, the switch light driver means 18 and the multibit cables 23, 25, and 26 to cause the illumination of the program keys which have been depressed and each of the wallblower and retract switch input means 15 and 16 provide the operator with an indication that the inputs selected have been accepted by the programmable controller and are in the process of being established in queue. When the selection process has been completed by the operator, start program keys are typically depressed at the wallblower and retract switch input means 15 and 16 to initiate automatic processing under program control. Upon receipt of these inputs the programmable controller will acknowledge such inputs through the illumination of the start keys depressed, in the same manner described above and begin automatic processing of the information received.

Once the addresses for all sootblowers in the initial sequence for the initial program defined have been established in queue, with the retracts being taken first, and the start signal has been received, the programmable controller will go to the write mode to automatically start the initial sequence of sootblowers in queue. This is done by issuing an inhibit to the scanner multiplexer means 3 through the A bus 11 to inhibit the operation thereof and thereafter by outputting each address established in queue on the B bus together with the appropriate write and output enable commands. As each address is issued on the B bus 27 the same is supplied through the multiconductor cable 36. The address is decoded by the IO decoder means 35 and since it was accompanied by a write command is forwarded through the multiconductor cable 37 to the AC driver 7. The information supplied to the AC driver 7 is employed to uniquely set an individual latch thereof assigned to the sootblower which has been addressed and thereafter, the output of the latch, is employed to start the sootblower in response to an output enable command. This process of uniquely setting individual latches within the AC driver 7 and thereafter starting the sootblower assigned thereto is continued for each address for the initial sequence of the initial program established in queue until all of the addressed sootblowers have been started.

Once all the sootblowers within the initial sequence of the initial program have been started, the inhibit on the scanner multiplexer means 3 is released so that the same may resume the cyclic generation of each address for each sootblower in the system. As each address is generated by the scanner multiplexer means 3 it is supplied to the multiconductor cable 28 for application to the B bus 27. This address applied to the B bus 27 is applied through the multibit cable 36 to the IO decoder 35 and to the display decoder 32. Both the IO decoder 35 and the display decoder 32 acts to appropriately decode the address applied by the scanner multiplexer 3 thereto and in each case a unique signal defining either the addressed sootblower or the indicia in the boiler diagram and display panel 30 associated therewith results. During this time a read input signal is applied, under these conditions, to the B bus 27 and the decoded information from the IO decoder 35 is applied through the multiconductor cable 38 to the AC receiver 8. The AC receiver 8, it will be recalled, receives a plurality of inputs from each of the sootblowers in the system wherein the operative or inoperative condition of that receiver is indicated.

Accordingly, the addressed input to the AC receiver 8 is gated back through the multiconductor cable 38, the IO decoder 35, and the multibit cable 36 back onto the B bus where the same is also applied, in an appropriately timed manner to the display decoder 32. If an operating condition results from an interrogation by the AC receiver, this information when applied to the display decoder 32 results in the display driver 31 being enabled whereupon the indicia associated with the addressed sootblower at the boiler diagram and display panel 30 is illuminated; however, if no operating condition input is received, the addressed indicia at the boiler diagram and display panel 30 is not illuminated.

The scanner multiplexer means 3 keeps cycling through all addresses for the sootblowers in the system so that the boiler diagram and display panel 30 maintains a consistent display which is indicative of which of the sootblowers in the system is in an operative condition. Information representative of this information is in fact latched into the display driver array 31 so that a persistent display is maintained at the boiler diagram and display panel which display is continuously updated each time the scanner multiplexer 3 cycles through all the addresses in the system.

While the scanner multiplexer means 3 functions to sequence through the system on a periodic basis and to present the results of such periodic interrogation of the sootblower receiver means 8 for display at the boiler diagram and display panel 30, it is effectively driving the digital sootblower control system according to the instant invention and this continues in the automatic mode of operation until the sootblowers originally initiated by the programmable controller 1 have completed their timed cycle of operation. During this operation, the programmable controller 1 acts to perform a plurality of monitoring functions. In these functions, the programmable controller 1 sits and monitors inputs supplied on the multiconductor cable 44 from both the B bus through the multiconductor cable 45 and the sensory outputs provided by the signal converter circuit means 10. These inputs, as will be set forth in greater detail below indicate what action is taking place with regard to sootblowers which have been enabled as well as trouble conditions such as motor overload, low header pressure and similar other sensed conditions. Should any condition indicative of trouble occur, this condition, as well as normal operating conditions are indicated on the boiler diagram and display panel 30 as applied thereto through the C2 bus 41. Additionally, should a problem arise with a sootblower, the controller will issue an emergency retract in an attempt to withdraw the retract; however, a wallblower will be permitted to complete its rather short period of operation. Thereafter, a flag is established in the programmable controller, under the control of the executive program, to maintain a persistent trouble indication for that sootblower and the boiler diagram and display panel indication for the blower in trouble is placed on a flashing basis to advise the operator as to which sootblower has encountered operational difficulty. This flashing condition associated with a particular sootblower together with the indication of the nature of the problem sensed, as supplied to the boiler diagram and display panel 30 through the C2 bus 41, will ordinarily enable the operator to dispatch maintenance personnel to the location of that sootblower and in any event will advise him that the same must be disabled. Furthermore, for each blowing cycle, a separate software timer is established for both retracts and wallblowers in service and if at any time the operating cycle of the sootblowers being timed exceeds the normal operating cycle, the problem indication will be provided in much the same manner as mentioned above together with an emergency retract should a retractable blower be involved. In addition to the above, the programmable controller 1 shortly after sootblower initiation and periodically thereafter will issue a sequence of addresses through the B bus to the sootblower receiver means 8 to ascertain whether sootblowers for which a start signal has been issued have in fact started. Basically, the programmable controller achieves this through scanning the input receivers by sweeping all of the inputs and picks up all of those blowers that are in service. Thereafter, the programmable controller compares them against the addresses for the sootblowers for which start signals have been issued which in the case under discussion corresponds to those in the initial sequence in the initial program defined by the operator. These addresses are still in storage and should a faulty comparison be obtained for any address retained in storage, a no blower start signal is issued together with an alarm and flashing condition for the indicia involved to indicate that a given unit has not responded and started. Similarly, should a motor overload condition be indicated by the signal converter circuit means 10 or a similar condition which is sensed on a generalized basis as will be seen hereinafter, the programmable controller 1 searches the input queue to ascertain which sootblower has overloaded or the like. Once this is ascertained in the case of wallblowers the indicia are blinked and an alarm is issued to the operator to indicate which sootblower is in trouble while correction of the condition is left to the operator. However, in the case of a retract, an emergency retract signal is also issued to try and remove the retract before damage occurs.

When the programmable controller 1 receives an indication that the sootblowers in the initial sequence of the initial program selected by the operator have completed their blowing cycle the second sequence of the initial program is queued. A sequence counter is maintained in the instruction register within the programmable controller and is employed as an index or sequence counter which is incremented each time a sequence is loaded. This is done by going through the blower tables stored within the memory of the program controller and selecting all blower addresses which have been designated as sequence 2 for the initial program selected. Thus, the addresses are read from memory data and placed into the arithmetic logic unit of the programmable controller which also acts as an accumulator. The accumulator actually receives the blower address together with the program data associated therewith. Thereafter, non-relative bits are masked off and only the program and sequence digits are inspected. The valid sootblower data which meets this criteria is loaded in step into a temporary storage area in memory and this process continues until the entire second sequence is loaded in queue within the temporary storage area. Once the second output to be initialized has been assembled in the temporary storage area it is read into a word register for output purposes. Thereafter, the second sequence of blowers is outputted by the controller in much the same manner described above for the initial sequence of the initial program selected.

Thus it will be seen that in an automatic mode of operation, the programmable controller 1 acts to receive all operator instructions and thereafter controls the starting of all sootblowers in the program sequence defined. Once the sootblowers defined for a given sequence have been outputted, the programmable controller 1 acts to monitor a multitude of aspects of the operation associated with each sootblower, in a manner to be described hereinafter, while the scanner multiplexer means acts to periodically sequence through all sootblower addresses so that its addressing of the sootblower receiver means 8 and the display decoder means 32 serves to provide a periodically updated display as to all aspects of current operation in the system independent of the control of the programmable controller 1 which is thus left to perform its various monitoring and control functions.

In the event that the programmable controller 1 goes down or it is desired to omit the automatic mode of operation, the programmable controller 1 may be fully bypassed under emergency override conditions and operation proceeds through the scanner multiplexer means 3. The scanner multiplexer means 3 has its own power supply so that upon malfunction of the programmable controller 1, an emergency override manual mode of operation may be implemented while the boiler diagram and display panel 30 is retained in an up condition despite the absence of the operation of the programmable controller 1. More particularly, in an emergency override manual mode of operation, input information specific to given sootblowers is inserted by the operator at the wallblower and retract select inputs 15 and 16. This is done through the operation of thumbwheels or the like which are capable of uniquely designating a given sootblower in the system. Thereafter, a manual start key is depressed. Manual mode operations normally occur under the control of the programmable controller in the usual manner, however, when the manual start key is depressed, in an emergency override situation, the sootblower information is gated from the wallblower switch inputs 15 or the retract switch input 16 through conductors 21 or 22 into the input gate array 17. This information is then gated through the input gate array 17 through the multiconductor cable 19 onto the A bus 11. Under these conditions, the scanner muliplexer means 3 is inhibited from its normal scanning mode and the sootblower address thus properly introduced onto the A bus 11 is supplied through the scanner multiplexer means 3 and the multiconductor cable 28 to the B bus 27. The address introduced onto the B bus 27 by a manual operation at the wallblower switch input means 15 or the retract switch input means 16 is accompanied by a write input and under these conditions is applied through the IO decoder 35 and the multiconductor cable 37 to the sootblower driver means 7 where it is utilized to start the sootblower which has been defined by the address. This same address information is supplied to the display decoder 32; however, the display driver array 31 will, under these conditions, be inhibited in the same manner as when a write operation is initiated in the automatic mode.

Thereafter, the scanner multiplexer means will again begin to generate addresses and each address generated will cause the sootblower receiver means 8 to be polled and the display decoder means 32 to generate an address. In response to the unique circuit enabled within the sootblower receiver means 8 and the reply information indicative of an operative or inoperative sootblower generated thereby and supplied through the multiconductor or cable 38 to the B bus 27, the display driver array will have information associated with the operative state of the address sootblower latch therein to thus appropriately provide an indication with respect to that sootblower on the boiler diagram and display panel 30. Thus, in this manner, selected sootblowers in desired patterns may be initiated through a manual input sequence from the wallblower and retract switch inputs 15 and 16 and the state of operation of the system will be indicated to an operator at the boiler diagram and display panel 30. Additionally, to the extent that the state of the system may be indicated by the signal converter circuit means 10, in a manner to be described hereinafter, without the operation of the programmable controller 1, the sensed input indicias developed by the signal converter circuit means 10 will be supplied through the common permit circuit means 9 through the C2 bus 41 and indicated at the boiler diagram and display panel 30. Thus, since the scanner multiplexer means 3 is provided with an independent power supply should the programmable controller 1 go down for any reason, the digital sootblower control system according to the instant invention has an emergency override, manual bypass mode of operation wherein designated sootblowers may be manually started under the control of the system while the boiler diagram and display panel 30 maintains an operator apprised of the operation conditions of the system until such time as the programmable controller may be brought on line.

The specific structural and operational details of the invention are set forth hereinafter in conjunction with specific figures devoted to particular structural or operational aspects thereof. In addition, a full print out of the executive program suitably annotated for a reader's convenience is attached hereto as an appendix to provide a complete and workable disclosure. However, it will be appreciated by those of ordinary skill in the art at the outset that due to the nature of the instant invention and the various off-the-shelf logical configurations employed herein, many variations and adaptations to the specific structure, operational modes and sootblower configurations disclosed in specie herein may be implemented without any deviation from the concepts which are here set forth.

INFORMATION INPUT MEANS CAPABLE OF DESIGNATING SOOTBLOWERS WITHIN THE SYSTEM

Figure 2B:
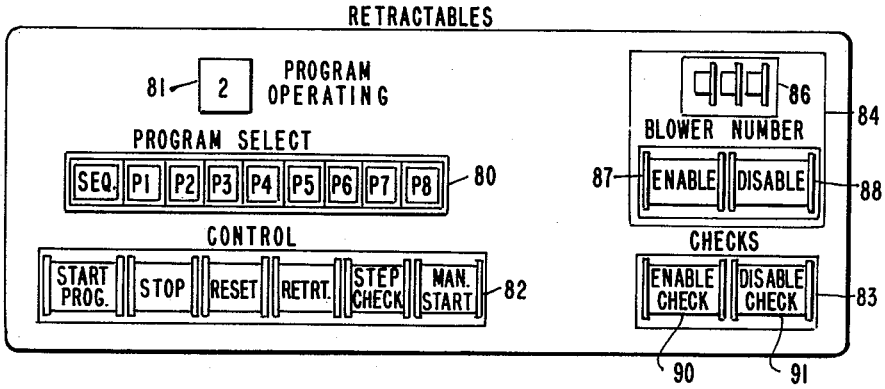
Figure 2C:
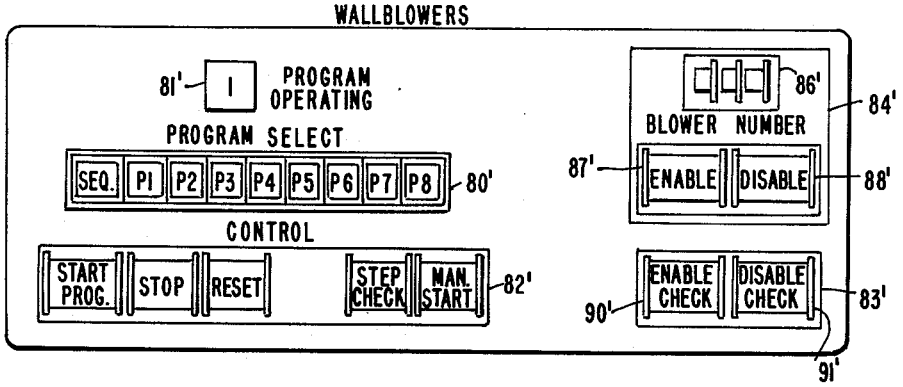

FIGS. 2A–2C show various input panels employed to insert program information and to initiate selected and/or programmed modes of operation in the embodiment of the digital control system illustrated in FIG. 1 wherein FIG. 2A illustrates a program panel for inputting sootblower programs into the instant invention and FIGS. 2B and 2C are retractable and wallblower input panels, respectively, employed to initiate programmed blowing modes of operation or selected display modes of operation with these devices. Referring more particularly to FIG. 2A there is shown the program input panel for inputting sootblower programs into the instant invention and more particularly for defining programs which are to be stored within the controller 1. The program panel for inputting sootblower programs into the instant invention would normally be accessible only to a supervisor rather than the operator so that program manipulation is retained under his control. This may typically be achieved by equipping the program panel illustrated in FIG. 2A with a locked cover or otherwise, as will be apparent to those of ordinary skill in the art, the program control panel may be maintained in a separate housing which is compatible through a plug connection or the like with the main panel board for the digitally controlled sootblower system according to the instant invention. In this manner, the insertion of program information to be stored is not available to the operator without appropriate supervision so that while the operator may initiate selected programs already within the system or meet emergency conditions through manual bypass modes of operation, the actual programming of the system may not be modified without appropriate consent. The program panel for inputting sootblowing programs into the instant invention, as illustrated in FIG. 2A comprises program buttons P1 – P8 as numbered 46 – 53, instruction buttons 55 and 56, unit select thumbwheels 58, sequence select thumbwheels 59, sequence check button 60 and accept and reject indicia 61 and 62. In overview, it should be appreciated that the program panel for inputting sootblower programs into the instant invention typically enables the loading of program routines into the controller so that they may be subsequently accessed by an operator at the retractable and wallblower input panels illustrated in FIGS. 2B and 2C. As indicated by the number of program number buttons P1 – P8 up to eight programs for wallblowers and retractables may be established so that a total of 16 programs may be set into the programmable controller 1 with each program being devoted solely to the operation of either wallblowers and retractables whereupon interleaved or dual operation of retractables and wallblowers is left up to the operator and the executive program through inputs supplied at the retractable and wallblower input panels illustrated in FIGS. 2B and 2C. Thus, each of the program number buttons P1 – P8, as annotated 46 – 53, is capable of defining one program for the wallblowers and a second for the retractable sootblowers as a function of the sootblower designations loaded in that program. Thus, in effect, the program number buttons P1 – P8 enable the establishment of up to 16 programs for sootblowers in the system wherein eight of such programs may be devoted solely to wallblower operation while the remaining eight of such programs may be devoted solely to the operation of the retractable. While only eight programs for wallblowers and retracts have been described, the number of programs available may be readily expanded. Each program loaded within the programmable controller for a wallblower or a retract may include a plurality of sequencers wherein a sequence is defined by a number of wallblowers or retracts operating at the same time. Thus such sequences may include from one to the maximum number of sootblowers which are capable of operating simultaneously from the header supply available. In the instant case, it may be assumed that eight wallblower units may operate simultaneously under conditions where a six header system is provided, four of those headers being assigned to wallblowers and up to two wallblowers being available for operation from a given header at one time. The remaining two headers are assigned two retracts one right side, the other left, and only two retractables may operate simultaneously.

Each program may have an arbitrary number of sequences which may be defined by the operator. In an exemplary embodiment of the instant invention, it may be assumed for discussion purposes that up to 64 sequences of operation may be available to the operator. The number of sequences is somewhat arbitrary and hence while the same is limited by available logic in the embodiment being discussed, a larger number of sequences are available from the logic but are here limited to 64 by the executive program established within the programmable controller as this number of sequences is viewed as all that is warranted or suitable for the embodiment of the instant invention being disclosed. The sequence number for which units are being selected is defined by dialing at the sequence select thumbwheels 59. The sequence select thumbwheels 59 may take any conventional form of digital to BCD thumbwheels conventionally available in the marketplace which enable an operator, as will be readily appreciated by those of ordinary skill in the art, to dial a digital number at the thumbwheels 65 and 66 to cause a decimal numeric to be displayed in the windows 67 and 68 as a function of the rotation of the thumbwheels. Once this number is dialed, its binary coded digital equivalent is output by the sequence select thumbwheels 59 in a manner well known to those of ordinary skill in the art. Accordingly, by a depression of one of the program number buttons 46 – 58 and a dialing of the sequence select thumbwheels 59 an operator defines both the program and the sequence therein for which sootblower information is being inserted.

The unit select thumbwheels 58 is a conventional three level thumbwheel set well known to those of ordinary skill in the art comprising three thumbwheels 70 – 72 and their associated view windows 73 – 75. As may be appreciated by a brief viewing of FIG. 6, all wallblowers controlled within the instant system are designated by a letter and a decimal number while retractables are defined by only a decimal number which does not exceed two digits. For this reason, the first two thumbwheels 71 and 72 of the unit select thumbwheels 58 serve to dial up decimal numbers from 0 to 9 in their associated windows 74 and 75 while the thumbwheel 70 serves to dial the letters A – K and has a blank position thereon which also may be displayed in its associated viewing window 73 corresponding to a no letter position. In this manner, an operator may dial up the designation for any sootblower in the system on the unit select thumbwheels 58 for entry or deletion from a given program and retractables are automatically distinguished from wallblowers by the alphanumeric code assigned to the latter as may be quickly appreciated by a cursory inspection of FIG. 6. Each alphanumeric character sequence dialed up at the unit select thumbwheels 58 is encoded, in a manner to be described in conjunction with FIG. 3 in a 9 bit code which acts in essence, to digitally describe the sootblower unit selected at the unit select thumbwheels 58.

The instruction buttons 55 and 56 serve to define whether the unit selected at the unit select thumbwheels 58 is to be inserted or removed from a program sequence defined by the sequence thumbwheels 59 and the program number buttons 46 through 53. More particularly, the unit defined at the unit select thumbwheels 58 may be inserted into a given program sequence by the depression of the insert button 55 which causes an insert instruction to be issued while the unit defined at the unit select thumbwheels 58 may be removed from a program sequence otherwise defined by a depression of the remove button 56 which causes a delete instruction to be issued in association with the code for the unit defined at the unit select thumbwheels 58.

The purpose of the accept and reject indicia 61 and 62 is to provide a viewable indicia to the system programmer which may be the supervisor or an operator that a given unit whose insertion or removal from a given sequence of a program has been commanded has either been accepted by the system in which case indicia 61 is illuminated or as been rejected by the system, in which case an error indicia 62 is illuminated to thus provide the programmer with immediate validation or invalidation of the sequence step then being programmed. More particularly, in a normal case, an operator will select a program and sequence therefor and thereafter dial up designated sootblower units at the unit select thumbwheels 58 for insertion or deletion from the system. As each unit is dialed up, it will be inserted or removed from the program sequence by the appropriate depression of the insert or remove buttons 55 and 56. Each time an insert or removal indication is provided through the depression of the insert or remove buttons 55 and 56, the codes will be processed by the system and if the appropriate instruction may be accepted by the programmable controller 1, the accept indicia 61 will briefly illuminate to advise the operator that the instruction has been accepted while if an illegal instruction has been attempted to be entered at the program panel illustrated in FIG. 2A, the error indicia 62 will be illuminated. Typically, error indications by the reject indicia 62 normally occur as the result of the violation of constraints on the system imposed by the executive program. For instance, as was briefly mentioned above, only eight wallblowers or two retracts may operate simultaneously in a given sequence step of a program. Thus, should the programmer arbitrarily attempt to exceed this limit, the executive program which keeps track of the number of wallblowers and retracts inserted in each sequence step of a program will not further process the unit code for the unit which the operator has attempted to enter in violation of this constraint and thus will cause the error indicia 62 to be illuminated. Similarly, it was also stated that only two wallblowers could operate simultaneously from a given header. Therefore, if the program being defined by the programmer should attempt to assign wallblowers in a given sequence which are on the same header, should more than two be defined, the executive program will refuse to enter the sootblower being defined which violates the constraint and instead will cause the error condition to be illuminated. The illumination of the error and accept indicia 62 and 61 as well as the illumination in answer back fashion of the instruction buttons 55 and 56, the program number buttons 46 - 53 as well as the sequence check button 60 are achieved through the issuance of an appropriate command by the programmable controller through the multiconductor cable 12 to the switch light drive 18 and the attendant issuance of drive commands therefrom to the program select inputs through the multiconductor cables 23 and 24. This manner of button illumination through an answer back routine assures the operation that the command issued has been received and processed by the programmable controller 1 as well as providing ready indicia to the operator to indicate the program in which he is operating as well as the last step he has initiated therefor through the depression of one of the instruction buttons 55 and 56.

The sequence check button 60 is provided so that the operator may readily ascertain what has been programmed in a given step of a given program for all sequences of a given program. More particularly, if the sequence check button 60 is depressed while a sequence number is specified by the sequence thumbwheels 59 and a program button 46 - 53 is in a down condition and hence illuminated, an instruction is issued to the programmable controller 1 which causes the executive program to access and display at the boiler diagram and display panel 30 all sootblowers having their codes stored in the programmable controller 1 for the sequence indicated at the sequence thumbwheels 59 in the program defined by the depressed one of the program number buttons P1 - P8.

In operation, up to eight wallblower and eight retract operational programs may be established at the program panel indicated in FIG. 2A and stored in a memory within the programmable controller 1 for access by an operator. Furthermore, each program may have up to 64 sequences of blower patterns incorporated therein. Thus typically, one or more wallblower and retract programs would be established for normal operation and hence these programs would be initiated by the operator during normal modes of operation. In addition, specialized blowing patterns to take care of emergency conditions, or unusual conditions, would be established so that upon a monitoring or sensing of these conditions such programs could be immediately implemented by an operator or by the programmable controller. Additionally, programs which are calculated as appropriate subsequent to certain operating procedures within the boiler such as a water blowing operation or the like may be established for periodic initiation by an operator. In addition, several normal operating program sequences may be established so that effectively different programs are available depending upon the conditions for the boiler and in this manner requisite blowing routines are available for immediate and automatic initiation as a function of the output of the boiler. Furthermore, programs may be readily modified at the program panel through the actuation of the insert and delete instruction buttons 55 and 56 as boiler break-in procedures occur or as the operator learns, through experience, the best patterns to maintain boiler operating conditions in a desired manner.

Typically, programs are entered at the program panel illustrated in FIG. 2A by the operator initially depressing a program number button P1 – P8 as numbered 46 – 53 and thereafter dialing the sequence number for the blower pattern to be established in this sequence of the program at the sequence select thumbwheels 59. For instance, assuming an initial program was being dialed, an operator would depress the program number button P1, 46 and thereafter dial 01 at the sequence select thumbwheels 59 to define the initial sequence of a first program. In response to this action, the P1 program number button 46 would be illuminated and a 01 would be displayed in the sequence select thumbwheels windows 67 and 68. Thereafter, the operator would go about the business of entering or if appropriate removing selected sootblower units from the program sequence being defined at the program panel illustrated in FIG. 2A.

Figure 6:
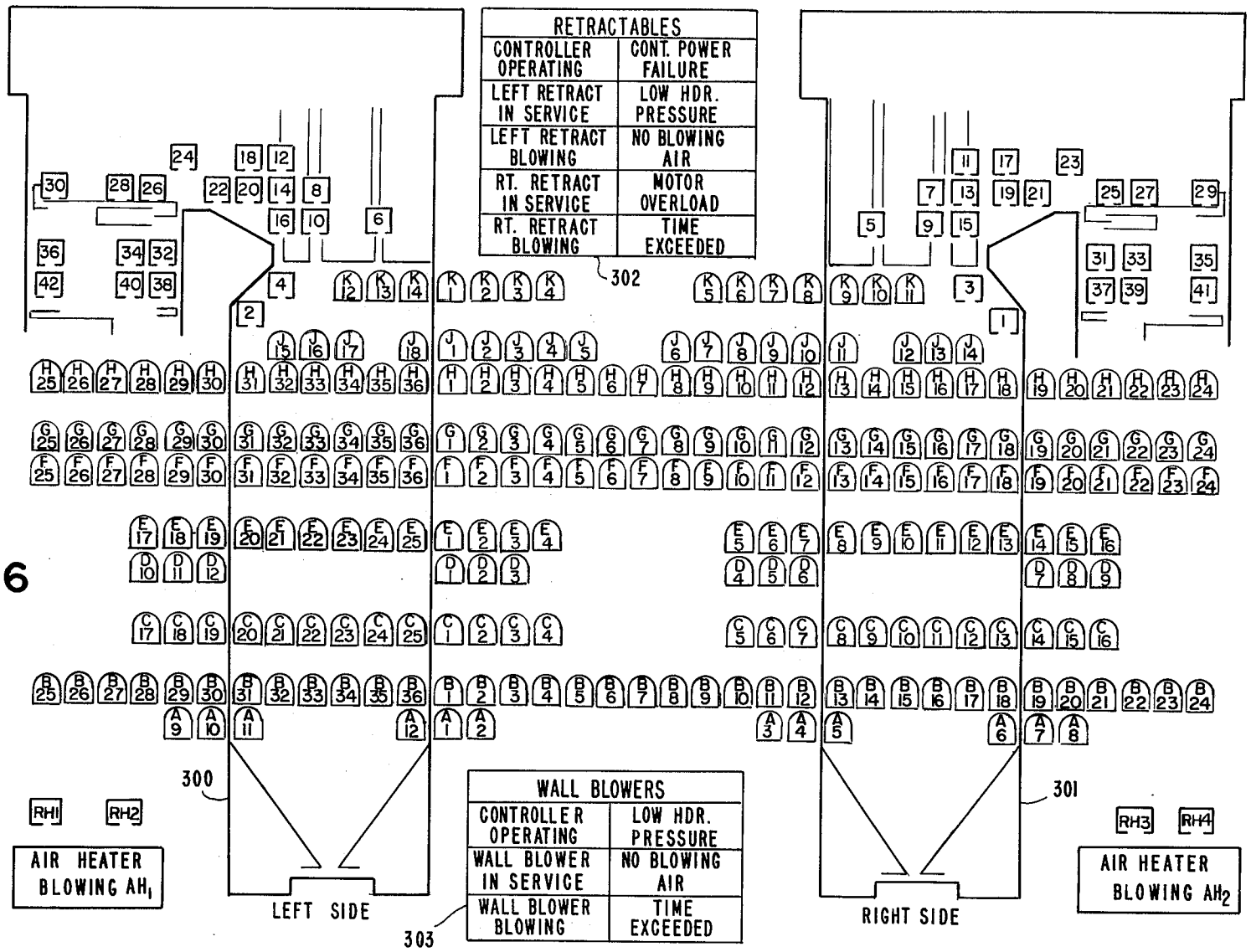

This is done, as will be apparent, by a dialing of the appropriate sootblower identifying number at the unit select thumbwheels 58 and depressing the insert or delete instruction buttons 55 and 56 as the case may be. For instance, turning briefly to the exemplary showing of a boiler display panel useable for the instant embodiment of the present invention as illustrated in FIG. 6, it may be assumed that an operator is desirous of establishing a first blowing sequence in the first program which involves the operation of wallblower units, it being recalled that each program being established at the program panel illustrated in FIG. 2A must involve either only retracts or only wallblowers in the embodiment of the invention presently being discussed. Furthermore, let it be assumed that the operator is desirous of having the initial sequence of the first program cause a blowing pattern in the G row of wallblowers illustrated in FIG. 6 wherein wallblower numbers G27, G32, G38, G4, G8, G14, G17 and G22 are to be selectively operated for their normal one minute cycle of operation. Under these conditions, subsequent to the depression of the P1 program number button 46 and a dialing of 01 at the sequence select thumbwheels 59, the operator would dial G27 at the unit select thumbwheels 58 by setting a G in window 73 through a manipulation of thumbwheel 70, a 2 in window 74 through the manipulation of thumbwheel 71 and a 7 in window 75 through a manipulation of thumbwheel 72. Thereafter, the operator would depress the insert instruction button 55 which would then illuminate it and assuming this entry into sequence 1 of program 1 was accepted by the executive program, the accept indicia 61 would be illuminated in response to instructions issued by the executive programmer within the programmable controller 1 and conveyed through the multiconductor cable 12, the switch light driver means 18, and the multiconductor cables 23 and 24 to the programmable panel illustrated in FIG. 2A.

Once the accept indicia 61 has been illuminated, the operator would then dial G32 at the unit select thumbwheels 58 and again depress the insert information button 55 to again cause the accept indicia to be illuminated and this would continue for each of the eight wallblowers G27, G32, G34, G4, G8, G14, G17 and G22 specified for the initial sequence of program 1. Should the operator attempt to define more than eight wallblowers for the initial program sequence, the reject indicia 62 would be illuminated to indicate program error and advise the operator that the last entered wallblower unit was unacceptable for entry into sequence 1 of program 1. Furthermore, as shall become more apparent below, the controller has been established under the auspices of the executive program an indexing counter which keeps track of the header assignments for the wallblowers being programmed. Each time a wallblower is entered in a sequence of a given program, this indexing counter is checked to ascertain that the number defined therein for a given header is no greater than one. If it is one, one more wallblower unit may be assigned thereto and hence the wallblower unit being inserted into the program is accepted. However, if in checking the indexing counter, a second wallblower unit is found on that header for the program sequence being defined, the header information, which, under these circumstances, would have been stored in tables, would cause the entry of the third wallblower on a given header to be rejected and hence, the operator would be advised through an illumination of the error indicia 62 that a modification to the program sequence being defined is required. Under these conditions, the operator could re-dial another wallblower unit assigned to that header at the unit select thumbwheels 58 and cause its deletion from a program by a depression of the remove instruction button 56 or alternatively, the last wallblower being assigned to the program sequence may be deleted in favor of one assigned to another header. At any rate, sequence one for program one would be defined by the operator in the foregoing manner and stored within the memory of the programmable controller 1 for later accessing. Under completion of sequence 1, the operator would dial up sequence 2 on the sequence select thumbwheels 59 and would proceed to program sequence 2. This would continue in the instant example until all the wallblower sequences for program one which were desired were programmed. Upon completion of all sequences for wallblowers desired in program one, the operator would typically program a new program one for retracts it being noted, as will be seen upon a perusal of FIG. 6, that retracts are not accompanied by an alphameric identification indicia but merely by a decimal designator. Accordingly, program one for retracts would be programmed in the same manner as described for wallblowers with the exception that only two retracts are permitted to operate in a given sequence. However, other than the number of retracts permitted per sequence and the different designation which effectively causes a zero to remain in the window 73 of the unit select thumbwheels, the programming of all sequences for program one of retract operation would be accomplished in the same manner outlined above for wallblowers.

After program one with all attending, desired sequences has been established, both for wallblowers and retracts, other programs could be established to accommodate specialized, emergency or different operating conditions through the establishment of succeeding wallblower and retract programs associated with program number buttons P2 – P8, 47 – 53 so that up to 16 individualized programs, each program having up to 64 independent sequences, could be established in the exemplary embodiment, through the utilization of the program panel illustrated in FIG. 2A. Once all desired programs have been established through the utilization of the program panel illustrated in FIG. 2A, the same would be locked up through either a closure or removal of the panel so that the same may not be arbitrarily modified by operators charged only with the operation of the system. Alternatively, an auxiliary input device could replace the program panel such as tape, TTY, etc. The programs stored are enabled in a manner to be described below in conjunction with FIGS. 2B and 2C so that preprogrammed blowing sequences are initiated in the digital sootblower control system illustrated in FIG. 1. It should be remembered however, that any time the system break-in, additional operator experience, or even supervisory preference dictates, established programs may be modified through the use of the unit select and remove information indicia button 56. Furthermore, during programming, an operator may be provided with a preview of the blower patterns established in a given sequence of a program or all sequences within a program by the utilization of the sequence check button 60.

Thus, if an operator wanted to observe the sootblowers provided in sequence one of program one, a depression of the program key 46 and the dialing of 01 at the sequence select thumbwheels 59 would set up the sequence to be checked while the depression of the sequence check key 60 would cause all wallblowers or retracts programmed for a given sequence to be displayed at the boiler diagram and display panel 30. Similarly, should the operator desire to preview all blower patterns established in all sequences of a given program, the operator would depress the desired program button, and depress the step check button, shown in FIGS. 2B and 2C, as described below. Under these conditions, the blower specified for each sequence of the selected program would be displayed in a stepwise manner per sequence at the boiler diagram and display panel 30 so that in effect, all wallblowers in sequence one would be displayed followed by wallblowers in sequence two and this would continue in a stepwise manner until all sequences specified had been exhausted. In this manner, the operator may quickly preview operations which had been previously specified.

FIGS. 2B and 2C illustrate the retractable and wallblower input panels respectively, employed to initiate programmed blowing modes of operation or selected display modes of operation associated with these respective types of sootblowers. Since both the retractable and wallblower input panels illustrated in FIGS. 2B and 2C are much the same, corresponding reference numerals will be employed in the description thereof wherein the reference numeral per se, is employed with the input panel for the retractables illustrated in FIG. 2B while a primed annotation therefor is utilized with respect to the wallblower panel illustrated in FIG. 2C.

Referring now more particularly to FIGS. 2B and 2C, it will be seen that both the retractable and wallblower input panels comprise a program select key array 80 and 80', program in operation indicia 81 and 81', a control key array 82 and 82', a check key array 83 and 83' and a status array 84 and 84'. The program select key arrays 80 and 80' for the retractable and wallblower input panels respectively each comprise program designating keys P1 – P8, and a specialized program key annotated SEQ standing for sequential. The sequential key is a specialized sequence key which effectively represents a preprogrammed operation set into the programmable controller through the executive program which causes each retract or wallblower to be operated in sequence depending upon whether the sequential key in the array 80 or 80' is actuated. This preprogrammed mode of operation is provided because it is frequently desireable to initiate each wallblower or retract in the system on a sequential basis and hence this ability is established within the digital soothblower control system according to the instant invention for the purposes of operator convenience. For instance, in certain applications it is desireable to blow every soothblower in the system once a day regardless of other blowing routines which have been established to ensure that each portion of the boiler is blown down at least once during each 24 hour period. Similarly, after a water wash job or the like, it is frequently desireable to blow down the entire system and hence under these conditions the use of the sequence operating key would be advantageous. Also, as will be appreciated by those of ordinary skill in the art, the periodic use of the sequence key is a good way to avoid continuously missing little utilized sootblowers in the system and through the periodic use of the sequence key an operator is assured that every blower in the system has been actuated at least once in every fixed interval of time.

The remaining program select keys in the program select key array 80 and 80' are employed to address established programs P1 – P8 in the programmable controller as defined through operations conducted at the program panel illustrated in FIG. 2A. The progrem keys P1 – P8 in the retractable input panel having the program select key array 80 will access correspondingly numbered programs established for wallblowers while program keys P1 – P8 in the program select key array 80' at the wallblower input panel will access correspondingly numbered programs for wallblowers. Each time one of the keys within the program select key array 80 and 80' is depressed, the key will be illuminated through an answer back technique initiated under the control of the programmable controller 1 in the manner described above and it should be noted at the outset that an operator may depress a plurality of program keys within each of the program select key arrays 80 and 80' to thereby establish lengthy program queues of operation under the control of the programmable controller. To facilitate this operation and to provide the operator with a ready display as to which program is then in progress, the program in operation indicia 81 and 81' are provided at both the retractable and wallblower input panels illustrated in FIGS. 2B and 2C. The program in operation indicia 81 and 81' are illuminated under the control of the programmable controller to display the program which is currently in operation. Therefore, although a plurality of program keys may have been depressed for both the retractable and wallblower input panels illustrated in FIGS. 2B and 2C, only one of the program in operation indicia 81 and 81' will be illuminated during the operation of the digital control sootblower system according to the instant invention and the illuminated indicia will display the program number for the program then in operation.

The control key array 82 and 82' at each of the retractable and wallblower input panels illustrated in FIGS. 2B and 2C are provided to input operational information to the digital sootblower control system according to the instant invention. More particularly, each of the control key arrays 82 and 82' are provided with a start program key annotated START PROG which acts to initiate the operation of blowers in the programmed routines input through the depression of the selected keys in the program select key arrays 80 and 80'. Normally, an operator will have depressed one of the program keys at each of the program select key arrays 80 and 80' and then will depress the start program key within the control key arrays 82 and 82'. The controller will also accept a plurality of programs and will operate them in the order of call i.e. P1/start, P3/start, P2/start, etc. to operate P1, then P3, then P2, etc. The programmable controller upon receipt of this information will act under the control of the executive program to merge the operation of the programs input from both the retractable input panel illustrated in FIG. 2B and the wallblower input panel illustrated in FIG. 2C so that the merger of each sequence in each program specified will take place in the most efficient manner without violating any of the constraints set forth for the system and imposed by the executive program. For instance, if it is assumed that the P1 program select keys have been depressed at both the retractable input panel illustrated in FIG. 2B and the wallblower input panel illustrated in FIG. 2C followed by the sequential depression of the start program key in the control key array 82 and this in turn is followed by the depression of the start program key within the control key array 82' what occurs under program control will be a function of the initial sequence specified for the P1 retractable program and the P1 wallblower program. More particularly, it will be recalled that three capacity type retracts are employed and that if low capacity retracts are operating, eight wallblowers may operate therewith, while if medium capacity retracts are operating only four wallblowers can be utilized while if high capacity retracts are enabled no wallblowers may operate simultaneously therewith. Under these circumstances, and further assuming that eight wallblowers are specified in each sequence of the P1 wallblower program, if the initial sequence of the P1 retractable calls for two high capacity retracts, only these two retracts will be enabled while the initial sequence of wallblowers will be held in abeyance until the fifteen minute operational sequence of the two high capacity retracts has been completed. Thereafter, the eight wallblowers as defined in the initial sequence of the P1 wallblower program will be started and after the one minute operational cycle thereof the next sequence of retracts in the P1 program will be initialized.

However, if the initial sequence for the P1 retract program loaded calls for two medium capacity retracts, it will be appreciated that four wallblowers may operate therewith. Under these conditions, as will be further appreciated below, the programmable controller will cause the two retracts defined in the sequence one for the P1 retract program to be initialized followed by the initialization of four wallblowers specified in the initial sequence of the P1 wallblower program. Since retracts have typically a fifteeen minute operational cycle while wallblowers have a one minute cycle, after one minute of operation when the first four wallblowers have completed their cycle, the second four in the initial sequence will be started under program control, while the two retracts are still operating. Once the eight wallblowers specified in the initial sequence of the P1 wallblower program have been operated, since the two retracts defined in the initial sequence of the retractable P1 program are still operating, the programmable controller will shift to the second sequence of wallblowers specified in the P1 wallblower program. This will continue until all wallblowers programmed have been operated or until the two retracts specified in the initial sequence of the P1 program have completed their cycle of operation. When this occurs, the two retracts specified in the second sequence of the P1 retract program will be initialized and any remaining wallblowers which have not been processed in succeeding sequences of the P1 wallblower program will be operated therewith assuming these too are medium capacity retracts. Once each of the sequences within the P1 wallblower program have been exhausted, wallblowers specified in succeeding programs defined by the operator will be operated until all retracts in the P1 program have been exhausted.

Should the initial two retracts specified in the first sequence within the P1 program be low capacity retracts, it will be recalled that eight wallblowers may be operated therewith. Under these conditions, the two retracts specified in the initial sequence of the P1 retract program will be started and the eight wallblowers specified in the inital sequence of the P1 wallblower program will be started also. Upon completion of the one minute operating cycle of the eight wallblowers specified in the initial program sequence, the retracts will still be operating and hence, the next sequence of wallblowers will be started. This will continue until the fifteen minute interval associated with the operation of the initial sequence of retracts has been completed whereupon the next sequence of retracts will be initialized. Thus it will be appreciated by those of ordinary skill in the art that the executive program acts to control the initiation of sootblowers under program control in such manner that the maximum number of sootblowers specified are operating simultaneously without violating the header requirements of the system. Since a normal sequence of programming of retracts will involve all types of capacity units, and since the operational cycle of wallblowers is much shorter than that of retracts, it will be seen that as a general principle, wallblowers are held in abeyance pending the completion of a cycle of operation of high capacity retracts while many sequences of wallblowers are initiated simultaneously with the operation of medium and low capacity retracts so that as a general rule, an advantageous mix of wallblowers and retracts are operating in an interleaved manner specified by the executive program as a function of each type of sootblower specified in the retract and wallblower programs. This convenient feature of interleaving is one reason why independent programs are preferably established for wallblowers and retracts; however, should the convenience of this interleaved mode of operation not be desired, it will be appreciated by those of ordinary skill in the art that the programming requirements of the system could be modified so that the operator specifies single programs which are a mix of wallblowers and retracts and the executive program could be made to process these programs in the priority manner established at the program control panel. It will be understood however, that such a system would not operate with the efficiency of the instant invention since the interleaving of wallblower units to fill the capacity of the system as a function of the capacity of the retracts being employed is tantamount to a time sharing system which is more within the province of the programmable controller than of the operator initializing program sequences.

The stop key provided within the control key arrays 82 and 82' are employed to terminate further initiation of sequences of blowers under program control. This means, that once the stop key is depressed at the control key array 82 and 82', no further retracts or wallblowers will be started under program control. However, it should be appreciated at the outset that wallblowers and retracts already started will be permitted to complete their cycle of operation. Typically, the stop key may be employed to terminate a program which has already been started in mid sequence and insert a new program at the stopping point. Thus, should an operator depress the stop key at both the control key arrays 82 and 82' when the P1 program is operating for both retractables and wallblowers this program would terminate at the completion of the cycle of the operation of wallblowers and retracts which were then operating. Subsequent to the depression of the stop keys at the control key arrays 82 and 82', an operator could depress new program keys at the program select arrays 80 and 80' and thereafter depress the start program keys at the control key arrays 82 and 82'. This would cause the initiation of a new program as soon as the sootblower units which were operating terminate their cycle of operation. Upon the completion of the new program specified by the operator, the previous program in operation could then be completed so that in effect the newly submitted program information is entered on a priority basis in the intervening step of the previous program but the previous program is permitted to be continued upon the completion of the newly specified program information. This is an advantageous procedure when the operator spots an indication that special conditions have occurred during the operation of the boiler and he wishes to immediately deviate from the prescribed or normal operating program to a program which is calculated to handle the unusual condition and thereafter return to the normal operating sequence.

The reset key disposed at each of the control key arrays 82 and 82' are employed to initially reset the system and abort programs which had been previously designated at the retractable and wallblower input panels illustrated in FIG. 2B and FIG. 2C. More particularly, under conditions where the operator is desirous of stopping a program in process and substituting a new program therefor without a succeeding return to the program in process upon completion of the newly entered program the operator would depress stop so that the program in process would be terminated upon the completion of the instant cycle of sootblowers in operation. Thereafter, a depression of the reset buttons at either the control key array 82 or 82' in conjunction with a Program Key would act to abort previously designated programs for retracts and wallblowers specified whereupon a new set of programs could be specified at the retractable and wallblower input panels illustrated in FIGS. 2B and 2C and initiated upon a depression of the start program keys.

The control key array 82 is provided with a retract key which has no corresponding key in the wallblower control key array 82'. The function of the retract key is to cause the digital sootblower control system according to the instant invention to issue an emergency retract signal for any retractable in current operation. As will be appreciated by those of ordinary skill in the art, retractables have a normal cycle of operation of approximately fifteen minutes and should a problem occur or it is desired to terminate a current sequence of operation, it may be undesireable to await the completion of the fifteen minute cycle of operation for the retract and if a problem situation arises with respect to a given retract where the same is effectively hung up in the boiler, damage to the retractable could occur. Under any of these conditions, the operator may issue an emergency retract signal by the depression of the retract control key which will cause an emergency retract to be issued under program control to the retractable units then in operation whereupon the same is immediately withdrawn from operation and returned to its home position. When problem conditions arise with respect to the operation of a given sootblower the same as indicated on the boiler display panel 30 through the flashing of the indicia associated therewith. Thus, under these conditions, the operator is provided with an advisory as to which retract may be in trouble and an emergency retract signal issued therefor. Accordingly, under emergency conditions associated with retractables, system operation acts automatically to issue emergency retract information. Furthermore, under conditions where it is undesireable to await the completion of the instant retract cycle of operation, a depression of the retract key by the operator will cause emergency retract signals to be issued to retractable units presently in service to cut short the current cycle of operation.

The step check keys within the control key array 82 and 82' function to provide an operator with a preview of the retractables or wallblower units enabled for operation in each sequence of a specified program. Thus the step check key within the control key arrays 82 and 82' enable an operator to ascertain which blowers are programmed for operation in each sequence of a program so that the sequential enabling of retractables and wallblowers in each program is available to an operator for inspection prior to the actual enabling of the program per se. The step check mode of operation is a specialized previewing function which is enabled under program control and established by the executive program. When the step check mode of operation is enabled, and the same may be enabled at any time regardless of whether or not programmed operation of sootblower units is in progress, the programmable controller acts to clear the boiler diagram and display panel 30, illustrated in FIG. 1 of current operating information and to shift through each sequence point of a program indicated by a depression of one of the program select keys P1 – P8 in one of the program select key arrays 80 and 80' causing each sootblower unit which is defined for operation within that sequence point to be displayed at the boiler diagram and display panel 30 so that the contents of each sequence point is displayed in a stepwise manner. In this manner, the operator may be provided with the contents of each sequence of a defined program in a stepwise manner prior to selection of that program or in the process of checking a program to ensure that the contents thereof are appropriate for the operating conditions presently being encountered or currently anticipated prior to the initiation of the desired program. Accordingly, to enable the step check previewing feature, an operator would depress one of the program keys P1 – P8 at either the retractable or wallblower program select key arrays 80 or 80' and thereafter, depress the associated one of the step check keys in the control key array 82 or 82'. Thereafter, the programmable controller 1 would cause the boiler diagram and display panel 32 to be cleared and thereafter the executive program therein would cause the sootblowers defined within each sequence of the program designated to be displayed in a stepwise manner so that the same may be previewed by an operator. Alone, the Step Check key will preview sequence information.

The manual start key within each of the control gate arrays 82 and 82' enable the manual starting of a retractable or wallblower unit which is defined by the thumbwheels within the status arrays 84 and 84' of the retractable or wallblower input panel illustrated in FIGS. 2B and 2C. The manual start feature associated with each of the retractable and wallblower input panels enables an operator to manually cause the initiation of any sootblower in the system when it is desired that either a specialized manual initiation mode of operation be performed or under emergency override circumstances where the programmable controller 1 has failed due to a malfunction or power failure and hence need be bypassed to maintain appropriate operating conditions within the boiler while the condition of malfunction is corrected. The manual start bypass mode of operation enabled by the depression of one of the manual start keys in the control key arrays 82 and 82' will operate to start a wallblower or retractable unit defined in the thumbwheels within the status arrays 84 and 84' under all conditions except when system conditions not associated with the operation of the programmable controller indicate that a malfunction within the system has occurred, as shall be seen below, which should preclude the operation of sootblowers. The manual start function is logically divided, as shall be seen in greater detail in conjunction with FIG. 12, into manual enabling associated with wallblowers and retracts as indicated by the separate treatments in FIGS. 2B and 2C and is operative any time the sootblowers associated therewith are not operated under program and no specialized conditions associated with either header pressure or flow rates should otherwise preclude the operation thereof. Thus typically, the manual operation of a defined retract is enabled anytime retracts are not in service and no condition in the system which precludes the operation is sensed such as conditions associated with motor overload, flow rates, or low header pressure and the like. Similarly, the manual enabling of wallblowers is permitted so long as wallblowers are not otherwise in service, flow rates are appropriate and no low header condition has been sensed. Accordingly, it will be seen that while the instant invention provides fully automatic modes of programmed operation when appropriate or desired, an operator may merely dial up a desired one of the system's sootblowers and cause the manual initiation from the appropriate retractable or wallblower input information panel to cause the initiation thereof while using the logical switching supplied by the instant invention and this capability, under conditions when controller failure has occurred, will enable the boiler to be maintained under appropriate operating parameters, despite possible failure conditions otherwise within the system.

The status arrays 84 and 84' associated with the retractable input information panel illustrated in FIG. 2B and the wallblower input information panel illustrated in FIG. 2C enable the selective enabling or disabling of any sootblower in the system as well as providing a set of thumbwheels for defining individual sootblowers which are to be initiated under manual start conditions. More particularly, the status arrays 84 and 84' each comprise sootblower defining thumbwheels 86 and 86' for retractable and wallblower units respectively, enable keys 87 and 87' and disable keys 88 and 88'. In essence, any retractable whose assigned code is dialed within the thumbwheels 86 or any wallblower whose assignment code is dialed within the thumbwheels 86' may be selectively disabled by the depression of the disable keys 88 or 88' so that the same may not be started either through the operation of the programmable controller and implementing programs which have been otherwise selected or through manual start procedures. Thus effectively, a sootblower unit defined at the thumbwheels 86 or 86' may be effectively removed from service by the depression of the disable key 88 or 88'. Subsequently, a disabled sootblower unit may be returned to service by dialing its assigned number within the thumbwheels 86 or 86' and depressing the enable key 87 or 87'. Thus it will be appreciated by those of ordinary skill in the art that particular sootblowers within the system may be removed from service so the same may undergo maintenance procedures or the like and thereafter return to service without otherwise effecting the overall system as a whole. This is highly advantageous not only for periodic maintenance which is conducted on all sootblowers within the system but in addition thereto, it will be seen hereinafter that any time system failure occurs which is associated with a given sootblower that condition is indicated at the boiler diagram and display panel 30 by a flashing of the indicia associated with that blower. Upon an indication of such a condition an operator may remove the blower from system operation through the use of the disable keys 88 and 88' in conjunction with the sootblower defining thumbwheels 86 and 86' whereupon maintenance can be performed on that sootblower while the integrity of the system as a whole remains in an operational state. Upon the completion of such maintenance, the sootblower effected may be returned to service through the operation of the enable keys 87 or 87' in conjunction with the sootblower defining thumbwheels 86 and 86'. The sootblower defining thumbwheels 86 and 86' maytake the same form as the unit selected thumbwheels 58 described in conjunction with FIG. 2A and hence, an operator need merely dial up the unit designation for the sootblower which is to be defined thereby. Furthermore, not only are the sootblower defining thumbwheels 86 and 86' employed in conjunction with the selective enabling and disabling features of the enable and disable keys 87, 87' and 88 and 88' but in addition thereto these thumbwheels are also employed to define a sootblower to be manually started in association with the manual start keys 82 and 82'. Although three sets of thumbwheels have been specified in conjunction with FIGS. 2A – 2C, it should be appreciated that a single set of thumbwheels may be utilized in place of the three sets illustrated if an avoidance of operator confusion is assured as the definition feature for each set of thumbwheels is the same. Furthermore, a definition pad such as a touch tone key pad may be employed in place of thumbwheels should this mode of defining sootblowers be deemed more desirable. The selective enabling or disabling function associated with the enable and disable keys 87 and 87', 88 and 88' acts under program control to provide a disable level associated with particular sootblowers which have been defined and hence no removal from actual programming sequences takes place. This results, as shall be seen below, in obviating a need to remove the particular sootblower from the various program sequences involved in that when the same is disabled it will merely not start other conditions which would otherwise cause the starting thereof through automatic initiation under program control or that associated with manual starting procedures.

The check key arrays 83 and 83' provide for separate status checks for retractables and wallblowers within the system under conditions wherein the enable and disable checks tend to be somewhat complementary in nature. Furthermore, these checks provide additional previewing features for the operator and may be implemented at any time regardless of whether or not the system is operating under program control, manual input control or is otherwise inactive. The check key arrays 83 and 83' each comprise an enable check key 90 and 90' as well as a disable check key 91 and 91' associated, respectively, within the retractable and wall blower input panels illustrated in FIGS. 2B and 2C. More particularly, when the enable check key 90 or 90' is depressed, without the depression of a program select key P1 - P8, the boiler diagram and display panel will be cleared under program control and thereafter all retractables or wallblowers which have an operational status will have the indicia therefor at the boiler diagram and display panel illuminated to advise the operator as to which sootblowers in the system are operational. Conversely, when the disable check keys 91 and 91' are depressed, the boiler diagram and display panel 30 will be cleared and the system will display all retractables or wallblowers which have been disabled to apprise the operator of the condition of the system with respect to units which have been disabled through the operation of the status arrays 84 and 84'. However, if a program key P1 - P8 in the program select control arrays 80 and 80' are depressed followed by the depression of the enable check keys 90 or 90' in that input panel, the boiler diagram and display panel 30 will be cleared under program control and thereafter the executive program will cause all sootblowers which are to be operated within the program whose definition key has been depressed to have their indicia illuminated at the boiler diagram and display panel 30 and hence advise the operator of all sootblowers to be operated during that program regardless of the sequence in which operation is to occur. Conversely, when one of the disable check keys 91 or 91' is depressed in conjunction with a program key P1 - P8, the boiler diagram and display panel 30 will be cleared and thereafter sootblower units associated with either the retractable or wallblowr input panels being operated upon which are not select in that program, again regardless of sequence, will be displayed to apprise an operator as to which units will not be blown in the various sequences of patterns defined for the program whose definition key has been depressed.

Accordingly, it will be appreciated by those of ordinary skill in the art that while the program input panel illustrated in FIG. 2A allows an operator, preferably on a supervisory level, a wide ambit of flexibility and control in defining various programs of blowing patterns and sequences therein for program operation, while thorough checks are provided to enable the operator to preview sequences of routines established, the retract and wallblower input panels illustrated in FIGS. 2B and 2C enable the operator to have similar flexiblility in operating the system according to selected programs which have already been established. In addition, the input panels associated with FIGS. 2B and 2C permit the operator to start any blower manually, to selectively enter and delete sootblowers from the system and in addition thereto may be operated to initiate every sootblower in the system in a sequential basis while providing a multitude of operational checks which can be initiated to provide the operator with information contained in various programs or the operational status of the system as a whole.

Figure 3:
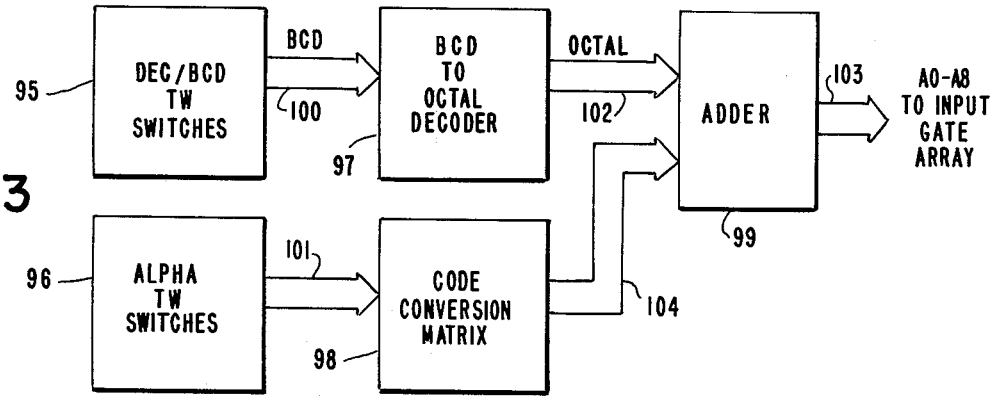

FIG. 3 is a block diagram schematically illustrating an exemplary code conversion arrangement for transforming sootblower designation defined at the various thumbwheel sets employed within the instant invention into nine bit address information appropriate for the embodiment of the digital sootblower control system illustrated in FIG. 1. It should be appreciated at the outset that the function of the exemplary code conversion arrangement illustrated in FIG. 3 is to translate information defined at the various thumbwheels illustrated in FIGS. 2A - 2C into nine bit address codes in octal which may be employed for processing purposes within the instant embodiment of the present invention. Thus, a code conversion arrangement such as is illustrated in FIG. 3 may be employed for each set of thumbwheels relied upon to define sootblower designation or sequence information or alternatively, information from each set of thumbwheels may be applied to a single conversion arrangement as such information from the various sets of thumbwheels is ordinarily not supplied in a simultaneous manner from the various information panels illustrated in FIGS. 2A - 2C. Furthermore, it will be appreciated by those of ordinary skill in the art that the code conversions performed by the illustrative circuitry set forth in FIG. 3 could be performed under software control by the programmable controller 1 should this approach meet the objectives of the designer of the system. Here however, the software conversion approach is not viewed as most desirable as under these circumstances manual start operations would not be available should the controller go down. Therefore, it is generally preferred where manual bypass of the controller is to be made available as in the exemplary embodiment of the present invention now being set forth, that code conversion arrangements such as illustrated in FIG. 3 be supplied in a hardware format at the back plane of the information input panels illustrated in FIGS. 2A - 2C even though other arrangements therefor are readily available and will immediately present themselves to those of ordinary skill in the art.

The exemplary code conversion arrangement illustrated in FIG. 3 comprises the thumbwheel converted decimal outputs indicated by the block 95, the thumbwheel switch outputs for alpha information indicated by the block 96, a BCD to octal decoder means 97, code conversion matrix means 98 and adder means 99. Each set of thumbwheels employed for the information panels such as the thumbwheels 58, 86 and 86' as illustrated in FIGS. 2A -2C include two thumbwheels with which the operator will set decimal numbers. For instance, in the unit select thumbwheels illustrated in FIG. 2A, decimal numbers are set by use of the thumbwheels 71 and 72 while with the sequence thumbwheels decimal numbers are set with the thumbwheels 65 and 66 while similar setting operations occur for the right most two thumbwheels in the thumbwheel sets indicated by the numerals 86 and 86' in FIGS. 2B and 2C. Similarly, the left most thumbwheel 70 in the unit select thumbwheels 58 as well as the left most thumbwheel for wallblowers indicated by the thumbwheels 86' is or may be employed to set an alpha character to define a wallblower, it being recalled that the retracts illustrated in FIG. 6 are designated by decimal numbers while wallblowers are indicated by an alpha character and a decimal number to distinguish them for the operator. Furthermore, as will be appreciated by those of ordinary skill in the art, the thumbwheels actually available in the marketplace are provided with a code conversion arrangement so that each decimal set in the window thereof is converted to a BCD code for purposes of outputting information and hence each decimal window has four output lines associated therewith to accommodate the setting of any decimal digit from 0 to 9 therein as four bits of digital information ranging from 0000 to 1001. However, as alpha informaton is not readily accommodated into a standardized digital format, independent lines for each alphacharacter capable of being set at the thumbwheels is provided and in the case of the instant invention, 16 distinct lines are output from the portion of the thumbwheel sets in which alpha characters may be set to accommodate the setting of alpha characters A - O as well as a blank designation indicative that no alpha character is set.

The portion of a set of thumbwheels in which decimal information is set and translated into BCD is illustrated by the block 95 it being appreciated by those of ordinary skill in the art that the first decimal number set is translated into four bits of BCD information and output in parallel from the thumbwheel converter indicated by the block 95 and similarly, the second decimal number set is translated into four bits of information and output in parallel as thumbwheel converted information for decimal inputs in the manner indicated by the block 95. Therefore, it will be appreciated that the output of the converter portion of the thumbwheels associated with decimal information as indicated by the block 95 corresponds to eight bits of BCD information wherein the first four bits thereof represent the first decimal set at the thumbwheel while the second four bits thereof represent the BCD equivalent for the second decimal set at the thumbwheels. Similarly, as indicated by the block 96, information corresponding to a blank or an alpha character set at the thumbwheel associated therewith is translated into one of sixteen lines of information which uniquely defines the alpha character or blank set and is translated through the multiconductor cable 101 to the code conversion matrix means 98. Therefore, the code conversion matrixing means 98 receives 16 lines of information and a high on one line will indicate the condition of the alpha character thumbwheel. Furthermore, all of the information provided by the multiconductors cables 100 and 101 are conventionally available at the outputs of thumbwheel sets availble in the marketplace and required no additional hardware except cabling required to be connected to the thumbwheel converted outputs for decimal outputs indicated by the block 95 and the thumbwheels switch outputs for alpha information indicated by the block 96.

A review of the boiler diagram and display panel illustrated in FIG. 6 render it apparent that 42 retracts which are indicated by block representations and numbered 1 - 42 are disposed symetrically on each side of the boiler while 250 wallblower units annotated by an alpha designation followed by a decimal designation are arranged in rows about the boiler. Therefore, it will be appreciated that the eight bit input supplied to the BCD to octal decoder means on the multiconductor cable 100 may specify either a retract or a wallblowr unit depending upon whether or not an alpha indication is provided at the thumbwheel switch outputs for alpha information indicated by the block 96. Furthermore, of the eight lines supplied to the BCD to octal decoder means 97 through the multiconductor cable 100, two distinct four bit codes each of which represent one of the decimal digits set at the thumbwheels are supplied rather than an eight bit code defining the decimal equivalent set at the thumbwheels.

The function of the BCD to octal decoder means 97 is to order the eight bits of information supplied thereto on the multiconductor cable 100 into a resulting code corresponding to the equivalent of the two digit decimal setting at the thumbwheels and to provide an output representative thereof in octal code. This is accomplished in a conventional manner by using a pair of conventional BCD to binary converters connected for two BCD decades in a manner well known to those of ordinary skill in the art. For instance, if the eight lines within the multiconductor cable are arbitrarily viewed as lines 0 - 7 wherein lines 0 - 3 represent the least significant digits and lines 4 - 7 represent the most significant digits, line 0 would be employed directly as an output while lines 1 - 5 would be connected to the respective inputs A - E of a first binary to BCD converter chip. Similarly, lines 6 and 7 would be connected to inputs D and E of a second converter chip while outputs Y3 - Y5 of the first converter chip would be connected to inputs A - C of the second converter chip.

Thereafter, in a manner well known to thos of ordinary skill in the art an eight bit binary output which here would correspond to an octal output would be provided by the zero line, serving as the least significant bit, the Y1 and Y2 outputs of the first BCD to binary converter and the remaining the five outputs $Y_1$-$Y_5$ of the second BCD to binary chip to thus form an 8 bit output code in binary which corresponds to an octal representation of the two digit decimal number set at the thumbwheels. For more information on the nature of the BCD to octal decoder means 97 reference may be had to page 402 of "The TTL Data Book for Design Engineers" published by Texas Instruments Corporation, copyrighted 1973. However, it is here sufficient to appreciate that the BCD to octal decoder means 97 provides an 8 bit output on the multiconductor cable 102 representative of the decimal digits set at a pair of thumbwheels and this 8 bit octal code is appropriately ordered to directly represent the number set at said thumbwheels. The 8 bit octal code on the multiconductor cable 102 is supplied directly to one set of inputs of the adder means 99. The adder means 99 may take the form of an 8 bit binary full adder which acts in the conventional manner to sum 8 bits of information presented at a first set of inputs thereto with 8 bits of information presented at a second set of inputs thereto and provide at the outputs thereof, a resulting 9 bit code (8 bits plus a carry) representing the sum of the two sets of inputs. The 8 bits of octal information on the multiconductor cable 102 are supplied to a first set of inputs of the eight bit binary full adder 99 and the output of this adder with carry as indicated is applied to the multiconductor cable 103 and, as shall be rendered more apparent below, serves as a 9 bit address $A_0$-$A_8$ which is employed for all addressing purposes for sootblowers and the like within the instant invention.

From discussions set forth heretofore, it will be appreciated that the retracts employed within the instant invention and set forth on the boiler diagram and display illustrated in FIG. 6 are numbered 1 - 42 and are symetrically disposed on each half of the boiler so that effectively 21 retracts sit on each side of the boiler. Similarly, wallblowers are illustrated and disposed in rows so that in the exemplary embodiment of the instant invention, 250 wallblowers are presented in rows wherein each row bears a different alpha designation together with a numeral defining the wallblower within that row. Of the 250 wallblowers illustrated in this exemplary embodiment the number and reference designation for each blower may be placed in the following array for consideration:

| Wallblower Designations Per Row | Number of Wallblowers |
|---|---|
| A1 - A12 | 12 |
| B1 - B36 | 36 |
| C1 - C25 | 25 |
| D1 - D12 | 12 |
| E1 - E25 | 25 |
| F1 - F36 | 36 |
| G1 - G36 | 36 |
| H1 - H36 | 36 |
| J1 - J18 | 18 |
| K1 - K14 | 14 |
| TOTAL | 250 |

Since the 42 retracts employed within the invention are not provided with an alpha designation and each alpha designation represents a varying numeral depending upon the number of wallblowers in previous rows, it will be appreciated by those of ordinary skill in the art that the 8 bit octal code applied to the adder means 99 through the multiconductor cable 102 may represent a retract or a wallblower depending upon whether an alpha character is set therewith and if an alpha character is set therewith its numerical representation to the system is strictly a function of the number of wallblowers in the rows which preceded it. For instance, considering a strictly consecutive numerical arrangement and according to the retracts in the system numerical representations corresponding to 1 - 42, it will be seen that wallblower A1 would correspond to the 43rd sootblower in the system, while wallblower B1 would correspond to the 55th sootblower in the system and similar varying equivalents would apply to any other alpha character employed in defining wallblowers since varying numbers of wallblowers are utilized in each row. Therefore, in tabular form, it will be seen that the alpha characters A - K represent the following numerical equivalents for the purpose of defining wallblowers:

| Letter Designation | Decimal Number Represented By the Alpha Designator |
|---|---|
| A | 42 |
| B | 54 |
| C | 90 |
| D | 125 |
| E | 137 |
| F | 162 |
| G | 198 |
| H | 234 |
| I | Not used |
| J | 270 |
| K | 288 |

Thus, it will be appreciated that if the foregoing numerical equivalents are added whenever its corresponding letter designation is inserted at the thumbwheels, the added value, when summed with that provided as inputs for the decimal number set at the thumbwheels will yield the appropriate sootblower number for the system when wallblowers are being defined while if a blank indication is left at the alphameric thumbwheel, the 0 - 42 indication at the decimal thumbwheels will suffice to define the retracts. The alpha inputs to the system as indicated by the block 96 are conveyed through the multiconductor cable 101 to the code conversion matrix means 98 under such circumstances that 16 lines of information are present within the multiconductor cable 101 each line representing either a blank indication or the alpha character assigned thereto. Thus, each time an alpha representation is supplied on the thumbwheel devoted to this purpose one line within the multiconductor cable 101 will go high to indicate the character which has been set. The code conversion matrix means 98 may comprise a conventional diode matrix or the like which acts in the well known manner to provide an 8 bit octal code representing a predetermined number in response to a high on any of the sixteen inputs supplied thereto through the multiconductor cable 101. In the case of the blank input going high, the 8 bit code output by the code conversion matrix means 98 is an all zero indication while when any of the inputs associated with the alpha characters A - K listed in the table go high, an 8 bit octal number corresponding to the decimal equivalents set forth for that alpha character in the table above is output. With 16 inputs available, it will be appreciated that five input codes I, L - O are not utilized within the instant invention but are retained as available for later assignment should the number of rows of wallblowers be desired to be expanded in other embodiments of the instant invention.

Each 8 bit output code provided by the code conversion matrix means 98 is supplied to the second set of inputs of the adder means 99 through the multiconductor cable 104. In this way, the decimal value set at the thumbwheels is supplied to the adder means 99 at a first set of inputs thereto as an 8 bit octal code on the multiconductor cable 102 and an 8 bit oct 1 code representing the octal equivalent for the alpha character set at the remaining thumbwheel, if any, is supplied to a second set of inputs to the adder means 99 through the multiconductor cable 104. In this manner, the function of the binary full adder means 99 is employed to output a nine bit code as address bits $A_O$ - $A_8$ which represents the number of the sootblower specified at the thumbwheels regardless of whether a retract which has only decimal digits associated therewith or a wallblower which has both an alpha character and decimal digits associated therewith has been defined. Accordingly, the nine bit code provided at the output of the adder means 99 represents in octal code the binary value of any sootblower specified at the thumbwheels regardless of whether or not retracts or wallblowers have been defined. Thus it will be appreciated by those of ordinary skill in the art that whenever a sootblower is defined to the system at the thumbwheels or for that matter a sequence number, a nine bit address code is provided by the output of the binary full adder means 99 so that the same may be employed for address purposes within the embodiment of the invention herein being disclosed. This 9 bit output, as indicated in FIG. 3, is supplied to the input gate array 17 which is described in greater detail in conjunction with FIG. 4.

INPUT GATE ARRAY

Figure 4:
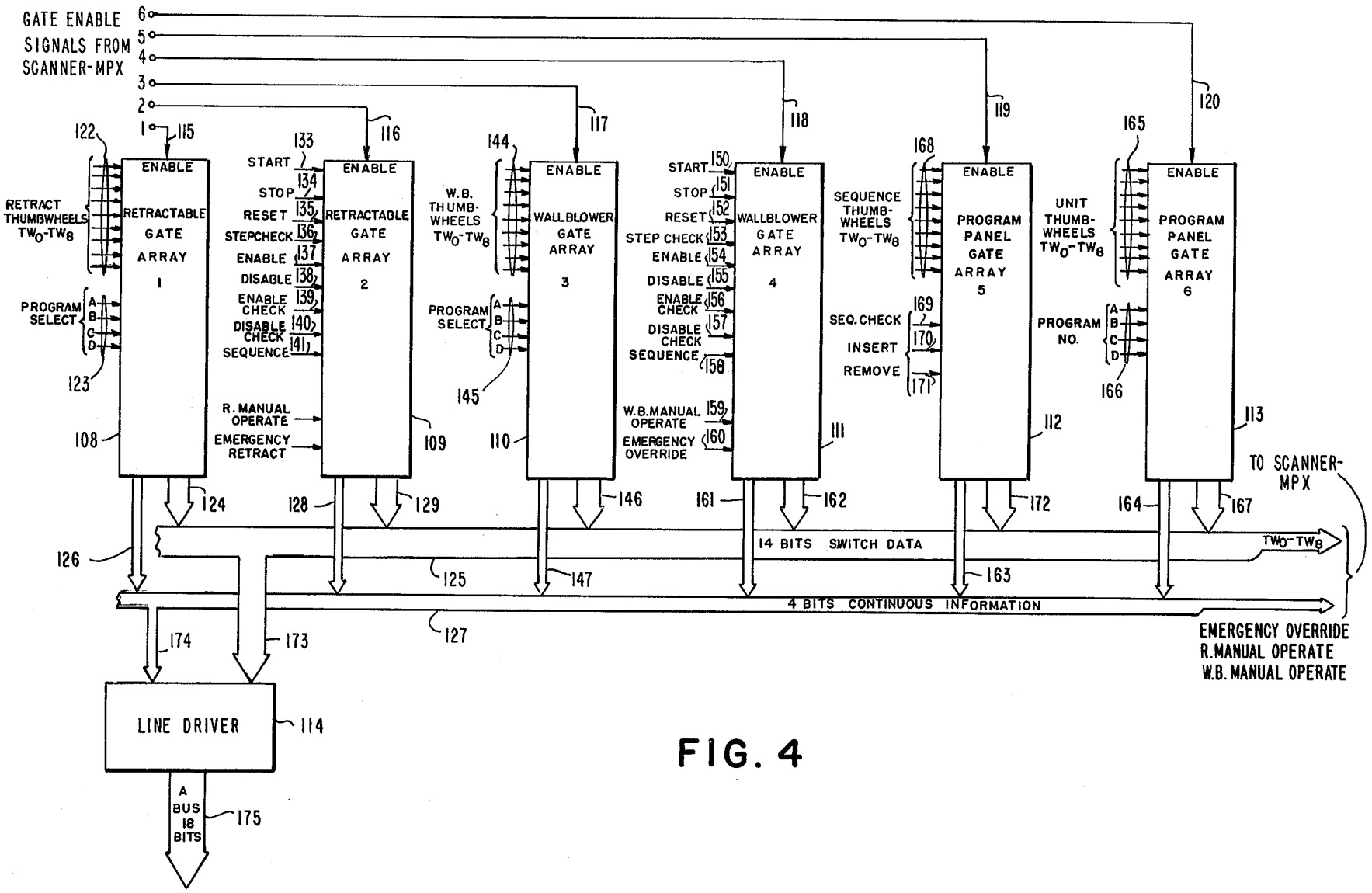

Referring now to FIG. 4, there is shown a block diagram which schematically illustrates an exemplary input gating arrangement for the embodiment of the invention shown in FIG. 1. In general, the input gate array 17 generally shown in FIG. 1 functions to receive input information from the various information inputs 14, 15 and 16 and control information from the scanner multiplexer means 3. In response to this control information, appropriate input information from the information inputs 14, 15 and 16 is forwarded through the A bus 11 to either the programmable controller 1 or to the scanner multiplexer means 3 for purposes to be described in greater detail below.

The exemplary input gate array illustrated in FIG. 4 for the embodiment of the invention shown in FIG. 1 comprises a plurality of AND gate arrays 108–113 and a line driver means 114. While only six AND gate arrays have been shown, it should be noted that it is possible to operate a total of nine input gates to accommodate additional control inputs. For instance, if it were desired to add a Air heater control key input, it could be added through gate number 7. In addition, as shall become apparent from the discussion of FIG. 4 which follows, in FIG. 4 the A bus 11 illustrated generally in FIG. 1 as a 24 bit bus has been broken up in a manner to better convey the input and output information presented to and obtained from the input gate array illustrated in FIG. 4 as well as to distinguish outputs which are present on a continuous basis from those which are provided on a command basis. Each of the AND gate arrays 108–113 comprises an 18 input AND gate array which, with the exception of a few specified inputs, to be discussed below, is a commonly enabled array so that when an enable signal is provided thereto, each of the 18 inputs available are gated to the outputs thereof. Thus, each of the AND gate arrays 108–113 may take the form of 18 individual AND gates each of which has two inputs with one of the inputs to each gate being commonly connected to an enabling input so that when such enabling input goes high, the entire AND gate array is enabled to gate inputs presented on the second inputs to each of the AND gates to the output thereof. The enable input to each of the AND gate arrays 108–113 is connected, as plainly indicated in FIG. 4 to a separate enable line 115–120 for that AND gate. The gate enable signals supplied to the enable lines 115 – 120 are supplied thereto as indicated in FIG. 4 from the scanner multiplexer means 3 which is described in detail in conjunction with FIG. 5. Here, it is sufficient to appreciate that six independent enable inputs (up to nine being available) are supplied over the A bus from the scanner multiplexer means 3 to the input gate array 17 over the A bus and these inputs terminate at the input gate array so that they are not further conveyed to the programmable controller 1. Accordingly, the gating inputs for the input gate array illustrated in FIG. 4 may be viewed as a limited input therto on the A bus which is not further conveyed and as shall be apparent from a description of FIG. 5, while these inputs are in fact developed at the scanner multiplexer means 3, they result as a function of specalized control inputs supplied on the B bus from the programmable controller 1.

The input gate array 17 as illustrated in FIG. 4 is organized in such a manner that pairs of the AND gate arrays 108 – 113 are associated with each of the distinct information inputs for which a panel is provided as illustrated in FIGS. 2A – 2C. Thus, as indicated by the annotations associated with each of the AND gate arrays 108 – 113, AND gate arrays 108 and 109 are associated with and receive input information from the retract switch input means 16 illustrated in detail in FIG. 2B, the AND gate arrays 110 and 111 are associated with and receive input information from the wallblower switch input means 15 illustrated in detail in FIG. 2C while the AND gate arrays 112 and 113 are associated with and receive input information from the program select inputs 14 illustrated in detail in FIG. 2A. Thus all information entered at any of the information inputs 14 – 16, as illustrated in detail in FIGS. 2A – 2C are selectively gated through the input gate array 17 and, as shall be further seen below, are conveyed through the A bus for direct application either to the programmable controller 1 or the scanner multiplexer means 3.

Turning specifically to the AND gate arrays 108 and 109 it will be seen that the AND gate 108 receives nine bits of retract defining information at the inputs thereto annotated 122. These nine bits of information correspond to the retract designating input set at the thumbwheels 86 illustrated in FIG. 2B after the same have been processed into a 9 bit octal code in the manner indicated in FIG. 3. Similarly, the AND gate array 108 receives four bits of program select information at the inputs thereto annotated 123 which correspond to a digital encoding of the 16 programs, of which 8 are used in this version, which may be specified through a depression of the program select keys P1 – as also illustrated in detail in FIG. 2B. The digital encoding of the eight program input designations which may be supplied through a depression of program select input keys P1 – P8 is accomplished at the back plane of the retractable input panel in the well known manner and while only nine of the sixteen input codes available are here used, it will be appreciated that the four bit input provisions supplied at the inputs 123 make the inputting of up to sixteen program designations readily available within the instant invention without any code modifications should the designer see fit to incorporate such additional programming capabilities into the system through the addition of program keys and encoding circuitry therefor at the retractable switch inputs illustrated in FIG. 2A. Thus, the AND gate array 108 receives 13 discrete inputs at the 18 inputs thereto of which nine bits of input information are associated with the thumbwheel information which may be established to define retractable units at the retractable input panel illustrated in FIG. 2B while four bits of information represent a digital encoding of the condition of the eight program select keys P1 – P8 at the retractable input panel, and one bit is a spare. The remaining four are disclosed below. Thus, whenever the AND gate array 108 is enabled by the presence of a high on the enabling input 115, the 14 bits of input information supplied thereto will be conveyed through the multiconductor output cable 124 to the multiconductor cable 125 which is 14 bits wide and serves to provide, in a manner to be rendered more apparent below, 14 bits of information which is presented thereto on a command basis to either the scanner multiplexer means 3 or to the line driver 114 where it is subsequently applied to the programmable controller 1. The multiconductor output cable 126 is connected to the multiconductor cable 127 which acts, as shall be further described below, to supply bit information which is automatically gated from the AND gate arrays 108–113 to either the scanner multiplexer means 3 or the programmable controller 1 whenever any of such bit information occurs. This information is related to emergency override information, retract manual operate information, wallblower manual operate Information and emergency retract information which does not require selective enabling of the AND gate array to which these inputs are applied for application to the multiconductor cable 127 since the gates to which this information is presented are permanently enabled. However, none of this information is supplied to the AND gate array 108 and hence, no information is applied to the multiconductor cable 126.

It is shown however, to illustrate the symetrical connections employed for the input gating array illustrated in FIG. 4. Accordingly, it will be seen that whenever an enable level is applied from the scanner multiplexer means to the enable line 115, any retract thumbwheel information or program select information associated with retractables and applied to the input gating arrangement 108 will be conveyed through the multiconductor cable 124 to the 14 bit cable 125 which forms the portion of the eighteen bit A bus associated with information presented thereto on a command basis from the multiconductor cable 125. This information is provided through the outputs thereof to the line driver 114 for subsequent application to the programmable controller 1 while a nine bit portion of the fourteen bit multiconductor cable 125 is applied to the scanner multiplexer means as indicated by the portion thereof annotated $TW_0$ – $TW_8$. Thus, a portion of the multiconductor cable 125 is applied to the scanner multiplexer means illustrated in FIG. 5 for reasons which will be clarified in the discussion thereof. Here, however, it is sufficient to appreciate that the only information which is conveyed from the input gating array means to the scanner multiplexer means 3 is information associated with thumbwheels which acts to designate a given sootblower which is to be operated upon. For this reason, only nine conductors within the fourteen conductor multiconductor cable 125 are applied to the scanner multiplexer means and these nine conductors are associated with thumbwheel information. Similarly, while the multiconductor cable 127 is four bits wide and is devoted to information which is presented thereto anytime the same occurs, only three conductors which are associated with emergency override information, retract manual operate information or wallblower manual operation are appropriate, as shall be seen below, for application to the scanner multiplexer means and hence, as indiated by the annotations to the multiconductor cable 127, only a three bit portion of this multiconductor cable is applied to the scanner multiplexer means 3. The fourth bit is associated with emergency retract.

The AND gate array 109 receives the remaining information which may be designated at the retract input panel illustrated in FIG. 2B. The AND gate array 2 may take precisely the same form of AND gate array described in conjunction with AND gate array 108 and is commonly enabled by the presence of an enabling level on the conductor 116 as indicated in FIG. 4. As with the AND gate array 108, this AND gate array has four AND gates which have their enable inputs permanently connected to an enabling level so that any time the inputs associated therewith go high, this information will be conveyed through the multiconductor cable 128 to the multiconductor cable 127 in the form of continuous information. Two of these four enabled AND gates are associated with the inputs annotated R MANUAL OPERATE AND EMERGENCY RETRACT and correspond to the control keys annotated MANUAL START and RETRACT for the retractable input panel illustrated in FIG. 2B. Thus, as will be apparent to those of ordinary skill in the art, any time an operator depresses a retract manual start or operate key at the retractable input panel or an emergency retract input is generated by the depression of the retract key, this information will be gated through the multiconductor cable 128 onto cable 127 regardless of the condition of the enable line 116. Furthermore, as indicated, this information is also gated to the scanner multiplexer means 3 and to the line driver means 114 for subsequent application to the programmable controller 1.

The remaining inputs to the AND gate array 109 correspond to the remaining key inputs for the retractable input panel illustrated in FIg. 2B and are gated through the multiconductor cable 129 only when the enable line 116 goes high. These inputs, as indicated by the appropriately annotated conductors 133 – 141 are devoted to information associated with the start key, the stop key, the reset key, the step check key, the enable key, the disable key, the enable check key, the disable check key, and the sequence key each of which is illustrated for the retractable input panel shown in FIG. 2B. Thus it will be appreciated by those of ordinary skill in the art that all information which may be generated at the retractable input panel illustrated in FIG. 2B is supplied to one of the two AND gate arrays 108 and 109 and with the exception of the manual operate and emergency retract inputs, such information is selectively gated onto the multiconductor cable 125 on a command basis. The manual operate and the energency retract information which may be entered at the retractable input panel illustrated in FIG. 2B are connected to AND gates which are permanently enabled and hence, whenever these inputs are entered, the 1 or 0 condition thereof is gated through the multiconductor cable 128 to the multiconductor cable 127 for application to the scanner multiplexer means 3 and the programmable controller 1. Since both the AND gates 108 and 109 associated with the retractable input panel have additional inputs available thereto, further information may be provided at the retractable input panel illustrated in FIG. 2B should it be desireable to provide the operator additional capability.

The AND gate arrays 110 and 111 provide the same functions for the wallblower input panel illustrated in FIG. 2C that were provided for the retractable input panel shown in FIG. 2B by AND gate arrays 108 and 109. Accordingly, both the AND gate arrays 110 and 111 may take the same form as described for the AND gate arrays 108 and 109 and are enabled by inputs provided thereto through enabling lines 117 and 118, respectively. Furthermore, it will be seen that the inputs to the AND gate 110 corresponds to the same inputs for wallblower input information as those provided to AND gate array 108 for information from the retractable input panel. Accordingly, wallblower thumbwheel information input at the thumbwheels 86' and subsequently encoded in the manner described in conjunction with FIG. 3 are supplied to the AND gate array 110 through inputs 144 while program select information associated with program select keys P1 – P8 are digitally encoded and applied to the inputs 145. Furthermore, when the AND gate array 110 is enabled through the application of a high level to the enable line 117, any wallblower or thumbwheel information which is supplied thereto will be gated through the multiconductor cable 146 to the multiconductor cable 125 where upon all of this information as may be present is supplied through the line driver means 114 to the programmable controller while thumbwheel information as may be supplied to the multiconductor cable 125 is gated through the nine lines associated therewith to the scanner multiplexer means 3 illustrated in detail in FIG. 5. Again, the multiconductor cable 147 is not employed for output information but is illustrated for the purposes of demonstrating circuit symmetry.

Similarly, the AND gate array 111 is employed for the purposes of selectively inputting the remaining information which may be inserted at the wallblower input panel illustrated in FIG. 2C for selective gating onto the multiconductor cables 125 and 127. Thus, for instance, selectively gating information in the form of information associated with the start key, the stop key, the reset key, the step check key, the enable key, the disable key, the enable check key, the disable check key, and the sequence key are supplied to the inputs 150 – 158 while information associated with a depression of the wallblower manual operate key and an emergency override input are supplied to inputs 159 and 160 which are connected to AND gates which have their enable inputs connected to a high level so that these inputs are output through the multiconductor cable 161 whenever they occur. The emergency override input connected to conductor 160 is not present on the wallblower input panel illustrated in FIG. 2C per se but instead is preferably a key input located on the chassis of the unit so that the emergency override condition may only be initiated by supervisory personnel charged with keeping the key. This input permits blower operations to be initiated in a manner to supercede programmed operations under conditions which are so unusual so as to require the inspection of supervisory personnel prior to the implementation of manual operations in a manner to supercede those which have been programmed. However, should it be desired to provide this function as a button input, the same could be readily provided at either the retract or wallblower input panels or if the program panel is a lock box the same may be provided thereon. Whenever the wallblower manual operate condition occurs on conductor 159 the same will be gated through multiconductor cables 161 and 127 to both the scanner multiplexer means 3 and the programmable controller in the manner indicated. The emergency override condition applied to conductor 160 is employed directly at the scanner multiplexer means illustrated in FIG. 5 and also applied through the line driver means 114 to the programmable controller. Aside from the inputs applied to conductors 159 and 160, the remaining inputs to the AND gate array 111, applied to conductors 150 – 158 must be selectively enabled by an enable level applied to line 118 and when this input condition occurs, these inputs are gated through the AND gate array 111, the multiconductor cable 162 to the multiconductor cable 125 where they are supplied through the line driver 114 to the programmable controller 1.

The remaining AND gate arrays 112 and 113 illustrated in FIG. 4 serve as gating arrangements for input information which may be inserted at the program select panel illustrated FIG. 2A. No continuously supplied inputs are present at either gate and the information inputted thereto is generally applied only to the programmable controller through the multiconductor cable 125 and the line driver 114 although thumbwheel information could effectively be provided to the scanner multiplexer means 3 although the same is never used when it is inputted from the program panel. Both the AND gates 112 and 113 take precisely the same form as the AND gate arrays 108 – 111 heretofore described in that they are 18 input gates having each input thereto commonly enabled through the application of enable levels to the enable lines 119 and 120 connected thereto. Although 18 input gating arrays are employed, a plurality of the inputs are not used; however, are available should it be viewed as desireable to add further input information to the program panels. Should this be viewed as advantageous, only changes to the input panels and softward modifications would be required to implement their function and hence, major modifications to the digital sootblower system according to the instant invention would not be necessary. Since no continuously available inputs are applied to either of the AND gate arrays 112 or 113, multiconductor cables 163 and 164 are shown as connected to the multiconductor cable 127; however, it will now be appreciated that the same are not utilized for the conveyance of information.

The AND gate array 113 receives essentially the same inputs supplied for the retract input panel to the AND gate 108 and supplied for the wallblower input panel to the AND gate array 110. Accordingly, information from the unit select thumbwheels 58, illustrated in FIG. 2A are supplied after apropriate encoding into nine bit octyl information in the manner described in conjunction with FIG. 3 and such nine bits of information are applied to the appropriately annotated input conductors 165. Similarly, program information inserted at the program keys P1 – P8 at the program input panel illustrated in FIG. 2A is digitally encoded and applied as four bits of informatin to the inputs 166 for the AND gate array 113. Thus, whenever the AND gate array 113 is enabled by an enable level applied to conductor 120, nine bits of thumbwheel information and four bits of program information, if present, are applied through the multiconductor cable 167 to the multiconductor cable 125 for subsequent application to the line drive means 114 and the programmable controller 1.

The AND gate array 112 receives the remaining inputs which may be inserted at the program panel illustrated in FIG. 2A. More particularly, sequence thumbwheel information entered at the sequence thumbwheels 59 is encoded into octyl information in the manner described in conjunction with FIg. 3 and supplied to the appropriately numbered inputs 168 as nine bits of parallel information. The remaining inputs which may be generated at the program panel illustrated in FIG. 2A are supplied to input conductors 169 – 171 as separate inputs. Thus, the sequence check key information is inserted on conductor 169, the insert key information is supplied on conductor 170 and the remove or delete information key information is supplied on conductor 171. Accordingly, whenever an enable level is supplied on the enable line 119 to the AND gate array 112 nine bits of sequence thumbwheel information and three bits of key insertion information is supplied through the multiconductor cable 172 and gated onto the multiconductor cable 125 for application to the line driver means 114 and subsequent application to the programmable controller.

The multiconductor cable 125 is connected, as indicated, through a 14 bit multiconductor cable 173 to the line driver 114 as is the four bits of information on the multiconductor cable 127 through the four bit wide multiconductor cable 174. Thus, the line driver means 114 receives eighteen bits of information from the multiconductor cables 125 and 127 for subsequent application to the programmable controller 1. The line driver means may comprise a conventionl eighteen bit logical driver, of any type well known to those or ordinary skill in the art which acts in the conventional manner to raise inputs supplied thereto to appropriate levels for application to the programmable controller 1. Furthermore the line driver means 114 if desired, may employ threshold detection to avoid spurious noise inputs to the programmable controller. After the eighteen bits of information supplied thereto have been raised to appropriate logic levels it is applied to the A bus annotated 175 which again takes the form of an eighteen bit wide cable for direct application as inputs to the programmable controller 1. Similarly, the nine conductors within the multiconductor cable 125 which receive thumbwheel information of any variety are supplied in the manner indicated to the scanner multiplexer means as are the three conductors within the multiconductor cable 127 which receive the emergency override, retract manual operate and wallblower manual operate information. As this is the only information required to be received by the scanner multiplexer means as will be further appreciated in conjunction with FIG. 5, the remaining bit inputs to the multiconductor cables 125 and 127 need not be supplied thereto.

As will be seen upon an inspection of FIG. 5, the enable levels applied to conductors 115 – 120 which are in fact generated by the scanner multiplexer means illustrated in FIG. 5, result as a function of control bits supplied to the B bus by the programmable controller 1. This means, that the selective gating of information from the AND gate arrays 108 – 113 is effectively controlled by by the operation of the programmable controller 1 in requesting information inserted at the information input panels and selectively gated through the AND gate arrays 108 – 113. In this manner, the programmable controller can periodically scan the inputs which may be supplied from the input panels and whenever an input is detected which is followed by further data, the programmable controller may process the initial input provided and then branch to a routine wherein such further data as is normally provided with that input is supplied. Thus, for instance, when a program select input from the program panel gate 113 is received during periodic scanning cycles, the programmable controller 1 would then request sequence thumbwheel information be gated thereto followed by unit select thumbwheel information and insert information and this would continue until an entire program had been accumulated. Similarly, if during periodic scanning cycles, the detection of a manual operate such as supplied by inut 159 to AND gate array 111 or the corresponding input to AND gate array 109 occurs, the programmable controller 1 would then request that appropriate wallblower thumbwheel or retract thumbwheel information be gated onto the multiconductor cable 125 so that the same may be appropriately acted upon.

Furthermore, in the case of a power failure or the failure of a blower, the programmable controller will tend to lock up the system under direction from the executive program, flash the blower number in trouble if appropriate and also flash the reset button at the retract and wallblower input panels indicated in FIGS. 2B and FIGS. 2C. This condition will persist until the failure condition has been acknowledged by the operator as it is presupposed that acknowledgement by the operator through a depression of the reset key is indicative that appropriate operator action was taken. Thus, the executive program will branch to a routine where the appropriate reset keys inputs are monitored and until such an input is received thereby the system will continue to be locked up and the reset buttons maintained in a flashing condition. Similarly, when an emergency override condition is input through the key switch operation by a supervisor, it is indicative that automatic processing may not continue. Therefore, a branch routine is initiated to condition the system for a manual operate sequence of operation and data directed to this purpose is disposed for appropriate gating into the multiconductor cable 125. Accordingly, it will be appreciated by those of ordinary skill in the art that the sequencing of all input information through the AND gate arrays 108 – 113 together with the control by the programmable controller of the output of data therefrom in a selective and precisely grouped manner, enables the programmable controller to operate under the executive program in a mode where it may periodically scan all appropriate inputs to the system and any time such an input as requires a branch operation to a data receiving mode is detected, the branch routine may be initiated and appropriate data gated onto the A bus through appropriate ones of the AND gate arrays 108 – 113. In this manner, the programmable controller acts to effectively control all input operations to the system and even if the programmable controller goes down, the malfunction thereof may operate to effectively gate appropriate ones of the AND gate arrays 108 – 113 onto the A bus for further processing in a mode of operation where the controller is effectively by-passed in a manner which shall be further seen below.

THE SCANNER MULTIPLEXER MEANS

Referring now to FIG. 5, there is shown a block diagram which schematically illustrates an exemplary embodiment of a scanner multiplexer arrangement suitable for the embodiment of the digital sootblower control system depicted in FIG. 1. The scanner multiplexer arrangement serves in its mode of operation to address every sootblower in the system during the 4 ms duty cycle thereof so that their status, as obtained each time an address is generated, may be displayed at the boiler diagram and display panel illustrated in FIG. 6. The scanner multiplexer means illustrated in FIG. 5 operates in this mode independently of the controller and on a continuous basis so that the display is cyclically refreshed independently of the controller unless the operation of the controller is such, as in the case of starting sootblowers or performing one of the various checks which may be initiated at the keyboard, that addresses are to be generated by the controller. Under this set of circumstances, the operation of the scanner multiplexer illustrated in FIG. 5 is inhibited so that direct generation of addresses by the controller may be performed.

In a further mode of operation, address information inserted at the input panels illustrated in FIGS. 2B and 2C may be directly applied through the A bus to the scanner multiplexer means illustrated in FIG. 5 whereupon the cyclic mode of address generation which normally occurs is inhibited and instead the address inserted onto the A bus is gated through the scanner multiplexer means onto the B bus for direct utilization. This last mode of operation is employed should the controller go down to permit manual operation of the sootblowers within the system even in the case of controller malfunction and for this reason, the scanner multiplexer means illustrated in FIG. 5 is additionally provided with its own power supply so that the sootblowers employed within the boiler may be manually operated to maintain the integrity of the system even under circumstances where the controller has gone down due to malfunction or has been removed from the system for other purposes. In addition to its function of address generation, the scanner multiplexer means illustrated in FIG. 5 performs a plurality of decoding functions wherein information present either on the A bus or B bus is decoded and utilized to generate gating information or information employed to time or otherwise control the writing or reading functions which take place in other peripherals within the instant invention. However, it should be plainly appreciated that in its normal role within the instant invention, the scanner multiplexer means illustrated in FIG. 5 operates principally, in a cyclic mode to generate addresses for each sootblower within the system so that the status thereof may be displayed on a consistently updated basis and this operation persists unless the controller is required to generate address information to perform a sootblower initiation function or one of the checks which may be initiated at the input portions of the present invention.

The scanner multiplex arrangement illustrated in FIG. 5 comprises address counter means 180, output gating arrays 181 and 182, a reset detector 183, address gating flip flops 184 - 186, a manual input gating arrangement indicated by the dashed block 187 and a gating array decoder arrangement 188. The address counter means 180 may comprise a conventional nine bit counter which acts in the well known manner to increment the state of the count therein each time an increment impulse is supplied thereto while the state of the count manifested thereby is output at the nine outputs thereof. In actually, the nine bit address counter 180 may be formed of three four bit counter chips such as SN 7493 binary counter chips whose carry outputs and inputs are connected in the well known manner to provide a resultant nine bit count, it being appreciated that the last thee bits of one counter chip would not be employed. Accordingly, the resulting configuration acts as a nine bit counter wherein the state of the count manifested thereby is incremented each time an increment pulse is supplied to the input thereof. The increment input to the nine bit address counter means 180 is supplied thereto through conductor 190 while the nine outputs of the nine bit address counter 180 are connected to the conductors 191 - 199. The function of the nine bit address counter 180 is to generate a nine bit address defining a unitary sootblower within the system so that the status thereof may be obtained and supplied to the boiler diagram and display panel 30 illustrated in FIG. 33. In addition, the address counter 180 is incremented on a continuous basis during normal operation so that each sootblower within the system is addressed once every four milliseconds so that the status of each sootblower within the system is updated on the display at 4 ms intervals.

The increment input to the address counter means 180 as plainly indicated in FIG. 5 is connected through the conductor 190 to the output of the address gating flip flop 184. The address gating flip flop 184 receives a count strobe pulse on conductor 200 and in response thereto will generate a pulse for the duty cycles thereof. This pulse is supplied through conductor 190 to increment the state of the address counter 180 and is additionally supplied through conductor 201 to the clock input of a second address gating flip flop 186. The address gating flip flop 184 may comprise a conventional single shot flip flop such as a SN 74121 available from Texas Instruments Corporation which acts in the well known manner to provide a high or incrementing pulse at the output thereof each time a pulse is supplied at the input thereto on conductor 200. Upon the completion of the duty cycle thereof, the output of the single shot 184 again goes low to await the arrival of the next count strobe pulse on conductor 200 whereupon the state of the address counter 180 is again incremented. The count strobe pulse is generated as indicated in FIG. 5 by the display decoder array and more particularly occurs each time one of the latches therein is strobed to gate status information thereinto. Thus, as shall be seen in greater detail hereinafter, each time a latch associated with a specific sootblower at the display is loaded with current status information as a function of the previous address generated by the address counter means 180, a count strobe pulse is generated at the display decoder so that the address manifested by the address counter means 180 may be incremented by one to cause the addressing of a succeeding sootblower. Accordingly, each time a count strobe pulse is applied to the input conductor on conductor 200, the address gating flip flop 184 will toggle to apply an incrementing pulse through conductor 190 to the address counter means 180 and through the conductor 201 to the clock input of the address gating flip flop 186.

The output or state of the count manifested by the address counter means 180 is connected to the output conductors 191 - 199. The output conductors 191 - 195 are connected directly as inputs to the output gating array 181 while the outputs applied to the conductors 196 - 199 serve as inputs to an adder means 202. The adder means 202 may take the form of a conventional four bit binary full adder such as ann SN 74LS83 as available from the Texas Instrument Corporation. The adder means 202 thus functions in the well known manner to add a four bit input supplied to one set off inputs thereto with a second four bit input supplied to a second input thereto and to supply the resultant sum thereof at the outputs thereof which are here connected to conductors 205 - 208. The output of the adder means as applied to conductors 205 - 208 are connected to the remaining four inputs of the output gating array 181. The addder means 202 here functions to add a sum to the total of the address and more particularly the total reflected by the last four bits thereof so that when the last sootblower in the system is addressed, an all one state will manifested at the eight inputs to the output gating array 181 regardless of the number of sootblowers in the system. This is accomplished in the instant case by adding a four bit constant indicated as a second input C to the four bit adder means 202 which is equal to the number 512 minus the total number of wallblowers in the system so that when the last sootblower in the system is addressed, the address therefor will be an all one condition on conductors 191 - 195 and 205 - 208. This is done, as will be readily appreciated by those of ordinary skill in the art because various designs for digitally controlled sootblowing systems should be constant even though the number of sootblowers within the system will vary to a substantial degree depending upon boiler size, the nature of the fossil fuels being burned and the design criteria specified. Thus for instance, while the instant embodiment of the present invention employs some 292 sootblowers, the nine bit address $A_0$ - $A_8$ will accommodate addresses for up to 512 sootblowers and hence, sootblowing systems up to this magnitude may be controlled throughout the entire system regardless of the number actually employed. For this reason, when the nine bit address counter 180 is effectively addresing sootblower 292, a four bit constant C is added by the adder 202 to the most significant four bits of the address of the address counter so that the total nine bit address reflected on conductors 191 - 195 and 205 - 208 equals 512. In this manner, the completion of an address cycle may be defined by the address output by the address counter 180 as reflected on conductors 190 - 195 and 205 - 208 whereupon this last address condition may be employed to reset the address counter means 180 so that a new cycle of operation may be initiated. Although the second input to the adder means has been specified only as the constant C it will be appreciated by those of ordinary skill in the art that this in effect is a four bit address.

The nine bit address thus applied to conductors 191 - 195 and 205 - 208 are applied in parallel to nine inputs of the output gating array 181 and through conductors 210 - 218 to the input of the reset detector 183. The reset detector 183 is in essence an eight bit AND gate which acts in the conventional manner to produce a high or resetting level at the output thereof whenever all of the inputs thereto are high. The output of the reset detector 183 is connected through a conductor 219 to the reset input of the address counter 180. Thus, it will be appreciated that whenever all of the inputs to the reset detector 183 go high, a high level is supplied on conductor 219 to cause the resetting of the address counter 180 in the conventional manner so that the same reflects an output address of all zeros. Thus, in this manner, the address counter 180 is reset to an all zero condition, whereupon a new cycle for addressing sootblowers may be initiated upon the appearance of the first count strobe on conductor 200.

The output gating arrays 181 and 182 together form a tri-state gate each output of which may be formed by a pair of transistors having their collectors interconnected in the well known manner so that the output which is currently in a low condition controls. More particularly, the output gating array 181 may be formed of nine OR gates taking the conventional form and each gate has one of the two inputs thereof commonly connected to an enable line which is indicated in FIG. 5 by the enable line 220. The other input to each OR gate within the output gating array 181 is connected to a respective one of the inputs on conductors 191 - 195 and 205 - 208 so that, in effect, whenever a low is present on the enable line 220, to thus enable the output gating array 181, the output thereof will follow the inputs present on conductors 191 - 195 and 205 - 208. The outputs of the output gating array 181 are supplied to conductors 221 - 229 in the manner indicated in FIG. 5. The output gating array 182 may take the same form of OR gate structure described in conjunction with the output gating array 181 and in this case each OR gate has one of the two inputs connected thereto commonly connected to the enable line 230 annotated EMERGENCY OVERRIDE NOT. This indicates, in the conventional manner well known to those of ordinary skill in the art that the output gating array 182 is enabled whenever a low input resides on the enable line 230 which here corresponds to a complement of the enabled emergency override condition which is initiated at the input panels illustrated in FIGS. 2B and 2C and is further disclosed below. The remaining inputs to the OR gates present within the output gating array 182 are connected to respective ones of the inputs annotated $TW_0 - TW_8$. Therefore, as will be appreciated from the annotations on these conductors, the inputs to output gating array 182 are supplied from the thumbwheels present within the input panels illustrated in FIGS. 2B and 2C and are supplied through the gate arrays 108 and 110, illustrated in FIG. 4 to the A bus for direct application to the output gating array 182 whenever the gate arrays 108 or 110 is appropriately enabled for application of thumbwheel information to the A bus or the multiconductor cable 125 whereupon nine bits of thumbwheel information are supplied to the scanner multiplexer means illustrated in FIG. 5 and more particularly to the inputs of the output gating array 182 annotated $TW_0 - TW_8$. The outputs of the output gating array 182 are applied to the conductors 231 - 239 whenever the output gating array 182 is enabled.

The outputs of the output gating arrays 181 and 182 are commonly connected in the manner indicated to form a conventional tri-state gating arrangement by the interconnection of conductors 221 and 231, 222 and 232 . . . and 229 and 239. Thus, in such a tri-state gating arrangement, it will be appreciated that due to the common collector connection, whichever output is low will control and therefore, whenever either of the output gating arrays 181 or 182 is not enabled due to the presence of a high on the enable lines 220 or 230, the outputs on the conductors 231 - 239 will follow the inputs supplied to the enabled output gating array on conductors 191 - 195 and 205 - 208 or the conductors whose inputs are connected to the $TW_0 - TW_8$ terminals. Alternatively, as will be appreciated by those of ordinary skill in the art, AND gate arrays could replace the OR gate arrays associated with the output gating arrays 181 and 182 provided the outputs supplied to the enable lines were inverted. The resulting outputs from the enabled output gating arrays 181 and 182 as supplied to the conductors 231 - 239 and the terminals annotated $A_0 - A_8$ supply the resulting address provided by the scanner multiplexer means illustrated in FIG. 5 and are supplied to the B bus in the manner indicated. From this arrangement, it will be readily appreciated by those of ordinary skill in the art that either a nine bit address developed by the address counter means 180 and supplied to the enabled output gating array 181 is gated onto the B bus or alternatively, an address defined at the thumbwheels and gated onto the B bus through the enabled output gating array 182 is supplied to the B bus for further utilization so that manual operation may be initiated under program control. Furthermore, it may here be observed that the depression of an emergency override input immediately results in the enabling of the output gating array 182 to affect hardward interrupt while if manual operate instructions are entered at the input panels, their imposition at the scanner multiplexer means, absent an emergency override condition, occurs through the operation of the programmable controller 1 and the output gating array 181 when appropriate operation in a program is not otherwise occurring.

The enabling for the output gating array 181 is supplied through conductor 220 from the output of an OR gate 240. Since a low level on conductor 220 acts to enable the output gating array 181 and the OR gate 240 acts, in the conventional manner, to provide a high at the output and thereof anytime any of the inputs thereto are high while providing a low or an enabling level at the output connected to conductor 220 only when all of the inputs thereto are low, it will be appreciated by those of ordinary skill in the art that the OR gate 240 here acts to perform the AND function with respect to an enabling of the output gating array 181 in that the same is enabled only when both of the inputs thereto are low while disabling the output gating array 181 under all other sets of input conditions. A first input to the OR gate 240 is supplied through conductor 241 from the manual input gating arrangement indicated by the dashed block 187 and as will be seen below, acts to inhibit the issuance of addresses from the output gating array 181 whenever the output condition of sootblowers is not to be read, or when an emergency override condition has been specified together with a manual operate instruction associated with either the wallblowers or the retracts. The second input to the OR gate 240 is supplied on conductor 242 from the output of the address gating flip flop 186.

More particularly, the address gating flip flop 186 acts in concert with the address gating flip flops 184 and 185 to control the enabling of the output gating array 181 when it is otherwise appropriate in conjunction with the incrementing of the address counter means 180 so that newly generated address information is gated onto the B bus and conductors 231 - 239 each time a new address is generated by the address counter means 180. This is accomplished in the instant embodiment of the present invention by employing the normal state of the address flip flop 186 to enable the output gating array 181 while the acknowledgement of a previous address by a receiver disposed on the B bus is employed in concert with the incrementing pulse generated by the address flip flop 184 to disable the output gating arrangement 181 during the interval when a new address is being established within the address counter 180. Specially, in the instant embodiment of the present invention, the address flip flop 186 may take the conventional form of a D type, positive edge triggered flip flop with a preset and clear input such as an SN 7474 flip flop as conventionally available from the Texas Instruments Corporation. The preset and the D inputs to the flip flop are tied high in the conventional manner to a positive voltage and the output therefrom supplied to the OR gate 240 through conductor 242 is connected to the Q output thereof. Similarly, the clock input to the address gating flip flop 186 is connected in the manner indicated through the conductors 201 and 190 to the output of the address flip flop 184 while the clear or reset input thereto is connected through the conductor 243 to the output of the address gating flip flop 185 which may take the same form of single shot or monostable flip flop as the address gating flip flop 184; however, while the address gating flip flop 184 has a duty cycle which approximates one microsecond, the single shot 185 has a longer duty cycle approximating 100$\mu$s.

Under these conditions, as will be readily appreciated by those of ordinary skill in the art, any time the clear input to the address flip flop 186 as supplied thereto on conductor 243 is low, the Q output thereof connected to conductor 242 will be low. This means, so long as no inhibiting pulse is supplied to the OR gate 240 through conductor 241 due to the specialized conditions associated with the manual input gating arrangement indicated by the dashed block 187 as aforesaid, the output of the OR gate 240 on conductor 220 will be low and the output gating arrangement 181 will thus be enabled to supply an address generated on input conductors 191 - 195 and 205 - 208 through conductors 221 - 229 to the B bus as connected to the conductors 231-239. When this address is gated onto the B bus and received and processed by the IO decoder illustrated in FIG. 8, which corresponds to the IO decoder 35 in FIG. 1, an IO reply signal is generated on the B bus and is applied in the manner indicated to the address gating flip flop 185 through the conductor 244. The IO reply signal thus applied through the B bus to conductor 244 will trigger the address flip flop 185 which is single shot having a duty cycle of approximately 100 $\mu$s as aforesaid and may conveniently take the form of a SN 74121 monostable as conventionally available from the Texas Instrument Corporation. When the address gating flip flop 185 is thus triggered, the output thereof will go high on conductor 243 for the 100 us duty cycle thereof whereupon the clear input to the address gating flip flop 186 will go high and will stay high for the 100 us duty cycle of the address flip flop 185 which is a single shot as aforesaid. While the clear input to the address gating flip flop 186 is now high, the output state of the address gating flip flop 186 as reflected at the Q output thereof connected to conductor 242 will stay low to enable the output gating array 181 as aforesaid until a clock signal is supplied to the input thereof connected to the conductor 201.

Subsequent to the generation of the IO reply signal from the IO decoder illustrated in FIG. 8, the display decoder illustrated in FIG. 7 will act upon the IO reply and generate a count strobe in response thereto to indicate that the previous address has been latched therein. Thus, as will be explained in greater detail in conjunction with FIG. 7, a count strobe signal will be applied to the input conductor 200 within a 100 us of the generation of the IO reply signal. The count strobe pulse will toggle the single shot address gating flip flop 184 to cause the address counter means 180 to be incremented and will also be supplied through conductor 201 to clock the address gating flip flop 186. Under these conditions, a high being present on both conductors 243 and 201 the output of the address gating flip flop 186 will go high to disable the output gating arrangement 181 while the address counter means 180 is being incremented. The high will be retained at the output on conductor 242 until the duty cycle of the single shot address gating flip flop 185 terminates whereupon the output of the address gating flip flop 186 will again go low in response to the low present on conductor 143. In this manner, as will be appreciated by those of ordinary skill in the art, the conjoint action of the address gating flip flops 184, 185 and 186 are responsive to the presence of an IO reply signal on conductor 244 and a count strobe signal on conductor 200 to gate a previous address from the output gating array 181 until an IO reply signal is received and thereafter disable the output gating arrangement 181 so that the address counter means 180 may be incremented in response to a count strobe. The disabled condition of the output gating arrangement 181 persists until the duty cycle of the address gating flip flop 185 terminates whereupon settling conditions within the address counter 180 are allowed to terminate so that a new address is established therein. By this time, the duty cycle of the address gating flip flop 185 will have terminated so that the newly established address may be gated through the now enabled output gating arrangement 181 and through conductors 231 - 229 and 331 - 239 to the B bus for further action by the IO decoder and the display illustrated in FIGS. 6 and 7, respectively.

The portion of the scanner multiplexer circuit illustrated in FIG. 5 which has been described above is charged with the generation of address information and the application of the nine bit addresses generated thereby to the B bus at the outputs thereto indicated at the terminals marked $A_0 - A_8$ which are connected to conductors 231 - 239. Thus, when the output gating array 182 is enabled, thumbwheel information generated at the input panels indicated in FIGS. 2B and 2C are selectively gated through the gating arrays illustrated in FIG. 4, and through the A bus to the inputs to the output gating array 182 annotated $TW_0 - TW_8$. These properly encoded thumbwheel inputs are thereafter gated directly to the B bus when the output gating array 182 is enabled. Conversely, when the output gating array 81 is enabled, address information generated by the address counter means 180 is gated through the enabled output gating array 181, through the conductors 221 - 229 and 231 - 239 onto the B bus at the terminals annotated $A_0 - A_8$. Furthermore, it will be recalled that the address counter means 180 acts in a cyclic manner to generate the address of each sootblower in the system starting with an all 0 address which occurs upon the resetting thereof and is followed by each address in sequence until the total number of sootblowers in the system have been addressed in a sequential manner with each address being generated being supplied through the output gating array 181 and conductors 221 - 229 to the B bus at the terminals annotated $A_0 - A_8$.

More particularly, it will be recalled that the address counter means starting with a given address has the state of a count therein modified by the constant added by the adder means 202 so that an all 1 count condition corresponds to the total number of sootblowers in the system. The resulting address generated is supplied through conductors 191 - 195 and 205 - 208 through the output gating array 181 and conductors 221 - 229 to the B bus. The enable level on conductor 220 in the normal sequencing mode of the multiplexer reflects a low condition at the output of the address gating flip flop 186. When this initial address is gated onto the B bus and received by the IO decoder arrangement illustrated in FIG. 8, an IO reply is generated. This IO reply is employed to trigger the single shot address gating flip flop 185 which applies a high level through conductor 243 to the clock input of the address gating flip flop 186. However, since the address gating flip flop 186 is a D type flip flop, the output condition thereof on conductor 242 remains enabled to gate the current address through the output gating array 181 and onto the B bus. When, however, the IO reply is received at the display decoder illustrated in FIG. 6 and latched therein a count strobe is generated thereby and applied from the B bus to conductor 200 to the single shot address gating flip flop 184.

This trigers the single shot address gating flip flop 184 to clock the flip flop 186 and disable the output gating array 181 due to the high level now imposed on conductors 242 and 220. The output supplied by the single shot address flip flop 184 to conductor 190 serves additionally to increment the count of the address counter means 180 by one unit; however, the new address thus generated is not gated through the output gating array 181 due to the disable level still present on conductor 220. When the 100us duty cycle of the single shot address gating flip flop 185 terminates, the level on conductor 243 again goes low causing the output of the address gating flip flop 186 to go low and again enable the output gating array 181 whereupon the newly generated address is gated out to the B bus. This mode of gating out a previously generated address and thereafter disabling the output gating array 181 while a new address is generated is continued until the state of the address counter means 180 as reflected conductors 191 - 195 and 205 - 208 is an all One address.

When all Ones are thus present on conductors 210 - 218, the AND gate 183 which here serves as a 0 detector will go high to apply a high or resetting level on conductor 219 to set the condition of the address counter means 180 to an all 0 condition. Thus when the address counter means 180 is reset, the process of incrementing the address of the address counter means 180 followed by the gating of the address onto the B bus through the enabled output gating array 181 continues again so that addresses of each sootblower in the system are gated in a sequential manner to thereby address the condition of each sootblower in the system on a cyclic manner so that the boiler diagram and display panel is constantly refreshed. At other times, the output gating array 181 may be disabled by a disable level suplied by the manual input gating arrangement indicated by the dashed block 187 so that either a manual address or a controller generated address may be directly gated onto the B bus while sequential addresses generated by the address counter means 180 are cut off from application to the B bus. Accordingly, the operation of the address counter means 180 when combined with the mode of enabling the output gating array means 181 causes the condition of each sootblower in the system to be interrogated in a sequential manner and the information obtained therefrom applied to the boiler diagram and panel display for visual presentation to an operator.

Furthermore, since the scanner multiplexer means illustrated in FIG. 5 operates independently of the controller and is provided with its own power supply, not shown herein, this mode of independent interrogation for the status of each sootblower and the continuous updating of the display is available to an operator and to the system as a whole even when the controller goes down through malfunction or the like. The disable signals applied to the output gating array 181 through the input 241 to the OR gate 240 are developed as a function of inputs supplied from the A bus or from the controller to the manual input gating arrangement indicated by the dashed block 187. More particularly, it was seen that the address counter means 180 acts independently to sequence through the system on a periodic basis to ascertain the status of all blowers therein regardless of what the programmable controller is doing at the time except under conditions when sootblowers within the system are to be started either directly through the operation of the programmable controller or through the initiation of an emergency override manual input operation when the same is input through a hardware interrupt.

Under either of these circumstances, a high is supplied on conductor 241 so that the output of OR gate 240 goes high to inhibit the condition of the output gating array 181. The conductor 241 which supplies these inputs to the OR gate 240 is connected through a conductor 245 to the output of an OR gate 246. The OR gate may take the conventional form of the OR gate 240 and hence acts in the well known manner to provide a high or inhibiting level at the output thereof connected to the conductor 245 whenever any of the inputs thereto go high. A first input is connected to the OR gate 246 through a conductor 247 which is in turn connected to a terminal annotated READ INHIBIT. A read inhibit level is supplied by the programmable controller 1 to the B bus anytime a writing operation in which sootblowers are addressed is initiated thereby. During this interval normal read operations wherein the address of each sootblower in the system is issued by the address counter on a sequential basis is inhibited so that addressing for the purposes of starting specified sootblowers or checks may be initiated by the programmable controller 1. Therefore, whenever a read inhibit level is issued by the programmable controller 1 pursuant to an addressing of sootblowers for start up, check or other purposes, a high is applied to the conductor 247. This high, will cause the OR gate 246 to supply a high on conductor 245. This high is applied through conductor 241 and 220 to inhibit the output gating array 181 so that sequential addresses issued by the address counter 180 are not supplied to the B bus under these circumstances. The output of the OR gate 246 is additionally brought out through the conductor 245 to a terminal annotated DISPLAY INHIBIT. This terminal, which is connected to the B bus is employed to additionally inhibit the display decoder as illustrated in FIG. 7 so that, whenever the action of the output gating array 181 is inhibited through the generation of a high at the output of the OR gate 246, the display is also inhibited through the gating of this high onto the B bus to the display decoder illustrated in FIG. 7.

A second input to the OR gate 246 is supplied through conductor 248 from the output of an AND gate 249. The AND gate 249 is a conventional two input device of this well known class which acts in the conventional manner to provide a high level at the output thereof on conductor 248 whenever both of the inputs thereto are high. The output of the AND gate 249 will go high, as will soon be fully appreciated by an examination of the inputs thereto when both an emergency override has been specified and a manual operate operation has been initiated which indicates, as shall be recalled from the description of FIGS. 2B and 2C that an operator has generated a hardware interrupt by activating the emergency override key and then specified a manual operation for immediate implementation. Thus, when an emergency override is specified with a manual operate instruction, a high level will be conveyed through the conductor 248, the OR gates 246 and 240 to inhibit the output gating array 181 and to disable the display through the conductor 245 while the complement of the emergency override input is applied to conductor 230 to enable the output gating array 182.

The two inputs to the AND gate 249 reflect, either directly or indirectly, the three inputs, i.e., emergency override, retract manual operate and wallblower manual operate supplied to the scanner multiplexer through the multiconductor cable 127 illustrated in FIG. 4 which is a part of the A bus as aforesaid. More particularly, an emergency override input is supplied from the A bus and more particularly, to the appropriately annotated terminal illustrated in FIG. 5 through a conductor 250 directly to one input of the AND gate 249. Thus, whenever an emergency override condition is specified at one of the input panels illustrated in FIGS. 2B or 2C, this condition is gated through the input gating array 17 and through the A bus immediately to the scanner multiplexer means illustrated in FIG. 5. More particularly, it is applied to the conductor 250 as one input to the AND gate 249 and additionally, as will be seen in FIG. 5 through a conductor 251 where the same is applied directly to the B bus as a data in signal and as a disable level to the conductor 252 which is described hereinafter. The data in signal supplied to the B bus through the conductor 251 is employed at the AC driver circuit illustrated in FIG. 9 to cause the writing of information therein associated with the starting of sootblower equipments. The disable signal applied to conductor 252 is employed to inhibit the gating array decoder arrangement 188 which, although described in greater detail below, supplies enabling information through the A bus to the input gate array illustrated in FIG. 4 through the conductors 115 – 120.

The remaining two inputs supplied to the scanner multiplexer means illustrated in FIG. 5 through the A bus or more particularly conductor 127 illustrated in FIG. 4 are the retract manual operate input and the wallblower manual input signals which are applied to the appropriately annotated terminals connected to the conductors 254 and 255. The conductors 254 and 255 are connected to respective inputs of an OR gate 256 which acts in the conventional manner to generate a high at the output thereof connected to conductor 257 any time either of the inputs thereto go high. The output of the OR gate 256 is connected through conductors 257 and 258 to the second input of the AND gate 249. Thus, it will be apparent that any time either a retract manual operate or a wallblower manual operate signal is specified at the inputs 254 or 255, the output of the OR gate 256 will go high to place a high level at the input of AND gate 249 at conductor 258. Furthermore, when this high level occurs during the presence of an emergency override input on conductor 250 both the input conditions to AND gate 249 will go high to place a high on conductor 248 and hence, through the OR gates 246 and 240 to cause the output gating array 181 to be inhibited. Additionally, under these conditions, the output gating array 182 will be enabled to supply nine bits of thumbwheel address information to the B bus for the purposes of writing information to start the sootblower in operation, the display will be inhibited due to the signal imposed on the B bus from the conductor 245 and a data in condition will be supplied to the B bus through conductor 251 as a result of the emergency override conditions specified.

The output of the OR gate on conductor 257 is also supplied to one input of an AND gate 260. The AND gate 260 is a conventional two input AND gate which acts in the well known manner to supply a high at the output level thereof when each of the inputs thereto are high. The input to the AND gate 260 on conductor 257 specifies as aforesaid, that either a retract manual operate or a wallblower manual operate signal has been received on conductors 254 and 255. The second input to the AND gate 260 is connected through conductor 261 to the output of the OR gate 246. The output of the OR gate 246 will go high whenever either a read inhibit signal is generated by the programmable controller on conductor 247 as aforesaid or the output of the AND gate 249 goes high indicating that both an emergency override condition and a manual operate input has been received. Thus, the input to AND gate 260 on conductor 261 will go high whenever a read inhibit input is generated by the programmable controller or an emergency override condition has been specified together with a manual operate input. The resulting input conditions on the AND gate 260 are such that the output thereof on conductor 262 goes high whenever read inhibit input has been generated by the controller together with a manual operate indication or when an emergency override input is received together with a manual operate input. Thus, in effect, the output of the AND gate 260 will go high as a function of the generation of either a read inhibit or an emergency override condition when a manual operate condition has been specified at the input panel by the depression of the manual operate key associated with either wallblowers or retracts and the output of the AND gate 260 will stay high so long as this key remains depressed.

The output of the AND gate 260 is connected through the conductor 262 to the input of a delayed single shot 263 and through the additional conductors 264 and 265 to the clear input of a bistable flip flop 266. The delayed single shot 263 may take the conventional form of a pair of monostables wherein the first monostable is toggled in response to a pulse on conductor 262 and upon the resetting thereof after the duty cycle has expired the second single shot is effectively toggled to provide a pulse at the output thereof connected to conductor 267. In the case of the delayed single shot 263, when the output of the AND gate 260 goes high, a delay of about 5 μs is imposed before the single shot is toggled to place a high on conductor 267 for the duty cycle thereof. When the high appears on conductor 267, this high is applied to the clock input of the bistable flip flop 266 and through the conductor 268 to the B bus where the same is employed as a write command for the IO decoder illustrated in FIG. 8 where the same acts to generate the write clock employed in the driver circuits shown in FIG. 9.

The high generated at the output of the AND gate 260 is also applied through conductors 264 and 265 to the clear input of the bistable flip flop 266. The bistable flip flop 266 may take the form of a conventional D type edge triggered flip flop such as an SN 7474 flip flop conventionally available from the Texas Instrument Corporation. In the bistable flip flop 266, the preset and D inputs are tied high so that the flip flop has a low at the Q output thereof connected to the output conductor 269 whenever a low resides at the clear input thereto connected to conductor 265. However, when a high is applied to the clear input 265, the Q output thereof will not go high until the clock input thereof connected to conductor 267 receives a positive going edge as occurs when the output of the single shot 263 goes high. Thereafter, the output state of the bistable flip flop 266 will go low whenever the clear again goes low as will occur when the manual operate button is released so that the output of AND gate 260 again goes low.

The input conditions for the bistable flip flop 266 are such that, as will be appreciated by those of ordinary skill in the art, a low normally resides on the output of conductor 269 which, as indicated, is supplied to the B bus and is employed to generate an output enable level which is utilized at the AC driver circuits illustrated in FIG. 9 to gate output information which has been established therein out to the sootblowers to cause the starting thereof. When a low resides on the conductor 269, no output enable level is conveyed to the B bus as the instant disclosure of the present invention generally employs a positive logic configuration although the same may be readily reversed to negative logic by those of ordinary skill in the art. When either a read inhibit or emergency override condition is present and a manual operate button is depressed, the output of the AND gate 260 on conductor 262 will go high to immediately apply a high through conductors 262, 264 and 265 to the clear input of the bistable flip flop 266. However, the output of the bistable flip flop on conductor 269 will not go high until the delay associated with the delayed single shot 263 has expired and a high level is gated onto conductors 267 and 268 to generate a write command as aforesaid. At the same time that the write command is generated, the bistable flip flop 266 which now has a high level on conductor 265 is clocked to cause the output thereof on conductor 269 to go high and hence, also generate an output enable level for the B bus to be employed in a manner to be described in conjunction with FIG. 9. The high condition present at the output of the bistable flip flop 266 will persist, as will be appreciated by those of ordinary skill in the art until the high condition at the clear input connected to conductor 265 terminates. This occurs when the operator releases, in the normal course of action the manual operate key which has been depressed and occurs in normal operation once the operator is assured by the display that the sootblower starting operation which has been initiated under manual operate conditions has been completed. Thus, when the operator releases the manual operate key which has been depressed, the output of the AND gate 260 will go low to place a low through conductors 260 - 264 and 265 at the clear input to the bistable flip flop 266. This causes the output enable level on conductor 269 to again go low to terminate the output enable signal supplied through the B bus and it may of course be assumed that the duty cycle of the single shot 263 has already terminated so that the write command signal on conductor 268 has also returned to a low condition.

The output of the bistable flip flop 266 is additionally applied through the conductor 270 to the input of the single shot 271. The single shot 271 is a conventional monostable which is triggered by the negative edge of a pulse to supply a high through conductor 272 to the input of the OR gate 273. The OR gate 273 whose output is connected to the conductor 274 is employed to generate a reset signal for application to the B bus so that said reset signal can be employed to reset latches at the AC driver for the purpose, as shall be seen in conjunction with the description of FIG. 8, of clearing the latch each time a sootblower start up operation has been terminated so that information set into the latch from a preceding cycle wiill not cause an erroneous attempt to restart a sootblower which has been started during a previous cycle. Because the single shot 271 is triggered by a negative edge, it will be seen that an output pulse is not supplied thereby through conductor 272 until the output of the bistable flip flop 266 goes from a high to low condition which occurs, as will be recalled, when the clear level supplied thereto on conductor 165 again goes low in response to a release of the manual operate key by the operator. Thus, when the single shot 271 is toggled, a high level pulse is applied to the conductor 272 for the duty cycle thereof and supplied to the OR gate 273. As the OR gate 273 acts in the conventional manner to produce a high level input any time any of the inputs thereto go high it will be appreciated by those of ordinary skill in the art that a resetting level is supplied to the B bus from conductor 274 during the duty cycle of the single shot 271 when the same is in effect toggled by the release of the manual operate key by the operator. This causes the latch at the driver circuit to be cleared as will be seen in conjunction with the description of FIG. 8 when the manual operate key is released so that a new sootblower start up operation or the like can again be initiated. An additional input to the OR gate 273 is supplied thereto through the conductor 275 which generates the data in input to the B bus as obtained from the indication of an emergency override input on conductors 250 and 251 as aforesaid. This high also will generate a reset signal from the output of the OR gate 273 on conductor 274 to clear the latches of the driver circuits for subsequent start up operations which are to be initiated subsequent to the hardware interrupt generated by a depression of the emergency override key.

The display inhibit supplied at the conductor 245, the data in command supplied on the conductor 251, the write command supplied on conductor 268, the reset command supplied on conductor 274, and the output enable supplied on conductor 269 are all direct inputs to the B bus which are not associated with addresses which are generated by the scanner multiplexer means illustrated in FIG. 5 and are developed in essence from either emergency override, or manual operate signals obtained from the A bus or a read inhibit signal supplied to the scanner multiplexer means from the B bus in the manner described for the portions of the manual input gating arrangement indicated by the dashed block 187 described heretofore. The remaining portions of the manual input gating arrangement indicated by the dashed block 187 as well as the remaining portion of the scanner multiplexer means associated with the gating array decoder arrangement 188 are principally devoted to the generation of gate enable signals which are applied from the scanner multiplexer means shown in FIG. 5 through the A bus to the input gating array illustrated in FIG. 4 to cause the selective gating of the gate arrays illustrated therein.

Returning now to the description of the circuitry within the manual input gating arrangement indicated by the dashed block 187 and more particularly to the output of the AND gate 260 therein, it will be seen that the output of the AND gate 260 is also supplied through conductors 262, 264 and 276, to the input of a delayed single shot 277. The delayed single shot 277 may take precisely the same form described for the delayed single shot 263 with the single exception that the initial delay imposed thereby is of the order of 1 $\mu$s. This means that when a high is produced at the output of the AND gate 260, and supplied through conductors 262, 264 and 276 to the input of the delayed single shot 277, the output thereof connected to conductor 278 will not go high for the duty cycle of the single shot 277 until a delay of approximately 1 us is imposed thereby. The output of the single shot is supplied through the conductors 278 and 279 to corresponding inputs of a pair of AND gates 280 and 281 which are employed to distinguish whether a manual operate input has been received for the retracts or wallblowers and to thus develop independent gating signals therefor. More particularly, each of the AND gates 280 and 281 are conventional two input AND gates which produce a high at the outputs thereof only when both of the inputs thereto go high. Furthermore, it will be recalled that the output of the AND gate 260 and hence, the delayed single shot 277 will only go high in response to the presence of a manual operate signal coupled with the presence of either an emergency override indication or a read inhibit indication. This means, that whenever the output of the delayed single shot 277 goes high on conductor 278 either a retract manual operate or a wallblower manual operating signal is present and is attended by either a read inhibit signal or an emergency override condition.

The second input to the AND gate 280 is connected through conductor 282 to the input conductor 254 which receives retract manual operate commands as aforesaid. Similarly, the second input to the AND gate 281 is connected through conductor 283 to the input conductor 255 which receives wallblower manual operate commands. Thus, whenever the output of the single shot 278 goes high, a high will be present on conductor 282 if a retract manual operate command has been issued while a high will be present on conductor 283 if a wallblower manual operate command has been issued. This means that the output of AND gate 280 which is connected to conductor 284 will go high when an emergency override condition or a read inhibiting condition has been issued together with a retract manual operate indication while the output of the AND gate 281 which is connected on conductor 285 will go high whenever either a read inhibit or emergency override condition is present and a wallblower manual operation command has been issued. Thus, in essence, whenever the output of AND gate 280 goes high, thumbwheel information for retracts will be available and should be gated through the gate array 108, as shown in FIG. 4, to the A bus for application to the controller for a plain manual start or through the A bus for application to the output gating array 182 for an emergency override condition and hence, the AND gate 108 in FIG. 4 should thus be enabled by the generation of an enable level at the scanner multiplexer means illustrated in FIG. 5 which is supplied to the enable conductor 115 in FIG. 4. For similar reasons, whenever the output of AND gate 281 goes high, thumbwheel information is available at the inputs to the gating array 110 illustrated in FIG. 4 and hence, an enable level should be supplied from the scanner multiplexer means shown in FIG. 5 through the conductor 117, as shown in FIG. 4 to cause the enabling thereof. The output of the And gate 280 on conductor 284 is connected to one input of an OR gate 286 while the output of the AND gate 281 as applied to the conductor 285 is connected to one input of an OR gate 287. Each of the OR gates 286 and 287 are conventional two input OR gates which provide, in the well known manner, a high or enable level at the outputs thereof whenever either of the inputs thereto go high. The output of the OR gate 286 is connected through conductor 288 to provide a gate enable signal on the A bus in the manner indicated. The conductor 288 as illustrated in FIG. 5 should be viewed as connected within the A bus to the enable conductor 115 for the gate array 108 illustrated in FIG. 4. Similarly, the output of the OR gate 287 is connected through the conductor 289 to the A bus and may be viewed as connected directly by the A bus to the enable conductor 117 for the gate array 110 illustrated in FIG. 4. Accordingly, when a retract manual operate condition has been specified at the input panel illustrated in FIG. 2B in concert with either an emergency override or an read inhibit condition, the scanner multiplexer means illustrated in FIG. 5 causes an enable level to be supplied through conductors 288, the A bus and conductor 115 to enable the gate array 108 so that retract thumbwheel information may be gated onto the A bus for appropriate utilization. Similarly, whenever a wallblower manual operate condition has been specified in concert with either an emergency override or read inhibit condition, a high level will be generated at the output of the OR gate 287 on conductor 289 to cause the direct enabling of the gate array 110 shown in FIG. 4 so that thumbwheel information associated with wallblowers may be gated thereby onto the A bus for further utilization.

The remaining gate enable levels generated for the gate arrays 108 - 113 illustrated in FIG. 4 are developed by the scanner multiplexer means illustrated in FIG. 5 as a function of enable levels A, B and C generated on the B bus from the programmable controller and the gating array decoder arrangement 188. The gating array decoder arrangement 188 may take the conventional form of a decoder/demultiplexer chip which acts in the well known manner, when enabled, to decode the binary condition on the three select inputs thereto and produce in response thereto, one of eight discrete decoded outputs. In the instant case, the gating array decoder arrangement 188 may take the form of a conventional MSI chip such as an SN 74LS 138 chip which is available in MSI form from the Texas Instruments Corporation. The three select inputs to the gating array decoder arrangement 188 are provided thereto through conductors 291 - 293 which are connected, as indicated in FIG. 5, to the B bus and receive therefrom enabled levels A - C as applied to the B bus from the programmable controller. This is done as will be appreciated by those of ordinary skill in the art when the same generates requests for information pursuant to performing programmed routines such as monitoring functions or the like which information is input from the input panels illustrated in FIGS. 2A - 2C and is supplied to one of the gating arrays illustrated in FIG. 4. Thus, whenever the gatng array decoder arrangement 188 is enabled, the same will decode enable levels presented thereto on conductors 291 - 293 and will provide up to one of eight output levels in response to the appropriate decoding of the inputs. The enable level to the scanning array decoder arrangement 188 is supplied, as aforesaid, through the conductor 252 from the input on conductor 250 and 251 associated with the generation of an emergency override condition. A high on the enable line 252 will disable the gating array decoder arrangement 188 so that, as will be appreciated by those of ordinary skill in the art, the gating array decoder arrangement 188 is normally in an enabled condition except when an emergency override operation is in process. Thus, except when an emergency override condition is indicated by a high on the conductor 250 and the conductor 252, the gating array decoder arrangement 188 will act to decode any enable levels presented thereto on conductors 291 - 293 from the B bus and provide up to one of eight output enable levels in response thereto. Furthermore, it will be appreciated by those of ordinary skill in the art that the disabling of the gating array decoding arrangement 188 during an emergency override condition is here appropriate because during such a condition only retract manual operate or wallblower manual operate information may be supplied at the input panels illustrated in FIGS. 2B and 2C and the selective gating of thumbwheel information under these conditions is independently handled through the operation of the AND gates 280 and 281 as well as the OR gates 286 and 287.

Although eight decodes are available from the gating array decoder arrangement 188, only six decodes are effectively employed within the instant invention as indicated by the output lines 294 - 299. The output lines 294 and 295 are supplied to the OR gates 286 and 287, respectively, as the same represent decodes for the enabling of the gate arrays 108 and 110 which are the same gate arrays enabled under different circumstances by the AND gates 280 and 281. Accordingly, the outputs of the AND gate 280 and the output line 294 are ORed by the OR gate 286 so that either condition will result in an enabling level on conductor 288 for application through the A bus to the enable line 115 of the gate array 108 illustrated in FIG. 4. Similarly, the output line 295 is applied to the OR gate 287 for ORing with the output of the AND gate 81 so that either condition will result in the application of an enable level on conductor 289 or application through the A bus to the enable line 117 for the gate array 110 illustrated in FIG. 4. The remaining outputs of the gating array decoder arrangement 188 as applied to output lines 296 - 299 are supplied, as indicated in FIG. 5, directly to the A bus for application to the enable lines 116 and 118 - 120 illustrated in FIG. 4 so that information supplied thereto from the input panels illustrated in FIGS. 2A - 2C may be gated onto the A bus for application to the programmable controller in response to command information therefrom supplied by the programmable controller to the B bus and received therefrom at the scanner multiplexer means illustrated in FIG. 5 on conductors 291 - 293.

The scanner multiplexer means illustrated in FIG. 5 is independently powered in preferred embodiments of the instant invention and performs a plurality of functions independent of the operation of the programmable controller so that the digitally controlled sootblower system according to the instant invention can operate even during a malfunction of the programmable controller while the programmable controller need not be devoted to the performance of ministerial functions such as the periodic addressing of all sootblowers in the system even when the same is operating properly. This means that in the case of a failure by the programmable controller, an emergency override condition may be specified together with appropriate manual operation instructions associated with either or both of the retract or wallblower units and this information may be gated directly through the output gating arrangement 182 to the B bus so that desired sootblowers may be started and employed to maintain appropriate boiler operation during the malfunction it being appreciated that while the display will be inhibited due to the action of the OR gate 245, appropriate outputs will be supplied to the B bus for start up operations due to the data in, write command, output enable, and reset instructions generated by the scanner multiplexer means illustrated in FIG. 5. Similarly, during proper operation of the programmable controller 1, normal reading of the condition of the sootblowers in the system with respect to the operative status thereof is handled by the address counter means 180 within the scanner multiplexer which serves to sequentially generate all addresses so that the status of each sootblower in the system can be interrogated and displayed at the boiler diagram and display panel. Similarly, any time operation of the controller requires the inhibiting of the application of sequential addresses to the B bus, so that the controller may start sootblowers, or set latches pursuant to checks or the like, a read inhibit signal applied to conductor 247 will achieve this purpose while any information the controller may periodically required is supplied on a command basis thereto through the selective enabling of the gate arrays 108 - 113 illustrated in FIG. 4 by the enable levels applied by the programmable controller to the B bus and received by the input conductors 291 - 293 for subsequent decoding by the gating array decoder arrangement 188 and application to the A bus as discrete enable levels for the gating arrays 108 - 113 illustrated in FIG. 4. Thus, it will be appreciated that the scanner multiplexer illustrated in FIG. 5 permits automatic start up of sootblower under emergency conditions wherein the programmable controller goes down while avoiding an undue burdening of the controller by the independent performing of ministerial functions such as the cyclic generation of sequential addresses for the purposes of obtaining status information and the like.

THE BOILER DIAGRAM AND DISPLAY PANEL

Referring now to FIG. 6, there is shown an exemplary depiction of a boiler diagram and display panel suitable for use with the embodiment of the invention illustrated in FIG. 1. More particularly, the exemplary boiler diagram and display panel illustrated in FIG. 6 depicts the left and right sides of the boiler by the outlines 300 and 301 and superimposes a plurality of indicia representing both sootblower stations and generalized sensory conditions to advise the operator as to what is occurring within the boiler pursuant to the operation of the digitally controlled soothblower system according to the instant invention as well as various indicia devoted to advising the operator as to the propriety of operation within the system. Accordingly, as the outlines 300 and 301 depict the left and right sides of the boiler, respectively, it will be appreciated by those of ordinary skill in the art that the central portion of FIG. 6 illustrates the front of the boiler while those portions of the boiler display diagram which extend past the outlines 300 and 301 correspond to the rear most portions of the boiler.

Superimposed upon the left and right side outlines of the boiler 300 and 301 are various indicia capable of being illuminated by the digitally controlled sootblower system according to the instant invention wherein each of such indicia represent a given sootblower within the system and is appropriately disposed on the display panel within the outlines 300 and 301 so as to correspond to its actual position within the boiler to the closest degree possible. Accordingly numbered rectangular 1 – 42 represent retracts within the system which are capable of being started and monitored by the digitally controlled sootblower system according to the instant invention. Similarly, each of the tombstoned shaped indicia bearing both an alpha and numeric designation represents wallblowers within the system disposed in a manner representative of their disposition witin the boiler. In the case of the wallblowers represented by the tombstoned shaped indicia, it will be appreciated that the wallblowers are disposed in rows and each row is given a new alpha designation so that the alpha character associated with each wallblower defines the row in which is resides while the numerical representation employed therefor represents in ascending order its frontal, right side, left side, or rearward disposition within the row in the boiler. Accordingly, it will be appreciated that the wallblowers depicted in FIG. 6 are representative of 10 rows of wallblowers wherein each row has a varying number of wallblowers depending upon the blowing parameters imposed for wallblowers located in rows of a designated height within the boiler being depicted.

More particularly, in ascending order, row A includes 12 wallblowers indicated $A_1$ – $A_{12}$, row B includes 36 wallblowers indicated as wallblowers $B_1$ – $B_{36}$, row C includes 25 wallblowers annotated $C_1$ – $C_{25}$, row D includes 12 wallblowers annotated $D_1$ – $D_{12}$, row E includes 25 wallblowers annotated $E_1$ – $E_{25}$, row F includes 36 wallblowers annotated $F_1$ – $F_{36}$, row G includes 36 wallblowers annotated $G_1$ – $G_{36}$, row H includes 36 wallblowers annotated $H_1$ – $H_{36}$, row J includes 18 wallblowers annotated $J_1$ – $J_{18}$ and row K includes 14 wallblowers annotated $K_1$ – $K_{14}$. Accordingly, it will be appreciated by those of ordinary skill in the art that there are 250 wallblowers disposed in 10 rows A – K depicted in the boiler display panel diagram illustrated in FIG. 6 accompanied by 42 retracts disposed in essentially 6 rows on either side of the boiler as is also depicted in FIG. 6. Generally, during normal operating sequences, indicia for each retract or wallblower operating at a given time is illuminated in the boiler diagram and display panel illustrated in FIG. 6 while those not operating currently are not illuminated so that the operator is constantly apprised of the operational condition within the system. Additionally, when the operator enters inputs at the input information panels illustrated in FIGS. 2B and 2C to initiate predetermined checks, wallblower and retracts are illuminated in an appropriate manner to indicate the results of such checks. Thus, when an enable check is initiated, all blowers that are enabled within the system for usage have their indicia illuminated while all wallblowers which are disabled remain in a non-illuminated condition and conversely, when a delete check is specified, all wallblower and retract units which have been deleted from system operation have their indicia illuminated while those enabled for operation remain in a non-illuminate condition. In similar manner, when a step check is specified at the input panels illustrated in FIGS. 2B and 2C, the retract units or wallblowers defined for each sequence of a specified program are illuminated in a sequential manner until each sequence of sootblowers for a given program have been displayed in a sequential manner at the boiler and display diagram illustrated in FIG. 6 while those which have not been defined for a given sequence do not have their indicia illuminated so that the operator is apprised by indicia displayed in a sequential manner by the boiler diagram and display panel illustrated in FIG. 6 as to which sootblower units have been defined for each sequence of a given program and each sequence is set forth in a step wise manner until all sequences specified for a given program have been exhausted. In a like manner, when the sequence check key illustrated in FIG. 2A is depressed, the sootblower units selected for a given program are displayed on the boiler diagram and display panel illustrated in FIG. 6, while non-selected units have the indicia associated therewith retained in a non-illuminated condition.

Similar modes of display for all of the indicia illustrated in FIG. 6 occur for each of the various check routines which may be initiated at the input panels illustrated in FIGS. 2A – 2C and it should be noted that each of these checks may be initiated while the exemplary digital sootblower control system according to the instant invention is in an operative condition since, the controller steps in to disable the sequential generation of addresses in the system and to initially disable the display whereupon the controller withdraws the appropriate check information from storage, latches this information into the receiver means and then permits the address counter means illustrated in FIG. 5 to again address each sootblower receive in a sequential manner whereupon the display information provided results as a function of the check information generated rather than information associated with the status of currently operational units within the system.

In like manner, when a sootblower start up procedure has been initiated under program control, the programmable controller will scan the input receivers by sweeping all of the inputs and picks all those sootblowers that are in service and compares them against the addresses for sootblowers for whom start up instructions have been issued as this information is still retained in storage. If no comparison obtains, a no start blower signal is issued together with an alarm and the indicia on the boiler diagram and display panel for the sootblower which failed to start is blinked so that the operator is apprised of which sootblower has failed. In like manner, in the case of a motor overload, sootblowers are in operation while the programmable controller sits there monitoring the operation thereof. When a motor overload signal is received, the controller acts to search the inputs until it finds the sootblower which is manifesting the overload condition. Thereafter, the indicia for that sootblower is blinked and a motor overload condition is indicated to again fully apprise the operator as to which sootblower in the system has malfunctioned. In the case of a retract, if an emergency retract signal is issued, upon receipt of a time exceeded signal or the like, the retracted blower will have its indicia again blinked so that the operator knows that maintenance for a specified blower is appropriate. Accordingly, the boiler and display diagram illustrated in FIG. 6 is employed within the system to constantly apprise the operator as to the status of individual sootblowers within the system from the standpoint of current operation or with respect to any of the plurality of system checks which may be initiated from the input panels illustrated in FIGS. 2A – 2C and in addition, should any malfunction occur with respect to a given sootblower, the nature of the malfunction is indicated and the indicia for the specific sootblower which has malfunctioned is also blinked so that the operator is apprised of the fact that a given sootblower in the system must be serviced and shold be deleted from further operation until such service has been accomplished. It should be additionally noted, that to cure the blinking condition associated with a given sootblower, the operator must acknowledge that the condition has been detected by a depression of the reset keys at the input panels illustrated in FIGS. 2B and 2C.

In addition to providing a discrete indicia for each sootblower within the system in a relationship with a cross-section of the boiler so that the position thereof within the boiler can be readily ascertained, the boiler diagram and display panel illustrated in FIG. 6 provides a plurality of additional indicia to more fully acquaint the operator with the status of the system as a whole when the same is operational. More particularly, preheater blower indicia PH1 – PH4 are disposed on the boiler display panel diagram illustrated in FIG. 6. These preheater blowers, as will be appreciated by those of ordinary skill in the art are operative, under normal circumstances, any time the boiler is operating and serve to clean the preheaters through which input gases are heated in an exchange operation with output gases in the well known manner. Accordingly, the function of the four preheater blowers which are disposed on either side of the boiler in the paired manner indicated in FIG. 6 are monitored by the controller and the indicia therefor provided are illuminated, under program control, whenever the same are operating. Similarly, pressure sensors associated with the air heater blowers are monitored in a manner to be described more fully in conjunction with the permit module described in conjunction with FIG. 12 and whenever the operation thereof is appropriate the air heater blowing indicia AH1 and AH2 are illuminated through an input supplied on the CT2 bus to further advise the operator that appropriate operating conditions with respect to the air heater blowers are present.

Additionally, a plurality of sensory conditions are monitored with respect to the retractable units and the wallblowers within the system and a plurality and advisory indicia are provided to the operator at the boiler diagram and display panel illustrated in FIG. 6 to indicate either appropriate operating conditions or that a malfunction has occurred. Furthermore, it will be appreciated that when a malfunction has occurred, the indicia associated with either the retractables or the wallblowers which defines the malfunction is illuminated and the wallblower or retractable which has experienced such malfunction has its indicia blinked so that the operator is advised as to the nature of the malfunction which has occurred as well as the unit which has malfunctioned. More particularly, retractable advisory information is indicated within the retangular block 302 while wallblower informaton is provided within the rectangular block 303 illustrated in FIG. 6. Furthermore, all informational inputs provided to the rectangular blocks 302 and 303 and more specifically to the individual indicia enclosed therein is provided thereto from the C2 bus illustrated in FIG. 1 and hence, is supplied either from the common permit module 9 illustrated in detail in FIG. 12 or from the outputs of the programmable controller 1 on the multiconductor cable 40 which are directly applied to the C2 bus. In either event, all inputs to the rectangular blocks 302 and 303 occur on specific input conductors associated with the individual indicia therein and are at an appropriate level to energize such indicia and hence need not be provided with either independent decoder or driver circuitry as are provided as may be seen in FIG. 1 for the indicia specifically associated with the sootblower units illustrated in FIG. 6.

The retractable information indicia provided within the rectangular block 302 comprise 1 individual indicia associated with operating conditions for retractable programming operations. More particularly, the retractable indicia indicated within the block 302 comprise a controller operation indication, a left retract in service indication, a left retract blowing indication, a right retract in service indication, a right retract blowing indication, a controller power failure indication, a low header pressure indication, a no blowing air indication, a motor overload indication, and a time exceeded indication. The controller operating indication, controller power failure indication, the no blowing air indication and the time exceeded indication are all conditions monitored directly by the controller and hence, are directly provided to the display illustrated in FIG. 6 therefrom. Thus, while the controller operating and controller power failure indications are obvious, the controller acts within a housekeeping function, as aforesaid, to monitor the condition of any retractable for which a start up routine has been initiated. After the start up routine has been initiated, receivers are monitored to ascertain which retracts are in service. Should a retract address for a retract whose operation is to be initiated not correspond to a retract in service indication, the no blowing indication will be illuminated while the retract which has failed to start will have its indicator blinked. In this manner, the controller will apprise the operator as to which retract has failed to start. Similarly, retracts within the system generally have a 15 minute cycle of operation and accordingly, the controller will start an internal counter/timer to monitor the timing cycle of any retract whose operation has been initiated. Should the timing interval on the timer time out prior to the completion of the cycle of operation for the retract, the time exceeded indication will be illuminated, an emergency retract signal will be forwarded to the retract in operation which has failed to complete its cycle within the time alloted and the indicia therefor at the boiler diagram and display panel will be flashed to indicate the retract which has malfunctioned. The left retract in service, left retract blowing, right retract in service, right retract blowing, and low header pressure are conditions for which sensors are provided and monitored in a manner to be described in conjunction with FIG. 12 which sets forth the details of an exemplary permit module for use in accordance with the teachings of the instant invention. Here it is sufficient to appreciate that when left and right retracts are properly operating, left retract in service, left retract blowing, right retract in service and right retract blowing indications will be provided to advise the operator that the system is properly operating while if a low header pressure condition is sensed, this indication too will be provided to the operator to advise of this condition of malfunction.

In similar manner, the wallblower advisory information contained within the rectangle 303 provides a controller operating indication, a wallblower in service indication, a wallblower blowing indication, a low header pressure indication, a no blowing air indication and a time exceeded indication. The controller operating, no blowing air and time exceeded indications are supplied directly through monitoring functions performed by the controller and occur precisely in the same manner as indicated for the retractables except that with respect to the time exceeded indication, the cycling time for wallblowers, as will be appreciated by those of ordinary skill in the art, is normally about a minute. Therefore, if a wallblower fails to complete its cycle of operation within the minute interval specified, the time exceeded indication will be illuminated and the wallblower indicia for the wallblower which has malfunctioned will be flashed. No emergency retract is however, provided for wallblowers in the instant embodiment of the present invention. The wallblower in service, wallblower blowing and low header pressure indications illustrated within the rectangular block 303 occurs as a direct result of sensors provided within the system and monitored at the permit module illustrated in FIG. 12. Thus, when wallblowers are properly operated, both the wallblower in service and wallblower blowing indications will be provided while if a low header pressure condition is sensed, this indication will be displayed to apprise the operator of this condition. Accordingly, it will be seen that the boiler diagram and display panel illustrated in FIG. 6 serves, under program control, to completely apprise the operator as to the operating status of the system and additionally functions as a visual information source to preview operating routines which are initiated through the various check sequences which may be established as well as the operational condition of each of the sootblowers in the system.

DISPLAY DECODER AND DISPLAY DRIVER ARRAY FOR THE BOILER AND DISPLAY PANEL ILLUSTRATED IN FIG. 6.

Referring now to FIG. 7, there is shown an exemplary embodiment of a display decoder and a display driver array for the boiler and display panel shown in FIG. 6. The display decoder is generally disposed in the left hand portion of FIG. 7 and comprises a circuit select decoder 308 and a driver select decoder 309 while the display driver array illustrated in FIG. 7 comprises 16 individual lamp driver cards 310 - 325 wherein lamp driver card 310 is shown in detail within the dashed block while the remaining lamp driver cards are generalized in block form as they take the same form as the driver array shown within the dashed block 310. The display decoder indicated generally as block 32 in FIG. 1 is connected to the B bus 27 in the manner generally shown in FIG. 1 and accordingly, the B bus is illustrated in FIG. 7 generally disposed along the left hand portion of the figure with specific outputs therefrom applied to specific portions of the display decoder in the manner indicated. Furthermore, it will be appreciated by those of ordinary skill in the art that while the display decoder and display driver array illustrated in FIG. 7 only provides for the outputting of information to 256 indicia within the boiler display panel diagram illustrated in FIG. 6, a second display decoder and display driver array such as is illustrated in FIG. 7 is additionally provided, although not shown herein to avoid repetitiveness, so that up to 512 individual indicia may be driven by the generalized display driver array 31 illustrated in FIG. 1.

The circuit select decoder 308 may comprise a conventional binary to decimal decoder or a four line to sixteen line decoder which acts in the conventional manner to accept a four bit input and to energize one of sixteen outputs in response to the condition of the four bit inputs supplied thereto so that each of the sixteen output states representative of the input are generated on an individual line. Thus, the circuit select decoder 308 may conventionally take the form of a four line to sixteen line decoder/demultiplexer such as an SN 74154 chip as conventionally available from the Texas Instrument Corporation. The four inputs to the circuit select decoder 308 are supplied, as indicated by the properly annotated multiconductor cable 326 from the B bus and take the form of the low order address inputs $A_0 - A_3$ present thereon. The nine bit address $A_0 - A_8$ supplied to the B bus may be applied, it will be recalled, by either the scanner multiplexer means illustrated in FIG. 5 or directly by the programmable controller when in the process of entering information into the system. Of this nine bit address, $A_0 - A_3$, the first four or low order bits of the address are supplied through the multiconductor cable 326 to the circuit select decoder 308 for the purposes, as shall be seen below, of circuit selection, while the second four address bits $A_4 - A_7$ are applied to the driver card select decoder for the purposes of selecting a discrete driver card. Finally, the most significant address bit $A_8$ is employed to select either the display decoder and display driver array illustrated in FIG. 7 or an identical display decoder and display driver array employed to drive indicia 257 - 512 in the boiler display panel illustrated in FIG. 6 as shall be made clear hereinafter. In any event, the four low order address bits are supplied to the circuit select decoder 308 through the multiconductor cable 326 and are appropriately decoded thereby so that a high is generated on one of sixteen output conductors here annotated CKT-1 - CKT-16 as indicated on conductors 327 - 342. As shall be seen hereinafter, each of the lamp driver arrays 310 - 325 include sixteen circuits wherein each circuit is capable of illuminating one indicia within the boiler and display diagram illustrated in FIG. 6. Therefore, the presence of a circuit select output on one of conductors 326 - 342 will enable a specific circuit within the lamp driver arrays 310 - 325 so that if a given one of the lamp driver arrays 310 - 325 is enabled by the output of the driver card select decoder 309, an individual indicia within the boiler and display diagram shown in FIG. 1 will be illuminated. Thus, each lamp driver array contains 16 circuit wherein each of the sixteen circuits is capable of illuminating one indicia within the boiler diagram and display panel and there are sixteen lamp driver arrays. Accordingly, each time four bits of information are decoded by the circuit select decoder 308, one of the sixteen outputs 327 - 342 will go high and this conductor will enable a common circuit in each of the sixteen lamp driver arrays 310 - 325.

The sixteen outputs of the circuit select decoder 308 are supplied through conductor bundles 343 - 358 to each of the sixteen lamp driver arrays 310 - 325 so that each of the lamp driver arrays are effectively connected in parallel to the outputs of the circuit select decoder 308 and receives at a corresponding input annotated 1 - 16 the outputs generated thereby on the output conductors 327 - 342. Thus, each of the lamp driver arrays 310 - 325 receives each of the sixteen outputs of the circuit select decoder 308 in parallel so that when a given one of the output lines 327 - 342 go high, a corresponding circuit in each of the lamp driver arrays 310 - 325 will be conditioned for an output to drive a particular indicia within the boiler diagram and display array illustrated in FIG. 6 if that lamp driver array should be enabled by an output of the driver card select decoder 309.

More particularly, each of the lamp driver arrays 1 - 16 illustrated by the blocks 310 - 325 generally takes the form shown within the dashed block 310 and comprises first, second and third AND gate arrays 359 - 361, and a flip flop array 362. Each of the AND gate arrays 359 - 361 may comprise sixteen two input AND gates wherein a commonly disposed input for each AND gate is commonly connected to an enable line illustrated within the dashed block 310 by the conductors 363 - 365. Accordingly, when a high resides on each of the enable conductors 363 - 365, any AND gate in the array which receives a high at the second input thereto will be enabled to provide a high at the output thereof. The first AND gate array 359 within the dashed block 310 receives each of the sixteen outputs of the circuit select decoder 308 through individual conductors within the conductor bundle 343 which are connected to the inputs thereto annotated 1 - 16, it being appreciated that each of the inputs annotated 1 - 16, within the AND gate array 359 is an input to one AND gate and that input is independent from those commonly connected to the enable line 363. The outputs of each of the sixteen AND gates within the first AND gate array 359 are connected through the conductors 366 - 381 to corresponding AND gates within the second AND gate array 360. Accordingly, as the enable line 363 is connected to a selected output of the driver card select decoder 309, in a manner to be described hereinafter, it will be appreciated that whenever the enable line 363 goes high, in response to a decoding for the lamp driver array 1 illustrated within the dashed block 310, whatever circuit has been selected through a decoding of address bits $A_0 - A_3$ will be applied to an enabled AND gate within the first AND gate array 359 and hence, if a high is present on one of the conductors 327 - 342, as communicated to the first AND gate array 359 through the conductor bundle 343, a resulting high will be produced at the appropriate one of the outputs from the first AND gate array 359 on one of conductors 366 - 381.

This combination effectively selects a discrete one of the indicia within the boiler and display diagram illustrated in FIG. 6; however, whether or not the same is to be illuminated, or remain a non-illuminated condition is a function of the status condition indicated by the sootblower which is addressed through the AC receiver means by the same address information reflected in address bits $A_0 - A_8$ on the B bus. Accordingly, the indicia information developed through the decoding achieved by the first AND gate array 359 is supplied over the selected one of conductors 366 - 381 to a corresponding AND gate within the commonly enabled sixteen AND gate array 360. Thus, if it is assumed that the lamp driver array 310 has been selected, one of the conductors 366 - 381 will have a high present thereon which is applied to one of the AND gates within the commonly enabled array 360.

The enable line 364, as shall be seen in greater detail below, has an enable level applied thereto after an IO reply has been received from the addressed sootblower through the IO decoder and the AC receiver means and hence, the enable line 364 will go high whenever an address receiver has responded to the address information in a read mode to supply a one or zero bit indicative of the operating condition of the address sootblower associated therewith. Accordingly, when the IO reply is received at the display decoder illustrated in FIG. 7, a high will obtain on the enable line 364 whereupon any AND gate which has been supplied with a high at the second input thereto within the AND gate array 360 will supply a high on the output thereof. The outputs of each of the sixteen AND gates within and AND gate array 360 are supplied in parallel through conductors 382 - 397 to the clock inputs of sixteen flip flops within the flip flop array 362.

The flip flop array 362 may comprise sixteen individual, D type flip flops which are arranged so that their D inputs are commonly connected as indicated to the data out line 398 while their clock inputs are individually connected to the outputs of the individual AND gates within the AND gate array 360 through respective ones of the conductors 382 - 397. This means, as will be appreciated by those of ordinary skill in the art, that if the lamp driver array 310 has been selected, the circuit therein which has been selected will supply a high level through an appropriate one of conductors 366 - 381 to the AND gate array 360 and this AND gate array in turn will supply a clocking input to the flip flop array 362 after an IO reply has been received. Thereafter, in a manner well known to those of ordinary skill in the art, the flip flop within the sixteen flip flop array 362 which receives a clock in its input which is connected to one of the conductors 382-398 will be set to the condition applied to its D input by the conductor 398. Thus, if a one level resides on conductor 398, the flip flop will be placed in a set state while if a zero resides thereon, the flip flop will be retained in its reset condition. The D input on conductor 398, as shall be seen in greater detail below, is supplied from the B bus and is connected to the data out conductor therein. This data out conductor, as indicated by the connection to the B bus manifested by conductor 399 receives the one or zero information reflecting the operative or inoperative status of an address sootblower from the AC receiver illustrated in FIG. 10 and hence whether or not the clocked flip flop within the array 362 is placed in a set or reset condition is determined by whether or not the sootblower which has been addressed is in an operative or inoperative condition as indicated by the one or zero condition of the data out conductor within the B bus as supplied to the D input thereto through conductors 398 and 399. Accordingly, it will be appreciated that the AND gate array 359 effectively acts to decode one of sixteen circuits or indicia at the boiler and display panel illustrated in FIG. 6 which corresponds to one of sixteen sootblowers which is being addressed in a read mode through the B bus. When the addressed sootblower is addressed at the AC receiver means an IO reply signal acts to gate this address information through the AND gate array 360 where it is employed to clock one of sixteen flip flops within the flip flop array 362, each flip flop therein also correspondding to a given one of sixteen indicia on the boiler diagram and display panel illustrated in FIG. 6. If the addressed sootblower is operative, this operative status is read from the AC receiver means as a one and supplied through the B bus to the flip flop array 363 through conductors 398 and 399 whereupon the flip flop corresponding to the addressed sootblower is either set or reset in response to the state thereof. Accordingly, the one or zero condition of each of the sixteen flip flops within the flip flop array 362, reflects the operative or inoperative condition of a sootblower bearing that same address or at least the operative or inoperative condition of that sootblower when the same was last addressed which, it will be recalled, is quite recent due to the operation of the scanner multiplexer means illustrated in FIG. 5. The output of each of the sixteen flip flops within the flip flop array 362 is supplied through the conductors 401 – 402 to corresponding inputs 1 – 16 of the AND gate array 361.

The AND gate 361 like the AND gate arrays 359 and 360 may also take the form of a sixteen AND gate array wherein one input of each AND gate is tied to a common enable line 365. The other input of each AND gate is connected to respective ones of the conductors 401 – 416 and hence the input information applied to this AND gate array reflects tne operative or inoperative status and hence the illuminated or non-illuminated status of each of the sixteen sootblower indicia associated therewith which are disposed in the boiler diagram and display means illustrated in FIG. 6. The common enable line 365 to the AND gate array 361, as will be apparent in FIG. 7 is tied high to a source of positive voltage (B+) so that the AND gate array 361 may be viewed as continuously enabled. However, as it should now be appreciated that the output of the AND gate array 361 is directly employed to drive sixteen indicia within the boiler diagram and display panel illustrated in FIG. 6, it will be appreciated by those of ordinary skill in the art that significant power savings may be obtained in large displays if the enable line 365 is pulsed rather than being connected to a source of B+ and so long as the frequency of pulsing is sufficient to accommodate the persistance rate of the eye, the display illustrated in FIG. 6 will appear to be continuously illuminated while the power saving feature is enjoyed. The outputs of each of the AND gates within the AND gate array 361 are connected to respective ones of the output conductors 417 – 432 and as indicated may be employed to directly drive sixteen indicia within the boiler diagram and display means illustrated in FIG. 6 whereupon the illuminated or non-illuminant state of each indicia driven by one of the conductors 417 – 432 reflects the set or reset state of the flip flop associated therwith within the array 362. Furthermore, it should be noted that depending upon the nature of the indicia employed within the boiler diagram and display means illustrated in FIG. 6, additional driver means may be connected to the outputs of the AND gates within the AND gate array 361 to raise the output of the AND gates therein to appropriate driving levels.

It should be further appreciated at this level that while the four bit output of the circuit select decoder 308 addresses each of the sixteen lamp driver arrays 310 – 325 in common to cause the addressing of only one circuit in each of the sixteen arrays, each of the sixteen lamp driver arrays 310 – 325 is separately enabled by an output from the driver card select decoder 309 so that as each sootblower within the system is addressed, only the indicia associated therewith will have its associated flip flop within the flip flop arrays 362 within lamp driver array addressed for appropriate setting in response to the operative or inoperative condition of that sootblower. However, since status information received as a data out condition on the B bus and applied to conductor 399 and IO reply information such as employed to enable the second AND gate array 360 through the conductor 364 is unique to the sootblower being addressed and hence the circuit in the lamp driver which is also addressed, the flip flop arrays and the second AND gate arrays within each lamp driver array 310 – 325 are commonly supplied with this information.

The driver card select decoder 309 may take precisely the same form of binary to decimal or four line to sixteen line decoder mentioned in conjunction with the circuit select decoder 308. Here, the driver card select decoder 309 receives address bits $A_4$ – $A_7$ from the B bus as indicated by the multiconductor cable 435 and acts in response thereto, when the driver card select decoder 309 is enabled, to supply a high at one of the sixteen outputs CS1–CS16 thereto. These outputs are connected to the individual output conductors 363, 436 – 450 and each of the output conductors 363 and 436 – 450 are connected to one of the lamp driver arrays 310 – 325, in the manner described in conjunction with the lamp driver array indicated by the dashed block 310 to secure the selective enabling of the first AND gate array 359 therein. Thus, due to the conjoint action of each of the circuit select decoder means 308 and the driver card select decoder 309, one of two 256 circuits may be selectively addressed and the state of the flip flop therein which corresponds to the sootblower whose indicia is to be controlled, may be set or reset to continuously reflect the state of that sootblower until subsequent addressing causes a change in the state therein.

As further indicated in FIG. 7, the driver card select decoder 309 is provided with a select (SEL) input and an inhibit input which are connected respectively to conductors 451 and 452 which control the enabling of the driver card select decoder 309. More particularly, the driver card select decoder 309 must be both selected and not inhibited before the same can be enabled to decode the four address bits $A_4 - A_7$ supplied over the multiconductor cable 435 thereto to produce an enabling level on one of the outputs thereof CS1–CS16. These conditions are here imposed because as shall be seen below, it is desired to have the availability to drive up to 512 discrete indicia and accordingly, the ninth bit in the address is employed to enable either the driver card select decoder 309 or another driver card select decoder, not shown, which is connected in identically the same manner as the driver card select decoder 309 but has its sixteen outputs connected to 16 additional lamp driver arrays which are also connected in parallel to the outputs of the circuit select decoder 308. In this way, the ninth bit of the address is employed to enable the selection of any one of up to 512 circuits. Conversely, there will be times when an address is issued on the B bus which is not to result in a setting of the flip flop arrays within the lamp driver arrays. These conditions obtain, for instance, when the controller is starting sootblowers as it is desired to set the flip flop arrays as a function of the status thereof and hence start up information is not employed for this purpose since there is no assurance that a sootblower will start as a function of start up information issued thereto. Thus, under these conditions, the inhibit line connected to the driver card select decoder 309 will be high to inhibit the operation thereof so that none of tne lamp driver arrays associated therewith will be enabled.

More particularly, the select information supplied to the driver card select decoder 309 through conductor 451 is developed from the ninth bit ($A_8$) of the address present on the B bus. Accordingly, the conductor within the B bus carrying address bit $A_8$ is supplied through a conductor 453 to either a straight through connection 454 or an inverter 455 for generating select information to both the driver card select decoder 309 illustrated in FIG. 7 and its complement decoder which is not shown. Thus in the instant case, the eight bit of information in the address is supplied through conductor 453, through the invertor 455 and is supplied through the jumper connection 456 to the select input on conductor 451. The jumper connection between the straight through conductor 454 is shown dashed to indicate that the same is not connected to the select line 451 for the driver card select decoder 309 but is employed for the second driver card select decoder employed to selectively decode information as a function of address bits $A_4 - A_7$ for a second set of sixteen lamp driver arrays. Thus, in the conventional manner, the one or zero condition of the ninth address bit of each address supplied to the B bus would be employed to decode information associated with one of two sets of sixteen lamp driver arrays. The display inhibit, is also taken from the B bus through the conductor 457 and applied directly to the inhibit input of the driver card select decoder 452. The display inhibit input on the B bus, it will be recalled, is generated at the scanner multiplexer illustrated in FIG. 5 and results as a function of signal information employed to inhibit address information generated by the address counter from gating onto the B bus. Thus under these circumstances, it is appropriate that the display be inhibited, as aforesaid, and this signal information, as gated onto the B bus is directly applied to the driver card select decoder 309 through conductors 457 and 452 to thus inhibit the enabling of any of the lamp driver arrays 310 – 325 as a function of the output of the driver card select decoder 309.

The select information supplied to the driver card select decoder 309 on conductor 451 is additionally supplied through a conductor 458 to one input of an AND gate 459. Thus, whenever a select level results as a decoding of the ninth bit of the address an enable level is applied through a conductor 458 to one input of the AND gate 459. The AND gate 459 may be a conventional two input AND gate which acts in the well known manner to produce a high at the output thereof connected to conductor 460 whenever both of the inputs thereto are high. The second input to the AND gate 459 is supplied from information obtained from the B bus.

More particularly, it will be recalled from a description of FIG. 5 that IO reply information is generated onto the B bus by the IO decoder illustrated in FIG. 8 each time address information is received thereby and acted upon. This IO reply information from the B bus is employed in FIG. 5 for the purposes of timing the gating of counter developed address information onto the B bus. Similarly, the IO reply signal present on the B bus is employed to appropriately time the operation of the circuitry within the display decoder and display driver arrays illustrated in FIG. 7. More particularly, IO reply information from the B bus is applied, through a conductor 461 to the input of a delayed single shot 462. The delayed single shot which may take the conventional form of delayed single shots described above here acts to insert about a 1 us delay in the IO reply signal received on conductor 461 and thereafter generate a positive timing pulse on the output thereof connected to conductor 463 for the duty cycle of the single shot. The purpose of the 1us delay inserted by the delayed single shot 462 is to permit address information otherwise being processed by the display decoder and display driver array illustrated in FIG. 7 to settle and also to permit the appropriate initial AND gate array within the enabled lamp driver array to be set up. Thereafter, the single shot will generate a high on conductor 463 which acts, assuming the AND gate 459 is otherwise enabled to cause both of the inputs thereto to go high and hence place a high at the output thereof on conductor 460. The output on the conductor 460 is applied to one input of a second two input AND gate 464 which may be conventional and thus acts to produce a high at the output thereof connected to conductor 465 whenever both of the inputs thereto go high. Thus, whenever the half of the lamp driver total array associated with the driver card select decoder 309 is selected by the ninth bit of the address and an IO reply is received from the B bus, a high will be supplied on conductor 460 to the AND gate 464. The second input to the AND gate 464 is connected through conductor 466 and the invertor 467 to the B bus and more particularly to the conductor 457 therein which receives, as aforesaid, display inhibit information. Due to the action of the invertor 467, as is well known, the AND gate 464 will be enabled when no display inhibit information is present on the B bus while the same will be disabled when display inhibit information is present. When the output of the AND gate 465 goes high on conductor 465, this information is supplied through conductors 364, and 468 – 483 to each of the lamp driver arrays 310 – 325 controlled by the output of the driver card select decoder 309. More particularly, as may be seen in connection with the description of the lamp driver array 310 and the second AND gate array therein 360, the enable supplied by conductors 364 and 468 – 483 acts to gate circuit select information through the second AND gate array 360 so the same may be employed to clock the flip flop array 362 or the corresponding flip flop array in each of the lamp driver arrays 310 - 325. As this clocking signal will affect a latching of the gate of the D input into the clock flip flop, it will be appreciated by those of ordinary skill in the art that the output of the AND gate 364 on conductor 365 is effectively a display latch strobe for each of the flip flop arrays in each of the lamp driver arrays 310 - 325. The display latch strobe generated at the output of the AND gate 464 is additionally returned to the B bus through the conductor 484 as a count strobe input to the B bus. The count strobe input, it will be recalled was employed for the purposes of incrementing the address counter 180 within the scanner multiplexer means illustrated in FIG. 5 and hence it will be appreciated that the count strobe information is gated onto the B bus after information for the address circuit has been latched into the flip flop array associated therewith.

The conductor 399 as has been described above, acts to convey operational status information in the form of a data out condition from the B bus to the D input of each flip flop array within the lamp driver arrays 310–325 through the conductors 398 and 485–499. This information represents the operating or non-operating state of a particular sootblower which has been addressed by the nine bits of address information on the B bus and will be latched into the particular flip flop which is clocked by the circuit select output of the second AND gate array 360 in each of the lamp driver arrays 310–325.

Accordingly, it will be appreciated by those of ordinary skill in the art that the display decoder and display driver array illustrated in FIG. 7 is responsive to address information supplied on the B bus during read modes of operation, through the lamp driver arrays, to control the illuminated or non-illuminated state of an indicia on the boiler and display diagram illustrated in FIG. 6 which corresponds to the sootblower which has been addressed. Furthermore, up to 512 individual indicia within the boiler diagram and display panel are controlled in this manner and once an individual driver circuit is addressed that circuit is responsive to IO reply information and data representing the operative or inoperative condition of the sootblower addressed to latch the operative condition of that sootblower into a flip flop associated with the indicia therefor where such information is retained until the sootblower is again addressed so that the boiler diagram and display illustrated in FIG. 6 is maintained in a continuously updated condition to apprise the operator of the operating status of all sootblowers in the system. Furthermore, the circuitry within the display decoder and display driver array illustrated in FIG. 7 is so timed that information from the B bus corresponding to the operative or inoperative status of an addressed sootblower is not clocked into a flip flop until an IO reply is received from the B bus to indicate that the AC receiver has responded to the address information on the B bus with a data out condition representing the state of the addressed sootblower. Once this is assured, the data out condition is latched into the addressed flip flop and at the same time a count strobe signal is generated back onto the B bus for use in the scanner multiplexer circuit illustrated in FIG. 5. The count strobe signal thus supplied by the display decoder and display driver array illustrated in FIG. 7 is thus employed in FIG. 5 to increment the state of the address counter and hence, it will be recalled, generate the next address for the reading of status information on sootblowers in the system and hence updating the display.

The data out information is not only representative of the AC receiver status but during the (read outputs) mode represents the status of the output latches. The display therefor will respond to the operative or inoperative state of the output latches. It is through this procedure that the program check, enable/disable condition, etc. are indicated on the display and comparisons performed in the controller with respect to latched information. The output enable is not active during the above.

THE INPUT/OUTPUT DECODER

Referring now to FIG. 8, there is shown an exemplary embodiment of an input/output decoder arrangement suitable for use within the exemplary embodiment of the invention illustrated in FIG. 1. While the general schematic of the instant invention illustrated in FIG. 1 schematically illustrates only a single IO decoder 35, together with a single AC driver 7 and a single AC receiver 8, numerically the number of sootblowers controlled by the instant invention requires that four AC driver means 7 and four AC receiver means 8 be provided within practical embodiments of the instant invention as the circuit card arrangements which are involved are better implemented in this manner. In addition, an IO decoder circuit such as is illustrated in FIG. 8 is provided in practical applications of the present invention for each receiver card and driver card wherein such IO decoder cages are connected in a cascade arrangement. This mode of implementation has been employed for convenience in practical embodiments, it being viewed appropriate to provide discrete cards having a limited number of circuits rather than a large card although a larger embodiment which takes care of all the AC driver and receiver circuits would include less in the way of redundancy. However, the exemplary IO decoder arrangement illustrated in FIG. 8 will render it manifest to those of ordinary skill in the art how a single IO decoder arrangement could be employed to control all receiver and driver circuits illustrated within the instant invention and in addition, the exemplary embodiment set forth will illustrate the manner in which a multiple of IO decoders such as here employed relies upon a stratified chip selecting arrangement to obtain one of four addresses in a sequential manner rather than directly employing a one of four decoding arrangements such as would be relied upon should a single IO decoder be utilized.

Turning specifically to FIG. 8, the exemplary embodiment of the input/output decoder arrangement illustrated therein comprises circuit select decoder means 501, card select decoder means 502, reset decoder 503, a next address detector 504 and gate select logic formed by the gates 505–515. As aforesaid, each IO decoder of the type illustrated in FIG. 8 employed within the instant invention, and eight such decoders are employed as mentioned above, will control either one AC driver or one AC receiver cage there being a total of four AC receiver cages and four AC receiver cages employed within the instant embodiment of the present invention and it should be noted that should it be desired to modify the architecture of the instant invention, only four IO decoders of the type displayed within FIG. 8 could be employed wherein each such decoder controls one AC driver cage and one AC receiver cage. Regardless of the architectural arrangement preferred, each AC driver and AC receiver cage will include sixteen cards and each card will include eight circuits which are uniquely assigned to given sootblowers for the purposes of either starting the same or receiving sootblower status information therefrom. Thus, with the nine bit $A - A_8$ address information being propagated on the B bus, it will be appreciated that low order bits $A_0$–$A_2$ are capable of defining one of the eight circuits on each driver or receiver card while address bits $A_3 - A_6$ are capable of each defining one card within each of the four AC receiver and AC driver cages relied upon.

The remaining two address bits $A_7$ and $A_8$ are employed to define the one of four cages in which the address circuit and card resides so that here again, the nine bit address provided may define one of up to 512 driver or receiver circuits within the instant invention wherein an address intended for a receiver is distinguished from that intended for a driver by the presence or absence of a write command associated with the issuance of the address. Thus it will be recalled that when the scanner multiplexer means illustrated in FIG. 5 is sequentially addressing each sootblower in the system no write command information is issued while when the scanner is inhibited so that the controller can issue start up information to a specified sootblower, both write information in the form of a write command and the address of the specific sootblower to be initiated is issued to the B bus through the programmable controller 1. Accordingly, it will be appreciated that address bits $A_8$ and $A_7$ define one of up to four driver or receiver cages while address bits $A_6$–$A_4$ define sixteen driver or receiver cards present at each cage and address bits $A_0 - A_3$ define the eight driver or receiver circuits present at each card.

The B bus 27 through which address information and command information is conveyed to the IO decoder means illustrated in FIG. 8 as well as through which select information as shall be seen below is exchanged between the various IO decoder cages employed within the instant invention is generally shown along the left hand side of FIG. 8 and, as was the case in previous figures, information supplied from the B bus to individual circuits within the IO decoder illustrated in FIG. 8 is shown along the left hand portion of the drawing while information input to the B bus or other appropriate multiconductor cables are shown at the output of the IO decoder along the right hand portion of the Figure. The circuit select decoder means 501 may take the conventional form of a binary to decimal or three line to eight line demultiplexer means which acts in the well known manner to receive three input bits in binary form and provide a high on one of eight output lines in response to the decoding of the three bit binary inputs supplied thereto. Accordingly, the circuit select decoder means may take the conventional form of an SN 74155 decoder chip such as is available from the Texas Instruments Corporation. The low order three address bits $A_0 - A_2$ are supplied from the B bus 27 through a multiconductor cable 517 to the inputs of the circuit select decoder means 501. The outputs of the circuit select decoder means 501 are connected to output conductors 518 – 525 where the same may be directly connected as indicated as circuit select inputs at either the AC driver or AC receiver means assigned to the IO decoder cage being described or alternatively, as will be appreciated by those of ordinary skill in the art, the circuit select inputs developed at the outputs of the circuit select decoder means 501 on conductors 518 – 525 may be employed to provide inputs for a commonly assigned AC driver and AC receiver cage, it being appreciated that whether the driver or receiver cage is energized by the selection technique employed under such circumstances will result as a function of whether or not write information is provided at the output of the IO decoder card being described.

The card select decoder means 502 may take the conventional form of a binary to decimal decoder or a four line to sixteen line demultiplexer which acts in the conventional manner to receive a four bit input and to energize one of sixteen lines in response thereto. Accordingly, the card select decoder means 502 may take the conventional form of an SN 74154 decoder chip as conventionally available from the Texas Instrument Corporation. The four bit input to the card select decoder means 502 here takes the form of address bits $A_3 - A_6$ and is applied thereto from the B bus 27 through the multiconductor cable 526. The sixteen outputs of the card select decoder means 502 are connected to output conductors 527–542 which again may be supplied as direct inputs to either the AC driver cage or AC receiver cage assigned to the decoder being described or alternatively, as in the case of the circuit select decoder means 501 both a AC driver and AC receiver means could be connected in parallel to the output conductors 527 – 542 whereupon both cages would receive card select information developed at the output of the card select decoder means 502 and the cage which would be responsive thereto would be addressed as a function of whether a write command was present. Accordingly, it will be seen that the card select decoder means 502 acts in response to four bits of address information $A_3 - A_6$ on the multiconductor cable 526 to define a card within each AC driver and AC receiver cage so that each cage may contain up to 16 cards while address bits $A_0 - A_2$ as acted on by the circuit select decoder means 501 acts to select one of up to eight circuits in each card wherein each circuit is assigned to a specific sootblower. Accordingly, the address bit $A_0 - A_6$ as decoded by the circuit select decoder means 501 and the card select decoder means 502 act to uniquely define one of eight circuits on one of sixteen cards within each of the four AC driver cages and the four AC receiver cages employed within the instant invention. The cage select, as shall be seen below, is developed as a function of a high order address bits $A_8$ and $A_9$ as logically operated upon by the cage select logic indicated by the gates 505 – 515.

Prior to discussing the cage select logic, the timing and housekeeping signals developed as a function of information on the B bus will be described. More particularly, reset information introduced onto the B bus by the programmable controller for periodic resetting functions within the AC driver circuits in a manner to be described below in conjunction with FIG. 9 is taken from the B bus by the reset line 545 and applied to one input of a two input OR gate 546. The OR gate 546 may take the form of a conventional two input OR gate which generates a high or reset level at the output thereof connected to conductor 547 any time either of the inputs thereto go high. The output of the OR gate connected to conductor 547 is applied to the AC driver circuits illustrated in FIG. 9, in the manner indicated and may be viewed as being connected through a multiconductor cable for this purpose in the manner indicated in FIG. 1. Here, it is sufficient to appreicate that any time the programmable controller issues start instructions to a given sootblower within the system, the start command is latched into the circuit associated with that sootblower. Thereafter, once a start condition for the sootblower has been ascertained, the latched condition is cleared so that other start orders will not be issued to the sootblower which has already been started. It is to this purpose that a reset command is issued from the controller on the B bus which is then applied through the reset line 545, the OR gate 546 and the output 547 to the AC driver circuits illustrated in FIG. 9.

A second input to the OR gate 546 is supplied through a conductor 548 connected to the output of an AND gate 549. The AND gate 549 is a conventional two input AND gate which produces a high or clearing level at the output connected to the conductor 548 only when all of the inputs thereto are high. A first input to the AND gate 549 is supplied through a conductor which, as shall be seen below, receives a high level each time a new address has been supplied to the B bus. The second input to the AND gate 549 is supplied through the conductor 551 from the output of the reset decoder means 503. The reset decoder means 503, as indicated, is a four input AND gate which acts to decode a 511 instruction within the address by a decode of four relevant bits therein. More particularly, the reset decoder means 503 is a four input AND gate which acts in the conventional manner to apply a high or a reset level to conductor 551 whenever its decode of address bits $A_8$, $A_7$ and the resultant decimal conversion of addresses $A_3 - A_6$ and $A_0 - A_2$ indicate that an all one address or an address decoding as 511 which is a general reset instruction employed within the instant invention is present. More particularly, since the nine bit address employed within the instant invention is capable of specifying up to 512 distinct sootblowers while far less than that is utilized, the maximum address or an all one condition for address bits $A_0 - A_8$ is employed as a general reset instruction which is utilized, among other functions to clear all latches set within the AC driver means illustrated in FIG. 9. The condition of address bits $A_8$ and $A_7$ are applied directly to two inputs of the reset decoder 503 through the conductors 552 and 553 so that when a one resides in the bit positions of address bits $A_8$ and $A_7$, these conditions are directly applied and decoded by the reset decoder means 503. Similarly, an all one condition for address bits $A_3 - A_6$ will result in a high at the output of the card select decoder means which is present on conductor 527 and this is supplied through a conductor 554 to a third input of the reset decoder means 503. Similarly, when address bits $A_0 - A_2$ are in an all one condition, the output of the circuit select decoder means 501 connected to conductor 518 will go high and this condition is supplied to the reset decoder means 503 through a conductor 554. Accordingly, it will be appreciated that when an all one address is present on the B bus all of the inputs to the reset decoder means go high to indicate a generalized reset instruction which causes the output of the reset decoder means 503 to go high. This condition is supplied through the conductor 551 to the AND gate 549 and when the same occurs as a part of a new address as indicated by a high on conductor 550, the output of the AND gate 549 goes high to supply a high through the conductor 548 and the OR gate 546 to the output to the AC driver circuit illustrated in FIG. 9 on conductor 547. Therefore, it will be appreciated by those of ordinary skill in the art that when either a reset instruction is issued by the programmable controller 1 on the B bus as reflected by a high on conductor 545 or a general reset command is issued by a setting of all address bits to a one condition as a part of a new instruction, a high or resetting level is supplied at the output of OR gate 546 and on conductor 547 so that the same may be applied to clear the latches in the AC driver illustrated in FIG. 9.

The output of the AND gate 549, which goes high in response to a decoding of a general reset or 511 address which occurs in a new address as applied to the AND gate 549 through conductor 550 is inverted at the invertor 556 and supplied through the conductor 557 to an input of an AND gate 511. The AND gate 511 may take the form of a conventional four input AND gate which produces a high or gating signal only when all of the inputs thereto go high. In the case of the AND gate 511, all of the inputs to this gate will go high when the IO decoder cage in which it resides has been selected and a new address which is not a general reset instruction has been supplied to the IO decoder. The function of the AND gate 511 is thus, as shall become more apparent below, to supply gating information indicative that this IO decoder has been selected in a currently received address so that a write command which is present on the B bus may be gated through to the AC driver circuit associated therewith and hence indicate that the AC driver rather than the AC receiver associated with a given IO decoder is to be enabled for a write operation rather than a read operation. Accordingly, the first input to the AND gate 511 as supplied thereto on conductor 557 is indicative that the last address received and decoded is not a 511 or all one address indicating that a general reset function is to take place as initiated on the output conductor 547. A second input to the AND gate 511 is supplied through the conductor 558 as a strobe input which is indicative that a new address has been received. This strobe input, it will be appreciated, is the same as the inputs supplied to the AND gate 549 through conductor 550 and results each time a new address is conveyed to the IO decoder cage illustrated in FIG. 8. Accordingly, the first two inputs to the AND gate 511 on conductors 557 and 558 go high whenever a new address has been received which address does not correspond to a 511 or all one address which results in a general reset condition. The third and fourth inputs to the AND gate 511 as supplied thereto on conductors 559 and 560 are select inputs which are both high only under such conditions as shall be seen below when a given IO decoder card has been selected in response to a decoding of address bits $A_8$ and $A_7$ to yield one of four possible combinations. Thus, if a single AC driver and a single AC receiver are connected to each decoder card, the input on conductors 559 and 560 will define whether or not that decoder card has been selected while when each driver and receiver circuit is connected to an IO decoder cage two IO decoder cages will be selected and whether an AC driver or AC receiver is energized therefrom will be determined by whether or not a write clock has been issued. In any event, the select one and select two inputs supplied to the AND gate 511 on conductors 559 and 560 go high each time the IO decoder cage associated therewith has been selected and accordingly, when such selection occurs as a part of an address which is not a general reset address all of the inputs to the AND gate 511 will go high to produce a high at the output thereof connected to conductor 561.

The conductor 561 is connected to one input of a two input AND gate 562. The second input to the AND gate 562 receives supplied on write command information from the B bus through the conductor 563. Write command information is issued by the programmable controller 1 or emergency manual circuits to the B bus each time a sootblower operation is to be initiated. In essence, the write command is issued concurrently with address information defining the sootblower to be started and accordingly, while the decoders 501 and 502 act on the first seven bits of the address to define the card and circuit which is to be energized in response to the addresses suppliedon the B bus, the write command is ANDed with select information which forms a part of the output of the AND gate 511 as aforesaid on conductor 561 which serves to decode the cage select information contained in the last two bits of the address to indicate which of four IO decoders is to further convey the write command to its associated AC driver circuit where the address set forth is employed to set a latch and start a sootblower in response thereto. Accordingly, when the programmable controller 1 has issued a write command on the B bus the selected IO decoder which has recently received an address which is not a generalized reset address will cause both of the inputs to the AND gate 562 to go high. Under these conditions, a high level will be applied at the output thereof which is connected to the conductor 564 which provides write clock information to the AC driver circuit illustrated in FIG. 9 which is connected to that IO decoder cage. Thus, only the IO decoder which is connected to a selected AC driver produces a write clock in addition to circuit select and card select information which acts to define the specific card and circuit within the AC driver, as illustrated in FIG. 9, which is to be employed for start up operations of a defined sootblower. The write clock information present on conductor 564 is conveyed to the associated AC driver circuit 7 connected to the IO decoder cage being discussed through the multiconductor cable 37 illustrated in FIG. 1.

The strobe information which is applied to conductors 550 and 558 is developed as a function of the next address detector 504. More particularly, the next address detector 504 is a nine input OR gate which acts in the conventional manner to provide a high or triggering output at the output thereof when any of the inputs thereto go high. The nine inputs to the next address detector 504 are connected through a multiconductor cable 566 to receive from the B bus, in the manner indicated, the nine bits of address information present thereon. As will be appreciated by those of ordinary skill in the art, each time a new address is issued on the B bus 27, at least one of address bits $A_0 - A_8$ must go high. This in turn will cause the output of the next address detector 504 which is an OR gate as aforesaid, to go high to place a high on the output conductor 567. The output of the next address detector 504 is thus connected through the conductor 567 to the input of a delayed single shot 568 and through the conductor 569 to the reset input of the IO reply flip flop 570. The delayed single shot 568 may take the same form of delayed single shot described above wherein a first monostable acts to delay the input pulse for the duty cycle thereof which here is approximately 2 us to allow for the settling of the address lines and thereafter acts to toggle a second monostable which provides a pulse at the output thereof which is employed as a strobe pulse to indicate that the address on the B bus has just been issued and should be processed in the appropriate manner. Accordingly, the output to the delayed single shot 568 is supplied through the conductor 571 to the clock input of the data out flip flop 572 and through conductors 550 and 558 for the purposes of strobing the 511 reset AND gate 549 and the cage select AND gate 511.

The data out flip flop 572 may take the conventional form of a D type flip flop which acts, as well known, to follow the D input thereof when a clock is supplied thereto. Thus, the data out flip flop 572 may take the conventional form of a SN 7474 flip flop as conventionally available from Texas Instruments Corporation or the like. The output of the data out flip flop 572 is supplied through a conductor 573 to the B bus which conveys the data out signal to FIG. 7 where the same is employed, as will be recalled, as the D input to the latches employed therein. Additionally, this information is supplied to the controller to indicate that a prescribed writing operation has been completed. More particularly, as shall be seen in conjunction with FIGS. 10 and 11, each time a particular sootblower circuit is addressed through information obtained from the IO decoder illustrated in FIG. 8, a data out condition is returned to the IO decoder from either the AC driver or AC receiver circuit addressed which is employed as the D input to the data out flip flop 572. In the case of the AC receiver, the One or Zero state of the data out signal returned to the IO decoder illustrated in FIG. 8 is indicative of the operative or inoperative state of the sootblower addressed and hence whether or not the data out flip flop is set or reset in response to the D input in the presence of a clock will supply a One or Zero signal to the display decoder illustrated in FIG. 7 which is indicative of the operative or inoperative state of the sootblower which was addressed so that this information may be set into the latches therein and appropriately displayed. In the case of the AC driver, the data out signal will represent the status of the latch information which is employed by the controller and display as an acknowledgement of an instruction and this information is returned from the AC driver to the IO decoder after the circuit select has been set to the state where it may cause the sootblower associated therewith to be initiated. Thus, the One or Zero output state of the data out flip flop as present on the conductor 573 represents the state of a sootblower addressed through the AC receiver or an acknowledgement that a write instruction has been processed by the AC driver depending upon the nature of the instruction initiated at the outset by the programmable controller.

The D input to the data out flip flop is connected through a conductor 574 to the output of an AND gate 575. The AND gate 575 may take the conventional form of a two input AND gate whose output goes high to set the data out flip flop in the presence of a clock only when both of the inputs thereto are high while if either of the inputs thereto are low, the data out flip flop 572 will be retained in its reset state during the presence of the clocking signal from the delayed single shot 568. A first input to the AND gate 575 as applied to conductor 576 is applied from the data out input from the AC receiver and/or the AC driver circuit connected to the particular IO decoder being discussed as shall be more apparent in conjunction with a discussion of FIGS. 10 and 11. Here it is sufficient to appreciate that for a reading of status of sootblowers, or latches any sootblower circuit addressed which is in an operative condition will cause a one to be placed at the data out output of the receiver illustrated in FIG. 11 while if the state of the sootblower is inoperative, a zero will be placed at the input conductor 576 to indicate this result. Conversely, when a write instruction is issued to the AC driver circuit illustrated in FIG. 9, a one will be supplied to the data out output thereof after the writing operation has been processed and the programmable controller issues a read signal thereto to ascertain whether or not its write command has been appropriately processed therein. Thus, the data out input supplied on conductor 576 as a first input to the AND gate 575 is indicative of whether or not a write operation has been processed at an AC driver as illustrated in FIG. 9 or the operative or inoperative condition of a sootblower whose status is being read through an addressing operation in a manner to be described in conjunction with FIG. 10. The second input to the AND gate 575 is supplied through conductor 557 from the output of the AND gate 512. The AND gate 512 acts, as shall be seen below, to provide a high at the output thereof connected to the conductor 577 any time the particular IO decoder cage in which it resides has been selected as a function of address bits $A_8$ and $A_9$. Accordingly, the data out information present on conductor 576 will be employed to set or reset the data out flip flop 572 only when this flip flop resides at the IO cage which is currently being addressed it being appreciated that each of the four or eight IO decoder cages being relied upon will have a corresponding data out flip flop 572 and hence only one is to convey data out status information to the B bus as a function of which of the four are currently being addressed. While the manner in which address bits $A_7$ and $A_8$ are employed in a one of four decoding for the appropriate selection of an IO decoder cage will be discussed below, it is here sufficient to appreciate that the output of the AND gate 512 is applied to the conductor 577 will only go high when the IO decoder cage in which it resides has been selected by the condition of address bits $A_7$ and $A_8$.

The output of the AND gate 512 applied to conductor 577 is also supplied through a conductor 578 to the input of the IO reply flip flop 570. The IO reply flip flop 570 acts to generate an IO reply signal which is applied to the B bus to acknowledge the receipt and processing of an address each time the IO decoder in which it resides effectively receives and processes an address from the B bus. This IO reply signal, it will be recalled, is employed by the scanner multiplexer illustrated in FIG. 5 and by the display decoder and driver array illustrated in FIG. 7 for gating information and is additionally employed by the programmable controller for housekeeping functions. Thus, it will be recalled that it is the IO reply signal which is used by the scanner multiplexer in combination with count strobe pulses to gate new address information onto the B bus and it is the IO reply that is employed by the display decoder and driver array illustrated in FIG. 7 to gate information therethrough for the purposes of clocking the latches therein and in the generation of the count strobe signal. Thus, whenever the IO decoder cage in which the IO reply flip flop 570 resides is selected a One level is applied to the D input of the IO flip flop through the conductor 578. Since the IO flip flop 570 may take the conventional form of a clocked flip flop such as a SN 7474 such as is available from the Texas Instrument Corporation, it will be appreciated that this flip flop is set to the state of the D input thereto each time a clock pulse is applied to the clock input thereof. The clock input to the IO reply flip flop 570 is connected through a conductor 579 to the output of the delayed single shot 568 through the conductor 571. Therefore, as it will be recalled that the delayed single shot 568 issues a clocking pulse 2ms after a new address is detected by the next address detector 504 it will be appreciated that when such new address is destined for the IO decoder cage in which the IO reply flip flop 570 resides, the IO reply flip flop 570 will be clocked by a pulse on conductors 571 and 579 while a high level will have been supplied on conductor 578 from the processing of the cage select address bits $A_7$ and $A_8$ in a manner to be described hereinafter. Thus, each time an address destined for a given IO decoder cage is issued, the IO reply flip flop which resides at that cage will gate a One onto the B bus at the output thereof connected to the conductor 580. Furthermore, since the reset input to the IO reply flip flop 570 is connected as aforesaid through the conductor 569, it will be appreciated that each time an address is gated onto the B bus and detected by the next address detector 504 this flip flop will be reset. Accordingly, it will be seen that the typical mode of operation for the IO reply flip flop 570 will be such that it will be reset to a Zero state each time an address is applied to the B bus and if that address is destined for the IO decoder cage in which it resides, it will be set to the One state to generate an IO reply on conductor 580 destined for the B bus as soon as the output of the AND gate 512 goes high and a clock is supplied after the 2ms delay associated with the delayed single shot 568. Accordingly, the clear reset and write clock outputs generated by the IO decoder cage illustrated in FIG. 8 are supplied to the AC driver circuit illustrated in FIG. 9 which is associated therewith while the data out and IO reply signals generated at output conductors 573 and 580 are applied to the B bus for general peripheral utilization in the manner described above.

While the address bits $A_8$ and $A_7$ could have been directly relied upon to define one of four AC driver cages and one of four AC receiver cages as aforesaid, whereupon only a single IO decoder cage would be required, practical construction of an embodiment of the instant invention may take place under conditions where four IO decoder cages each of which is identical to that illustrated in FIG. 8 were employed. Therefore, instead of using a two line to four line decoder/demultiplexer for the decoding technique associated with cage select bits $A_8$ and $A_7$, as was done for address bits $A_6$ – $A_0$, a unique decoding arrangement was developed so that an appropriate decoding of address bits $A_8$ and $A_7$ takes place at each IO decoder card and rather than establishing different input conditions on each card, a stratified decoding technique was developed so that identical decoder card structure could be used in each place and the position of the IO decoder card in the circuits employed determine the address employed thereby to ascertain whether a given cage was being addressed. This stratified decoding technique is highly practical in that uniform structure for each decoder card is relied upon and hence should a malfunction occur in a given decoder card, replacement of the generalized structure thereof may take place without the difficulty of ascertaining specialized input codes associated with a given card. More particularly, the stratified decoding technique employed for all of the IO decoder cages is such that their position within their plugboard arrangement determines whether or not address bits $A_8$ and $A_7$ are directly employed for the decode for that card or whether in effect, the outputs of the previous decoder card are relied upon in the selection of that cage. Thus, typically, each IO decoder cage takes identically the same structure and connects to the B bus, and to the AC driver and AC receiver cages associated therewith in the manner indicated in FIG. 1; however, its plugged position will determine whether or not the inputs thereto associated with conductors 581 and 582 are high or low and all but the first IO decoder cage obtains select one and select two outputs, as indicated by the conductors 583 and 584 from the preceding IO decoder cage. In this manner, the same structure may be employed for each IO decoder cage and its function within the overall embodiment of the invention will turn on the position in which it is inserted in the decoder cage array. Furthermore, although the instant description assumes four IO decoder cards are used, each decoder card having one AC driver and one AC receiver cage connected thereto and being distinguished in addressing via the presence or absence of a write clock, it will be appreciated by those of ordinary skill in the art that eight IO decoder cages could be employed wherein each pair of IO decoders would be commonly connected in the manner described above so as to obtain either most significant address or select information from a preceding IO decoder cage and under these circumstances, either an AC driver circuit or an AC receiver cage would be connected to each IO decoder, each pair of decoders being commonly addressed.

Turning specifically to the cage select logic associated with the gates 505 – 515, it will be seen that each decoder card has a pair of AND gates 505 and 506 which receives at a separate input thereto, the most significant bit information of the address as present on the B bus. Thus, a first input to AND gate 505 receives the condition of address bit $A_7$ from the B bus through a conductor 585 and in a similar manner, the AND gate 506 receives the condition of address bit $A_8$ from the B bus through a conductor 586. In addition, each of the AND gates 505 and 506 have one of the inputs commonly connected through a conductor 581 to a terminal annotated use $A_7$ and $A_8$. The terminal annotated use $A_7$ and $A_8$ connected to the conductor 581 is connected to a high input for only the first of the series of four IO decoder cards and hence it is only the first of four IO decoder cards which directly employs address bits $A_7$ and $A_8$ to perform a decode of the most significant bits of the address to ascertain whether or not the address defines the initial IO decoder cage. The remaining three IO decoder cages are connected to perform a decode on select One IN and select Two IN information as applied to select AND gates 507 and 508 which information is generated by the previous IO decoder card in the series. Thus, the second IO decoder card uses a select information carried by the first IO decoder cage which employed the most significant address bits for the purposes of decoding and similarly, the third and fourth IO decoder cages employ select information developed at the preceding i.e. the second and third IO decoder cages. Thus, AND gates 507 and 508 receive select One IN and select Two In information from the B bus through the conductors 587 and 588 and it should be appreciated at the outset that the information on these conductors was generated at the select One and select Two outputs on conductors 583 and 584 of the preceding decoder card. A second input to each of the AND gates 507 and 508 is connected through the conductor 582 to a terminal annotated Do Not Use address bits $A_7$ and $A_8$ and it will be appreciated that this input on conductor 582 is connected to ground for the first IO decoder cage which has a high connected to the conductor 581 while the conductor 582 is connected to a high level for the succeeding three IO decoder cages while the conductor 581 is connected to a low level for the three succeeding IO decoder cages. Thus, in effect AND gates 505 and 506 are enabled by the terminal annotated Use $A_7$ and $A_8$ on the first IO decoder cage in a string so that a decoding of address bits $A_8$ and $A_7$ may be conducted thereat while the conductor 581 is low for the next three IO decoder cages so that the address information applied to AND gates 505 and 506 is employed in the resulting decode carried on at the decoder cage. Conversely, AND gates 507 and 508 are enabled in the three succeeding IO decoder cages by a high connected to the conductor 582 so that select information introduced on the conductors 587 and 588, as developed from the preceding IO decoder cage, is employed in the resulting decode.

The output of the AND gate 505 is connected through a conductor 590 to one input of an OR gate 509 while the output of the AND gate 507 is connected through a conductor 591 to a second input of the OR gate 509. Similarly, the output of the AND gate 506 is connected through a conductor 592 to one input of an OR gate 510 while the output of AND gate 508 is connected through a conductor 593 to the second input of the OR gate 510. Therefore, since both the OR gates 509 and 510 act in the conventional manner to produce a high at the output thereof anytime either of the inputs thereto are high it will be appreciated that OR gate 509 acts in the first IO decoder cage to produce a level at the output thereof which corresponds to the level of address bit $A_7$ since for the first IO decoder cage AND gate 505 is enabled by a high on conductor 581 while in the second, third and fourth IO decoder cages OR gate 509 will act to produce a level at the output thereof which corresponds to the select One input supply to AND gate 507 on conductor 587 since for the latter three IO decoder cages AND gate 507 is enabled by a high on conductor 582 while the AND gate 505 is disabled due to a low on conductor 581. Accordingly, the output of the OR gate 509 as present on conductor 559 reflects the bit condition of address $A_7$ for the first IO decoder cage while it reflects the condition of the select One input on conductor 587 for the second, third, and fourth IO decoder cages.

For the same reasons, the output of the OR gate 510 as applied to conductor 594 reflects the input condition of address bit $A_8$ in the first IO decoder cage while reflecting the input condition of the select Two input to AND gate 508 as present on conductor 588 for the second, third and fourth IO decoder cages in the string. The output of the OR gate 509 is connected through the conductors 559 and 595 to the input of the AND gates 511 and 512 while the output of the OR gate 510 is connected through conductors 594 and 560 to the inputs of the same AND gates 511 and 512. The AND gate 512 it will be recalled generates a cage select output which is applied through conductors 577 and 578 to the D input of the IO reply flip flop 570. This cage select input only occurs when the IO decoder cage in which the AND gate 512 resides has been selected. Since both the outputs of the OR gates 509 and 510 are supplied as inputs to the AND gate 512 it will be appreciated that the input conditions on this AND gate are such that a cage select signal is only generated thereby when both the outputs of the OR gates 509 and 510 are high to thus indicate that a given IO decoder card in which these two AND gates reside has been selected by either the direct address obtained from the most significant bits and an address presently on the B bus or through select information developed therefrom from preceding IO decoder cages. Similarly, the outputs of both OR gates 509 and 510 are supplied through conductors 559, 594 and 560 to the two lower inputs of the AND gate 511. The AND gate 511 it will be recalled supplies an enabling signal to the AND gate 562 which gates write clock information to the AC driver associated with this IO decoder cage when a write command is present, and the IO decoder cage in which it resides has been selected in a recently issued address which is not a general reset condition. Thus, the input conditions on AND gate 511 are such that the output of both OR gates 509 and 510 must be high to produce the appropriate IO decoder cage select information. Thus, it will be appreciated by those of ordinary skill in the art that the given IO decoder card is selected when both of the outputs of the OR gates 509 and 510 are high as present on conductors 559 and 594 regardless of whether or not address bits $A_7$ and $A_8$ were employed in the decode occurs for the first IO decoder cage or whether select One or select Two inputs as applied to conductors 587 and 588 were employed for the purpose of decoding. Furthermore, it will be appreciated that the select One input and select Two input in information present on the conductors 587 and 588 is developed on the succeeding IO decoder cage.

The outputs of the OR gates 509 and 510 which define select One and select Two information as indicated are supplied through conductors 596 and 597 to an increment by one circuit from which select One and select Two outputs as present on conductors 583 and 584 are developed and applied as select One and select Two inputs to the succeeding IO decoder cage. Thus, the outputs on conductors 584 and 583 for the first IO decoder cage serve as inputs on conductors 587 and 588 to the second IO decoder cage, the outputs on conductors 583 and 584 of the second IO decoder cage serve as inputs on conductors 587 and 588 to the third IO decoder cage and the outputs on conductors 583 and 584 for the third IO decoder output cage serve as inputs on conductors 587 and 588 to the fourth IO decoder cage.

The increment by one circuit employed to develop select One and select Two output information from the select One and select Two information on conductors 596 and 597 comprises an inverter 598, and AND gate 513, an AND gate whose inputs are inverted 514 and an OR gate 515. More particularly, the operation of the increment by one circuit formed by the gates 513 - 515 and the inverter 598 is such that select information present on conductor 596 is inverted by the inverter 598 and supplied directly through the conductor 583 to the select One output, for application to the next IO decoder cage. In addition, the output of the inverter 598 is connected through the conductors 599 and 600 to one input of the AND gate 513 and a second input of the AND gate 514 whose inputs are inverted. Similarly, the select Two information on conductor 597 is supplied through the conductors 601 and 602 to a second input of the AND gate 513 and a second input of the AND gate 514 whose inputs are inverted. The AND gate 513 acts in the conventional manner to produce a high at the output thereof connected to conductor 603 only while both of the inputs thereto are high while conversely the AND gate 514 whose inputs are inverted acts in the conventional manner to provide a high at the output thereof connected to conductor 604 only when both of the inputs thereto on conductors 599 and 602 are low. The output of the AND gate 513 is applied through conductor 603 to one input of an OR gate 515 while the output of the AND gate 514 whose inputs are inverted is supplied through a conductor 604 to a second input of the OR gate 515. The OR gate 515 acts in the conventional manner to supply a high at the output thereof connected to conductor 584 which defines select two output information for the IO decoder in which it resides anytime either of the inputs thereto on conductors 603 or 604 goes high.

The operation of the increment by one circuit formed by the gates 513 - 515 and 598 is conventional in that the primary condition of the select Two and select One input information applied thereto on conductors 597 and 596 are incremented by One and supplied at the outputs thereof on conductors 583 and 584. Thus, if a 00 combination is input on conductors 597 and 596, a 01 output combination will be applied to conductors 584 and 583 while if a 01 input combination is applied on conductors 597 and 596 a 10 output combination will result on conductors 584 and 583 and similarly, if a 11 input combination is applied on conductors 597 and 596 a 00 output combination will result on conductors 584 and 583.

The operation of the gate select logic associated with the gates 505 - 515 may best be appreciated by a description of the operation thereof which illustrates the manner in which select information is generated to provide a select or non-select condition on conductors 559 and 594 while select information for the next succeeding IO decoder cage is developed on output conductors 583 and 584. The decoding arrangement employed assumes that a 11 combination for address bits $A_8$ and $A_7$ defines the first IO decoder card, a 10 combination for address bits $A_8$ and $A_7$ defines the second IO decoder card, a 01 combination for address bits $A_8$ and $A_7$ defines the third IO decoder cage while a 00 combination for address bits $A_8$ and $A_7$ defines the fourth IO decoder cage. The description of the operation of the gate select logic associated with gates 505 - 515 will be set forth in conjunction with a Table I below. In Table I, the various columns set forth from left to right indicate whether a given cage is selected, the number of that cage, the bit content of address bits $A_8$ and $A_7$, the select Two and select One inputs applied to that cage for that address, the select Two and select One information developed on conductors 559 and 594 as a result of the address or the select input information and the select Two out and select One out output information developed on conductors 583 and 584 for application to the next succeeding IO decoder cage as a result of the action of the increment by one circuit on the select information which resides on conductors 596 and 597.

TABLE I

| Row Number | Cage Selected | Cage No. | $A_8$ | $A_7$ | $S_2$ in | $S_1$ in | Select 2 | Select 1 | $S_2$ out | $S_1$ out |
|---|---|---|---|---|---|---|---|---|---|---|
| 1 | Yes | 1 | 1 | 1 | X | X | 1 | 1 | 0 | 0 |

TABLE I-continued

| Row Number | Cage Selected | Cage No. | $A_8$ | $A_7$ | $S_2$ in | $S_1$ in | Select 2 | Select 1 | $S_2$ out | $S_1$ out |
|---|---|---|---|---|---|---|---|---|---|---|
| 2 | No | 2 | X | X | 0 | 0 | 0 | 0 | 0 | 1 |
| 3 | No | 3 | X | X | 0 | 1 | 0 | 1 | 1 | 0 |
| 4 | No | 4 | X | X | 1 | 0 | 1 | 0 | 1 | 1 |
| 5 | No | 1 | 1 | 0 | X | X | 1 | 0 | 1 | 1 |
| 6 | Yes | 2 | X | X | 1 | 1 | 1 | 1 | 0 | 0 |
| 7 | No | 3 | X | X | 0 | 0 | 0 | 0 | 0 | 1 |
| 8 | No | 4 | X | X | 0 | 1 | 0 | 1 | 1 | 0 |
| 9 | No | 1 | 0 | 1 | X | X | 0 | 1 | 1 | 0 |
| 10 | No | 2 | X | X | 1 | 0 | 1 | 0 | 1 | 1 |
| 11 | Yes | 3 | X | X | 1 | 1 | 1 | 1 | 0 | 0 |
| 12 | No | 4 | X | X | 0 | 0 | 0 | 0 | 0 | 1 |
| 13 | No | 1 | 0 | 0 | X | X | 0 | 0 | 0 | 1 |
| 14 | No | 2 | X | X | 0 | 1 | 0 | 1 | 1 | 0 |
| 15 | No | 3 | X | X | 1 | 0 | 1 | 0 | 1 | 1 |
| 16 | Yes | 4 | X | X | 1 | 1 | 1 | 1 | 0 | 0 |

X - Dont't Care
Rows 1, 5, 9 and 13 will utilize the "use $A_7$ and $A_8$" (Cage #1)
Rows 2, 3, 4 - 6, 7, 8 - 10, 11, 12 - 14, 15, 16 will utilize the "Do not use $A_7$ and $A_8$"

Referring now to Table I in conjunction with the portion of FIG. 8 associated with the cage select logic it will be recalled that a 1 1 condition for address bits $A_8$ and $A_7$ will select the first IO decoder in a string while the last three IO decoders will not be select. Therefore, moving across the top row of Table I and viewing the cage select logic indicated by the gates 505 - 515 in FIG. 8 it will be seen that when the condition of address bits $A_7$ and $A_8$ are 1 1, the AND gates 505 and 506 will each produce a high at the outputs thereof due to the high input conditions associated with the first IO decoder cage on conductor 581 to produce a high on conductors 590 and 592. The outputs of the AND gates 507 and 508 however will be low since a low is present on the input conductor 582 for the first card and select inputs will not be present for this card on conductors 587 and 588. Thus, a pair of highs are provided to each of the OR gates 509 and 510 on conductors 590 and 592 while lows are applied to OR gates 509 and 510 on conductors 591 and 593. Since a high is applied to one input of each of the OR gates 509 and 510, the select One and select Two levels for this IO decoder cage as present on conductors 559 and 594 will both be in a 1 condition as indicated in the top row of Table I whereupon this card will be selected causing an enabling of the inputs to AND gates 511 and 512. When the 1 1 condition of the select One and select Two levels on conductors 559 and 594 are applied to the increment by one circuit the select One output becomes 0 due to the action of the inverter 598 while the select Two output is also 0 since a 1 0 or 0 1 combination is applied to each of the AND gates 513 and 514 so that both of the outputs thereto are low. Thus, as indicated by the first row of Table I when the $A_8$ and $A_7$ address bits are each in a 1 condition and the $S_2$ in an $S_1$ in inputs on conductors 587 and 588 are in a 0 condition, the cage is selected due to One levels at each of the select One and select Two conductors 559 and 594 and the select One out and select Two out outputs which are supplied to the second IO decoder card in a string are incremented by one so that a 00 input is supplied to the second IO decoder card in the string.

Turning now to the second row of Table I it will be seen that when address bits $A_7$ and $A_8$ are in a 11 condition cage number 2 will not be selected. This occurs, because for cage number 2, a low is present on the conductor 581 which disables the AND gates 505 and 506 regardless of the inputs associated with the address on conductors 585 and 586. Hence the output of each of the AND gates 505 and 506 on conductors 590 and 592 is 0. Similarly, while the enabling input to AND gates 507 and 508 on conductor 582 is high, the select One inputs and select Two inputs for the second cage has developed from the select One and select Two outputs of the first cage are in a 00 condition as indicated in row 2 of Table I. Under these conditions the output of the OR gates 509 and 510 will be in a 00 condition to produce 00 values on select lines 559 and 594 whereupon the IO decoder cage is not selected for the instant condition of address bits $A_8$ and $A_7$ being discussed. The second IO decoder cage under these conditions will develop on a 10 condition for the select One and select Two outputs as indicated by the last two columns of row 2 which select outputs are supplied as inputs to the third IO decoder cage.

Running across the third row of Table I it will be seen that when the select One and select Two outputs developed at the output of the second IO decoder cage are supplied as inputs to the third IO decoder cage as indicated the select One and select Two lines will be in a 1 0 condition which will not select the chip and the resulting select Two and select One outputs developed by the increment by one circuit will cause the $S_2$ and $S_1$ outputs to be in a 1 0 condition. Similarly, when these inputs are applied to the select One and select Two inputs of the fourth IO decoder cage a 1 0 condition will occur on the select Two and select One lines 594 and 559 which will also preclude this IO decoder cage from being selected and the fourth IO decoder cage will produce a 1 1 condition for the select Two and select One outputs developed thereby. Accordingly, it will be appreciated from the first four rows of Table I that when a 1 1 condition resides in address bits $A_8$ and $A_7$ only the first IO decoder cage will be selected due to the 1 1 condition at the outputs of OR gates 509 and 510 while the action of the increment by one circuit formed by the gates 513 - 515 and the inverter 598 will cause a 0 0 $S_1$ and $S_2$ output to be developed at the select outputs of the initial IO decoder cage and this address will be incremented by one at each succeeding IO decoder cage but will not result in the enabling of any succeeding IO decoder cage but the first when the most significant address bits $A_8$ and $A_7$ are in a 1 1 condition.

Similarly, when the second IO decoder cage in a string is to be selected a 1 0 condition obtains for address bits $A_8$ and $A_7$ as indicated by row 5 of Table I. At the first IO decoder cage whose relevant values are set forth in row 5 the 10 condition of address bits $A_8$ and $A_7$ are employed in the decoder while the condition of the $S_2$ and $S_1$ inputs are not used and in any event are in a 0 condition. This will result in a 10 condition on the select lines 594 and 559 and a resulting address of 11 at the select Two and select One outputs on conductors 583 and 584. Thus under these conditions the first IO decoder cage is not selected when a 10 condition is present for address bits $A_8$ and $A_7$. Turning however to row 6 it will be seen that when the 11 condition of the select Two and select One outputs from the first decoder cage are supplied as inputs $S_2$ in and $S_1$ in to the second IO decoder cage, a 11 condition will obtain on the select Two and select One lines which causes the cage to be selected. In addition, the 11 condition of the select two and select one lines are incremented by one to obtain the resulting 00 condition for the $S_2$ out of the $S_1$ out. Thus as indicated by row 6 when a 10 condition is present for address bits $A_8$ and $A_7$, the initial IO decoder card is not selected but the $S_2$ and $S_1$ outputs developed therefrom will cause the second IO decoder cage to be selected. Furthermore, as indicated by rows 7 and 8, the succeeding incremented by one $S_2$ and $S_1$ outputs are insufficient to cause the enabling of the third and fourth IO decoder cages when a 10 address is supplied for the address bits $A_8$ and $A_7$ which are to cause the enabling of the second IO decoder card in a string.

Now considering rows 9 through 12 of Table I it will be seen that when a 01 address is supplied for address bits $A_8$ and $A_7$ the third IO decoder card is to be enabled. Thus, at the first card selection does not occur due to the 01 condition on select lines 2 and 1 and the select Two and select One outputs of 10 developed therefrom are insufficient to enable the second card. However, the 11 condition of the select two and select one outputs from the second IO decoder cage are sufficient to cause an enabling of the third IO decoder cage due to the 11 condition on the select Two and select One lines indicated. The resulting $S_2$ and $S_1$ output from the third or enabled IO decoder cage is again incremented by one from the address on the select lines and hence the fourth IO decoder cage remains disabled under these conditions.

Finally, when a 00 address is present for address bits $A_8$ and $A_7$ the initial IO decoder cage whose parameters are illustrated in row 13 is not enabled due to the 00 condition on the select lines. Furthermore, the sequential incrementing by one action of the increment by one circuit employed to develop the $S_2$ and $S_1$ outputs at each cage are sufficient here to provide a 11 condition at the output of the third IO decoder cage whose parameters are set forth for these address bit conditions in row 15. Therefore, as may be seen in row 16, the fourth IO decoder cage is enabled due to a 11 condition on select lines 1 and 2. Accordingly it will be appreciated from Table I that the stratified decoding technique employed in the embodiment of the invention illustrated in FIG. 8 will cause the first IO decoder card in a series of four to be enabled when address bits $A_8$ and $A_7$ are in a 11 condition, the second IO decoder cage to be enabled when the address bits $A_8$ and $A_7$ are in a 10 condition, the third IO decoder cage to be enabled when the address bits $A_8$ and $A_7$ are in a 01 condition and the fourth IO decoder cage to be enabled when the address bits $A_8$ and $A_7$ are in a 00 condition.

The exemplary IO decoder illustrated in FIG. 8 thus acts in response to 9 bits of address information to select one of four cages for writing or reading purposes as well as one of 16 cards within the selected cage and one of 8 circuits within the selected card so that a unique circuit of a possible 512 circuits is selected for the exclusive purpose of reading or writing. In addition, the writing mode associated with the AC drivers is distinguished from the reading mode associated with the AC receivers due to the action of the IO decoder illustrated in FIG. 6 in responding to a write command under appropriate conditions for the IO decoder cage selected to produce a write clock on conductor 564 which is tested for by the AC driver associated with the selected cage. Additionally, data out, IO reply and clear/reset information is developed at the outputs of the IO decoder illustrated in FIG. 8 to ensure appropriate peripheral timing within the instant invention as well as to achieve clearing operations within selected AC drivers. The utilization of the outputs developed along the right hand portion of FIG. 8 will be appreciated in association with FIGS. 9 and 10.

AC DRIVER ARRANGEMENT

Referring now to FIG. 9, there is shown a block diagram schematically illustrating a portion of an AC driver arrangement for outputting commands decoded by the input/output decoder arrangement illustrated in FIG. 8. More particularly, it will be recalled from the description of the IO decoder cages set forth in conjunction with FIG. 8 that four AC driver cages are employed within the instant embodiment of the present invention wherein one AC driver cage is connected to receive outputs from each of the IO decoder cages. Furthermore, each AC driver cage includes sixteen AC driver cards and each driver card includes eight AC driver circuits so that each AC driver cage provides 128 discreet sootblower outputs and the sum of the four is capable of energizing up to 512 sootblowers. The portion of the AC driver arrangement for outputting commands decoded by the input/output decoder arrangement illustrated in FIG. 8 comprises one of the sixteen cards present in a driver cage and thus it will be appreciated that while only one card is illustrated in FIG. 9, sixteen cards are present in each AC driver cage and is separately energized by one of the card select outputs provided by the card select decoder means 502 illustrated in FIG. 8 so that each cage provides up to 128 discrete circuit outputs and four cages, one associated with each IO decoder cage, may be utilized within the present embodiment of the instant invention. Since only a single AC driver card is illustrated in FIG. 9 it will be appreciated by those of ordinary skill in the art that the remaining fifteen AC driver cards within a given AC driver cage is formed in an identical manner to that illustrated in FIG. 9 with the single exception that each driver card receives a different card select input from the output of the IO decoder cages associated therewith. The AC driver card illustrated in FIG. 9 comprises eight identical AC driver circuits indicated by the dashed blocks 611 - 618 wherein each AC driver circuit 611 - 618 is identical in construction and provides a single output which is connected to a given sootblower in the system which is started thereby. Each of the eight AC driver circuits illustrated in FIG. 9 receives a circuit select input CKT-1 - CKT-8 at the inputs thereto provided by the conductors $619_1$ - $619_8$. These inputs to the AC driver card illustrated in FIG. 9 are supplied from the circuit select decoder 501 illustrated in FIG. 8 and would be applied in parallel to each AC driver card within a given AC driver cage. The circuit select inputs supplied on the conductors $619_1$ - $619_8$ are applied to a first input of an AND gate $620_1$ - $620_8$ in each of the AC driver circuits indicated by the dashed blocks 611 - 618.

In addition, each of the AND gates $620_1$ - $620_8$ has its second input commonly connected to a card select input applied to the conductor 621. The card select input applied to conductor 621 is supplied from a given one of the sixteen card select outputs developed by the card select decoder 502 at the IO decoder illustrated in FIG. 8 and it will be appreciated by those of ordinary skill in the art that while each of the sixteen driver cards in a given AC driver cage would be connected in parallel to the circuit select inputs supplied on conductors $619_1$ - $619_8$, each card would have its initial set of AND gates $620_1$ - $620_8$ connected through a conductor 621 to a different one of the sixteen card select outputs provided by the output of the card select decoder 502 illustrated in FIG. 8 so that only one of the 128 circuits in a sixteen card array would have both of the inputs to the AND gates $620_1$ - $620_8$ enabled indicating that one circuit out of the 128 available has been selected.

Each of the AND gates $620_1$ - $620_8$ may comprise a conventional two input AND gate which produces a high at the output thereof only when both of the inputs thereto are high. The outputs of each of the AND gates $620_1$ - $620_8$ are connected through the conductors $622_1$ - $622_8$ and $623_1$ - $623_8$ to an input of one of the AND gates $624_1$ - $624_8$ and $625_1$ - $625_8$ respectively. Accordingly, when any of the AND gates $620_1$ - $620_8$ have highs placed on both of the inputs thereto indicating a selection of that circuit at that cage, a high will be applied on the appropriate one of the outputs connected to the conductors $622_1$ - $622_8$ to apply a high to one input of the connected one of the AND gates $624_1$ - $624_8$ while this same high at the output of a selected AND gate will be supplied through an appropriate one of the conductors $623_1$ - $623_8$ to place a high at one of the inputs to the AND gates $625_1$ - $625_8$.

Each of the AND gates $624_1$ - $624_8$ and $625_1$ - $625_8$ are conventional two input AND gates wich produce a high at the outputs thereof only when both of the inputs thereto go high. A second input to each of the AND gates $624_1$ - $624_8$ is commonly connected through a conductor 626 to the terminal annotated write clock. A write clock it will be recalled is produced by a selected IO decoder cage as illustrated in FIG. 8 in response to the issuance of a write command and the selection of that IO decoder cage. Accordingly, an appropriate one of the AND gates $624_1$ - $624_8$ will be enabled when the circuit in which it resides has been selected through the application of two highs to the appropriate one of the AND gates $620_1$ - $620_8$ and a write command has been issued to the IO decoder cage connected thereto. When both of these conditions are present, the output of the AND gates $624_1$ - $624_8$ will go high for the duration of the write clock signal supplied on the conductor 626 which has a pulse width of approximately 1 microsecond. The output of the AND gates $624_1$ - $624_8$ are connected through conductors $627_1$ - $627_8$ to clock inputs of the flip flop $628_1$ - $628_8$. The flip flops $628_1$ - $628_8$ may each take the form of conventional clocked flip flops such as model SN 7474 flip flops as available from the Texas Instrument Corporation, as aforesaid. Each of the flip flops $628_1$ - $628_8$ has its reset input commonly connected through the conductor 629 to a terminal annotated clear/reset. The clear/reset input which is applied to conductor 629 is developed, it wll be recalled, as an output from the IO decoder cage illustrted in FIG. 8 as a function of either a reset command generated by the computer or a general reset address which decodes as the 511 address handled by the reset decoder 503. Furthermore, it should be appreciated that the clear/reset input on conductor 629 would be connected in the same manner illustrted in FIG. 9 to each card within the AC driver cage connected to a given IO decoder cage and hence any time this clear/reset signal is generated the state of each of the flip flop $628_1$ - $628_8$ in each of the sixteen AC driver cards in a given cage will be reset to a cleared or zero state.

The D input to each of the flip flop $628_1$ - $628_8$ is connected through a conductor 630 to a terminal annotated DATA IN which connects to the data in conductor within the B bus. The condition of the data input on conductor 630 is thus directly set by the programmable controller 1 or emergency manual so that the state of a given flip flop $628_1$ - $628_8$ in any of the 128 circuits in any of the four AC driver cages may be simply set merely by addressing a given circuit through the nine bit address $A_0$ - $A_8$ issued thereby, issuing a write command so that the output of an appropriate one of the AND gates $624_1$ - $624_8$ is enabled and imposing a 1 or 0 level on the conductor 630 so that when a clocking level appears on conductor $627_1$ - $627_8$ the condition at the D input to each of the flip flop $628_1$ - $628_8$ will be latched into the flip flop which is clocked through the imposition of the address and write commands. Thus, the condition of any of the flip flops within any selected AC driver circuit may be readily set by the programmable controller or emergency manual by the issuance of an appropriate address therefor, a write command, and the imposition of the 0 or 1 level desired to be written onto the data in conductor 630; it being appreciated by those of ordinary skill in the art that when a 1 is writted into any of the flip flops $628_1$ - $628_8$ that flip flop is conditioned to either initialize a sootblower associated with the circuit in which it resides or is conditioned to indicate the active state of a sootblower for display purposes associated with the sequence checks and the like. The output of each of the flip flops $628_1$ - $628_8$ is connected through conductors $631_1$ - $631_8$ and $632_1$ - $632_8$ to respective ones of the inputs to AND gates $633_1$ - $633_8$ and $625_1$ - $625_8$, respectively. The function of the AND gates $633_1$ - $633_8$ within each AC driver circuit is to actuate the operation of the particular sootblower connected to that AC driver circuit while the function of the AND gates $625_1$ - $625_8$ is to provide output information on the B bus indicative of the condition of any AC driver circuit which the programmable controller addresses.

For instance, it was seen in the description associated with each of the circuit flip flops $628_1$ - $628_8$ that any of up to 512 AC driver circuits may be set or reset by the programmable controller or emergency manual by the issuance of an appropriate address, a write command which is reflected as a write clock on conductor 626 and the issuance of a 1 or 0 condition on the data in conductor 630 which is to be clocked into the address flip flop circuits $628_1$ - $628_8$. This setting or resetting of the flip flops $628_1$ - $628_8$ may be performed by the programmable controller 1 or emergency manual for the purpose of initiating sootblower operation through the actuation of a sootblower connected to a respective one of the AC driver circuits in which information is latched in the flip flop $628_1$ - $628_8$ or alternatively, the condition of this flip flop may be set from storage tables as a function of any of a plurality of check operations which may be initiated by the operator from the information input panels illustrated in FIGS. 2A through 2C. Accordingly, if it is desired to merely read the state of a given flip flop $628_1$ – $628_8$ in a selected AC driver circuit, it will be seen that the 1 or 0 output condition of each of the flip flop $628_1$ – $628_1$ is applied to one input of the AND gate $625_1$ – $625_8$ through a conductor $632_1$ – $632_8$. In addition, it will be recalled that the second input to the AND gates $625_1$ – $625_8$ is supplied from the output of the AND gates $620_1$ – $620_8$ through the output conductors $623_1$ – $623_8$. Therefore, as the output of any of the AND gates $625_1$ – $625_8$ which is conveyed onto the conductor 634 will follow the output of the flip flop $628_1$ – $628_8$ connected thereto if that circuit is addressed producing a high on the conductors $623_1$ – $623_8$, it will be appreciated that merely by issuing the appropriate address the programmable controller may cause the condition of any of the flip flop $628_1$ – $628_8$ to be gated onto the conductor 634 through the appropriate one of the AND gates $625_1$ – $625_8$. This means, that for the purposes of a sequence check, a delete check, an enable check or similar other check conditions which may be initiated at the information input panels illustrated in FIGS. 2A and 2C, the programmable controller merely acts to set or reset the flip flops within the specific circuits associated with specific sootblowers to the 1 or 0 condition indicated in tables for the check being performed and after a complete setting operation has been established will cause the state of those flip flops to be read in an appropriate sequence through its associated AND gates $625_1$ – $625_8$ onto the conductor 634. The conductor 634 is connected to one input of an AND gate 635 while the second input thereto is connected through a conductor 636 to a terminal annotated READ OUTPUTS.

The read outputs terminal connected to conductor 636 is connected to a conductor within the B bus which is connected directly to the programmable controller 1 and receives therefrom gating information timed to correspond to the reading of the state of an addressed flip flip within an addressed AC driver circuit whenever it is desired to ascertain the state of that flip flop such as would normally follow a setting sequence associated with a check preview operation initiated at one of the information input panels illustrated in FIGS. 2A – 2C. Therefore, as the AND gate 635 is a conventional AND gate it will be appreciated that the output thereof which is applied to conductor 637 will follow the condition of the conductor 634 whenever a high is present on conductor 636. The conductor 637 annotated DATA OUT is connected to the B bus and is coupled therethrough, it will be recalled, to both the programmable controller and to the data out input on conductor 399 for the display decoder illustrated in FIG. 7. Furthermore, a recollection of the description of FIG. 7 will disclose that the data out input is employed to latch a 1 or 0 condition into an addressed one of the flip flops to drive the display illustrated in FIG. 6.

Thus, typically, in a check situation, the programmable controller draws from tables all information associated with the check which the operator desires to preview and would set the flip flops $628_1$ – $628_8$ within each of the driver cages to the appropriate condition specified in the table for the check condition initiated. For instance, if an operator initiated an enable check One's would be written into each of the flip flops $628_1$ – $628_8$ in all of the AC driver cards where the sootblower associated therewith was enabled while zeros would be written into each flip flop associated with a disabled sootblower. After this operation had been completed, the condition of each flip flop would be read by addressing the circuit without the issuance of a write command while a read output level was imposed on the conductor 636 to correspond to the addressing of that flip flop for read purposes. The address issued would cause whatever One or Zero information was present in the flip flop to be applied to conductor 637 as the One or Zero condition of the address flip flop while the same address information processed in the manner associated with the display decoder and drive array would cause the information on the data out input to FIG. 7 to be latched into a flip flop associated with the indicia in the display which was addressed. Under these circumstances, it will be appreciated that the check information would be set forth at the display illustrted in FIG. 6 while the operational condition of sootblowers actually involved in current operations would remain undisturbed. Where checks of a sequential nature were to be initiated, the writing into the flip flops $628_1$ – $628_8$ would occur in the sequence indicated by the information in storage and after information associated with each sequence has been written, a reading and subsequent display thereof would occur. Thus in this manner, the programmable controller 1 may withdraw status information on sootblowers which is completely unassociated with current operational information and employ a selective setting of the conditions of the flip flops $628_1$ – $628_8$ together with the subsequent reading of the states thereof and the gating of this information onto the data out conductor 637 to initiate and maintain display conditions which are completely capable of previewing the operation for which the check was imposed at the information inputs illustrated in FIGS. 2A and 2C.

The AND gates $633_1$ – $633_8$ are employed for the purposes of initiating start signals to sootblowers connected to the rear respective ones of the AC driver circuits for which the flip flops $628_1$ – $628_8$ have been set to a 1 condition. Furthermore, the gating here is such that a plurality of sootblowers may have start operations initiated therefor in a concurrent manner. More particularly, for a start up operation, each of the flop flops assigned to specific sootblowers which are to be initiated is placed in a 1 condition through the application and issuance of an appropriate address, write command and data in inputs to the B bus, all of which occur under the control of the programmable controller 1, under these circumstances. Once a sequence of sootblowers and the flip flops $628_1$ – $628_8$ in the AC driver circuits assigned thereto are set in a state, the output condition of these flip flops will be applied through the conductor $631_1$ – $631_8$ to one input of the AND gates $633_1$ – $633_8$. The second input to each of the AND gates $633_1$ – $633_8$ is commonly connected through a conductor 638 to a terminal annotated OUTPUT ENABLE. This terminal is connected to the output enable conductor within the B bus which is set by the programmable controller 1 to a One level when it is desired to output start instructions to a sequence of sootblowers for which start instructions have already been written into the associated ones of the flips flops $628_1$ – $628_8$. When a one level is present on the conductor 638, each of the AND gates $633_1$ – $633_8$ in all of the AC driver cards at each AC driver cage will be primed so that its output connected to conductors $639_1$ – $639_8$ will follow the input applied thereto through conductors $631_1$ – $631_8$ which represents the One or Zero condition of the flip flop within the circuit in which it resides. If a One condition resides in the flip flop $628_1$ – $628_8$ within the AC driver circuit assigned thereto, the imposition of a One on the conductor 638 will cause a One lever to be applied to the output conductor $639_1$ - $639_8$ in the AC driver circuits assigned to a sootblower which is to be started.

When a 1 occurs on any of the conductors $639_1$ - $639_8$ the photocoupled AC driver circuits $640_1$ - $640_8$ are energized whereupon the 120 volt energizing lever is supplied to the output conductor $641_1$ - $641_8$ connected thereto. The AC outputs which are supplied on conductor $641_1$ - $641_8$ are connected directly to individual sootblowers assigned to the individual ones of the AC driver circuits and are responsive to the AC driver signal present on the conductor $641_1$ - $641_8$ to initiate the operation of the sootblower connected thereto in a conventional manner which will be illustrated in an exemplary manner in conjunction with FIG. 11. Here however, it is sufficient to appreciate that when an AC driver circuit $640_1$ - $640_8$ causes an AC signal of 120 volts to issue at one of the conductors $641_1$ - $641_8$ the sootblower connected thereto will initiate an operational cycle assuming no malfunction condition exists.

The AC driver circuits $640_1$ - $640_8$ may take any conventional form of AC driver circuit which is responsive to a DC level in the form of a One level to produce 120 volt AC at the outputs thereof. However, as indicated in FIG. 9, it is preferred that the AC driver circuits $640_1$ - $640_8$ take the form of photocoupled AC driver circuits to ensure that the DC logic is isolated from the AC driver through the photocoupling techniques employed. In a practical embodiment of the invention which was built and tested, Motorola MCS-2 and M-28 photocoupled SCRs were employed to trigger a triac and thus achieve sootblower starting information from a totally solid state AC driver circuit having complete isolation. In such an arrangement, a light emitting diode is employed to trigger a silicon controlled rectifier and whenever the silicon controlled rectifier included within the photoisolation circuit is triggered, the output thereof may be employed to trigger a triac which acts, in this case, as an AC switch to directly apply AC voltage to the output conductors $641_1$ - $641_8$. Additionally, a full wave rectifier may be employed intermediate the output of the SCR and the input to the triac to enhance triggering while a surge suppressor is employed across the output of the triac to prevent false transient triggering of the triac. A RC snubber network may be employed to smooth the output voltage.

The portion of the AC driver arrangement illustrated in FIG. 9 will thus demonstrate that each of the four AC driver cages employed within the instant invention is responsive to the card select, and circuit select information generated at each IO decoder cage to address a specific AC driver circuit which is associated with and is capable of providing outputs to a given sootblower within the system there being one AC driver circuit which is uniquely addressable provided for each sootblower in the system. Furthermore, each AC driver circuit includes a latch in the form of a clocked flip flop which is uniquely addressable for writing or reading purposes and the mode of reading the output of each latch is such that the output thereof may be employed either to initiate the operation of a given sootblower within the system which is assigned to that AC driver circuit or alternatively may be employed to supply a data out condition for latching display information into the boiler diagram and display panel. Thus, in this mode the display is not associated with current operation but instead synthesized displays associated with check modes of operation and the like may be generated at the AC driver arrangement illustrated in FIG. 9 during such times as the AC driver is not involved with the starting of sootblowers which often occurs since once the sootblower is started the same must run through its predetermined cycle of operation. In addition, once start up information has been latched into the AC driver arrangement illustrated in FIG. 9 an output enable command, issued by the programmable controller, is capable of causing latched information to be simultaneously conveyed to a plurality of associated AC driver stages to achieve the concurrent start up of an entire sequence of sootblowers.

THE AC RECEIVER ARRANGEMENT

Referring now to FIG. 10 there is shown a block diagram which schematically illustrates a portion of an AC receiver arrangement for receiving status information from associated sootblowing apparatus and supplying same, when appropriate, to the input/output decoder arrangement illustrated in FIG. 8. The AC receiver arrangement illustrated in FIG. 10 functions to receive sootblower in service information from each sootblower in the system and to selectively gate this information, as the same is addressed, onto the B bus for application to the data out conductor therein whereupon the same may be employed to latch display information into the display decoder and driver arrangement illustrated in FIG. 7. More particularly, each sootblower within the system is provided with a park limit switch of the type illustrated in FIG. 11 which provides an AC output whenever that sootblower is operating. The AC receiver illustrated in FIG. 10 receives the output of each park limit switch representing whether or not the given sootblower associated therewith is operating at an input circuit which is devoted to that particular sootblower. Each input circuit within the AC receiver is addressable and when the same is addressed will gate the operative or inoperative condition of the sootblower associated therewith onto the B bus as a One or Zero indication which may then be employed to set the latch within the display decoder and driver array illustrated in FIG. 7 so that each time a specific circuit within the AC receiver is addressed, current information representing the operative or inoperative state of the sootblowers associated therewith may be latched up for the display to provide current information for the indicia thereon. The AC receiver is normally addressed by the scanner multiplexer illustrated in FIG. 5 and hence when the controller has not disabled the scanner multiplexer for the purposes of starting sootblowers or for performing the various checks which may be initiated at the input panels illustrated in FIGS. 2A - 2C, sequential address as generated by the scanner multiplexer means illustrated in FIG. 5 on a periodic basis are employed to address each circuit within the AC receiver illustrated in FIG. 10 so that latched information in the boiler panel display diagram is maintained in current condition. It should also be appreciated at the outset that the address information generated by the scanner multiplexer illustrated in FIG. 5 is decoded by the IO decoder arrangement illustrated in FIG. 8 and that outputs therefrom in the form of circuit and card select information is directly applied to the AC receiver illustrated in FIG. 10 to cause the addressing of a particular circuit therein for output purposes. In addition, the programmable controller 1 can address the AC receiver to obtain current operative conditions and use this data to process individual alarm logic and for data logging processes.

The AC receiver arrangement illustrated in FIG. 10, depicts only eight AC receiver circuits associated with the given card employing the same illustrative technique utilized in regard to the AC driver circuits arrangement illustrated in FIG. 9. However, it will be appreciated by those of ordinary skill in the art that in actuality, sixteen AC receiver cards such as illustrated in FIG. 10 are employed for each AC receiver cage relied upon and the present invention envisions the use of up to four AC receiver cards. The interconnections of a card within a cage is identically the same as mentioned in regard to FIG. 9 in that circuit select inputs are connected in parallel while card select inputs are uniquely applied to each card and each cage thereby formed of sixteen cards is uniquely connected to an IO decoder cage in the same manner mentioned for the AC driver arrangements. Turning specifically to FIG. 10 it will be seen that the AC receiver card illustrated therein comprises a plurality of AC converters $\mathbf{644}_1$ - $\mathbf{644}_8$, a plurality of circuit select gates $\mathbf{645}_1$ - $\mathbf{645}_8$ and first and second output gating arrangements 646 and 647. Each of the plurality of AC converters $\mathbf{644}_1$ - $\mathbf{644}_8$ is associated with a specific sootblower within the system and receives therefrom operating or not operating information from the park limit switch associated with that sootblower. More particularly, whenever a sootblower is in operation within the instant invention, sootblower in service information in the form of a 120 volt AC signal is present at the park limit switch and is supplied therefrom to the AC converter $\mathbf{644}_1$ - $\mathbf{644}_8$ associated with that sootblower. Thus, as indicated in the exemplary AC receiver card illustrated in FIG. 10, each of the AC converters $\mathbf{644}_1$ - $\mathbf{644}_8$ is connected through a conductor $\mathbf{648}_1$ - $\mathbf{648}_8$ to the output of the park limit switch of the sootblower associated therewith as indicated by the terminals $PL_1$ - $PL_8$. Although a detailed description of a park limit switch arrangement for each sootblower will be set forth in conjunction with FIG. 11, it is here sufficient for an appreciation of the operation of the AC receiver card illustrated in FIG. 10 to understand that whenever a sootblower within the system is in operation a 120 volt AC signal indicative of a sootblower in operation condition is present at the park limit switch input thereof at the point in which the terminals annotated $PL_1$ - $PL_8$ are connected. Therefore, whenever a sootblower is in operation a 120 volt AC signal will be applied to the appropriate conductor $\mathbf{648}_1$ - $\mathbf{648}_8$ while when the sootblower is not operating no AC input will be present at the terminals $PL_1$ - $PL_8$.

The function of the AC converters $\mathbf{644}_1$ - $\mathbf{644}_8$ is to convert the AC input present on conductors $\mathbf{648}_1$ - $\mathbf{648}_8$ to a digital signal under such conditions that when 120 volts is present at any terminal $PL_1$ - $PL_8$ a One output in the form of a high level will be output from the AC converters $\mathbf{644}_1$ - $\mathbf{644}_8$ while when no AC input is supplied from the terminal $PL_1$ - $PL_8$, a Zero output will be supplied from the associated AC converters $\mathbf{644}_1$ - $\mathbf{644}_8$. The outputs of each of the AC converters $\mathbf{644}_1$ - $\mathbf{644}_8$ are connected through conductors $\mathbf{649}_1$ - $\mathbf{649}_8$ to one input of an associated one of the circuit select gate $\mathbf{645}_1$ - $\mathbf{645}_8$.

While any appropriate form of AC converter may be employed for use as the AC converters $\mathbf{644}_1$ - $\mathbf{644}_8$ illustrated in FIG. 10 so long as the same is capable of translating a 120 volt input signal to a binary One level at a magnitude capable of being handled by conventional logic elements photo isolation techniques similar to those employed for the gating of output information for the AC driver circuits illustrated in FIG. 9 are preferred to ensure that the logic is totally isolated from the AC circuits associated with the sootblowers. Therefore, while the AC converters $\mathbf{644}_2$ - $\mathbf{644}_8$ are merely illustrated in block form, an exemplary circuit arrangement for a preferred type of AC converter is shown within the dashed block $\mathbf{644}_1$; it being appreciated that such preferred circuit arrangement would be employed for the remaining AC converters $\mathbf{644}_2$ - $\mathbf{644}_8$. Thus, as shown within the dashed block $\mathbf{644}_1$ a preferred form of AC converter would comprise a full wave rectifier 650, a photo coupler 651 and an output driver stage 652. The full wave rectifier 650 may take any conventional form of this well known device which acts in the usual manner to full wave rectify any AC signals applied thereto. In addition, the input to the full wave rectifier 650 may include smoothing circuitry and/or a threshold detector to ensure that a 120 volt input is in fact being applied at the input conductor $\mathbf{648}_1$. The output of the full wave rectifier 650 is supplied through a conductor 653 to the input of the photo coupler 651. The photocoupler 651 may again take the form of a conventional photocoupling device wherein a light emitting diode is supplied with the output of the full wave rectifier 650 to trigger a light sensitive transistor or the like. Such photocoupling devices ensure complete electrical isolation between the AC input and the DC output through optical coupling techniques and are conventionally available. For instance, the photocoupler illustrated within FIG. 10 may take the form of a model MCT-26 photocoupler as conventionally available from the Motorola Company. Accordingly, whenever a 120 volt AC input is supplied at the input terminal $\mathbf{648}_1$ a One level will be applied to the output of the photocoupler 651 connected to conductor 654. This output of the photocoupler is applied through a conventional driver stage 652 to the output of the AC converter on conductor $\mathbf{649}_1$ it being appreciated that the driver stage 652 acts in the conventional manner to shape and raise the output of the photocoupler 651 to an appropriate logic level for application to the remaining logic circuitry employed with FIG. 10 and remaining portions of the instant invention. Thus, whenever an AC signal indicative that a sootblower is operative is applied to one of the input conductors $\mathbf{648}_1$ - $\mathbf{648}_8$ a One level is applied through the operation of the AC converter $\mathbf{644}_1$ - $\mathbf{644}_8$ to the outputs on conductors $\mathbf{649}_1$ - $\mathbf{649}_8$ and conversely when no AC level resides on the input conductors $\mathbf{648}_1$ - $\mathbf{648}_8$ a Zero level will reside on the output conductors $\mathbf{649}_1$ - $\mathbf{649}_8$.

The circuit select gates $\mathbf{645}_1$ - $\mathbf{645}_8$ are conventional two input AND gates which act in the usual manner to supply a high on the outputs thereof connected to conductors $\mathbf{655}_1$ - $\mathbf{655}_8$ whenever both of the inputs thereto are high. As one input to each of the circuit select gates $\mathbf{645}_1$ - $\mathbf{645}_8$ is connected at the first input thereto to conductors $\mathbf{649}_1$ - $\mathbf{649}_8$ it will be appreciated that whenever a sootblower with which a circuit select gate $\mathbf{645}_1$ - $\mathbf{645}_8$ is associated is operative a One will be applied to this input while when the associated sootblower is inoperative a Zero level will reside at the input to the circuit select gate $\mathbf{645}_1$ - $\mathbf{645}_8$ connected to conductor $\mathbf{649}_1$ - $\mathbf{649}_8$. The second input to each of the circuit select gate $\mathbf{645}_1$ - $\mathbf{645}_8$ is connected as indicated in FIG. 10, through their respective conductors $\mathbf{656}_1$- $\mathbf{656}_8$ to the circuit select outputs developed from the circuit select decoder 501 in FIG. 8. This means, as will be readily appreciated by those of ordinary skill in the art that only one of the circuit select gates $645_1$ - $645_8$ will be enabled by a high on one of the conductors $656_1$ - $656_8$ each time an address is issued and the enabled one of the conductors $656_1$ - $656_8$ will represent the circuit defined by the address currently on the B bus. Whenever a high resides on one of the circuit select inputs connected to conductor $656_1$ - $656_8$ the output of the circuit select gate $645_1$ - $645_8$ to which it is connected will be enabled to follow the input which resides on the conductor $649_1$ - $649_8$. Therefore, as only one of the circuit select gates $645_1$ - $645_8$ will be enabled to follow the inputs applied thereto on conductor $649_1$ - $649_8$ it will be appreciated that the output of the enabled gate which is connected to the one of the conductors $655_1$ - $655_8$ will reflect the operative or inoperative state of the sootblower being addressed as indicated by a One or Zero condition on that conductor. Furthermore, it will be appreciated by those of ordinary skill in the art that since sixteen AC receiver cards are employed per cage each of the circuit select inputs connected to each card at the terminals annotated CKT-1 - CKT-8 will be connected in parallel.

The first output gating arrangement 646 takes the form of an eight input or gate which acts in the conventional manner to produce a high at the output thereof connected to conductor 657 any time one of the inputs thereto go high. Therefore, as each of the inputs to the first output gating arrangement 646 are connected to one of the outputs of the AND gates $645_1$ - $645_8$ and only one of the AND gates $645_1$ - $645_8$ will be enabled in response to an address it will be seen that if a high is gated onto one of the conductors $655_1$ - $655_8$ it will be conveyed to the output of the first output gating arrangement 646 on conductor 657 to indicate that the sootblower addressed by the circuit select portion of the address is operative or conversely if a low occurs at the output of the first output gating arrangement 646 it will indicate that the sootblower addressed by the circuit portion of the address is inoperative.

The second output gating arrangement 647 is a three input AND gate which acts in the conventional manner to provide a high at the output thereof connected to conductor 658 only when all of the inputs thereto are high. The first input to the second output gating arrangement 647 is connected through conductor 657 to the output of the first output gating arrangement 646 and therefore it will be appreciated that the output of the second output gating arrangement 647 on conductor 659 will follow the inputs applied thereto only when the remaining two inputs to this gate are high. Thus when both the inputs on conductors 660 and 661 are high the operative or inoperative condition of the sootblower addressed by the circuit select inputs on conductor $656_1$ - $656_8$ will be gated to the output of the second output gating arrangement 647 on conductor 659. The second input to the second output gating arrangement 647 is connected through conductor 660 to a terminal annotated card select. This input terminal as will be appreciated by those of ordinary skill in the art is connected to one of the outputs of the card select decoder 502 in the IO decoder illustrated in FIG. 8 and hence this input on conductor 660 defines whether or not this card in the AC receiver cage has been selected. Thus, as each AC receiver cage will have sixteen cards and each card is provided with independent first and second output gating arrangements 646 and 647, it will be seen that the input to the second output gating arrangement 647 connected to the conductor 660 is connected to a different IO decoder cage output corresponding to the card addressed with bits $A_3$ - $A_6$ of the current address on the B bus. The third input to the second output gating arrangement 647 is connected through conductor 661 to a terminal annotated read inputs. The read input terminal is connected to the B bus and more particularly to a terminal therein wherein the controller defines whether a reading operation which is defined by the absence of a write command is to occur from the AC receiver cages associated with a particular decoder or the AC driver circuits. Thus as was seen in FIG. 9 when reading is to occur from the AC driver the read output conductor 636 is energized and similarly here when the reading is to occur from the AC receiver the read input terminal connected to conductor 661 is energized.

Thus, when the card illustrated in FIG. 10 is selected as indicated by the presence of a high on conductor 660 and a read operation from the AC receiver is desired as indicated by a high on the conductor 661, the operative or inoperative state of a sootblower whose circuit has been addressed will be gated through the first and second output gating arrangements 646 and 647 to the output conductor 659 annotated data out. This data out conductor is connected, to the data out conductor 637 illustrated in FIG. 9 and hence is supplied through the B bus as aforesaid to the data out input supplied to the latches in the IO decoder card and driver array illustrated in FIG. 7. This means, as was explained in conjunction with FIG. 9, when a given sootblower is addressed for a read input command the operative or inoperative status of that sootblower will be gated onto the data out conductor 659 in the form of a One or Zero and this One or Zero will be latched into the address indicia circuit within the display decoder and driver circuits to update the condition of the display so that the appropriate indicia in FIG. 6 may be illuminated or left unilluminated in response thereto. Thus in this manner the cyclic generation of addresses by the scanner multiplexer means together with the concurrent reading of addressed sootblowers from the AC receiver gates illustrated in FIG. 10 will result in constant updating of the boiler diagram and display panel illustrated in FIG. 6 so that an operator is constantly apprised as to the operative or inoperative condition of all sootblowers within the system. Accordingly, the AC receiver arrangement illustrated in FIG. 10 acts to supply through the data out conductor 659 current information as to the operative or inoperative state of addressed sootblower so that the display may be updated in response thereto while the AC driver illustrated in FIG. 9 acts to both start sootblowers upon command and to gate information associated with the status condition of blowers which has been stored in tables into the latches of the display so that the results of check procedures initiated at the information input panel may be displayed on a command basis while the periodic addresses generated by the scanner means illustrated in FIG. 5 and the operation of the AC receiver means illustrated in FIG. 10 ensures that when starting and check procedures are not occurring the display information reflects the current operational condition of the system. The data out can also be processed by the programmable controller 1 for alarm logic and data logging.

TYPICAL SWITCHING ARRANGEMENT FOR SOOTBLOWERS

Figure 11:
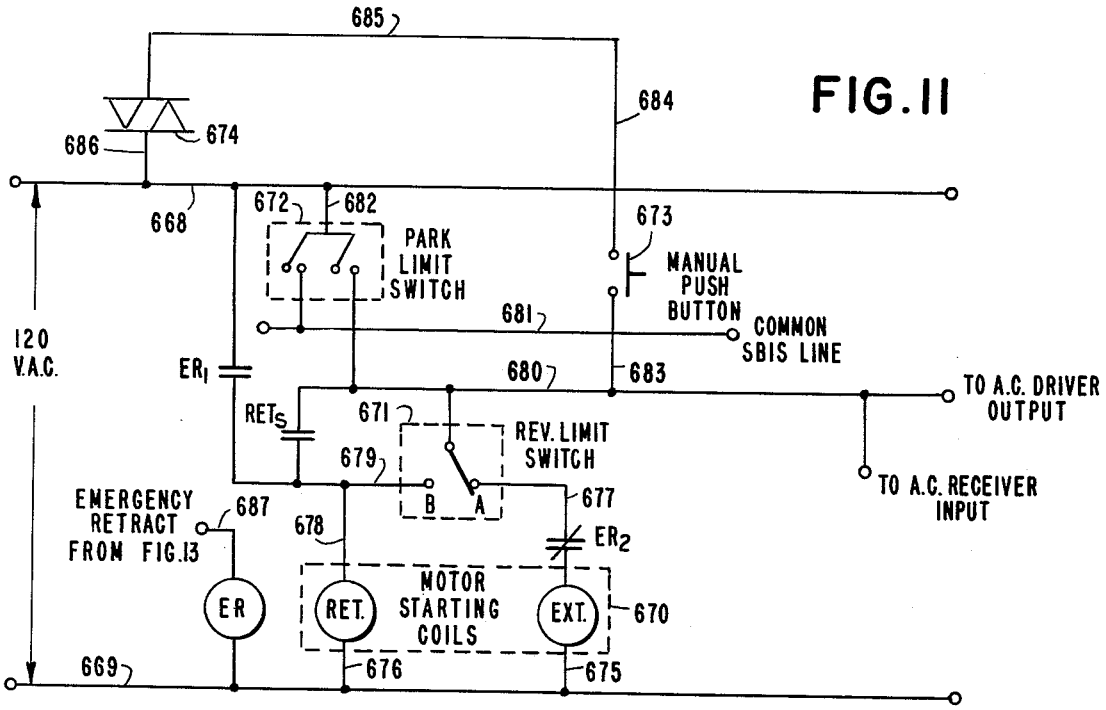

Referring now to FIG. 11 there is shown a schematic diagram illustrating a typical switching arrangement at the sootblower apparatus as modified to receive input commands from the AC driver arrangement depicted in FIG. 9 and to supply status indications to the AC receiver arrangement illustrated in FIG. 10. The switching arrangement illustrated in FIG. 11 is suitable for use in the sootblower apparatus employed within the instant invention and would be employed in conjunction with both wallblowers and retracts with the single exception that in the case of wallblowers, the emergency retract relay defined as ER in FIG. 11 would be omitted together with the two sets of contacts associated therewith annotated $ER_1$ and $ER_2$. Under these conditions, the conductor containing the open set of contacts $ER_1$ would be omitted while the conductor containing the normally closed set of contacts $ER_2$ would be replaced by a short circuit. These omissions from the exemplary switching circuit illustrated in FIG. 11 in the case of wallblowers are appropriate since wallblowers only have a duty cycle which approximates a minute and therefore no emergency retract condition and response in the switching circuit is required. Conversely, in the case of retractables a fifteen minute cycle of operation is typical and hence the emergency retract relay ER is provided to initiate the immediate withdrawal of the probe so that the same is not damaged through excessive presence within the boiler.

The typical switching arrangement for sootblower apparatus employed within the instant invention as modified to receive input commands from the AC driver arrangement depicted in FIG. 9 and supply status indications to the AC receiver arrangement illustrated in FIG. 10, as shown in FIG. 11 comprises a pair of main power conductors 668 and 669, the sootblower starting coils indicated by the dashed block 670, a reverse limit switch indicated by the block 671, a park limit switch indicated by the block 672, a manual start push button 673 and a manual start triac 674. The main power conductors 668 and 669 have a power supply equal to a 120 volt AC source imposed thereacross as indicated at the left hand portion of FIG. 11. The main power conductors 668 and 669 thus apply the power supply for the sootblower in operation and it is this supply across which the motor starting coils indicated by the dashed block 670 are imposed whenever the sootblower is in operation. The sootblower starting coils indicated by the dashed block 670 are in actuality the contactor coils within the sootblower starter unit per se and as indicated in FIG. 11, the contactor coil annotated EXT for extend, acts when energized to cause the sootblower motor to revolve in a direction to traverse from its home position outside the boiler to a fully extended position inside the boiler which, in the case of all wallblowers is in a preassigned position within the boiler unit on the walls thereof as in the case of a retract is through the tube which is being cleaned thereby. Conversely, the motor starting coil annotated RET for retract acts to drive the cleaning end or probe of the sootblower from its fully extended position back to its home position.

The motor contactor coil annotated EXT is connected to the main power conductor 669 through the conductor 675 while the motor starting coil annotated RET for retract is connected to the main power conductor 669 through the conductor 676. The opposite sides of the motor starting coils are connected through the conductors 677, 678 and 679 to opposite poles A and B of the reverse limit switch 671 and the seal-in contact RETs of the retract coil. The reverse limit switch 671 is also a part of the sootblower unit which acts in the well known manner to reverse the operation of the sootblower probe whenever the same is fully extended. Thus, the reverse limit switch 671 resides in position A when the sootblower probe is in its home position and continues in this position until the probe has been fully extended. Upon a full extension of the sootblower probe the reverse limit switch is mechanically actuated to its B position whereupon the retract starting coil is enabled to withdrawn the probe from its fully extended position to its home position.

When the probe begins to withdraw, the reverse limit switch again reverses and shifts to position A so as to be in the appropriate state for the next cycle of initiation for the sootblower being considered; however, the seal-in contact RETs acts to maintain probe withdrawal. Accordingly, when the reverse limit switch is in position A and the circuit is completed from the conductor 680, through the reverse limit switch, conductor 677 and the normally closed set of emergency retract contacts $ER_2$ through the extend motor starting coil and the conductor 675 to the main power conductor 669. Conversely, when the reverse limit switch is in position B as is the case when the probe is in a fully extended position, the circuit is completed from the conductor 680 through the reverse limit switch 671 and conductors 679, 678 and 676 to the main conductor 669. When the relay RET has been energized, the coil is sealed in from conductor 680 through RETs contacts to conductors 679, 678, 676 and 669.

The conductor 680 connects as indicated to the park limit switch indicated by the dashed block 672 and to the terminals annotated to AC driver output and to AC receiver input. These terminals, as will be appreciated by those of ordinary skill in the art are connected to the specific circuit driver outputs and specific circuit receiver inputs in the AC driver circuit and AC receiver circuits illustrated in FIGS. 9 and 10 and it will be appreciated by those of ordinary skill in the art that when a specific sootblower is to be energized by the output of an AC driver circuit illustrated in FIG. 9 a 120 volt AC signal is applied to the conductor 680 from the terminal annotated to AC driver output while when the operative or inoperative condition of a sootblower is motored by a specific AC receiver circuit as illustrated in FIG. 10 the no signal or 120 input signal supplied to the circuit in the receiver which is specifically addressed is supplied from the conductor 680 to the terminal annotated to AC receiver input.

The conductor 680 is also connected to the C contacts of the park limit switch 672. The park limit switch is a conventional device as commonly available from manufacturers such as Square D or Allen Bradley and is a mechanically actuated device which resides in its open position, as shown in FIG. 11 whenever the probe of the sootblower unit is in its home position while the same is immediately closed to close both contact sets C and D thereon whenever the probe of the sootblower is away rom its home position. The D set of contacts to the park limit switch 672 are connected to the conductor 681 annotated, SBIS (sootblower in service) line which is a conductor that is looped through a plurality of sootblowers having common characteristics and each of the common sootblower in service lines looped in the foregoing manner are monitored at inputs to the programmable controller 1 for the purposes of ascertaining whether or not sootblowers are in a started condition. The other side of the park limit switch is connected through the conductor 682 to the other main power conductor 668 and hence it will be seen that whenever the park limit switch is in a closed condition the 120 AC volts applied across the main power conductors 668 and 669 is imposed through the conductor 682, contacts C of the park limit switch, the conductor 680 and either contacts A or B of the reverse limit switch or RET coil contacts RETs through one set of motor starting coils 670 to the main power conductor 669. In addition, the 120 volt signal is conveyed through the main power conductor 668, the conductor 682 and contacts D of the park limit switch 672 to impose a 120 volt signal on the common sootblower in service line 681.

In a typical starting operation by the digitally controlled sootblower system according to the instant invention, the sootblower will be started by the imposition of a 120 volt AC signal at the terminal to the conductor 680 annotated to AC driver output. When this occurs, the sootblower probe will be in its home position whereupon the park limit switch 682 is in the open condition illustrated and no voltage is applied to the conductor 681 connected to the terminal annotated COMMON SOOTBLOWER IN SERVICE LINE. The 120 volt signal on conductor 680 however will be supplied through the reverse limit switch 671 in the position shown, contacts A, the conductors 677 and 675 and the closed contact $ER_2$ through the extended motor driving coil indicated within the dashed block 670. In the normal mode of operation this 120 volt signal will energize the extend motor starting coil to cause a sootblower probe to extend from its home position. While this is occurring, the programmable controller is monitoring the common sootblower in service line connected to the conductor 681 to ascertain if a sootblower start up procedure has been initiated; however, until the park limit switch 672 is closed no confirmation signal will appear on the common sootblower in service line connected to the conductor 681. When the probe has moved awy from its home position under the influence of the energized extend motor starting coil the park limit switch 672 will close at contacts C and D. When this occurs, 120 volts AC will be applied from the main conductor 668 and the conductor 682 through the D contacts of the park limit switch 672 to the conductor 681. Additionally, this 120 volt AC signal will be applied through contact C of the park limit switch to the conductor 680 and contacts A of the reverse limit switch, through the conductor 677, the closed contacts $ER_2$ to the extend motor starting coil. Upon a detection of the sootblower in service signal on the line connected to conductor 681 the controller which has been monitoring this line, as aforesaid, to ascertain the presence of a start condition, will terminate the output of the AC driver circuit connected to the conductor 680 so that no starting signal is now applied to this line. However since the monitoring operation of the common sootblower in service line effectively implements a make-before-break mode of operation in association with the park limit switch 672, the conductor 680 remains energized and this signal is now available to the AC receiver input terminal. Therefore, the controller may specifically address the sootblower through the AC receiver circuit to obtain precise confirmation that the sootblower whose starting circuit is illustrated in FIG. 11 has effectively started.

The operation of the extend motor starting coil will continue until the probe is fully extended assuming that we are not dealing with a retractable and that no emergency retract condition arises. When the probe becomes fully extended, the reverse limit switch 671 switches over to its B contacts. When this occurs, the AC voltage applied to the main power conductor 668 is conveyed through the conductor 682 and contacts C of the park limit switch through the conductor 680, contacts B of the reverse limit switch and conductors 679 and 678 to the retract motor starting coil. At this juncture, the retract motor starting coil is sealed into an energized condition and the probe is driven backwards from its fully extended position towards its home position. However, the 120 volt AC signal remains on the conductor 680 for periodic monitoring at the AC receiver input and the subsequent display of the information received therefrom due to the periodic monitoring of all sootblower status conditions by the scanner multiplexer means illustrated in FIG. 5. When the energization of the retractable motor starting coil causes the probe to return to its home position, the park limit switch 672 opens cutting off all power to the conductor 681 through its D contacts and rmoving the voltage on the conductor 680 which is monitored by the AC receiver. When this occurs, a periodic monitoring of this sootblower by the AC receiver will indicate an inoperative condition whereupon a Zero will be set into the display latch so that the indicia therefor at the display is extinguished. In addition, the motor starting coils indicated by the dashed block 670 will be de-energized, it being recognized that upon reaching its home position, the RET coil de-energizes opening its sealing contact.

The foregoing mode of operation briefly outlines the normal modes of operation of the sootblower when the same is initiated by the digital control system according to the instant invention and no malfunction occurs so that the manner in which an AC output from an addressed driver circuit may start the sootblower, as well as the manner in which the common sootblower in service line, is monitored to cause the programmable controller to terminate the start signal and thereafter initiate monitoring of the AC receiver circuit to ensure that a start has occurred, is apparent. Of course, if no start has occurred upon specific addressing of this circuit by the programmable controller, the malfunction indication is initiated by the controller by flashing the display associated with the specifically addressed sootblower while if no malfunction has occurred normal monitoring by the scanner multiplexer may proceed in the normal manner.

In addition to the circuitry outlined above associated with normal operation of sootblowers under the control of the digital sootblower control system according to the instant invention, a manual start button 673 is provided at each sootblower to initiate a manual start up operation of that sootblower for maintenance for other specialized functions. This manual push button initiates start up of a given sootblower at the blower per se and effectively bypasses the start up procedures assocated with the digital control systems according to the instant invention; however, once start up has been initiated monitoring in accordance with the instant invention at the AC receiver input is available. More particularly, the manual push button 673 is connected to the conductor 680 through a conductor 683 and to the manual start triac 674 through the conductors 684 and 685. The manual start triac 674 which may take the conventional form of this well known device and acts effectively as an AC switch is connected through the conductor 686 to the main power conductor 668 and hence to the 120 volt AC source applied thereto. When the manual push button is depressed so that the contacts thereof are closed, the manual start triac 674 is triggered to convey the AC supply voltage from the main power conductor 668 through the conductors 684 - 686 and the cloosed manual push button switch 673 to the conductor 680. This voltage is then applied through contact A of the reverse limit switch 671 through the extend coil within the motor starting coils indicated by the dashed block 670 to cause the sootblower probe to start to extend. Once the sootblower probe has been extended from its home position, the park limit switch 672 closes in the manner described above whereupon the 120 volt AC source voltage is applied therethrough to conductor 680 to maintain the operation of the extend motor starting coil while additionally supplying the sootblower in service signal to the conductor 681. Thereafter, the operation of the sootblower starting circuit is precisely the same as if starting had occurred in response to an AC input and will be continued in the manner described above.

For retractable sootblowers an emergency retract relay ER as illustrated in FIG. 11 is provided together with a normally open set of contacts $ER_1$ and a normally closed set of contacts $ER_2$. The terminal to the emergency retract relay ER annotated 687 is connected to receive an emergency retrct signal from the common permit module illustrated in FIG. 12 which, as shall be seen below, results in response to a detection of a malfunction in a retract under such circumstances that the retract should be immediately withdrawn and not allowed to continue its normal cycle of operation. Such a condition may result when the retract probe is stuck as manifested by its exceeding its timed cycle of operation as is also monitored by the programmable controller 1 or other conditions which will be further elucidated in conjunction with FIG. 12. Here however, it is sufficient to appreciate that when an energizing signal is applied to the terminal annotated 687 the emergency retract relay ER will be energized. Upon the energization of the emergency retract relay ER the contacts $ER_1$ will close while the normally closed contacts $ER_2$ will open. This immediately deenergizes the power supply to the extend motor starting coil EXT while the closure of the contacts $ER_1$ bypasses the reverse limit switch 671 and supplies voltage from the main power conductor 668 through the conductor, 679 and 678 to the retract motor starting coil. This will of course, initiate the immediate retraction of the probe for the retractable unit which has malfunctioned and cause the same to be retracted unles the unit is stuck in place.

Accordingly, the exemplary switching arrangement for sootblower apparatus illustrated in FIG. 11 is responsive to an input from the AC driver circuits illustrated in FIG. 9 to cause the starting of the sootblower in which it resides and provides an enable level on the sootblower in service line 681 as soon as the probe thereof has moved away from its home position. Thereafter, sootblower operation continues in a normal manner without maintenance by the programmable controller while an output is provided to the AC receiver so that the particulr sootblower may be periodically monitored to ascertain whether or not the same is in a state of operation. In addition, an emergency retract is provided for retractable sootblowers so that an immediate retraction of the probe can occur in response to a command issued by the programmable controller.

THE COMMON PERMIT MODULE

Referring now to FIG. 12 there is shown a schematic diagram depicting an exemplary embodiment of a common permit module for use in accordance with the teachings of the instant invention. The common permit module illustrated in FIG. 12 functions to receive a plurality of sensory signals from the signal converter illustrated in FIG. 3 as well as the programmable controller and to provide output signals which are either employed to illuminate specific indicia at the boiler diagram and display panel 30 illustrated in FIG. 1 or are forwarded to the signal converter circuits illustrated in FIG. 13 for conversion to an AC level which is employed directly to control specified functions at the sootblower energizing circuits per se. More particularly, a plurality of condition sensors are employed within the instant invention, as shall be described in greater detail as the description of FIG. 12 proceeds and these condition sensors provide an AC signal in response to the occurrence or non-occurrence of the condition which is to be monitored. These AC signals are converted, in a manner to be described in conjunction with FIG. 13 into a DC level which is logically processed at the permit module illustrated in FIG. 12 so that advisory indications may be developed therefrom and conveyed through the C2 bus to the boiler diagram and display panel 30 to cause the selective illumination of discrete indicia therein. In addition, other DC levels which are logically processed at the permit module result in logical conditions which are employed directly at the sootblower units. These logical conditions, such as an emergency retract level or a wallblower or retract manual permit level, are utilized in the form of an AC level directly at the starting circuitry for the sootblower units per se. Accordingly, when these signals are developed, they are supplied through the multiconductor cable 42 to the signal converter circuits 10 illustrated in FIG. 13 where the same are converted into AC levels appropriate for direct application to the sootblower switching circuits of the type illustrated in FIG. 11. Since the AC to DC conversions as well as the DC to AC conversions conducted by the signal converter circuits illustrrated in FIG. 13 are generally repetitive in nature and are each performed in the same manner, the detailed recitation of each of the sensors whose inputs are submitted to the permit module illustrated in FIG. 12 will be discussed in detail in conjunction with the description of this figure.

Figure 13:
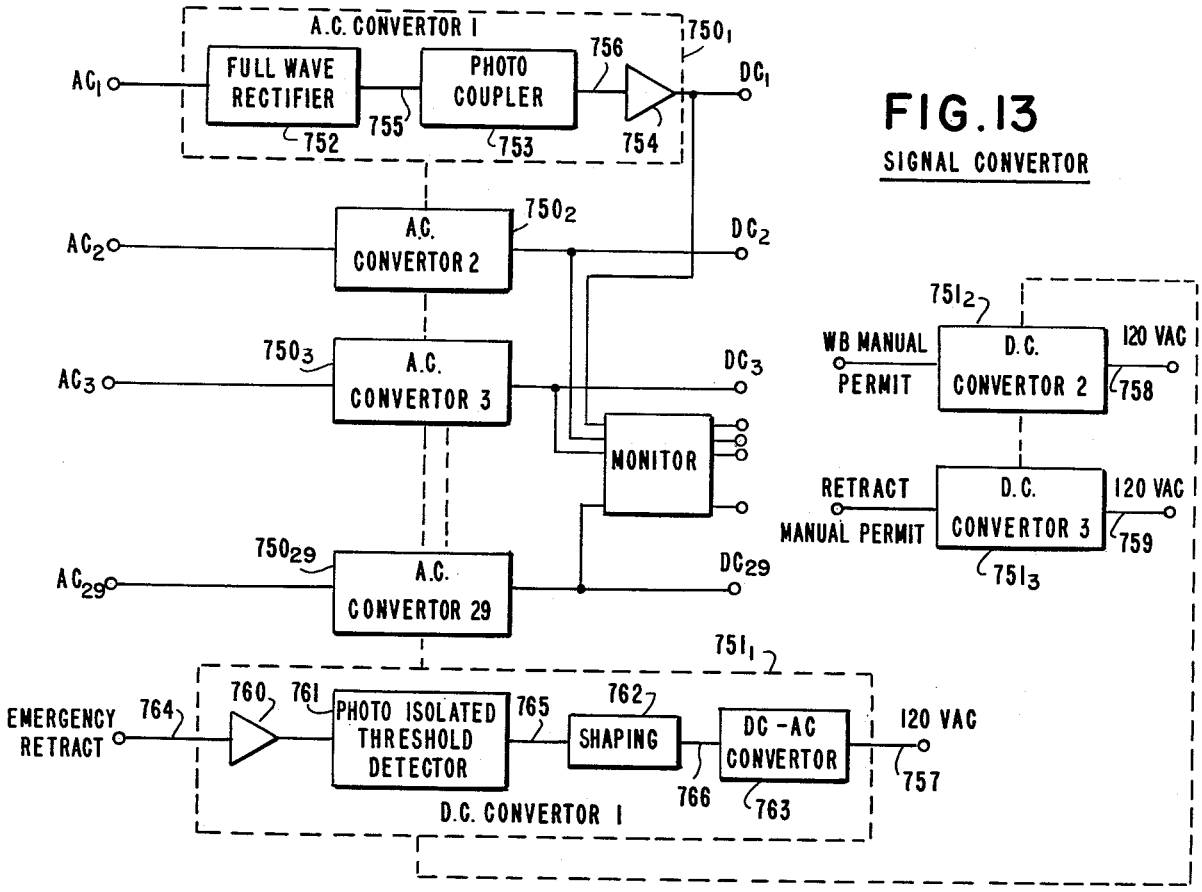

Referring now specifically to FIG. 12, the permit module illustrated therein comprises a plurality of condition sensing gates 690-702 which each act to receive a DC control level from either the signal converter circuits illustrated in FIG. 13 and/or the programmable controller 1 and are responsive thereto to provide an output level through the C2 bus for illuminating one of the indicia illustrated in the boiler diagram and display panel 30 shown in detail in FIG. 6 as well as providing, in certain cases, logical levels which are employed for the development of additional signals on a control basis. Thus, the condition sensing gate 690 is a five input OR gate which acts in the conventional manner to produce a high at the output thereof connected to conductor 703 any time any of the inputs thereto are high. The first four inputs to the OR gate 690, as indicated by the terminals annotated $MO_1$ - $MO_4$ are DC levels corresponding to the detection of a motor overload condition by a field sensor and the resulting DC conversion of the AC signals suppllied by such sensor to the signal controller circuits illustrated in FIG. 3. More particularly, sootblower motors have a power line provided with an overload sensor which acts to trip a relay should excessive current be drawn by the motor. While such a sensor could be provided by a thermocouple or the like, in the case of the instant invention, it was deemed preferable to use magnetically operated overload switches taking a conventional form. These magnetically operated overload switches are interconected among the various retract motors in four serial loops so that the entire network of retractables is monitored by four loops and hence the condition sensing gate 690 receives four inputs annotated $MO_1 - MO_4$ indicating inputs from the four motor overload loops formed. When any of the motor overload inputs $MO_1 - MO_4$ go high, a high will be supplied on the output conductor 703 from the output of the condition sensing gate 690 and will be supplied through the C2 bus in the manner indicated in FIG. 1 to illuminate the motor overload indicia within the retractable indicia block 302 in FIG. 6. In addition, any time a motor overload condition is detected, it is supplied to the controller to cause the controller to search the inputs to find which retractable motor has overloaded.

When this condition has been found, it causes the operational indicia for that sootblower to be flashed and an emergency retract signal is immediately issued to try to get the probe withdrawn. In addition, a fifth input is provided to the OR gate which acts as the condition sensing gate 690 which is here annotated $MO_{cont}$ standing for MOTOR OVERLOAD CONDITION from the controller. This input to the condition sensing gate 690 is high whenever the programmable controller has received a motor overload condition such as one of the motor overload conditions detected by sensors and supplied to the condition sensing gate 690 from a previous cycle of operation which has not yet been cleared. Thus, when a motor overload condition is supplied at one of the input terminals $MO_1 - MO_4$ a flag will be set in the programmable controller 1, the motor overload indication at the display will be illuminated and the unit in which the overload condition has occurred will be flashed. Should the cycle of operation for that unit terminate such as will occur when an emergency retract operation is successful, the motor will be deenergized and the motor overload condition indicated at the terminals $MO_1 - MO_4$ will terminate; however, as this is insufficient to ensure that the operator has cured the condition, the motor overload controller terminal will remain high until the operator has acknowledged that the condition has been noticed and hopefully cured by a depression of the reset key. Accordingly, the input to the condition sensing gate 690 annotated $MO_{cont}$ is representative of a flag condition set in the programmable controller any time a motor overload condition is detected and this condition will persist until the same has been reset by the operator as a form of acknowledging that the condition has been noticed. Anytime a motor overload condition obtains on the output conductor 703 it is supplied through the C2 bus to the boiler display diagram illustrated in FIG. 6 as aforesaid and is additionally conveyed through the conductor 704 to an input of the OR gate 705 as well as an input to the condition sensing gate 695 which also takes the form of an OR gate.

The condition sensing gate 691 takes the form of a conventional OR gate which acts in the usual manner to produce a high at the output thereof connected to the conductor 706 any time either of the two inputs thereto go high. The output of the condition sensing gate 691 on conductor 706 is supplied, as indicated, through the C2 bus to the boiler and display diagram illustrated in FIG. 6 and any time a high level appears thereon a low header pressure indication for the retractable units as indicated within the block 302 is illuminated. The two inputs to the OR gate 691 which is annotated with an R to indicate it is associated with the operation of retractables are supplied from the terminals annotated CONT LHP (controller low header pressure) and SC LHP (signal convertor low header pressure). As was discussed previously, all retractable units within the system operate from a single header and a pressure switch is mounted within the header to indicate the pressure therein to thus reflect whether the same has supplied enough pressure to power the retract or wallblower unit which is operational therefrom. When the appropriate pressure is present no signal is provided to the signal conversion circuits illustrated in FIG. 13; however, when the pressure drops below a predetermined value an AC signal is supplied to the signal converter circuits illustrated in FIG. 13 which is then converted to a DC level and applied to the signal converter low header pressure terminal (SC LHP) connected to the condition sensing gate 691. This signal will thus go high any time during the operation of a retract when the header pressure in the header connected to retracts goes below a predetermined value and this high level will be communicated through the conductors 706 and the C2 bus to illuminate the low header pressure indicia within the block 302 as aforesaid. In addition, the SC LHP indication from the signal converter is supplied to the controller and acts to set a flag therein. This flag is maintained until the condition is cleared by an operator resetting the system through a depression of the reset key in the input panel illustrated in FIG. 2B, subsequent, it is hoped, to a correction in the operation of the header feeding retracts. In any event, the SC LHP input would generally go high during the operation of a retract whereupon the retract low header pressure within the block 302 will be illuminated and as shall be seen below, an emergency retract signal will be issued to withdraw the proble to avoid damage. In addition, a flag is set in the programmable controller 1 which causes the CONT LHP input to the OR gate 691 to go high and stay high until this condition is reset. This mode of operation would cause subsequent retract operation to be inhibited until such time as the low header pressure condition is corrected and the indication within the controller cleared.

Any low header pressure indication present on conductors 706 from the output of the condition sensing gate 691 is additionally supplied through the conductor 707 to a first input of an OR gate 708 and a corresponding input of an AND gate 709. These inputs, as shall be seen below, are associated with negating the availability of a manual permit for retract operation and the issuance of emergency retract signals whenever a low header pressure condition is present.

The condition sensing gate 692 takes the form of a conventinal two input OR gate which serves to monitor the operation of retractables located on the right side of the boiler. More particularly, the condition sensed by the condition sensing gates 692 is limited to retracts and as it will be recalled that normally one retract on each side of the boiler can operate at a time, the condition sensing gate 692 acts to monitor the flow conditions associated with retracts located on the right side of the boiler. More specifically, the piping from the single header which services all retracts is provided with a two position flow or pressure switch which monitors flow through the piping directed to an operative retract as it will be further remembered that retracts may be roughly divided into high capacity types, medium capacity types and low capacity types depending on the amount of blowing medium required thereby. The flow switch present in the piping therefor has a double set of contacts which will close to a first position in response to the operation of a low capacity retract properly blowing and to a second position in response to the operation of a high capacity retract properly blowing. Thus, when a low capacity retract is properly operating a high is present at the input terminal to gate 692 annotated R FLOW REG (retract flow regular) while when a high capacity retract on the right side is properly operating, a high will be present on the lower terminal annotated R FLOW HC (retract flow high capacity). Any time a high is present at either of the terminals annotated R FLOW REG or R FLOW HC, a high will be produced at the output of the OR gate 692 which is connected to the conductor 710. This high level signal will indicate that a retract located on the right side is properly operating and hence, is supplied through the C2 bus to illuminate the right retract blowing indicia within the retractable block 302 of indicia illustrated in FIG. 6. Whenever a high is present at the output of the condition sensing gate 692 it is also coupled through the conductor 711 to an input of the OR gate 712.

The condition sensing gate 693 performs the same function for retracts located on the left side of the boiler as is performed by the condition sensing gate 692 for retracts located on the right side of the boiler. Thus, in header piping associated with the retracts located on the left side of the boiler there is again located a two position flow switch which acts, in the conventional manner, to monitor the flow of fluid therethrough as a function of the media being supplied to an operative retract. If a normal capacity retract is in operation, a high will be present at the terminal annotated L FLOW REG or left retract flow regular, while if a high capacity retract is properly operating, the terminal annotated L FLOW HC, left flow high capacity, will have a high thereon. When a high is present at either of the inputs to the OR gate 693, a high will be output therefrom and supplied through the conductor 713 to the terminal annotated L RET BLOWING INDICIA which signal is supplied through the C2 bus to illuminate the left retract blowing indicia within the retractable block 302 in FIG. 6. In addition, whenever a high is produced by the output of the OR gate 693 it is coupled through the conductor 714 to the second input of the OR gate 712. The OR gate 712 functions in a manner to be seen below to selectively disable the retract manual permit whenever other retracts are operating. It should be noted that the programmable controller according to the instant invention has the ability to perform data logging functions should the same be desireable and hence, if desired a flow transmitter such as those available from Taylor, Bailey or Foxborough Corporations could be relied upon to monitor the magnitude of the flow measured here merely as inputs to the OR gates 692 and 693 after transducing to DC levels in the signal converter circuit illustrated in FIG. 13. If this were done, a D to A converter module supplied by FX Corporation, which manufactures the programmable controller used herein could then be relied upon to develop an analog representation of the flow characteristics which occur and these may be logged for periodic read out in the form of a print out or the like.

The OR gate 712 receives a high on the input thereto connected to conductor 711 when any right retract is properly blowing and similarly receives a high on the input thereto connected to conductor 714 whenever any left retract is properly blowing. Since the OR gate 712 is conventional and will produce a high at the output thereof whenever either of the inputs thereto are high, any time either a left or right retract is properly blowing, a high will be produced at the output of the OR gate 712 which is connected to the conductor 715. The conductor 715 serves as One input to the OR gate 705 which receives a second input, as aforesaid, through conductors 704 and 703 from the output of the condition sensing gate 790 which is high, it will be recalled, any time a motor overload condition has been detected in a retract, which is currently operating or such a condition was detected and has not yet been cleared. Accordingly, the output of the OR gate 705 will go high when either a motor overload condition in a retract has occured or a left or right retract is blowing. The output of the OR gate 705 is supplied through a conductor 716 to one input of a three input NOR gate 717.

The NOR gate 717 is a conventional three input NOR gate which produces a low at the output thereof connected to conductor 718 whenever any of the three inputs thereto are high while producing a high on the output conductors 718 only when all of the inputs thereto are low. The NOR gate 717 thus controls, as indicated in FIG. 12, the generation of a retract manual permit which, when enabled acts to permit the manual starting of retracts. More particularly, when a high is produced at the output of the NOR gate 717 this high is coupled, as indicated in FIG. 12, to the signal converter illustrated in FIG. 13 where the manual permit signal is converted into an AC enabling level which is then applied to the retract starting circuitry to enable the manual starting thereof. However, when any of the inputs to the NOR gate 717 are high, a low is produced at the output of NOR gate 717 on conductor 718 and when this level is supplied to the signal converter illustrated in FIG. 13, no AC enabling signal is produced therefrom to permit the starting of a retract under a manual start mode of operation.

A second input to the NOR gate 717 is supplied through the conductor 719 from the terminal annotated CONT RETRACT INHIBIT (controller retract inhibit). The retract inhibit level supplied to the conductor 719 is provided directly from the controller any time conditions are such that the executive program is required to inhibit sootblower operations due to precedent conditions which have occurred. More particularly, should a control power failure occur or a motor overload condition, or a similar malfunction condition have occurred, it will be seen that the boiler diagram and display panel 30 will indicate the problem however, until conditions are corrected or at least acknowledged by the operator it is not desireable to permit the operator to circumvent controls in the system through the manual initiation of a sootblower which in this case would take the form of a retract. Accordingly, under any of these circumstances, the controller would impose a high level on the conductor 719 to effectively disable the manual permit for retracts until a reset indication at the input panel illustrated in FIG. 2B has been received. Thereafter, the inhibit level on conductor 719 would be released. Of course, any time a high level is present on conductor 719, the output of the NOR 717 will go low and hence, no AC level will be developed therefrom at the signal converter illustrated in FIG. 13 to be employed as a manual permit level.

The third input to the NOR gate 717 is supplied through the conductor 720 from the output of the output of the OR gate 708. The OR gate 708 is a conventional two input OR gate which acts to produce a high or a disabling level on conductor 720 any time either of the inputs thereto are high. Thus, whenever either of the inputs to the OR gate 708 go high, a high is produced at the output thereof connected to conductor 720 to cause a low level to reside at the output of the NOR gate 717 effectively removing the manual permit level on conductor 718. A first input to the OR gate 708 is supplied through the conductor 721 and the conductor 707 as aforesaid from the output of the retract low header pressure condition sensing gate 691. Accordingly, it will be recalled, that the input to the OR gate 708 supplied on conductor 721 will go high any time a low header pressure condition has either occurred or has not yet been cleared as indicated by a high at the output of the OR gate 691 and such a high level on conductor 721 will cause the output of the OR gate 708 to go high to remove the retract manual pemit. The second input to the OR gate 708 is supplied through conductor 722 from the output of an OR gate 723. While the input conditions to the OR gate 723 will be discussed below, it is here sufficient to appreciate that the output of the OR gate 723 will go high any time a retract be it regular or high capacity is in service and hence any time a retract is in service, a high will be provided to the OR gate 708 through the input thereto connected to conductors 722. This too, will cause the output of the OR gate 708 to go high to inhibit the retract manual permit level which is generated at the output of the NOR gate 717 and supplied to the signal converter illustrated in FIG. 13. Accordingly, it will be seen that the retract manual permit signal is high to enable an AC level to be generated as a manual permit signal by the signal converter illustrated in FIG. 13 only under such conditions when the controller is not inhibiting retracts, no motor overload condition is indicated, no low header pressure condition is indicated and no retract is presently in service. When none of these conditions obtain, a manual permit signal in the form of a high will be generated at the output of NOR gate 717 connected to conductor 718 and will be converted by the signal converter illustrated in FIG. 13 to a AC level for application to the retract starting circuits.

The condition sensing gate 695 takes the form of a conventional three input OR gate whose output controls the generation of an emergency retract signal. Thus, when the output of the OR gate 695 goes high on conductor 724, this output level, as indicated in FIG. 12 is supplied to the signal converter illustrated in FIG. 13 where it is transformed into an AC level for application to the emergency retract relay employed for retracts in the manner illustrated in FIG. 11 and is applied to the terminal 687 shown therein. More particularly, the OR gate 695 acts in the conventional manner to provide a high at the output thereof which corresponds to an emergency retract indication any time any of the inputs thereto go high. A first input to the OR gate 695 is supplied, as aforesaid, through conductors 704 and 703 from the output of the condition sensing gate 690 which acts, it will be recalled, to detect the presence of a motor overload condition. A second input to the OR gate 695 is supplied through the conductor 725 from a terminal annotated CONT EMERGENCY RETRACT. This input is supplied through the multiconductor cable 40 as shown in FIG. 1 directly to the controller and will go high any time an emergency retract condition is generated by the controller pursuant to a monitoring operation conducted thereat. The third input to the OR gate 695 is supplied through the conductor 726 from the output of an AND gate 709. The AND gate 709 comprises a conventional two input AND gate which produces a high at the output thereof connected to conductor 726 only when both of the inputs thereto go high to thus cause the generation of an emergency retract level on the conductor 724. The first input to the AND gate 709 is connected through the conductors 707, as aforesaid, to the output of the retract low header pressure OR gate 691 and hence, a high is present on this conductor any time a low header pressure condition on the header associated with retracts occurs. The second input to the AND gate 709 is conncted through the conductor 727 to the output of the OR gate 723. The output of the OR gate 723 will go high, it will be recalled, any time a retract is in service and hence, the output of the AND gate 709 goes high to cause the generation of an emergency retract signal at the output of the OR gate 695 any time a retract is in service and a low header pressure condition exists. Accordingly, it will be seen that the OR gate 695 will generate an emergency retract level on conductor 724 which is transduced into an AC level by the signal converter illustrated in FIG. 13 any time a motor overload condition exists, the controller has generated an emergency retract indication on the input conductor 725 or a retract is in service and a low header pressure condition exists.

The OR gate 723 produces a high at the output thereof connected to conductor 727 and conductor 722 any time a retract is in service. The OR gate 723 takes the form of a conventional two input OR gate which produces a high at the output thereof any time either of the inputs thereto go high. A first input to the OR gate 723 is supplied from the output of the condition sensing gate 696 through a conductor 728. The condition sensing gate 696 is a two input OR gate which here acts to detect retract in service conditions for retracts located on the right side of the boiler. Accordingly, for regular capacity right retracts in service, a high level is supplied to the terminal annotated RRIS and it will be appreciated by those of ordinary skill in the art that this signal is developed from the AC signal on conductor 681 shown in FIG. 11 from a loop for retracts located on the right hand side of the boiler after the AC signal representative of a sootblower in service condition has been converted into a DC level by the signal converter illustrated in FIG. 13. Similarly, the sootblower in service loop for high capacity retracts on the right hand side of the boiler provides an AC level to the signal converter illustrated in FIg. 13 and this is transformed into a DC level which is supplied to the terminal RRIS (HC) standing for right retracts in service high capacity. Accordingly, any time a right retract is in service, one of the inputs to OR gate 696 will go high to supply a high level on conductor 728 to cause the output of the OR gate 723 to go high and hence, disable the retract manual permit and condition the AND gate 709 to produce a high should a low header pressure condition occur. The output of the OR gate 696 is additionally connected through the conductor 729 to the terminal annotated right retract in service indicia. This terminal is connected through the C2 bus to the boiler diagram and display panel 30 and when a high exists thereon it will be appreciated that the right retract in service indicia illustrated within the block 302 in FIG. 6 will be illuminated.

The OR gate 697 performs the same functions for regular capacity and high capacity retracts located on the left hand side of the boiler as was performed for retracts on the right hand side of the boiler by the OR gate 696. Thus, when a retract on the left hand side of the boiler is operating, a high will be imposed at the terminal annotated LRIS if it is a regular capacity retract, while if it is high capacity retract a high will be imposed on the terminal of OR gate 697 annotated LRIS (HC). If a high is present at either terminal as an input to the OR gate 697, the output thereof on conductor 730 will go high to cause a high at the output of the OR gate 723 and to addtionally cause a high at the terminal annotated Left Retract in Service Indicia. The conductor 730, it will now be appreciated by those of ordinary skill in the art, is connected through the C2 bus to the boiler diagram and display panel 30 and when a high resides thereon will cause the left retract in service indicia within the block 302 to be illuminated to apprise the operator of this condition. All of the inputs discussed hereinabove are principally associated with retract operations and except for the controller low header pressure, controller retract inhibit and controller emergency retract signals discussed in association with the OR gate 791, the conductor 719 and the conductor 725, are obtained as a function of external sensors present at the sootblowers which sensors provide an AC signal to the signal converter circuits illustrated in FIG. 13. These signals are transduced into logic levels by the AC to DC converters therein and then are supplied directly to the retract permit circuits discussed above for logical manipulation in the manner described and to the programmable controller through the multiconductor cable 44 for continuous monitoring by the programmable controller.

The remaining circuitry to be discussed in conjunction with FIG. 12 is associated principally with the operation of wallblowers and it will be appreciated by those of ordinary skill in the art that much of the same conditions already described for the retracts are again monitored for wallblowers through the use of external sensors which provide an AC signal whereupon the AC signal is transduced into a DC level by the signal converter circuits illustrated in FIG. 13 and are supplied as inputs to the permit module illustrated in FIG. 12 and to the programmable controller 1 through the multiconductor cable 44 for continuous monitoring thereby.

The condition sensing gate 698 is a four input OR gate which here acts to monitor sootblower in service signals obtained from four loops of the common SBIS line 681 illustrated in FIG. 11. Accordingly, when an AC level resides on conductor 681 illustrated in FIG. 11, and this line is connected in one of the four wallblower loops described in conjunction with FIG. 11, the AC level will be transduced into a DC signal in the form of a high by one of four dedicated converters in the signal converter illustrated in FIG. 13 and be produced as a high level at one of the four inputs to the OR gate 698 annotated $WBIS_1$, $WBIS_2$, $WBIS_3$ and $WBIS_4$. Anytime any one of the inputs to the OR gate 698 goes high, the output of this gate will go high in the conventional manner to impose a high on the output conductor 731'. The output conductor 731' is connected to a terminal annotated WALLBLOWER IN SERVICE INDICIA which connects as will now be apparent through the C2 bus to the indicia annotated wallblower in service within the wallblower indicia block 303 in FIG. 6. Accordingly, when a high resides on conductor 731' the wallblower in service indicia within block 303 will be illuminated. The output of the condition sensing gate 698 is also connected through a conductor 732 to one input of an OR gate 733.

The condition sensing gate 699 monitors header pressure for wallblowers in precisely the same manner as the condition sensing gate 691 monitored low header pressure conditions for retracts. Thus, a first input to the OR gate 699 supplied from the terminal annotated SC LHP is a low header pressure indication obtained from the signal converter which in turn transduces an AC signal representative of a low header pressure condition sensor located in the header into a DC level which is then applied from the signal converter illustrated in FIG. 13 to the terminal annotated SC LHP. The second input to the OR gate 699 annotated CONT LHP is a controller indication of a low header pressure condition which obtains, in similar manner to that described above, when a low header pressure condition has been detected in a previous cycle of operation and has not been corrected or at least acknowledged through a resetting operation. Accordingly, when any of the inputs to the OR gate 699 goes high to indicate a low header pressure condition, the output thereof connected to conductor 734 will go high to cause the terminal annotated WB LHP indicia to go high which in turn is connected through the C2 bus and will cause the low header pressure indicia within the wallblower block 303 in FIG. 6 to be illuminated to apprise the operator of the low header pressure condition. The output of the wallblower low header pressure condition sensing gate 699 is additionally connected through the conductor 735 to a second input of the OR gate 733.

The OR gate 733 is a conventional two input OR gate which acts to produce a high at the output thereof connected to conductor 736 any time either of the inputs thereto go high. Therefore, since a first input to the OR gate 733 is supplied through conductor 732 whenever a wallblower is in service while a second input thereto is supplied through conductor 735 whenever a low header pressure condition is indicated by the output of the wallblower low header pressure gate 699, it will be appreciated that the output of the OR gate 733 on conductor 636 goes high any time a wallblower is in service or a low header pressure associated with wallblowers exists. The output of the OR gate 733 is connected through conductors 736 to the input of a NOR gate 737. The NOR gate 737 is a conventional three input NOR gate which acts to produce a high at the output thereof which here corresponds to a manual permit level only when all of the inputs thereto are low while conversely, to produce a low or an inhibiting level for the wallblower manual permit signal any time any of the inputs thereto go high. The output of the NOR gate 737 is connected through conductor 738 to a terminal annotated WALLBLOWER MANUAL PERMIT. This terminal is connected to a DC to AC converter in the signal converter illustrated in FIG. 13 as indicated and in the same manner described for the retract manual permit whenever this AC signal is present wallblower starting circuits may be enabled while when this level is absent no manual enabling of wallblowers may occur. A second input to the NOR gate 737 is supplied through conductor 739 to a terminal annotated CONTROLLER WALLBLOWER INHIBIT (CONT WB INHIBIT). This signal is supplied by the controller whenever it is desired to inhibit wallblowers and occurs for the same reasons described in connection with the controller retract inhibit imposed on conductor 719. The controller wallblower inhibit level which is a One in the active state is supplied to the permit modules illustrated in FIG. 12 through the multiconductor cable 40 and, as will be appreciated by those of ordinary skill inthe art, whenever a high is supplied by the controller to the conductor 739, the output of the NOR gate 737 will go low to remove the wallblower manual permit level on the conductor 738.

The third input to the NOR gate 737 is supplied through the conductors 740 and 741 from the output of the OR gate 700. The function of the OR gate 700 is to monitor flow switches located on the output side of the wallblowers and hence a high will be imposed by the OR gate 700 any time a wallblower is appropriately operating in that it is in a blowing condition. Thus, whenever a high is imposed on conductors 741 and 740 from the output of the OR gate 700, the output of the NOR gate 737 will go low to remove the wallblower manual permit. Accordingly, it will be appreciated by those of ordinary skill in the art that the wallblower manual permit will be removed by a low on conductor 738 any time a wallblower is in service, a low header pressure condition is indicated, the wallblowers are inhibited by the controller or a wallblower is operating as all of these conditions will cause the output of the NOR gate 737 to go low. Only if none of these conditions are present will the output of NOR gate 737 go high whereupon the high level on conductors 738 will be transformed into an AC signal to enable the manual starting of the wallblower starting circuits as aforesaid.

The OR gate 700 functions, as aforesaid, to monitor the appropriate operaton of wallblowers in service. This is done in this embodiment of the present invention by providing flow switches at the output of each wallblower and connecting the flow switches into four loops so that any time the proper blowing of media is occurring within any wallblower, an AC level will be developed in the loop in which that flow switch is connected. These AC signals are conveyed to four independent AC to DC converters within the signal converter circuits illustrated in FIG. 13 and are transduced into One and Zero logic levels thereby. Accordingly, when any wallblower is properly blowing media a high will be present at one of the terminals annotated $FSW_1$, $FSW_2$, $FSW_3$ and $FSW_4$ and any time a high is present at any of these terminals the output of OR gate 700 on conductor 741 will go high. When a high resides on conductor 741 this high is connected, in the manner indicated in FIG. 12, through the C2 bus to cause the illumination of the wallblower blowing indicia within the block 303 in FIG. 6 to apprise the operator that this result obtains.

The condition sensing gates 701 and 702 are employed to monitor the condition of pressure switches associated with fans that are relied upon to clean through their blowing operation the rotating preheater baskets employed in the preheaters utilized within the instant invention. More particularly, the condition sensing gates 701 and 702 are conventional two input OR gates which each receive the output of a pressure switch associated with the output of one of the fans employed for cleaning the preheater baskets and when the fans are appropriately operating, the blowing medium will close the sensors to provide an AC level indicative of this condition. This AC level is transformed into a DC logic level by the signal converter illustrated in FIG. 13 and more particularly by four dedicated AC to DC converters therein which are devoted to sensors A – D. Accordingly, when the cleaning fans for the preheater baskets are operating a high level is imposed on the terminals associated with the pressure sensors therefor indicated in FIG. 12 as PSA, PSB, PSC and PSD. In the conventional manner any time any one of the inputs to the AND gate 701 and 702 go high, a high will be developed at the output of OR gates 701 and 702 connected to conductors 742 and 743 respectively. This high is connected to the terminals annotated $AH_1$ indicia and $AH_2$ respectively in FIG. 12 which connect, through the C2 bus to the respective air heater blowing indicia for the left and right sides of the boiler indicated in FIG. 6 and will cause the illumination of these indicia. The small indicia annotated $RH_1$ – $RH_4$ located above the air blowing indicia in FIG. 6 indicate the appropriate operation of the preheaters per se and these are direct outputs from motor sensors therefor as these preheaters are normally in continuous operation.

All of the various DC logic levels supplied to the permit module circuitry illustrated in FIG. 12 are additionally supplied, as indicated in FIG. 1 through the multiconductor cable 44 where the same are monitored by the controller so that the same may supply appropriate inhibit inputs or the like through the multiconductor cable 40 to the common permit module illustrated in FIG. 12 to initiate emergency retract conditions, inhibit conditions or advisory indications at the display panel. Accordingly, it will be seen that the common permit module acts, in the manner exemplified by the schematics shown in FIG. 12 to respond to sensory inputs initially provided by external sensors to the signal converter circuits illustrated in FIG. 13 and to produce indicia at the boiler diagram and display panel 30 which totally illustrates the condition sensed so that the operator is continuously apprised of the condition of operation within all parts of the system. In addition, whenever conditions are such that an emergency retract signal is required to withdraw the probe of an operational retractable a DC level is issued by the common permit module illustrated in FIG. 12 which is supplied to the signal converter illustrated in FIG. 13 for translation into an AC signal which is applied directly to the sootblower starting circuit associated with a retractable to initiate a retract operation. Similarly, any time a sootblower is in operation, low header pressure conditions are present, a sootblower is blowing or the controller has inhibited operation, a manual permit inhibit signal is initiated which is supplied to the signal converter illustrated in FIG. 13 to foreclose an enabling of circuitry in response to a manual start operation. Accordingly, it will be seen that the manual permit circuitry illustrated in FIG. 12 acts to initiate all display conditions to be set forth for the operator while implementing selective disabling or retract operations as a function of instructions issued by the controller or operational conditions within the system.

In addition to the outputs to the C2 bus generated by the permit module illustrated in FIG. 12, a plurality of direct controller outputs are generated by the programmable controller 1 shown in FIG. 1 and conveyed through the multiconductor cable 40 to the C2 bus to the boiler diagram and display panel 30 whereupon these outputs are directly employed to illuminate selected indicia thereon. While all information applied to the multiconductor cable 40 shown in FIg. 1 is illustrated as being through the common permit module 9 shown in detail in FIG. 12 to the C2 bus, the aforesaid additional outputs from the programmable controller are effectively connected directly to the C2 bus and hence are not shown in detail in FIG. 12. Accordingly, these outputs from the programmable controller which are directly applied to the C2 bus will be briefly discussed to fully acquaint the reader with all the physical aspects of the instant invention although their common connection to the C2 bus will be apparent to those of ordinary skill in the art. The outputs which are applied by the programmable controller directly to the C2 bus through the multiconductor cable 40 are as follows:

Controller Operating Retract
Controller Operating Wallblower
No Blower Air Retract
No Blower Air Wallblower
Time Exceeded Retract
Time Exceeded Wallblower The controller operating retract and controller operating wallblower inputs supplied to the C2 bus from the outputs of the programmable controller are employed to illuminate the controller operating indicia illustrated in FIG. 6 within the blocks 302 and 303 for the retracts and wallblowers respectively. These output signals are automatically provided any time the controller is operating retracts or wallblowers pursuant to program instructions or manual start operations. The no blower air retract and no blower air wallblower outputs are provided by the programmable controller in response to a monitoring of the flow switches which are provided as inputs to the permit module illustrated in FIG. 12 and additionally provided as inputs to the programmable controller from the signal converter circuits 10 through the multiconductor cable 44. More particularly when other inputs to the programmable controller through the multiconductor cable 44 are indicative that either retract or wallblower units are in operation, the flow switch inputs associated with OR gates 692 and 693 for retracts and OR gates 700 for wallblowers are monitored to ascertain whether or not appropriate high levels are present thereon. If such high levels are absent and should be present due to other indicia associated with the operation of a retract or wallblower the programmable controller 1 will issue a no blowing air-retract or no blowing air-wallblower output on the multiconductor cable 40 which is supplied through the C2 bus to the boiler diagram and display panel 30 to illuminate the no blowing air indicia within the appropriate rectangle 302 or 303 within FIG. 6 to apprise the operator as to the nature of the failed condition. In addition, the sootblower unit which is experiencing a malfunction will have its indicia in FIG. 6 flashed in the manner described above.

Similarly, the programmable controller 1 maintains a real time timer for retracts and wallblowers and each time a start up cycle is initiated therefor the operating cycle thereof is timed by the programmable controller in an independent manner for retracts and wallblowers and if the timed operating cycle of the unit exceeds the time alloted by the real timer in that the units operation persists even though the timer has timed out, the time exceeded output is issued by the programmable controller for the retractable or wallblower unit involved and the appropriate block indicia within the block 302 or 303 for the unit involved is illuminated by this output. In addition, if a retractable unit is involved, an emergency retract is issued and in either case, the unit is inhibited until the condition is cleared. The inhibiting is accompanied by a flashing of the indicia associated with the unit involved so that the operator can either disable a unit or dispatch a maintenance unit thereto prior to a resetting of the condition at the programmable controller. In addition to the foregoing signals other advisory indications could be provided to the operator. For instance, once a start up operation was initiated by the programmable controller, the receiver could be monitored after a given interval to ascertain whether the unit had started. If the unit had not started, a no start condition could also be indicated within the retractable or wallblower block indicia illustrated in FIG. 6. Various other conditions which may be viewed as desireable by a designer could be added as direct outputs from the programmable controller due to the myriad of processing available therein as well as all of the sensory inputs which are provided thereto as well as to the permit module. Thus, the nature of the indicia provided in the exemplary boiler display diagram and panel means illustrated in FIG. 6 is in no way viewed as limited. In addition any of the various conditions which are sensed to provide an advisory indication to the operator or are employed for monitoring purposes by the programmable controller as well as other conditions which can be measured by external sensors may be utilized for the purposes of data logging whereupon they are supplied to the programmable controller and accumulated. Thereafter, print out of these conditions may occur on a periodic basis or alternatively, these conditions which are data logged may be supplied to a main plant computer for use in maintaining or varying the operation of the boiler system which is controlled in accordance with the teachings of the present invention.

SIGNAL CONVERTER CIRCUITRY

Referring now to FIG. 13 there is shown a schematic diagram illustrating exemplary signal converter circuits suitable for use in the embodiment of the digital sootblower control system illustrated in FIG. 1. The function of the signal converter circuits illustrated in FIG. 13, as indicated above is to receive AC levels from the sensors in the field and provide logical inputs representative thereof to the permit module illustrated in FIG. 12 and to the programmable controller 1. In addition, three DC levels corresponding to the emergency retract signal, wallblower manual permit and retract manual permit are supplied from the permit module illustrated in FIG. 12 to the signal converter circuits illustrated in FIG. 13. These signals are transduced into an appropriate AC signal and are applied to starting circuits in the field to implement the operation thereof. Therefore, as the plurality of these functions occur on a repetitive basis, the various AC to DC and DC to AC converter means employed therein are merely generally shown with one circuit of each type shown in detail. More particularly, the exemplary signal converter circuits illustrated in FIG. 13 comprise a plurality of AC converter means $750_1$ – $750_{29}$ and a plurality of DC converter means $751_1$ - $751_3$ wherein each of said AC converter means is responsive to an AC sensory input supplied from the field to provide the DC logic output to the programmable controller 1 and/or the common permit module illustrated in FIG. 12 and the DC converter means are responsive to a plurality of DC logical inputs supplied thereto by the common permit module illustrated in FIG. 12 and supply an AC enabling signal to the field devices in the form of a 120 volt AC signal. Each of the AC converter means $750_1$ - $750_{29}$ receives an AC input $AC_1$ - $AC_{29}$ from a field sensor located within the apparatus controlled by the instant invention. More particularly, general designations for the field sensor inputs are provided in FIG. 13 as a detailed discussion of the individualized nature of the AC signals received and transformed into DC logic levels was set forth in conjunction with the discussion of the permit module set forth in FIG. 12. Thus, with regard to the signal converter circuits illustrated in FIG. 13 it may be simply assumed that each of the AC converter means $750_1$ - $750_{29}$ receives either an AC signal or an absence of signal from the various sensors provided about the boiler as mentioned in conjunction with FIG. 12 and whenever an AC signal is present will output a DC level corresponding to a logical one therefor while when an absence of signal is present, a zero level will be output in response thereto to the permit module illustrated in FIG. 12. While only 24 DC inputs are described in conjunction with FIG. 12, 29 AC converter means $750_1$ - $750_{29}$ have been illustrated in FIG. 13 to provide additional DC inputs representative of sensory outputs should the same be required by the designer of an embodiment of the instant invention. All of the outputs provided by the AC converter means $750_1$ - $750_{29}$ as here indicated by the terminals $DC_1$ - $DC_{29}$ are supplied both to the programmable controller through the multiconductor cable 44 illustrated in FIG. 1 for direct monitoring by the programmable and to inputs of the common permit module illustrated in FIG. 12 for direct processing thereby. Each of the AC converter means $750_1$ - $750_{29}$ acts in the conventional manner to transduce an AC level supplied at one of the inputs thereto annotated $AC_1$ - $AC_{29}$ to a logical One representation at the outputs thereof annotated $DC_1$ - $DC_{29}$ or an absence of an AC input to a Zero logical level. As each of the AC converter means $750_1$ - $750_{29}$ may take precisely the same form and provides essentially the same function, only the initial AC converter means $750_1$ has been shown in detail within the dashed block while the remaining AC converter means $750_2$ - $750_{29}$ have been shown in generalized block format. Referring more specifically to the AC converter means $750_1$ illustrated within the dashed block, it will be seen that this AC converter means takes essentially the same form described for the AC converter means employed within the AC receiver circuitry illustrated in FIG. 10 and performs essentially the same conversion mentioned in association therewith. Thus, as indicated within the dashed block $750_1$, the AC converter means each comprise a full wave rectifier 752, a photocoupler 753 and a driver stage 754 much as described in conjunction with the AC receiver circuitry described in conjunction with FIG. 10.

The full wave rectifier means 752 may take the form of a conventional full wave rectifier formed of diodes which receives an AC input as impressed at the terminal annotated $AC_1$ and provides at the output therefrom on conductor 755 an output signal corresponding to a fully rectified AC signal or a Zero level reflecting the absence of an AC signal. The output on the conductor 755 is supplied to the photocoupler 753.

The photocoupler may comprise a conventional photocoupler which achieves perfect electrical isolation of the rectified signal from the DC logic circuit in much the same manner as described in conjunction with the AC receiver circuitry described in conjunction with FIG. 10. Here, the photocoupler 753 may comprise a conventional 4N28 photocoupler such as is available from The Motorola Company which acts in the well known manner to employ the output of the full wave rectifier 752 as impressed on conductor 755 to energize a light emitting diode (LED) which in turn is employed to trigger the base of a photosensitive transistor in the conventional manner. Accordingly, when a fully rectified AC signal is supplied to the conductor 755 a corresponding DC level is supplied at the output of the photocoupler 753 connected to the conductor 756 while when no signal is applied to the AC input annotated $AC_1$ from a field sensor or field sensory loop, a zero level is applied at the output of the photocoupler 753 to the conductor 746. The driver stage 754 may take the conventional form of a DC driver or amplifier which is employed to raise the output of the photocoupler 753 as present on conductor 756 to an appropriate output logic level. Accordingly, whenever an AC signal is impressed upon any of the AC converters $750_1$ - $750_{29}$ at the input terminals annotated $AC_1$ - $AC_{29}$, a DC logic level corresponding to a One level is provided at the outputs thereof at the terminals annotated $DC_1$ - $DC_{29}$ while when no AC input is received from the field sensor, a Zero resides at the DC outputs thereof annotated $DC_1$ - $DC_{29}$. In this manner, AC outputs from the field sensors specifically described in conjunction with FIG. 12 are transformed into operative DC logic levels for use within the common permit module illustrated in FIG. 12 for the logical conversions mentioned therein and are additionally supplied to the inputs of the programmable controller so that current operating factors within the system being controlled may be monitored on a continuous basis thereby.

Conversely, certain DC command information output in response to the logical processing by the common permit module illustrated in FIG. 12 is transformed by the DC converter circuit $751_1$ - $751_3$ illustrated in FIG. 13 into an AC waveform which may be employed directly at the sootblower starting circuits or in association with the supply of power thereto so that the same may be rendered operative in respone to command information supplied thereto by the instant invention. More particularly, it was seen in conjunction with FIG. 12 that an emergency retract signal is issued when conditions are appropriate on the conductor 724 from the permit module illustrated in FIG. 12 which emergency retract signal is transformed by the signal converter illustrated in FIG. 13 into an AC level which is applied to the emergency retract relay at the terminal 687 in FIG. 11 to trigger the immediate retraction of the probe of a retractable sootblower for which a malfunction condition was sensed. Similarly, when manual operation of retracts or wallblowers are appropriate, a manual retract level in the form of a one is output by conductors 718 and 738 in FIG. 12 which signals are transformed into AC levels by the signal converter circuitry illustrated in FIG. 13 and these signals are used thereafter in supplying 120 volt AC information to the sootblower starting circuitry illustrated in FIG. 11 by triggering a triac or the like which supplies basic power across the power conductors 668 and 669 as shown therein.

The emergency retract level from the common permit circuit illustrated in FIG. 12 supplied to the DC converter $751_1$ at the appropriately annotated input terminal thereto while wallblower manual permit and retract manual permit input information is supplied to the appropriately annotated inputs of the DC converters $751_2$ and $751_3$, respectively. In each case, when a One level resides at the inputs to the DC converter $751_1$ - $751_3$ a 120 volt AC output signal is supplied thereto at the output terminals connected to the conductors 757–759 and this output signal is supplied to the starting circuits for the individual sootblowers for utilization therein. As each of the DC converters $751_1$ - $751_3$ takes essentially the same form and performs the same function and in any event is highly similar to the DC conversion circuitry employed within the AC driver, the details of the DC converter $751_1$ have been shown within the dashed block representation thereof, while the DC converters $751_2$ and $751_3$ have been generally shown in block form.

The DC converter $751_1$ comprises a driver stage 760, a photo isolated threshold detector 761, a shaping network 762, and a DC to AC converter 763. When a DC input in the form of a One or an enabling level is applied to the input of the DC converters $751_1$ on the conductor 764, it is amplified by the driver stage 760 to an appropriate level to trigger the photo isolated threshold detector 761. The driver stage 760 may comprise a conventional amplifier stage which acts in the well known manner to raise a DC input level supplied thereto to a value which is appropriate to trigger the photo isolated threshold detector 761. The output of the driver stage 760 is supplied as indicated to the input of the photoisolated threshold detector 761. The photoisolated threshold detector may comprise a conventional photodetector network such as an H11C2 photodetector combination manufactured by The Motorola Company which comprises essentially a light emitting diode and a SCR arranged to be triggered thereby. More particularly, when the output level of the driver stage is sufficient to cause the light emitting diode within the photoisolated threshold detector 761 to emit light, the SCR which is photosensitive is triggered thereby to cause an output voltage which is photoisolated from the input voltage to be developed at the output of the photoisolated threshold detector 761 on the conductor 765. This output is then supplied to the shaping network 760 to which may comprise a fullwave rectifier or other appropriate shaping device to impose a DC level at the output thereof connected to the conductor 766. The DC to AC converter 763 may here comprise a triac which is connected across a 120 volt supply and is arranged to be triggered by the output of the shaping network 762 applied thereto through the conductors 766. Thus, when a one level is applied to the input to the DC converter $751_1$ at the input terminal 764, the resulting output of the threshold detector 761 is shaped and employed to trigger a triac within the DC to AC converter 763 and hence, in the well known manner, cause a 120 volt AC signal to be applied to the output conductor 757. This 120 volt AC signal in the case of the DC converter $751_1$ is employed to directly energize a retract relay in the starting circuitry for retractable sootblowers as illustrated in FIG. 9 while in the case of the DC converters $751_2$ and $751_3$ is employed to trigger triacs furnishing supply voltages to respective ones of the starting circuits for the retract and wallblower sootblower units. Also a monitoring circuit may be added to the AC converter so that the status of AC field sensors can be viewed prior to processing.

Accordingly, it will be appreciated that the signal converter illustrated in FIG. 13 acts to transform AC sensory inputs supplied from field sensors into logical levels suitable for processing by the programmable controller 1 and the permit module illustrated in FIG. 12 and conversely is responsive to DC commands issued by the permit module to supply AC levels to the sootblower starting circuits to enable or disable the same or cause the initiation of an immediate retract operation. Thus, through sensory inputs present in the field, the system and operator is constantly apprised of the operational conditions within the system while the same may cause the issuance of commands to immediately enable, disable, of initiate retract operations at specified sootblower units.

EXECUTIVE PROGRAM

While the description of FIG. 1 is directed to the generalized organization of structure within the instant invention and FIGS. 2 - 13 disclose in a highly detailed way, specifics of each of the peripherals therein, the progammable controller 1 as illustraed and disclosed in conjunction with FIG. 1 must be loaded with an appropriate executive program to cause the processing and exchange of information within the system in the manner set forth in conjunction with the structure described in association with FIGS. 1 - 13. The executive program may take various forms and may be readily modified to function in various ways for specified applications of the instant invention in manners well known to those or ordinary skill in the art. However, to assure that one of ordinary skill in the art will gain a full appreciation of the instant invetion, an exemplary executive program suitable for use herein is attached hereto as Appendix A and is additionally provided with heavy annotation to ensure that one of ordinary skill in the art can implement the instant invention without resort to heavy programming functions. The exemplary program attached hereto as Appendix A is provided with reference annotations to assist the reader thereof in gaining a full appreciation thereof; however, it will be appreciated that while the exemplary program attached hereto is included as part of the instant specification by reference, a multitude of variations and modifications therein are available to those or ordinary skill in the art should it be desired to modify the exemplary embodiment of the instant invention to specify other applications or to vary or enhance the control, monitoring or operational procedures therein.

Furthermore, to assist a reader of the instant specification in a complete understanding of the exemplary embodiment of the present invention, a highly simplified set of functional flow sheets have been set forth in conjunction with FIGS. 14 - 22 and the operation of the exemplary program will be set forth in a highly simplified manner with respect to the simplified flow charts set forth herein. Thus, while the operations outlined in conjunction with the flow charts proceed to provide a functional description of the operation which occurs in conjunction with the exemplary executive program attached hereto as Appendix A and is highly simplified, it should be appreciated at the outset that a detailed understanding of the programming technique employed may be obtained directly fron a review of Appendix A which is incorporated herein by reference.

Figure 14:
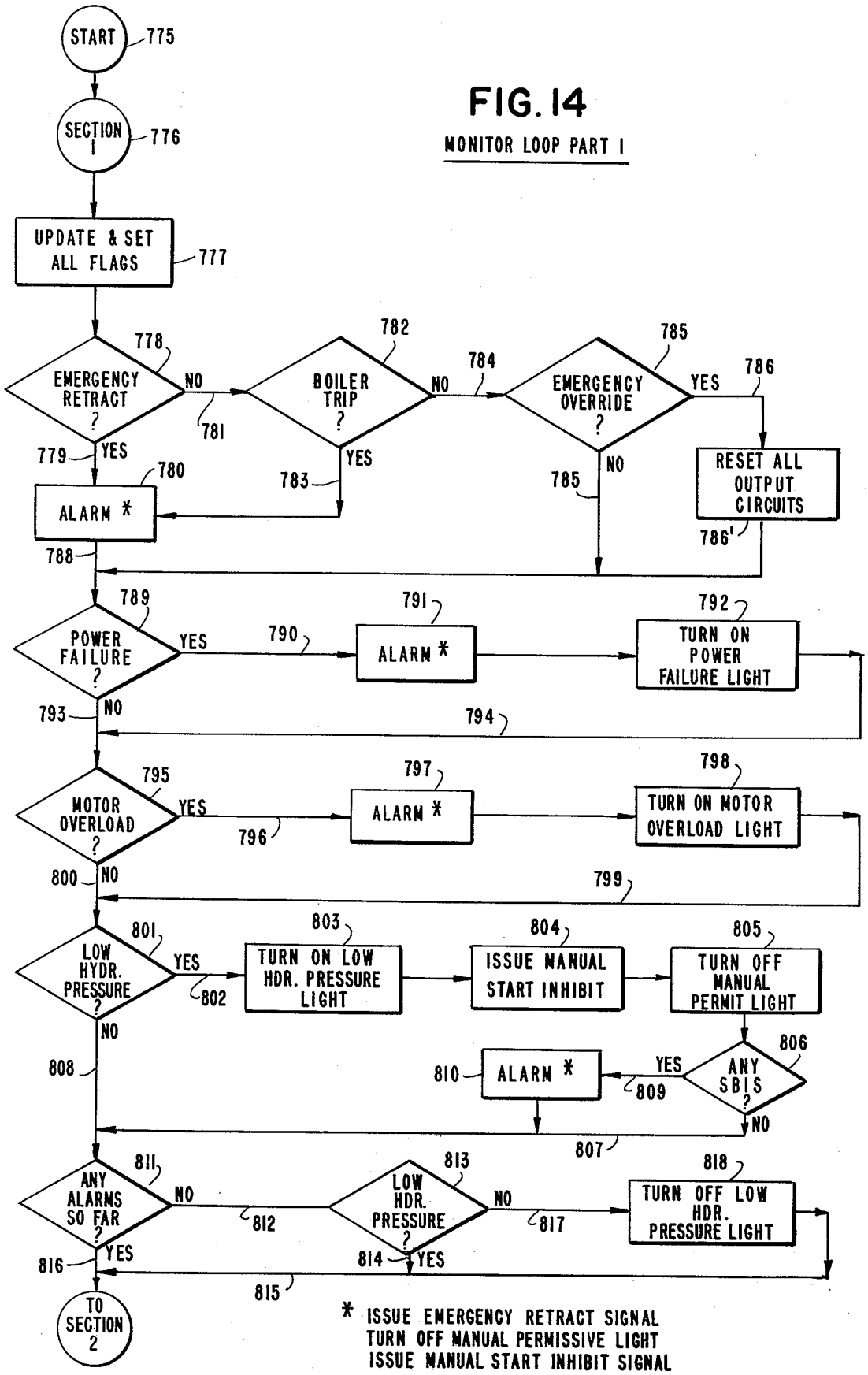
Figure 16:
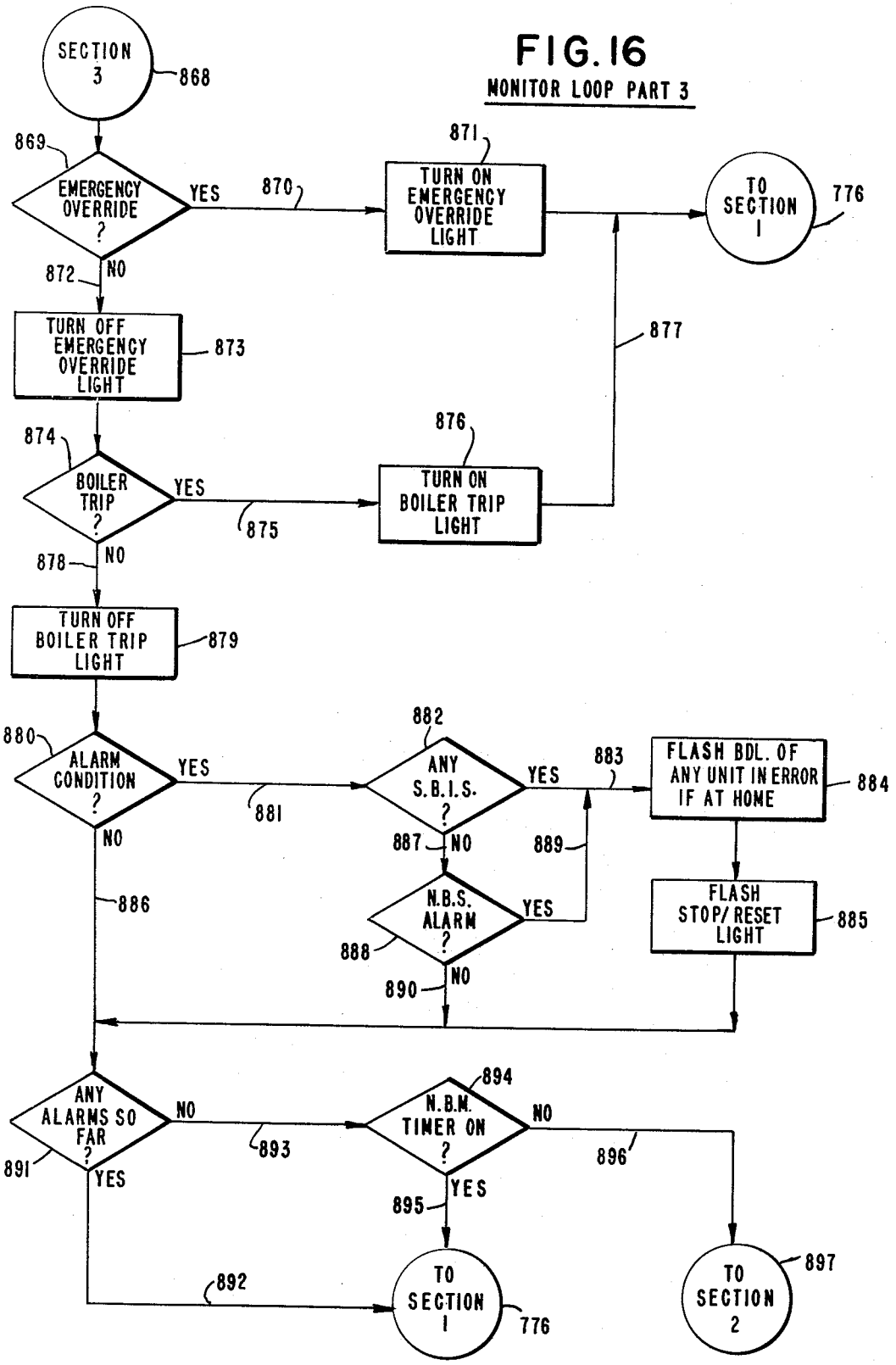
Figure 18:
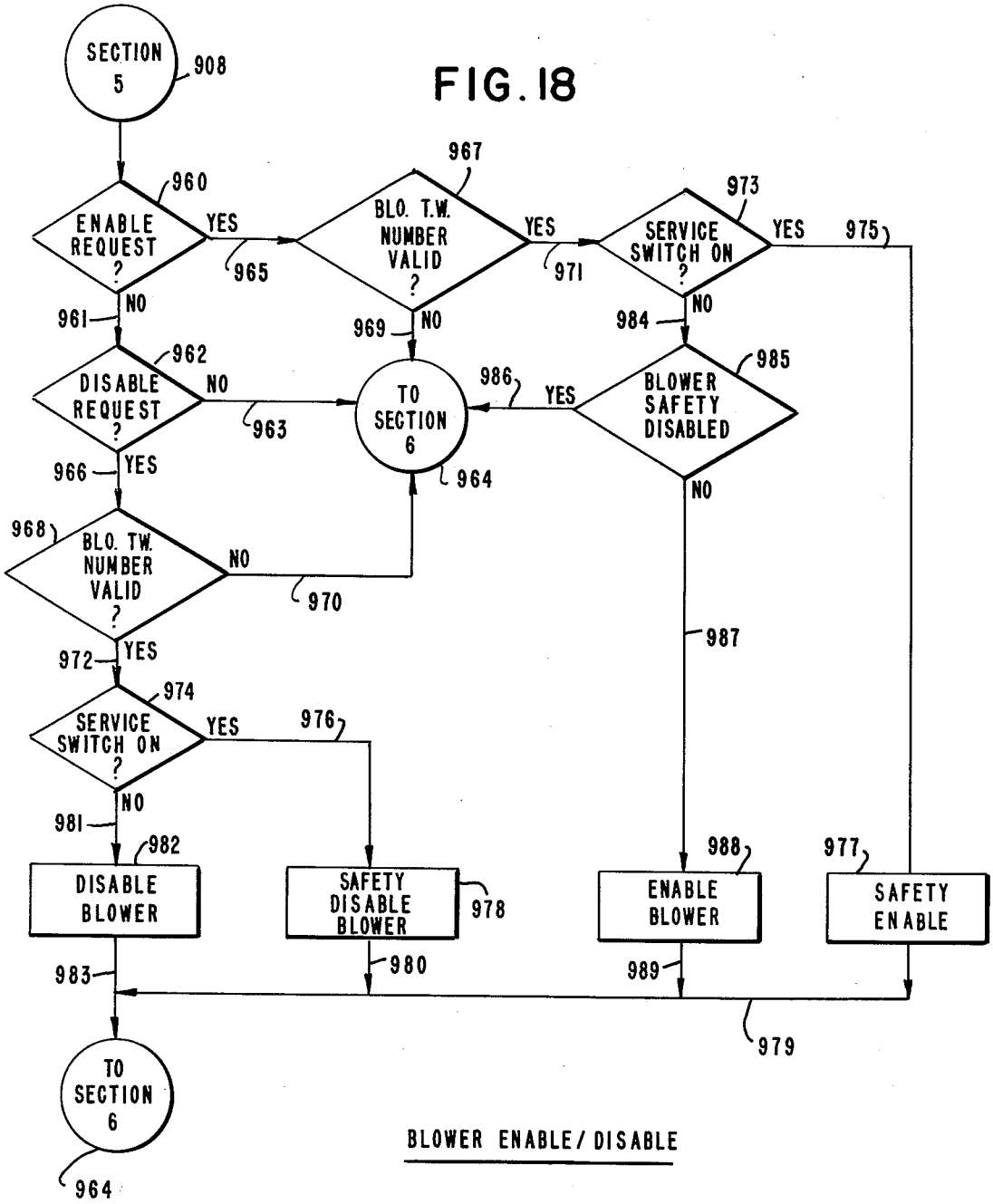
Figure 20:
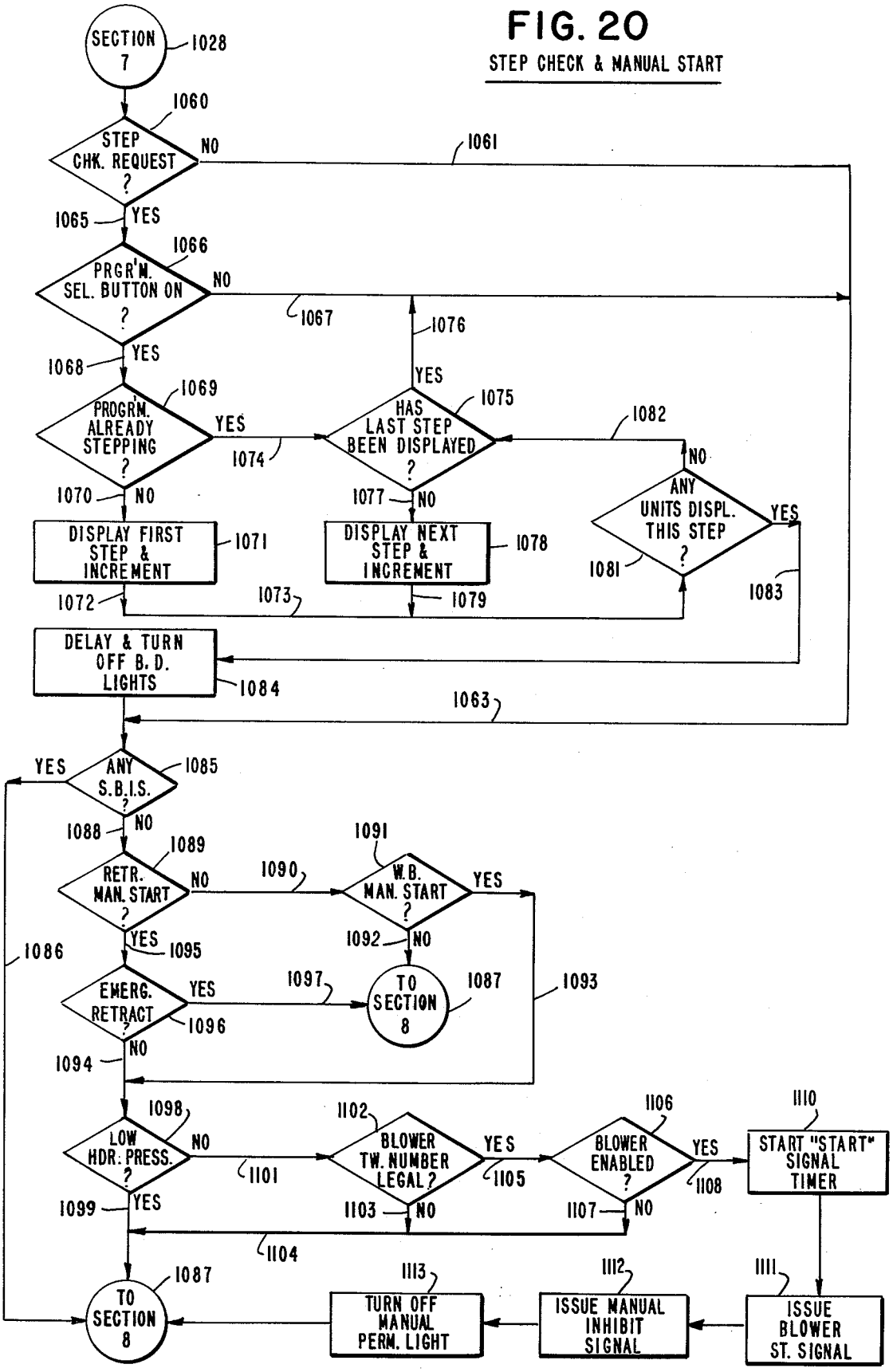
Figure 19:
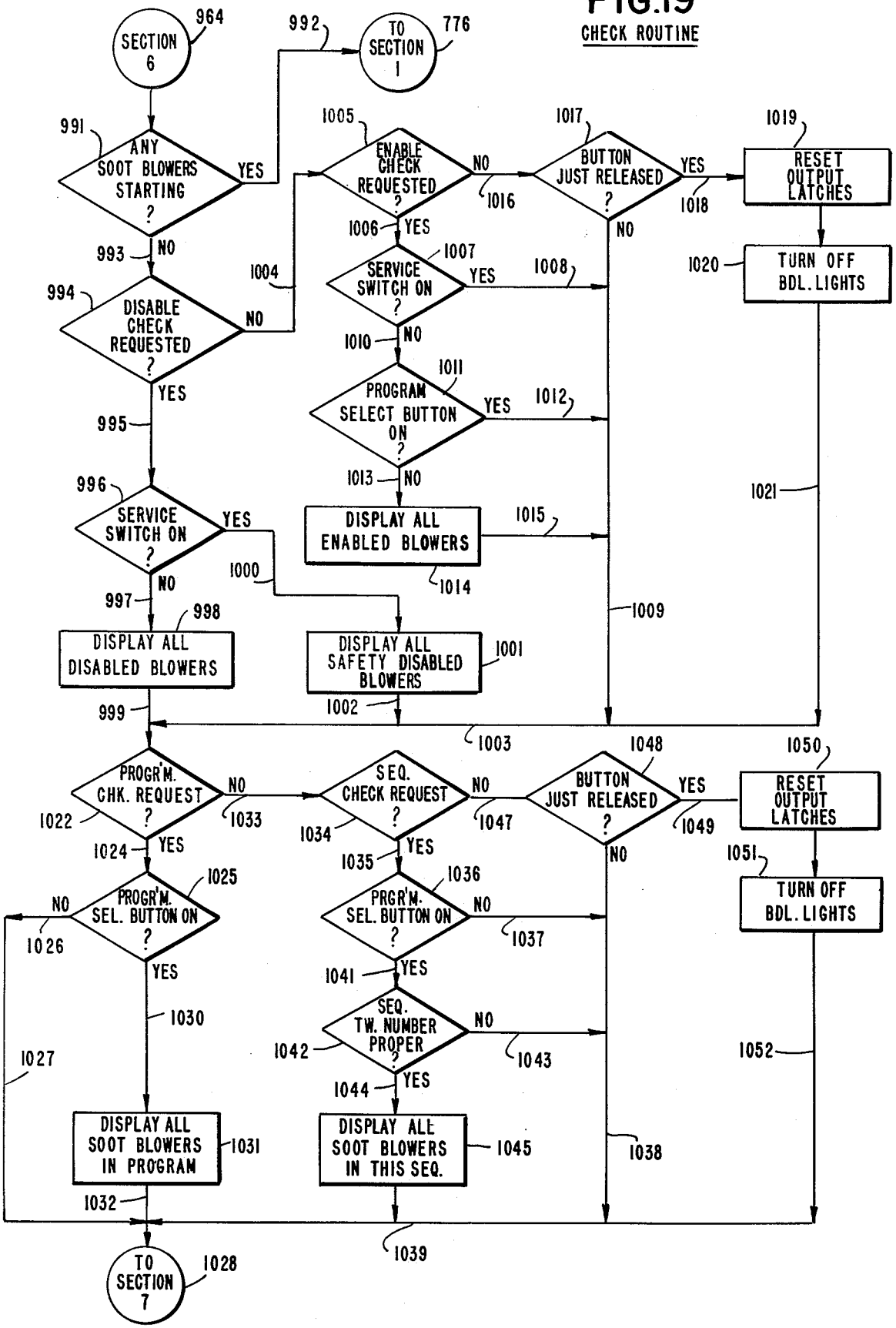
Figure 21:
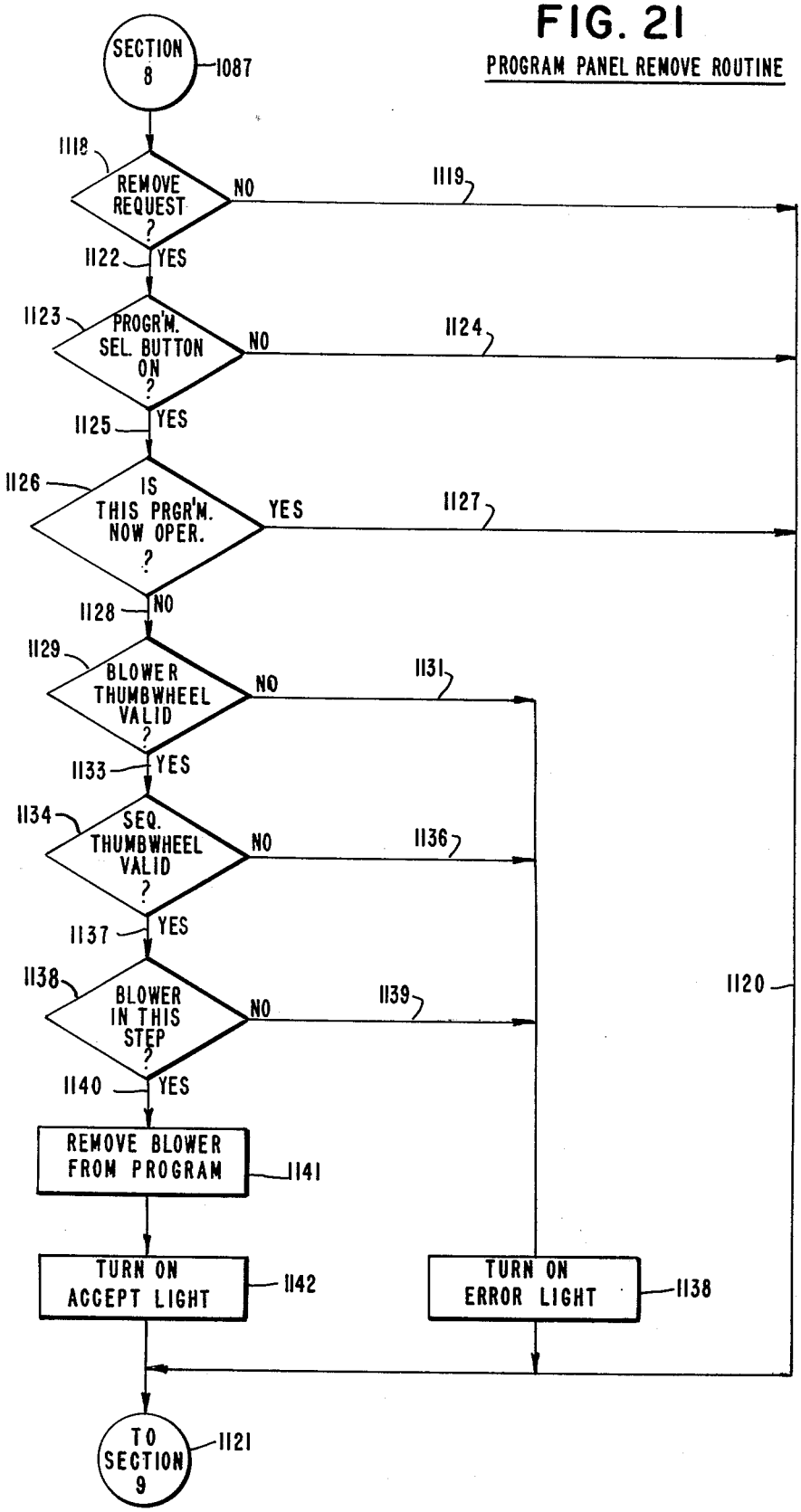
Figure 22:
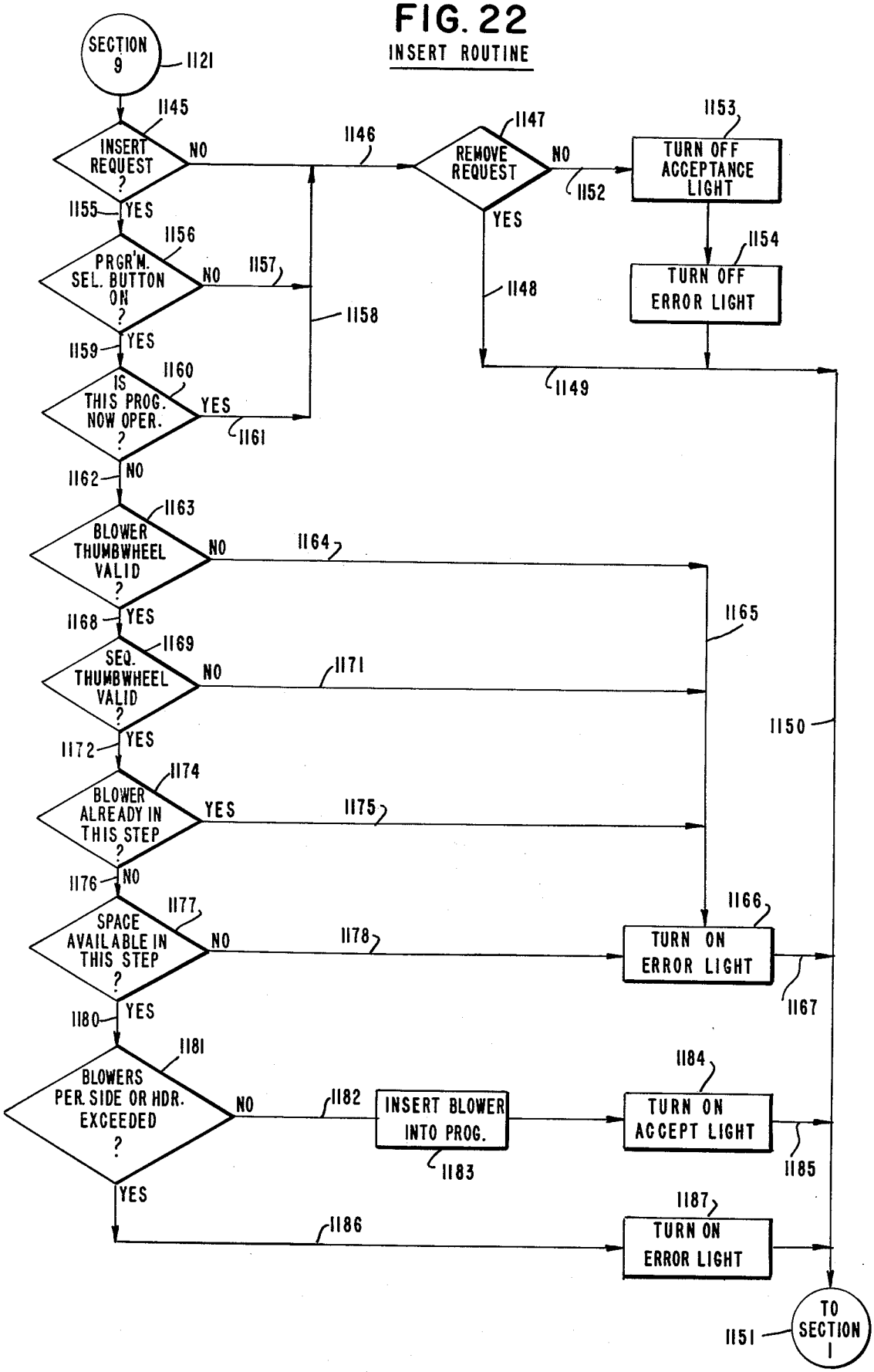

The functional flow diagrams set forth in conjunction with FIGS. 14 – 22 represent in combination the operations which take place under the control of the executive program and are separated among the figures in such manner so as to illustrate separate portions of the executive program in a functional manner associated with one or more specific routines. More particularly, FIGS. 14 – 16 illustrate portions 1 – 3 of the monitor routine within the executive program wherein registers and flags are set and sensory conditions are monitored prior to the initiation of any action. FIG. 17 sets forth a flow chart illustrating in a functional manner the manner in which automatic program execution is initiated while FIG. 18 sets forth a flow chart illustrating the manner in which the selective enabling or disabling of sootblowers within the system is implemented. FIGS. 19 and 20 illustrate the manner in which various check routines and manual start up operations are implemented under the control of the executive programmer while FIGS. 21 and 22 illustrate the manner in which sootblower designations are inserted or removed from programmed blowing routines during programming operations by an operator. The flow chart set forth in FIGS. 14 – 22 are described in great detail below.

THE MONITOR PORTIONS OF THE EXECUTIVE PROGRAM

Referring now to FIG. 14, there is illustrated a functional flow diagram showing part 1 of a three part representation of the monitor loop portion of an exemplary executive program which may be employed within the instant embodiment of the present invention. Turning specifically to FIG. 14 it will be seen that the executive program is entered at the location indicated by the circular flag 775 annotated START. If the system is being powered or initially energized a hardware interrupt for the power up routine, not shown, is initially entered where in essence semi-conductive registers, flip flops, counters and the like are cleared after a suitable delay interval which allows any transient conditions and spurious noise levels to subside. At the onset of the power up routine, all registers and the like are loaded from memory. Thereafter, as indicated by the oval flag 776, Section One of the executive program which contains, as aforesaid, part one of the monitor loop is entered and, as will be appreciated by those of ordinary skill in the art, each time the entire executive program is cycled through, which occurs every 200 ms., the monitor loop is re-entered at part one at the location indicated by the oval flag 776 annotated SECTION 1.

When part one of the monitor loop of the executive program is entered at the location indicated by the oval flag 776, all flags are updated and set in the manner indicated by the rectangle 777. In essence, what here occurs is that all pertinent register information within the hardware is reviewed and stored away within the memory of the programmable controller. This means, that all sensory signals which are supplied to the programmable controller from the signal converter are stored away in memory as flag conditions as well as any switch information input at the various information panels illustrated in FIGS. 2A – 2C. This is done, as will be recalled, through the selective gating of such switch input information through the OR gate and arrays associated therewith and ultimately onto the A bus for direct application to registers within the programmable controller 1. In addition, the state of various timers and counters within the system, all of which will be better appreciated from subsequent discussion of the flow charts, are stored away to provide flag information which is current and reflects current operating conditions as well as commands entered into the system.

Upon completion of the updating and setting routine of all flags as indicatd by the rectangle 77, the program initially tests in the manner indicated by the diamond 778 to ascertain whether or not an emergency retract condition is in being. This test, as will be appreciated by those or ordinary skill in the art is conducted by testing the state of a flag which is set each time an emergency retract command is issued within the system. If the test indicated by the diamond 778 is affirmative, as indicated by the arrow 779 annotated YES, an alarm condition is initiated in the manner indicated by the rectangle 780. When an alarm condition is initiated, as indicated by the asterisk and the annotations associated therewith in the lower left hand portion of FIG. 14, an emergency retract signal is issued if the same has not already been commanded, the manual permit light at the indicia panel is turned off and a manual start inhibit signal is issued all in the manner described above.

Similarly, if the test indicated by the diamond 778 is negative in the manner indicated by the arrow 781 annotated NO, the program next tests to ascertain whether or not the boiler is in a tripped condition in the manner indicated by the diamond 782. The boiler trip condition is set into a flip flop in the update and setting portion of the routine indicated by the rectangle 777 and in essence, as will be appreciated by those of ordinary skill in the art, is indicative of whether or not the boiler has tripped out or is in an operating state. If the boiler has tripped out or is not operating in the manner indicated by the arrow 783 annotated YES, alarm instructions are issued in the manner indicated by the rectangle 780. However, if the boiler trip condition test is negative in the manner indicated by the arrow 784 annotated NO, the program next tests in the manner indicated by the diamond 785 as to whether or not an emergency override condition is present. This again occurs through the sampling of a flip flop which is set when an emergency override condition is initiated through the operation of supervisory personnel in the manner described above. If the results of the test indicated by the diamond 785 are affirmative, as indicated by the arrow 786 annotated YES, the output circuits on the controller are reset to allow manual control by the scanner multiplexer in the manner indicated by the rectangle 786'. Thereafter, the main routine is rejoined at the location indicated by the arrow 788.

If the condition indicated by the test associated with the diamond 785 is negative as indicated by the arrow 787 annotated NO, the issuance of the alarm condition associated with the rectangle 780 is bypassed and the main program is re-entered at the location indicated by the arrow 788. Accordingly, once the program updates and sets all flags in the manner indicated by the rectangle 777, it initially checks to ascertain whether or not an emergency retract condition or a boiler trip condition is present in the manner indicated by the diamonds 778 and 782. If any of these conditions exist, an alarm condition is issued in the manner indicated by the rectangle 780 wherein an emergency retract signal is issued, the manual permit indicia is de-energized and a manual start inhibit signal is issued. Conversely, if no emergency retract condition or boiler trip condition is present, the issuance of an alarm in the manner indicated by the rectangle 780 is bypassed, all output circuits are reset if an emergency retract condition is present and the main portion of this program routine is rejoined at the location indicated by the arrow 788 so that further tests which serve as a predicate to the initiation of programmed operating routines may be conducted.

When the program is re-entered at the location indicated by the arrow 788 either subsequent to the issuance of an alarm condition in the manner indicated by the rectangle 780 or due to the absence of an emergency retract, boiler trip, or emergency override condition as indicated by the arrow 787, the system then tests, in the manner indicated by the diamond 789, as to whether or not a power failure condition has occurred. The test for the power failure condition may comprise both a test for the AC level supplied to the controller 1 and the 5 volt DC level which is supplied through each peripheral within the system on a separate conductor within the B bus on a conductor in a serial manner so that a DC failure within any peripheral will be detected in the well known manner. The AC and DC levels may then be periodically tested and the result thereof employed to set flags in association with the rectangle 777 so that both an AC and DC power level test is in fact implemented in association with the sampling of the condition of these flip flops in the manner indicated by the diamond 789. If a power failure condition is detected in the manner indicated by the arrow 790 annotated YES, an alarm condition is issued in the manner indicated by the rectangle 791. The commands issued as a result of the step indicated by the rectangle 791 are identical to those described in association with the alarm indicia rectangle 780 described above. While the instant invention employs a programmable controller 1 which relies upon a magnetic core array and hence, will retain both the executive program and conditions stored therein in the event of power failure, it should be noted that it would also be possible to employ a temporary power supply within the system which would be energized in response to the alarm condition to either mantain operation or alternatively provide a sufficient operating interval to dump the registers onto magnetic tape or the like should a volatile storage medium be preferred over magnetic cores. In any event, after the issuance of an alarm condition in the manner indicated by the rectangle 791, the power failure light is turned on in the manner indicated by the rectangle 792 and thereafter the main portion of the program routine is returned to at the location indicated by the arrow 793 in the manner indicated by the arrow 794.

Alternatively, should the test for a power failure condition indicated by the diamond 789 prove negative, as indicated by the arrow 793 annotated NO, the program next tests in the manner indicated by the diamond 795 to ascertain whether or not a motor overload condition is present. The motor load condition, it will be recalled is indicated to the hardware through field sensors in the manner described in association with the permit module and field entry conditions are supplied from the signal converter to the controller to advise of this result. Thus, whenever a motor overload condition is detected in association with the operation of the retracts, a flag will be set in the step associated with the rectangle 777 to cause the controller to issue a motor overload condition and the result of the motor overload condition will be indicated during the test therefor in the monitor loop indicated by the diamond 795.

If the test for a motor overload condition indicated by the diamond 795 is affirmative as indicated by the arrow 796 annotated YES, an alarm command will be initiated in the manner indicated by the rectangle 797. The alarm commands issued in association with the rectangle 797 are precisely the same as occur in response to this condition in the manner described in conjunction with the rectangle 780. Thereafter, as indicated by the rectangle 798, the motor overload condition within the boiler and display diagram is illuminated to again apprise the operator as to the precise nature of the alarm condition which has occurred. Thereafter, in the manner indicated by the arrow 799 the main routine is returned to at the location indicated by the arrow 800.

If the test for a motor overload condition is negative as indicated by the arrow 800 annotated NO, the system next tests in the manner indicated by the diamond 801 as to whether or not a low header pressure condition is present. A low header pressure condition, it will be recalled, is detected through the use of external sensors as described in condition with the permit logic unit disclosed in association with FIG. 12 and is additionally supplied to the controller after signal conversion by the signal converter unit illustrated in FIG. 13. The presence of this condition as applied to the controller is then employed to set flags in the manner indicated in conjunction with the rectangle 777. Thus, it is the condition of these flags which are tested in association with the test for low header pressure indicated by the diamond 801. If the test for a low header pressure condition is affirmative as indicated by the arrow 802 annotated YES, and it will be recalled that this test is performed for each of the five headers involved in the exemplary system, the low header pressure indicia at the boiler diagram and display panel is energized in the manner indicated by the rectangle 803. Thereafter, as indicated by the rectangle 804, a manual start inhibit command is issued by the programmable controller and subsequently, as indicated by the rectangle 805, the manual permit indication at the boiler panel and display diagram is turned off.

After a manual start inhibit command has been issued and the manual permit light has been turned off in the manner indicated by the rectangles 804 and 805, the system then tests in the manner indicated by the diamond 806 as to whether or not any sootblower is in service. If the test for a sootblower in service is negative in the manner indicated by the arrow 807 annotated NO, the program main routine is returned to at the location indicated by the arrow 808. This action is here appropriate because the system may have just been energized and a pressure condition has not yet been buildup within the headers. Therefore, since no sootblower is yet in service no alarm condition need be entered. However, if a sootblower is in service in the manner indicated by the arrow 809 annotated YES, an alarm condition is issued in the manner indicated by the rectangle 810 and thereafter the program main routine is returned to at the location indicated by the arrow 808. The alarm commands associated with rectangle 810 are the same as described for the alarm conditions associated with the rectangle 780.

If the test for a low header pressure condition indicated by the diamond 801 is negative as indicated by the arrow 808 annotated NO, the system next tests as to whether or not any alarm has yet been issued and it should be appreciated that each time an alarm condition is issued an appropriate flag is set to indicate that the same has occurred. If the test for an alarm condition indicated by the diamond 811 is negative as indicated by the arrow 812 annotated NO, the system next tests in the manner indicated by the diamond 813 as to whether or not a low header pressure condition is present. If the test associated with the diamond 813 is affirmative as indicated by the arrow 814 annotated YES the system returns as indicated by the arrow 815 to the main program routine at a location indicated by the arrow 816. However, if no low header pressure condition is present in the manner indicated by the arrow 817 annotated NO, it means that a pressure condition has builtup in the headers monitored or that appropriate header pressure is now present. Accordingly, as indicated by the rectangle 818, the low header pressure light is deenergized and thereafter the main program routine is returned to in the manner indicated by the arrow 815.

If alarms have been issued as indicated by an affirmative result from the tests indicated by the diamond 811, in the manner associated with the arrow 816 annotated YES, the program then moves to SECTION 2 which corresponds to part two of the monitor loop which is illustrated in FIG. 15. Thus, if no alarms have been issued the low header pressure condition is tested and if no low header pressure condition is present the low header pressure light is deenergized which will either turn the light at the display off or maintain it in a deenergized condition and thereafter entry to SECTION 2 of the executive program occurs. Similarly, if an alarm condition has been issued or a low header pressure condition is present, direct movement to SECTION 2 of the monitor loop occurs.

Referring now to FIG. 15, there is shown a functional flow diagram illustrating part 2 of the monitory loop portion of the exemplary executive program which may be employed within the instant embodiment of the present invention. More particularly, turning to FIG. 15, it will be seen that the second portion of the monitor loop illustrated therein is entered at the location indicated by the oval flag 820 annotated SECTION 2. Part two of the monitor loop illustrated in FIG. 15 acts, in essence, to ensure that if any sootblower has been started either by manual or automatic means, operation proceeds in an appropriate manner while if no sootblowers have been started, an enabling of the manual permit mode of operation is implemented so that an operator may start sootblowers in a manual mode under the control of the programmable controller 1. Thus, while part one of the monitor loop acted to ensure that all prerequisites for the basic operation was present and that no alarms were pending, part two of the monitor loop as illustrated in FIG. 15 attends to appropriate operation of a previously initiated sootblower and if no sootblower operation was previously attempted through automatic execution or manual operation, an enabling of the manual permit mode of operation is implemented.

When part two of the monitor loop illustrated in FIG. 15 is entered at the location indicated by the circular flag 820, the program first acts, in the manner indicated by the diamond 821, to ascertain whether or not the start signal timer has expired. The start signal timer is a software timer which is started during an automatic program execution routine or manual start, as will be described in conjunction with FIGS. 17 and 20, which provides, in essence, a five second start signal during which sootblowers which have been issued start signals must start. All start signals are removed after five seconds and if no start up takes place within the five second interval mandated by the start-up timer, established under software control, the system assumes a malfunction condition has occurred. Thus, the system tests in the manner indicated by the diamond 821 to ascertain whether or not the start signal timer has timed out through the testing of a flip flop associated therewith.

If an affirmative result is indicated by the test associated therewith, diamond 821, as indicated by the arrow 822 annotated YES, all start signals are terminated, as indicated by the rectangle 822', and the program next tests in the manner indicated by the diamond 823 to ascertain whether or not all blowers have appropriately started. Thus, it will be recalled that when start instructions have been issued to specifically addressed sootblowers, the programmable controller may act under the auspices of the executive program to address each sootblower to which a start command was issued and obtain from the AC receiver circuits an indication of whether or not that sootblower is operating. Thus, in this manner, the check indicated by the diamond 823 is performed. If all sootblowers have started properly in the manner indicated by the arrow 824 annotated YES, the main portion of the routine is returned to in the manner indicated by the arrows 824 and 825 at a location associated with the arrow 826. However, if the test indicated by the diamond 823 is negative as indicated by the arrow 827 annotated NO, it means that not all the blowers which were desired to be started have started within the 5-second interval allowed by the start signal timer. Under these conditions, as indicated by the rectangle 828, an alarm command is issued to bring the malfunction condition to the attention of the operator. The alarm condition indicated by the rectangle 828 is precisely the same as described in conjunction with the alarm command rectangle 780 in FIG. 14 with the addition that here the sootblowers which have failed to start as ascertained by addressing the AC receiver circuits have their indicia on the display flash through a pulsing of the signal supplied thereto by the display decoder so that the operator is fully apprised as to which sootblowers have failed to start and presumably have malfunctioned. In addition, the NO Blower Start indicia on the display is illuminated in the manner indicated by the rectangle 829 so that the nature of the malfunction associated with the alarm is specified at the boiler diagram and display panel whereupon the operator is fully apprised as to the condition of malfunction. Thereafter, as indicated by the arrow 825 the program returns to the main portion of the routine associated with the arrow 826.

If the start timer has not timed out in the manner indicated by the arrow 826 annotated NO, the program attempts to ascertain whether or not any sootblower is in operation, is in an initiating phase and if not the manual permit light is turned on. The start signal timer times the sootblower start signal only and does not indicate if the start signal was initiated manually or automatically. Similarly, the test associated with diamond 821 only ascertains whether or not the timer has timed out and whether a sootblower to which a start signal has been issued is on or off. Therefore, if the start signal timer has not timed out in the manner indicated by the arrow 826, the program next monitors sootblower operation in the manner indicated by the diamond 832 to ascertain whether or not any sootblower is in service. This may be achieved by examining the condition of the flip flops set in response to signals present on the common sootblower in service line, as aforesaid and is not associated with whether operation was initiated through automatic or manual start up procedures. If no sootblower is in service in the manner indicated by the arrow 831 annotated NO, the program next tests in the manner indicated by the diamond 832 to ascertain whether or not any sootblower is blowing. If a sootblower is blowing under conditions where there is no sootblower in service signal we may have a malfunction condition where a valve is stuck in an open condition at the input of a sootblower. Thus it will be recalled that in essence, the inputs here being tested are flow switch inputs which should not be in an open condition if the sootblower is in a parked condition. The sootblower in service signal is always present before any flow occurs. Accordingly, under conditions when no sootblower is in service, the system is tested for flow into a sootblower in the manner indicated by the diamond 832 to ascertain whether or not the system is in a quiescent condition or whether further testing pursuant to a sootblower operation is appropriate.

If the test indicated by the diamond 832 is negative as indicated by the arrow 833 annotated NO, Elapsed Time timers and NO Blowing Media timers, which are established under software control in a manner to be described below, are stopped and reset in the manner indicated by the rectangle 834 as the negative results obtained from the test associated with diamonds 830 and 832 are indicative that no sootblower has started and hence neither its' timed cycle of operation or the interval for flow to be established therein need be timed. It should be appreciated that under the conditions associated with a negative result from the test defined by the diamond 832 the elapsed time timer and no blowing medium timers established under software control will normally be in a stop condition assuming no malfunction has occurred and hence the command associated with the rectangle 834 is merely a housekeeping function which is periodically performed.

Once the commands associated with the rectangle 834 have been performed the program will seek to ascertain whether the enabling of a manual permit mode of operation is appropriate. This is done by initially testing, in the manner indicated by the diamond 835, as to whether or not any alarms have been issued thus far in the program sequences of operation by testing the condition of a flag set each time an alarm is issued. If an alarm has been issued in the manner indicated by the arrow 836 annotated YES, it is indicative that an alarm condition has occurred and has not yet been reset. Under these conditions as indicated by the arrow 836 annotated YES, branching in the manner indicated by the arrows 837 and 838 occurs so that the remaining portions of part two of the monitor loop are bypassed and the program proceeds to SECTION 3 of the executive program which is associated with the last part of the monitor loop and is described in FIG. 16.

If no alarms have yet been issued in the manner indicated by the arrow 840 annotated NO, the program next tests in the manner indicated by the diamond 841 to ascertain whether or not the start signal timer is on. The start signal timer it will be recalled is a software timer which is started each time a start signal is issued to a sootblower by the AC driver and in essence permits a five-second interval for the sootblower to start. If the start signal timer is on in the manner indicated by the arrow 842 annotated YES, it means that while no sootblower is yet in service and no sootblower is blowing the start up routine under automatic control or manual start procedure has been initiated for one or more sootblowers. Under these conditions, as indicated by the arrows 842, 837, and 838, the remaining portions of the program illustrated in FIG. 15 are bypassed and entry to SECTION 3 of the executive program occurs in the manner indicated by the circular flag 839.

If the start signal timer has not been started as indicated by a negative result from the test associated with diamond 841 as indicated by the arrow 843 annotated NO, the program is assured that the sootblower system is in a quiescent state, flow is not present and that no sootblower operation is in the process of initiation. Under these conditions, as indicated by the rectangles 844 and 845, the manual start inhibit is removed and the manual permit light which corresponds to the illumination of the manual start key is turned on whereupon, as indicated by the arrow 838 and the circular flag 839 branching to SECTION 3 of the executive program takes place. Accordingly, when no sootblower operation is in progress and no sootblower is blowing and no start up operation is in the process of initiation, conditions are appropriate for enabling the operation of sootblowers in a manual mode as directed by the operator and this is enabled by the removal of the manual start inhibit and thereafter apprising the operator that this mode of operation is permissible by an illumination of the manual start key.

When no sootblower is in service in the manner indicated by the arrow 831 but flow to the sootblower is indicated by the test associated with the diamond 832, a flow switch at the input side to a sootblower may be stuck in an open condition, as aforesaid, or alternatively that sootblower may just be finishing and flow is slowly subsiding. Under these conditions, as indicated by the arrow 846 annotated YES and the rectangle 847, a no blowing media timer is started. The no blowing media timer is a software timer which is employed to provide a real time interval which typically may be from 45 - 60 seconds during which a media blowing condition is established at the output of a sootblower as monitored by the flow switches thereat. Thus, whenever the results of the test indicated by the diamond 832 are affirmative to thus indicate that blowing media is being supplied at the input to the sootblower and there is no sootblower in service, a software timer is enabled to establish a real time interval of from 45 - 60 seconds. After the no blowing media timer is started in the manner indicated by the rectangle 847, the expired or unexpired condition of this timer is tested in the manner indicated by the diamond 848. If the no blowing media timer has timed out in the manner indicated by the arrow 849 annotated YES, a condition is confirmed wherein flow is established at the input side of a sootblower while no flow is established at the output side thereof and hence the presence of a malfunction is confirmed. Under these conditions, as indicated by the rectangles 850 and 851 an alarm condition, as described above, is initiated and additionally the no blowing media light at the boiler and display panel is illuminated in the manner indicated by the rectangle 851. Additionally, the malfunctioning sootblower will have its indicia flashing in the manner described above.

Conversely, if the no blowing media timer has not timed out in the manner indicated by the arrow 852 annotated NO, the alarm conditions and advisory conditions associated with rectangles 850 and 851 are bypassed in the manner indicated by the arrow 853 and the main routine is rejoined at the location indicated by the arrow 854. Here, as will be appreciated by those of ordinary skill in the art, this bypass mode is appropriate because while media is being supplied at the input to a sootblower the presence of a stuck flow switch may not be confirmed as the 45 – 60 second interval in which flow must be established at the output side of the sootblower has not yet expired.

After testing the condition of the no blowing media timer in the manner indicated by the diamond 848, the condition of the elapsed time timer is tested in the manner indicated by the diamond 855. The elapsed time timer comprises one of three software timers which are established to time the cycle of operation of sootblowers once a start up thereof has been confirmed. More particularly, it will be recalled that wallblowers typically have a one minute a cycle of operation while retracts have cycles of operation which typically fall within eight or fifteen minute intervals depending upon the nature of the retract involved. Accordingly, whenever a start up routine for sootblowers is initiated the nature of the sootblower is defined by the address therefor and as shall be seen below the appropriate software timer therefor is indicated by a flag. Then once a sootblower in service signal is acquired the appropriate timer is initiated therefor so that the cycle of operation thereof is timed and should the sootblower become stuck in a non-home position this condition will be indicated by the timing out of the software timer initiated therefor. Accordingly, if the test indicated by the elapsed timer is negative as indicted by the arrow 856 annotated NO, the elapsed time timer has not yet expired and operation of the sootblower started in a non-home position is appropriate. Under these conditions, the program therefor continues to SECTION 3 of the monitor loop in the manner indicated by the circular flag 839.

Conversely, if the test associated with the diamond 855 is affirmative as indicated by the arrow 857 annotated YES the elapsed time timer has timed out and it is assumed that the sootblower or blowers being monitored are stuck within the boiler away from their home position. Under these conditons an alarm is issued in the manner indicated by the rectangle 858, the blower or blowers involved have their indicia flashed in the manner described above and the time exceeded light at the boiler and display panel is illuminated in the manner indicated by the rectangle 859. Once these conditions have been initiated the program then shifts to SECTION 3 of the monitor routine, as shown in FIG. 16, in the manner indicated by the arrow 838 and the circular flag 839. Accordingly, when either the no blowing media timer or the elapsed time timer have timed out an alarm is issued, the condition and sootblower involved are indicated and thereafter branching to SECTION 3 of the monitor loop occurs.

Turning back now to the sootblower in service signal test associated with diamond 830, it will be seen that whenever this test is affirmative, as indicated by the arrow 857 annotated YES, a sootblower is away from its park or home position and has began a cycle of operation. Under this condition, as indicated by the diamond 858, the program next tests to ascertain whether or not any sootblower is blowing. This is a flow switch indicia associated with the input side to the sootblower and is identical to that described in conjunction with the diamond 832. When the results of the test conducted in association with the diamond 858 are negative as indicated by the arrow 859 annotated NO, it is ascertained that a sootblower has started but no blowing media has yet been provided at the input flow switch thereto. Under these conditions the elapsed time timer to time the cycle of operation of that sootblower is started in the manner indicated by the rectangle 860 and thereafter the no blowing media timer which provides the 45 – 60 second interval allowed for determining the presence of flow at the output side of the sootblower is initiated in the manner indicated by the rectangle 847. After each of these timers have been started their expired condition is tested in the manner already described in association with diamonds 848 and 855 and if either timer has expired without the acquisition of the appropriate condition an alarm condition is issued in the manner indicated by rectangles 850 and 858 and the alarm condition defined is indicated at the boiler diagram and display panel in the manner indicated by the rectangles 851 and 859. Thereafter, branching to SECTION 3 of the monitor loop occurs. Conversely, if either or both of the no blowing media timer or the elapsed time timer have not expired, the alarm condition associated therewith is bypassed in the manner indicated by the arrows 853 and 838 and direct branching to SECTION 3 in the manner indicated by the circular flag 839 occurs.

When the test indicated by the diamond 858 is affirmative in the manner indicated by the arrow 862 annotated YES, the presence of a sootblower in service and a flow condition established at the input side thereto is established. Under these conditions, as indicated by the rectangle 863, both the elapsed time timer and the no blowing media timers are initiated so that the cycle of operation of the started sootblowers is timed and the alloted interval is provided for flow to be established at the output sides thereof. Thereafter, as indicated by the diamond 864, the condition of all sootblowers is checked to ascertain whether or not the flow switches associated with specific blowers thereof are indicative that the true unit flow condition has started and hence that all started sootblowers are properly operating. If all sootblowers do not have flow established at the output side thereof as indicated by the arrow 865 annotated NO, the condition of the no blowing media timer and the elapsed time timer is tested in the manner indicated by the diamonds 848 and 855. However, if all sootblowers have a flow condition established at the output side thereof in the manner indicated by the arrow 866 annotated YES, the no blowing media timer is stopped to prevent the establishment of an expired condition thereat and thereafter the test associated with diamond 848 and 855 are initiated it being appreciated that under these conditions the test associated with the diamond 848 will always be negative. In either event, if the associated timer has timed out either an alarm and indication associated with a no blowing media or time exceeded condition will be established and branching to SECTION 3 of the monitor loop will occur while if neither a timed out condition for the no blowing media timer or the elapsed time timer occurs direct branching to SECTION 3 of the monitor loop as shown in FIG. 16 will occur in the manner indicated by the arrows 853 and 856. Accordingly, it will be appreciated that when portion two of the monitor loop illustrated in FIG. 15 has established that no sootblower is in service, no sootblower blowing media condition is present no start up condition is being initiated, a manual permit operation will be enabled and branching to SECTION 3 of the monitor loop will occur while if any sootblower in service signal is acquired or any sootblower blowing media condition is defined appropriate timers will be initiated to ensure that no malfunction condition has occurred and branching to SECTION 3 of the monitor loop occurs. Conversely, if a malfunction has occurred an alarm condition is established, the nature of the condition is defined at the display, the faulty sootblower is indicated and thereafter branching to SECTION 3 of the monitor loop occurs.

Turning now to FIG. 16, there is shown a functional flow diagram illustrating part three of the monitor loop portion of the exemplary executive program which may be employed within the instant embodiment of the present invention. More particularly, the last portion of the monitor section of the executive program as illustrated in FIG. 16 attends to clean up functions associated with the monitoring routine should various alarm conditions for an emergency override condition occur and acts to effectuate the flashing of blower units for which an alarm condition was issued in the manner briefly described above in conjunction with FIGS. 14 and 15. In addition, the last portion of the monitor loop illustrated in FIG. 16 makes basic decisions as to whether to proceed further into the executive program or to reinitiate the loop at the beginning of the monitor program shown in FIG. 14.

Part three of the monitor loop illustrated in FIG. 16 is entered at the location indicated by the oval flag 868 annotated SECTION 3. When this portion of the monitor loop is entered the program initially tests, in the manner indicated by the diamond 869 as to whether or not an emergency override condition has been entered by the operator. An emergency override condition, it will be recalled is entered by supervisory personnel through the actuation of a key switch or the like any time automatic program operation is to immediately terminate and manual input operations associated with the emergency override conditions specified are honored in place thereof. If the emergency override key is actuated, a flag is set when this information is picked up each time the monitor portion of the executive program is initiated as was explained in conjunction with FIG. 14. Therefore, the test associated with the diamond 869 merely acts to ascertain whether or not this condition is present. If an emergency override condition is present as indicated by the arrow 870 annotated YES, an instruction is issued to turn on an emergency override indicia light in the manner indicated by the rectangle 871 and thereafter a return to the initial portion of the monitor routine occurs as indicated by the circular flag 776. The instruction issued in the manner indicated by the rectangle 871 will have no effect in the embodiment of the instant invention being discussed since no emergency override indicia is provided on the boiler diagram and display panel illustrated in FIG. 6; however, in many embodiments of the instant invention it will be desirable to provide such an indicia to indicate that an override mode of operation has been commanded by supervisory personnel and hence automatic processing may not take place. Thus, when an emergency override condition is present a return to the initial portion of the monitor loop illustrated in FIG. 14 occurs and in effect the executive program acts, under emergency override conditions, to merely cycle through the monitor loop on a recurrent basis without proceeding further into the executive program. During such cycling the program steps of operation illustrated in FIGS. 14, 15 and the initial stage of FIG. 16 will occur but further entry into the executive program will be precluded by the jump and return condition associated with the detection of an emergency override condition.

When no emergency override condition is present as indicated by the arrow 872 annotated NO, an instruction to turn off the emergency override light is issued in the manner indicated by the rectangle 873. This instruction also will not have any effect in the embodiment of the instant invention however in alternative embodiments wherein an emergency override mode indicia is provided this instruction will serve to cause the same to be extinguished. Thereafter as indicated by the diamond 874, the flag associated with a boiler trip condition is tested to ascertain if the boiler has tripped out or is operative. If the boiler has tripped out as indicated by the arrow 875 annotated YES, an energized instruction for the boiler trip light is issued in the manner indicated by the rectangle 876 and thereafter as indicated by the arrow 877 the beginning of the monitor routine is returned to as indicated by the circular flag 776 so that cycling only through the monitor portions of the executive program takes place. This form of action is appropriate since as the boiler is not operating under the conditions ascertained, no actual operations within the system are appropriate. The boiler trip light may be provided on the boiler diagram and display panel illustrated in FIG. 6 or as provided as a separate indicia near the boiler itself.

If the boiler has not tripped out as indicated by the arrow 878 annotated NO, an instruction is issued to turn off the boiler trip light in the manner indicated by the rectangle 879 and therefter a test is conducted for the presence of an alarm condition in the manner indicated by the diamond 880. If an alarm condition is ascertained from the flag condition set in response thereto, as indicated by the arrow 881 annotated YES, the system next tests to ascertain whether or not any sootblower is in service.

The test for the sootblower in service condition as indicated by the diamond 882 acts to effectuate the flashing of the sootblower indicia at the display associated with the defect unit. Thus, it will be recalled that any time sootblowers have been started and a sootblower in service signal is provided to the controller, the AC receiver may be addressed to ascertain the status of any sootblower in the system and the various sensory inputs provided to the permit module illustrated in FIG. 12 may be relied upon in checking the conditions associated with the operative status of various sootblowers to which start signals have been issued by the system. Accordingly, if a sootblower in service signal is indicated by the test associated with diamond 882, as indicated by the arrow 883 annotated YES, the queue of sootblowers to which start signals have been issued are compared to the various sensory inputs provided to the permit module and the controller to ascertain which sootblower is malfunctioned. Thus, for instance, if a motor overload condition was indicated by the sensory inputs, the queued retracts on each side of the boiler would be compared to the loop in which the motor overload condition is occurring to ascertain which retract is experiencing a motor overload condition.

Once this was ascertained, the indicia therefor would be addressed and the display indicia would be flashed if and only if the units were not in service in the manner indicated by the rectangle 884. Thereafter, as indicated by the rectangle 885, the stop/reset button associated with either the retract or wallblower input panel would be flashed to indicate that a reset or stop request must be entered by the operator and the program returns to the main routine at the location indicated by the arrow 886. As will be appreciated by those of ordinary skill in the art, a similar determination could be made with respect to any sensory input provided to the controller and to the permit module and once this determination was made the indicia for the wallblower unit or retract experiencing difficulty would be flashed in the manner indicated by the rectangle 884 and thereafter the flash stop/reset light associated with the appropriate wallblower panel or retract panel would additionally be flashed prior to returning to the main routine at the location indicated by the arrow 886.

Should the test for a sootblower in service signal associated with the diamond 882 prove negative in the manner indicated by the arrow 887 annotated NO, the system would then test for a previously determined no blower start condition in the manner indicated by the diamond 888. This test is performed in association with the operation of the start signal timer described above and, in essence, causes a no blower start flag to be set any time the five second start signal timer times out without the acquisition of a sootblower in service signal. If this flag is set the test associated with the diamond 888 will be affirmative as indicated by the arrow 889 annotated YES. When this occurs, the units which have failed to be started will have their indicia on the boiler and display panel flashed in the manner indicated by the rectangle 884, a flashing instruction to the stop/reset keys will be issued in a manner indicated by the rectangle 885 and the main routine will be returned to at the location indicated by the arrow 886. It should be noted that when a no blower start condition is ascertained, the blower or blowers which have not started may be quickly identified under program control by addressing the AC receiver with the addresses of blowers for which start instructions have been issued and whenever a Zero condition is indicated in response to the output of the AC receiver a failure to start condition for the blower address will have been ascertained. Under these conditions a One will be set into the latch for this blower in the boiler diagram and display panel and the output thereof will be strobed in the manner described above to cause a flashing of the indicia therefor at the display.

When the test for a no blower start alarm associated with the diamond 888 is negative in the manner indicated by the arrow 890 annotated NO, it will be indicative that although an alarm condition was indicated by the test indicated by the diamond 880, no sootblower is in service nor has any sootblower failed to start. Under these conditions, the program will return directly to the main routine at the location indicated by the arrow 886 since no blower unit is directly involved and hence no blower unit indicia need be flashed. Similarly, when the test for an alarm condition is negative in the manner indicated by the arrow 886 annotated NO, the program then tests to ascertain whether or not any alarm condition has been issued thus far in the manner indicated by the diamond 891.

Should the test for the issuance of any alarm so far, indicated by the diamond 891 be affirmative in the manner indicated by the arrow 892 annotated YES, a return to the beginning of the monitor routine occurs in the manner indicated by the circular flag 776. This occurs since no actual operating routines will be initiated until the alarm condition is cleared and the operator actuates the reset key which provides an indication that the operator is acknowledging the alarm condition and hopefully will take the defective blower unit out of operation and cause the repair of the same or otherwise have system maintenance performed. However, it should be noted that an actuation of the reset key will have no effect if the condition causing the alarm remains. Thus, in the event of an alarm, the monitor loop illustrated in FIGS. 14 – 16 provides all indicia for the operator to be advised of the condition involved as well as the blower unit and then loops back on itself awaiting an acknowledgement of the condition.

When the test associated with the diamond 891 is negative in the manner indicated by the arrow 893 annotated NO, it is indicative that no alarms have been ascertained in these cycles through the monitor loop. Therefore, the program next tests in the manner indicated by the diamond 894 to ascertain whether or not the no blowing medium timer is operative. This timer was set together with a flag, it will be recalled, during various portions of the monitor loop shown in FIG. 15 when it was ascertained that a sootblower might be in the process of starting. When the test indicated by the diamond 894 is affirmative as indicated by the arrow 895 annotated YES, a return to the beginning portion of the monitor loop as indicated by the circular flag 776 is initiated. This here occurs since either the timing out of the no blowing medium timer or a confirmation of a sootblower blowing condition must be ascertained before it can be determined whether the sootblower is in the process of starting or has malfunctioned, accordingly further cycles through the monitor loop will recur until this condition is capable of finite evaluation. If no alarms are pending and the test indicated by the diamond 894 is negative in the manner indicated by the arrow 896 annotated NO, further processing may occur within the executive program and hence the program proceeds, in the manner indicated by the circular flag 897 to SECTION 4 of the executive program which is devoted to automatic program execution and is explained in conjunction with FIG. 17.

Thus, it will be appreciated that the portion of the monitor loop illustrated in Section 3 first acts to ascertain whether or not an emergency override or boiler trip condition is present. If either condition is present commands to actuate appropriate indicia therefor are issued and then a return to the beginning portion of the monitor loop is initiated. If neither condition obtains, the program then acts to test whether an alarm condition is present and if the same is ascertained acts to identify the sootblower unit or units involved and initiates a flashing routine therefor together with the flashing of the reset key for the appropriate wallblower or retract panel depending upon which type of units are involved. If no alarm condition is present the system then tests to ascertain if any alarms have been detected during the monitor cycle, if any alarm is present reentry into the beginning portion of the monitor loop occurs so that the same may be acknowledged by the operator. If no alarm condition has been detected, the condition of the no blowing medium timer is tested to ascertain whether it is on. If the no blowing medium timer is on, a return to the beginning of the monitor loop again occurs so that a definitive determination can be made as to whether or not a malfunction condition or a start up of sootblowers is occurring. However, if the no blowing medium timer is off, the monitor routine is terminated within the executive program and thereafter the portion of the executive program associated with SECTION 4 is entered so that program execution may be implemented. It should be noted that the monitor routine has been highly simplified to provide an unencumbered disclosure thereof however, any modifications and variations therein may be provided to meet particular design requirements, data logging functions or particular requirements of a specified system. Thus, for instance, in the flow chart illustrated in FIG. 16, start conditions for various types of sootblowers can be enabled to assure the operation thereof or appropriate initializing conditions for the system may be added to test appropriate characteristics of the system prior to moving forward to programmed operating routines associated with execution of such programs. Similarly, the operation of retracts and sootblowers may be segregated and separately tested and of course, what is true of retracts and/or blower systems is also true of air heater, for the blower and systems which may be desired to operate on a continuous or intermittent basis with the sootblower provided within the instant invention.

AUTOMATIC PROGRAM EXECUTION

Referring now to FIG. 17 there is shown a functional flow diagram illustrating a portion of the exemplary executive program which is devoted to automatic program execution. The automatic program execution routine within the executive program is entered in the manner described in conjunction with FIG. 16 at the appropriate completion of the monitor routine set forth in conjunction with FIGS. 14 – 16. The automatic program execution routine within the executive program here acts to initiate the automatic operation of sootblowers within the system in a manner defined by a pre-existing program and initiated by the operator through a depression of the program keys and start keys located at the retract and wallblower input panels illustrated in FIGS. 2B and 2C.

Entry to the automatic program execution routine illustrated in FIG. 17 occurs at the circular flag 897 annotated SECTION 4. When the automatic program execution routine illustrated in FIG. 17 is entered as a part of normal processing which takes place within the executive program, the routine initially acts to test, in the manner indicated by the diamond 898 as to whether or not the program start key has been depressed. A depression of the start program key within the control key arrays 82 or 82' as illustrated in FIGS. 2B or 2C will cause a flag to be set during the updating portion of the monitor routine illustrated in FIG. 14 and thus the test indicated by the diamond 898 is merely a test of the condition of the flag associated with the start program keys illustrated in FIGS. 2B and 2C.

If the results of the test indicated by the diamond 898 are affirmative in the manner indicated by the arrow 899 annotated YES, the program next tests in the manner indicated by the diamond 900 as to whether or not a program is already in progress. If a program is already in progress, as indicated by the arrow 901 annotated YES, the program start request flag has already been acted upon in preceding cycles through the executive program and hence the routine returns in the manner indicated by the arrows 901 and 901 to the main program routine at a location associated with the arrow 903. However, if a program has not already started, as indicated by the arrow 904 annotated NO, it is indicative that the start request key has just been depressed and hence further prerequisites for starting a program mode of operation must be checked.

Accordingly, if the results of the test indicated by the diamond 900 are negative in the manner indicated by the arrow 904 annotated NO, the program next tests in the manner indicated by the diamond 905 to ascertain whether or not a program select button has been depressed. The program select buttons are contained within the program select arrays 80 and 80' in the retract and wallblower information arrays illustrated in FIGS. 2B and 2C and it will be recalled that the designation of a program together with the depression of a start program key is the dual key input procedure required to initiate automatic operation within the instant invention. Therefore, if a program select button has been depressed in the manner indicated by the arrow 906 annotated YES, further processing within the automatic program execution routine illustrated in FIG. 17 is appropriate and hence the program select light is illuminated as instructed in 906' and the program returns in the manner indicated by the arrow 902 to the main program routine at the location indicated by the arrow 903. However, should a program select button not be in an ON condition as indicated by the arrow 907 annotated NO the operator has not properly entered all of the prerequisites to initiate automatic program execution within the instant invention. Therefore, under these conditions, the remaining portion of the automatic program execution routine illustrated in FIG. 17 may be bypassed and branching to SECTION 5 in the manner indicated by the circular flag 908 is initiated so that the next portion of the executive routine may be operated upon it being appreciated that further operation within the automatic program execution routine illustrated in FIG. 17 is not yet timely.

If no program start request has been entered as indicated by a negative result from the test associated with the diamond 898 the program proceeds directly in the manner indicated by the arrow 903 annotated NO. This result may obtain because no program start request was in fact entered or a program start request was in fact entered properly executed and cleared. In any event, as indicated by the arrow 903 annotated NO, the program again tests to ascertain whether or not a program is in progress and this may result, it will be appreciated by those of ordinary skill in the art, due to the fact that the program entered was properly executed and completed. If the test indicated by the diamond 909 as to whether or not the program is in progress is negative as indicated by the arrow 910 annotated NO, the program next tests in the manner indicated by the diamond 911 as to whether or not a reset request has been entered. This is entered, it will be recalled by a depression of the reset keys within the control arrays 82 and 82' illustrated in FIGS. 2B and 2C and it will be appreciated that when an operator is desirous of resetting programmed operation such resetting may occur in one of two manners. Thus for instance the operator may desire to terminate a program then in progress for substitution of a new program or the like or may wish to reset the program then in progress so that the same will be reinitiated from the beginning thereof. In the latter case, the program select button within the program select arrays 80 or 80' within FIGS. 2B and 2C will be depressed in association with the reset key or alternatively will be left in a depressed condition as was the case during the execution thereof.

In any event, should the test conducted under the auspices of the diamond 911 prove negative in the manner indicated by the arrow 912 annotated NO, it is clear that the operator has merely stopped the program or that the program is completed and hence further processing within the auto program execution routine illustrated in FIG. 17 need not occur. Thus, under these conditions, as indicated by the arrows 912, 913 and 914, branching to the initial point of the blower enable/disable routine shown in FIG. 18 occurs in the manner indicated by the circular flag 908 so that further processing within the executive program may continue without performing the additional function set forth within the auto program execution routine illustrated in FIG. 17. However, if the reset request key has been depressed the test conducted in association with the diamond 911 will result in an affirmative indication from the flag set in response thereto in the manner indicated by the arrow 915 annotated YES.

When a reset request has been generated in the manner indicated by the arrow 915 annotated YES, the program must determine whether or not a specific program is being reset to its initial state. Accordingly, as indicated by the diamond 916 the program next tests to ascertain whether or not a program select button is in a depressed condition by testing the flags which are set in response to the depression of the program select keys within the arrays 80 and 80' illustrated in FIGS. 2B and 2C. These flags, it will again be recalled, are set in response to the update and flag setting routine in the initial portion of the monitor routine. If the test indicated by the diamond 916 produces a negative result as indicated by the arrow 917 annotated NO, resetting of the automatic program execution then in force is not appropriate and accordingly, as indicated by the arrows 913 and 914 a branching to the initial portion of the blower enable/disable routine illustrated in FIG. 18 occurs so that further processing within the executive program may continue in the manner indicated by the circular flag 908. However, if the test conducted in association with the diamond 916 is affirmative in the manner indicated by the arrow 918 annotated YES, it is apparent that a resetting of the program which was in progress is desired. Accordingly, as indicated by the rectangles 919 and 920, the program for the select button depressed is reset to initial conditions so that if the same is restarted it will start from the beginning of sequence one and therafter the program select light which illuminates the depressed program select key is extinguished in the manner indicated by the rectangle 920. This means, as will be appreciated by those of ordinary skill in the art, that if the operator retains the program select key in a depressed condition and subsequently depresses the program start key, the program will be initialized at the beginning thereof rather than from some intermediate state which was present when the program was stopped. Thereafter, as indicated by the arrows 921, 913 and 914, a branching to SECTION 5 which is the beginning of the blower enable/disable routine illustrated in FIG. 18 is initiated for continued processing within the executive program.

When the test associated with the diamond 909 is indicative that the program is in progress as indicated by the arrow 922 annotated YES under these circumstances, as indicated by the diamond 923, the program tests the flag associated with the insertion or depression of the stop key or the completion of an automatic cycle at either the wallblower or retractable panels illustrated in FIGS. 2B and 2C to ascertain whether a stop request has been inserted which has not yet been fully processed. If the stop key has been depressed, as indicated by the arrow 924 annotated YES, processing of this request is then implemented. More particularly, the program acts to issue an instruction to turn off the start light at the display panels illustrated in FIGS. 2B and 2C in the manner indicated by the rectangle 925 and thereafter acts to illuminate the stop key at the appropriate panel through the instructions indicated by the rectangle 926. Following the issuance of these instructions, orders are issued to cause the controller operating light at the boiler and display panel illustrated in FIG. 6 to be extinguished in the manner indicated by the rectangle 927. The indicia which is extinguished thereat will be associated within either the rectangle 302 or 303 associated with either retractables or wallblowers depending upon whether the stop key has been depressed at either the retractable or wallblower input panel illustrated in FIGS. 2B and 2C.

Upon the completion of the issuance of appropriate indicia instructions as indicated by the rectangle 925 – 927 the program tests in the manner indicated by the diamond 928 to ascertain whether or not the program which was in progress prior to the insertion of the stop command has been fully processed. If this program has not been fully processed as indicated by the arrow 929 annotated NO, a branch operation as indicated by the arrow 914 and the circular flag 908 occurs to the beginning portion of SECTION 5 so that the executive program may be continued. However, if the program is completed as indicated by the arrow 930 annotated YES, maintenance of intervening conditions need not be provided and hence, as indicated by the rectangle 920 the program select light which takes the form of an illuminated program select key, as aforesaid, is extinguished in the manner indicated by the rectangle 920 and thereafter branching to the initial portion of the blower enable/disable routine illustrated in FIG. 18 occurs in the manner indicated by the arrows 921, 913 and 914 as well as the circular flag 908.

Should the test for a program stop request indicated by the diamond 923 prove negative in the manner indicated by the arrow 931 annotated NO, the program next tests in the manner indicated by the diamond 932 as to whether or not an emergency retract instruction has been issued due to previous operations. This test is conducted through the testing of a status flag which is set each time such an emergency retract instruction is issued and the setting occurs during the initial portions of the monitor routine in the manner aforesaid. If an emergency retract signal has been issued, as indicated by the arrow 933 annotated YES, branching to SECTION 5 in the manner indicated by the circular flag 908 is immediately initiated as no further processing within the automatic program execution routine will occur. However, if no emergency retract instruction had been issued, as indicated by the arrow 934 annotated NO, processing of the program will occur. Under these conditions, the program acts in the manner indicated by the rectangles 936 – 940 to issue instructions in the manner indicated by the rectangle 936 to turn off the manual permit light to advise the operator that manual operations may not be initiated in a permissive mode through an extinguishing of the manual start key within the controller arrays 82 and 82' shown in FIGS. 2B and 2C. Thereafter, as indicated by the rectangles 937 and 938 instructions are issued to extinguish the stop key and illuminate the start key so that appropriate processing in accordance with instructions inserted at the information input panels illustrated in FIGS. 2B and 2C will be provided to the operator. Thereafter, as indicated by the rectangle 939, a manual inhibit signal is issued by the controller to effectively inhibit manual start up operations. Thereafter, as indicated by the rectangle 940 the controller operating indicia on the boiler diagram and display panel is illuminated within the appropriate rectangle 302 or 303 for the retract or wallblower program operation being initiated.

Once advisory information has been issued in the manner indicated by the rectangles 936 – 940 the program tests in the manner indicated by the diamond 941 as to whether or not any sootblower is in service or blowing. If sootblowers are in service or flow is indicated it will be appreciated by those of ordinary skill in the art that automatic program execution has already occurred for the program sequence then being processed and no further operations within FIG. 17 are appropriate until such sootblowers are in service terminate their cycle of operation. Accordingly, under these conditions, as indicated by the arrow 942 annotated YES, and the circular flag 908 branching to the beginning portion of SECTION 5 as shown in FIG. 18 occurs to permit the executive program to continue until processing within this sequence or step of the program already in process has terminated.

If no sootblower is in service as indicated by the arrow 943 annotated NO, it still must be ascertained whether or not a sequence or step of a program is being initiated since it is possible the SBIS (sootblower in service signal) or flow indication have not yet been actuated. Accordingly, as indicated by the diamond 944, the program tests to ascertain whether or not any blowers are starting by testing flags associated with the issuance of start commands. If the test associated with the diamond 944 is affirmative as indicated by the arrow 945 annotated YES, a branching operation to the beginning portion of the boiler enable/disable routine illustrated in FIG. 18 occurs in the manner indicated by the arrow 942 and the circular flag 908, as processing for a step of a program specified has already been initiated and further processing within the routine illustrated in FIG. 17 must be held in abeyance until blowers have been started and their cycle of operation has been completed or a malfunction condition is detected in the monitor loop described in association with FIGS. 14–16.

If no sootblower is in service or there is no flow indicated, and no blowers are started as indicated by the arrow 946 annotated NO, the program then checks to ascertain whether a start up operation for blowers in a succeeding sequence of the program is appropriate. This is initially done, as indicated by the diamond 947 by checking for a low header condition for retracts or wallblowers depending upon which input information panel has initiated program operation. If a low header condition is present as indicated by the arrow 948 annotated YES branching to SECTION 5 occurs in the manner indicated by the circular flag 908, it being appreciated that at the completion of the executive program a return to the monitor loop will appropriately cause processing of this condition. However, if no low header pressure condition is present as indicated by the arrow 949 annotated NO, the program next tests to ascertain if a succeeding program sequence is present or the end of the program is at hand in the manner indicated by the diamond 950. The test for the end of the program is performed by testing the condition of the sequence counter which is maintained under software control to ascertain the program step which is then being processed and thereafter cycling through sequence information contained in memory to ascertain if the sequence information stored for each blower contains a sequence number or step number which is greater than the step of the program then being executed. If the result of the test indicated by the diamond 950 is affirmative as indicated by the arrow 951 annotated YES, the end of the program is at hand. Accordingly, a stop request is initiated and as indicated by the arrow 951 and the rectangles 925 - 927 the start light is extinguished, the stop light is illuminated and the controller operating light is extinguished to provide appropriate advisory information to the operator. Thereafter, the program tests in the manner indicated by the diamond 928 to ascertain if the program has been completed and if the same has not been completed direct branching in the manner indicated by the arrows 929 and 914 occurs to the beginning portion of SECTION 5 as indicated by the circular flag 908. However, if the program step then in progress has been completed, the program select light is extinguished in the manner indicated by the arrow 930 annotated YES and the rectangle 920 and thereafter branching to the beginning of SECTION 5 occurs in the manner indicated by the arrows 921, 913, 914 and the oval flag 908. Accordingly, whenever the end of the program is detected appropriate advisory information is furnished to the operator and a branching to the next section of the executive program occurs.

When the test associated with the diamond 950 is indicative that the last step or sequence of the program has not been processed in the manner indicated by the arrow 952 annotated NO, the program then proceeds to go to the next sequence step in the identified program in the manner indicated by the rectangle 953. This is done, as will be appreciated by those of ordinary skill in the art by incrementing the sequence counter maintained under software control and thereafter inspection of the data field associated with each blower to ascertain which blowers are entered in the sequence presently pointed to by the sequence counter. The data fields established within the programmable controller may be typically configured in the form of triple words addressed by twelve bits of information wherein the last three bits of information effectively define the sootblower involved. Each word in turn comprises eighteen bits of information so that fifty-four bits of information are present in each triple word for ech blower and a new triple word for each blower may be addressed on a repetitive basis as a function of the number of blowers in the system. Accordingly, typical triple word assignment within each blower address would provide six bits of information for sequence information as well as six bits of information for each of the eight programs in which a blower is capable of being assigned. In addition, in the initial word assigned to each sootblower, i.e., that whose address is defined by a Zero in the most significant address bit; unit select flag, header assignment flag capacity type, unit start flag, unit in service flag, and unit area flags are maintained as well as additional flag information which is necessary in the remaining twelve bits of that word. Accordingly, to ascertain which blowers are assigned to a given program, the controller operating under the auspices of the executive program, addresses the data field for each blower in turn and masks off all bit information except that defining the program which is being executed. When it is found that the blower has been assigned to the program presently being executed the sequence information stored for that program is inspected to ascertain if that blower is assigned to the sequence presently being executed. If the sequence information for the program being checked is appropriate to that currently registered in the sequence counter and this check is being ran for the purposes of outputting sootblowers, the address information of that field may be directly outputted and latched into the AC driver circuit with a write instruction while if it is not part of that sequence no outputting need occur. Similarly, in tests for the end of program, the programmable controller merely need seek sequence information in the program being processed which is greater than that presently loaded in the sequence counter and if no information is present the presence of the end of the program is confirmed.

Accordingly, when an end of program is not confirmed the program routine presently being discussed in conjunction with FIG. 17 increments the sequence counter in the manner indicated by the rectangle 953 and ascertains each blower which is assigned to the sequence step being operated upon. Thereafter, as indicated by the rectangle 954 each address for a blower found to reside in this sequence is latched into the AC driver circuit illustrated in FIG. 9 so that the start up instruction will be issued for the appropriate sootblowers in the selected sequence whenever a start sootblower command is issued by the programmable controller by the application of an output enable command on the B bus.

After the programmable controller has cycled through the entire data field in the manner described in conjunction with the rectangle 954 and set any latches for sootblowers to be enabled within this step of the program, the program then checks in the manner indicated by the diamond 955 to ascertain whether or not any latch in the AC driver has been set. This may be done by an addressing of each of the latches in the AC driver illustrated in FIG. 9 and reading the data out output thereof to ascertain whether or not any of these latches is in a One state. If no latch is in a One state as indicated by the arrow 956 annotated NO, the executive program then checks to ascertain whether the end of the program is present in the manner indicated by the diamond 950. If the end of program is present in the manner indicated by the arrow 951 annotated YES, the start light is turned off, the stop light is illuminated, the controller operating indicia is turned off, and branching to SECTION 5 takes place after it is determined whether or not the program step in progress is finished in conjunction with the test explained in association with diamond 928. However, if the end of the present program is not ascertained by the test associated with diamond 950 incrementing to the next step of the program and a setting of latches continues in the manner explained in conjunction with rectangles 953 and 954 until either an end of program is ascertained or a set latch condition is determined by the test associated with the diamond 955.

When the test for the setting of a latch as indicated by the diamond 955 is affirmative as indicated by the arrow 957 annotated YES, the program then acts in the manner indicated by the rectangle 958 to issuee sootblower start signals. This is donee as will be recalled from a description of the AC driver illustrated in FIG. 9 through the issuance of an output enable command on the B bus which causes the latch condition of all latches which have been set to a One state to cause the application of an AC output signal to the sootblower assigned thereto. Thereafter, as indicated by the rectangle 959 the five second start signal timer is initiated so that during the next cycle through the executive program and more particularly through the portion of the monitor loop described in conjunction with FIG. 15 the appropriate starting time of sootblowers may be monitored to assure that start up occurs within the five second interval alloted therefor and if start up should not occur a malfunction condition is executed. After the start "start" signal timer is initiated in the manner indicated by the rectangle 959, the automatic program execution routine illustrated in FIG. 17 is completed and thereafter the routine moves as indicated by the circular flag 908 to SECTION 5 of the executive program for further processing.

Thus, in the manner illustrated in FIG. 17, automatic processing, and hence when appropriate the automatic starting of sootblowers in accordance with predetermined operating programs and sequences therein are initiated under program control and in addition thereto start and stop request as entered at the retractable and wallblower input panels illustrated in FIGS. 2B and 2C are executed. In addition, the automatic program execution routine illustrated in FIG. 17 acts to provide the operator will all appropriate execution indicia so that the operator is constantly apprised of the condition of the system.

BLOWER ENABLE/DISABLE ROUTINE

Referring now to FIG. 18 there is shown a functional flow diagram illustrating the portion of the exemplary executive program devoted to the selective enabling and disabling of sootblowers within the system. From the description of FIGS. 2B and 2C set forth above it will be recalled that an operator may disable any retractable or wallblower in the system by dialing the number of that sootblower on the appropriate set of thumbwheels 86 or 86' and thereafter depressing the disable key 88 or 88'. This will place a designator code in the data field associated with that sootblower to prevent the operation thereof even if that sootblower has been specified for operation within a particular sequence of a program then being executed. Such disabling will typically occur because it is desired by the operator to take the blower out of service as the same has malfunctioned, is to be omitted by choice, requires periodic service, inspection or the like. Subsequently, the given sootblower which has been disabled for one of these reasons may be returned to service by dialing its designator number in the appropriate set of thumbwheels 86 or 86' shown in FIGS. 2B and 2C and thereafter depressing the enable key 87 and 87'. This will remove the special designator code from the data field thereof and thus return the sootblower which has been defined for the enable operation into service. Additionally, while not previously mentioned, it should be noted that the key switch associated with emergency override operation would normally be provided with a third position which is referred to as the service position. When the key switch is placed in the service position and a disable operation is initiated therefor in the manner described above in conjunction with FIGS. 2B and 2C, i.e., a dialing of the designator for the sootblower at the thumbwheels and a depression of the disable key, a special safety disable operation is initiated wherein a designator code is placed in the data field for that sootblower which will permanently disable that sootblower regardless of attempted enable operations at the input panels illustrated in FIGS. 2B and 2C until such time as the key switch is again placed in the service mode and an enable operation is then initiated at the input panels illustrated in FIGS. 2B and 2C to remove the safety disable designator. The safety mode of disabling is provided so that when a sootblower is to be worked on by service personnel such service personnel may safely disable the blower so that the same may not be enabled by the operator accidentally. Such accident protection is provided by requiring the operator to secure the key from the supervisor to enable in a safety enable mode of operation. This guarantees against conditions where a serviceman has disabled the blower and an operator in a subsequent shift attempts to enable the sootblower since he may not have knowledge that that sootblower is being serviced. Thus, he must secure a key to enable a safety disabled blower and in this manner inadvertent accidents associated with the operation of sootblowers being serviced are avoided.

The portion of the executive program devoted to the selective enabling and disabling of sootblowers within the system, as illustrated in FIG. 18, is entered at the location indicated by the circular flag 908 annotated SECTION 5. When this routine is entered the routine first tests in the manner indicated by the diamond 960 whether or not an enable request has been received. This test is conducted in the same manner as any other test for input information from the input panels illustrated in FIGS. 2A – 2C in that each time an input key is depressed this information is taken by the controller during the initial stage of a monitor loop illustrated in FIG. 14 and is employed to said flip flops which served to provide a flag indication of the input conditions specified. If no enable request has been specified as indicated by the arrow 961 annotated NO, the program next tests in the manner indicated by the diamond 962 to ascertain whether or not a disable request has been received. If no disable request has been received as indicated by the arrow 963 annotated NO, no further action is required within the blower enable/disable routine illustrated in FIG. 18 and hence, branching occurs, as indicated by the circular flag 964, annotated to SECTION 6, which corresponds to the entry point for the check routine within the executive program as illustrated in FIG. 19.

Conversely, if either an enable request is ascertained by the test associated with diamond 960, as indicated by the arrow 965 annotated YES, or a disable request is ascertained in association with the test indicated by the diamond 962, as indicated by the arrow 966 annotated YES, the program then checks to ascertain whether or not the blower thumbwheel information input in association with this test is valid in the manner indicated by the diamonds 967 and 968. Thus, for instance, if an enable request or a disable request were generated at the wallblower input panels, the thumbwheel designating information must include a letter and a pair of digits to identify that wallblower and the letter and digit designators must correspond to those present within the system. Similarly, if a retract was specified, the two digit number inserted must correspond to retract designators within the system. In either event, if an enable request has been received but the sootblower thumbwheel information inserted therefor is invalid in the manner indicated by the arrow 969 annotated NO, or a disable request has been received but the blower thumbwheel information inserted therefor is invalid in the manner indicated by the arrow 970 annotated NO, branching immediately occurs to the initial portion of the check routine illustrated in FIG. 19 as indicated by the circular flag 964 annotated to SECTION 6.

If the test conducted for valid blower thumbwheel designating information in the manner indicated by the diamonds 967 or 968 pursuant to the detection of an enable request or a disable request is affirmative in the manner indicated by the arrows 971 or 972 annotated YES, the program next tests in the manner indicated by the diamonds 973 or 974 to ascertain whether or not the key switch is in the service position. If the kay switch is in the service position as indicated by the arrows 975 or 976 annoted YES, it is clear that the enable or disable reuest detected by the test associated with diamonds 960 and 962 are being inserted pursuant to a safety enable or safety disable condition wherein a blower is to be locked out so that is can not be enabled from the input panels or conversely, a blower which has been locked out in a safety mode is being enabled as the service procedures which have been conducted therefor have been completed. Accordingly, when a safety enable request is detected for a blower defined by the thumbwheels in the manner indicated by the arrow 975 annotated YES, the blower is enabled in the manner indicated by the rectangle 977 annotated Safety Enable through the writing of enabling inormation into the data field of that blower. Subsequent to this the blower will be in an enabled condition whereupon the same may be operated under either program or manual control and disabled or/and subsequently enabled by the operator from the input panels illustrated in FIGS. 2B and 2C. Conversely, if a safety disable condition is ascertained by the test associated with the diamond 974 as indicated by the arrow 976 annotated YES, it is clear that the blower is to be safety disabled and hence in the manner indicated by the rectangle 978, annotated Safety Disabled Blower, a character is written into the data fields for the blower defined at the thumbwheels which character will cause the blower to effectively be removed from all manual start or programmed starting operations and this character may not be overcome by a mere enable request inserted at the input panels illustrated in FIGS. 2B and 2C. Once either a safety enable or safety disable writing operation has been implemented by the program in the manner indicated by the rectangles 977 and 978, the blower enable/disable routine illustrated in FIG. 18 has been completed and hence the routine exits to the check routine illustrated in FIG. 19 in the manner indicated by the arrows 979 and 980 as well as the circular flag 964.

Should the test for the service switch condition prove negative in the manner indicated by the arrow 981 annotated NO, it is apparent that processing is occurring within the routine in response to the receipt of a disable request as ascertained by the test associated with diamond 962 for a blower for which valid thumbwheel information has been received in the manner indicated by the diamond 968 and that, since the service switch is in an off condition this is merely an operator initiated disable request from either the input panels illustrated in FIGS. 2B or 2C and hence, is of the type which may be overcome by a subsequent enable command from the input panels. Under these circumstances, as indicated by the arrow 981 a blower disable character is written into the data fields for the defined blower in the manner indicated by the rectangle 982. Thereafter, in the manner indicated by the arrow 983 exiting to the check routine portion of the executive program illustrated in FIG. 19 occurs in the manner indicated by the circular flag 964 annotated to SECTION 6.

When the test for the service switch on condition associated with the diamond 973 is negative in the manner indicated by the arrow 984 it will be apparent that an enable request has been ascertained by the test associated with diamond 960, valid blower information has been presented as ascertained by the test associated with the diamond 967 and since the service switch is not in an on position an ordinary enable request has been inserted by the operator at the input panels illustrated in FIGS. 2B and 2C. Under these conditions it will be apparent that the enable request should be honored if the blower involved was disabled by a disable operation, merely entered by the operator at the input panels illustrated in FIGS. 2B and 2C while the same must be ignored if the blower was safety disabled through the operation of the service switch. Accordingly, when these conditions obtain as indicated by the arrow 984 annotated NO, the program then tests in the manner indicated by the diamond 985 to ascertain whether or not the data fields for the blower identified by the thumbwheel information contains a safety disable character. If a safety disable character is ascertained in the manner indicated by the arrow 986 annotated YES, the enable request is ignored and branching to the beginning of the check routine is immediately implemented in the manner indicated by the circular flag 964 annotated to SECTION 6. However, if the character in the data fields for the identified sootblower is not a safety disable character as indicated by the arrow 987 annotated NO, it will be apparent that this blower was merely disabled by operator initiated actions at the input panels illustrated in FIGS. 2B and 2C. Therefore, under these conditions an enalbed character is written into the data field therefor in the manner indicated by the rectangle 988 and thereafter in the manner indicated by the arrows 989 and 979 the program enters the beginning portion of the check routine illustrated in FIG. 19 for further processing within the executive program in the manner indicated by the circular flag 964.

Accordingly, it will be appreciated that the blower enable/disable routine illustrated in FIG. 18 initially acts to ascertain whether or not an enable or disable request has been received and if no such request was received, branching to the check routine illustrated in FIG. 19 immediately occurs. If an enable request or disable request was received the program routine illustrated in FIG. 18 then checks to ascertain whether or not valid blower information was inserted at the thumbwheels. If no valid blower information is ascertained the request is ignored however if valid thumbwheel information was provided the next check performed within the routine for that enable or disable request is one calculated to ascertain whether or not the service switch is in an on position. If the service switch is in an on position then the enable or disable request being processed is a safety disable or enable instruction and hence, a safety enable or disable character is written into the data fields for the sootblower involved. When it is ascertained that the service switch is not in the on position for a disable request, the blower involved is merely disabled by writing a disable character into the data fields therefor and thereafter processing continues. However, when it is ascertained that the servide switch is off for an enable operation the program next looks at the data fields for the sootblower specified. If that data field indicates that the blower has been safety disabled, the enable request is ignored however if the same has not been safety disabled the blower has an enable character written into the data field therefor and processing within the executive program continues.

CHECK ROUTINE

Referring now to FIG. 19 there is shown a functional flow diagram illustrating a portion of the exemplary executive program associated with certain check routines. More particularly, the portion of the executive program whose flow charts are illustrated in FIG. 19 act to process certain check routines which may be entered from the retractable and wallblower information input panels illustrated in FIGS. 2B and 2C as well as the portion of the check routine which may be entered from the program input information panel illustrated in FIG. 2A. The check routines processed within the flow chart illustrated in FIG. 19 correspond to the enable check, the disable check, the program enable check and the portion of the sequence check wherein the blower designations loaded for a given program sequence are displayed. The enable and disble checks, it will be recalled, may be actuated by an operator by a depression of the enable check keys 90 and 90' shown in FIGS. 2B and 2C while the disable checks may be enabled through a depression of the disable check keys 91 and 91' illustrated in FIGS. 2B and 2C. When either of these keys are actuated by themselves all enable or disable sootblowers as the case may be, within the system will be displayed, Conversely, should one of the enable keys 90 and 90' illustrated in FIGS. 2B and 2C be depressed with one of the program keys within the program select arrays 80 and 80' illustrated in FIGS. 2B and 2C all sootblowers which are enabled within that program will have their indicia displayed on the boiler panel and display diagram illustrated in FIG. 6. Each of these check routines are processed within the flow diagram for the check routine illustrated in FIG. 19. In addition, it will be recalled that an operator may display sootblowers defined within a given sequence of a program during a programming mode of operation by setting the sequence check of the program selected at the thumbwheels 59 as shown in FIG. 2A and additionally depressing an appropriate programmed definition key 46 - 53 therein together with the sequence check key 60. In the check routines illustrated in FIG. 19, the portion of the sequence check wherein a single step of the program is defined within the thumbwheels 59 and process is disclosed; however, step check conditions wherein stepwise processing of each sequence in a program is displayed is handled in the flow chart illustrated in FIG. 20.

The check routine illustrated in FIG. 19 is entered at the location indicated by the circular flag 964 annotated SECTION 6. Upon entry of this routine, the program initially tests in the manner indicated by the diamond 991 as to whether or not any sootblowers are starting. This test may be conducted as described above by checking the condition of the start signal timer which is a 5 second timer which times the interval during which start signals are issued to sootblowers and corresponds to the permitted interval in which such sootblowers as have been issued a start signal may start. If the results of the test indicated by the diamond 991 are affirmative in the manner indicated by the arrow 992 annotated YES, the program immediately branches back to the beginning portion of the executive program and re-enters the initial portion of the monitor loop as indicated by the circular flag 776 annotated TO SECTION 1. This occurs because no check routines are processed during a sootblower start up cycle of operation and hence any check routines which have been designated are held in abeyance until the start up operation has been completed.

If no sootblowers are in the process of starting as indicated by the arrow 993 annotated NO, the routing then checks, in the manner indicated by the diamond 994 to ascertain whether a disable check has been requested. A disable check, it will be recalled, may be initiated by an operator by the depression of either the disable check keys 91 and 91' illustrated in FIGS. 2B and 2C and if the same occurs in the absence of a depression of a program key, the operator is requesting check information with regard to all sootblowers which are disabled on a current basis within the system. Whenever the disable key is depressed, this condition is loaded into the program controller as a flag indication during the initial portion of the monitor loop illustrated in FIG. 14. Thus, the disable check request test indicated by the diamond 994 is performed by merely sampling the condition of the flag associated with each of the disable check keys 91 and 91' illustrated in FIGS. 2B and 2C.

When the result of the test for a disable check associated with the diamond 994 is affirmative as indicated by the arrow 995 annotated YES, the program next tests in the manner indicated by the diamond 996 as to whether or not the key switch is in the service position. If the key switch is in a service position when a disable check is requested, it will be apparent that the operator or more properly, a supervisor is requesting that sootblowers which have been safety disabled be displayed while if the test associated with the diamond 996 is negative only operator disabled sootblowers are to be displayed. Accordingly, if the results of the test associated with the diamond 996 are negative in the manner indicated by the arrow 997, the program acts in the manner indicated by the rectangle 998 to display all disabled blowers, including safety disabled blowers. This is achieved, as will be readily appreciated by those of ordinary skill in the art by addressing the data field associated with each sootblower in the system and inspecting the digits therein associated with disable or enable information. This information is then directly loaded into the latches within the AC driver associated with each sootblower until the data field and more properly the appropriate digits therein for each sootblower have been latched in the assigned latch therefor within the AC blower so that in effect the appropriate queue to be displayed is latched within the AC driver circuitry and then through succeeding data out operations in the AC driver circuitry the appropriate information is loaded into the display decoders for the display of appropriate information concerning which sootblowers in the system are disabled or enabled under conditions where disabled sootblowers are idicated by having their indicia illuminated while enabled blowers have no condition displayed therefor under the parameters imposed by a disable check request. After this has been completed, the program continues in the manner indicated by the arrow 999.

Should the test for the condition of the service switch indicated by the diamond 996 prove affirmative as indicated by the arrow 1000 annotated YES, an instruction is issued in the manner indicated by the rectangle 1001 to display all blowers which are safety disabled. This instruction is implemented in precisely the same manner as that associated with the display of all disabled blowers which have been disabled through the action of the operator in defining a specific blower at the thumbwheels 86 and 86' and thereafter depressing the disable key 88 and 88' except here the appropriate digits within the data field which are inspected and loaded within the AC latches correspond only to those associated with a safety disabling of the blowers which is achieved in the manner described in conjunction with FIG. 18. Thereafter, as indicated by the arrows 1002 and 1003 the program main routine is rejoined at the location indicated by the arrow 999.

Returning not to the test for a disable check request indicated by the diamond 994, it will be seen that if no flag indication defining a disable check request is present, as indicated by the arrow 1004 annotated NO, the program next checks in the manner indicated by the diamond 1005 to ascertain whether an enable check has been requested. This check is performed in the same manner described for the disable check request test except flip flops associated with the enable check keys 90 and 90' as illustrated in FIGS. 2B and 2C are tested to ascertain the condition thereof. If an enable check has been requested in the manner indicated by the arrow 1006 annotated YES, the system then again tests to ascertain whether or not the service switch is in a ON condition as indicated by the diamond 1007. This test is performed in the same manner described in conjunction with the diamond 996; however, if an affirmative result is obtained in the manner indicated by the arrow 1008 annotated YES, it is assumed that the enable check key was hit in error and hence, processing of the enable check request is skipped, since as indicated by the arrows 1008, 1009 and 1003, the program main routine is rejoined at the location indicted by the arrow 999. A malfunction is assumed under these conditions because while a safety disable condition which is maintained in the data field to prevent accidental operation of a specially disabled sootblower, a safety enable condition merely returns the data field of the designated blower to operational status and hence is neither specially noted nor is any different from the data field of the sootblower which has not been safety disabled. Accordingly, no display information can be obtained under these conditions and it is assumed that the operator hit the enable check key in error. Thus, the main routine is returned to in the manner indicated by the arrows 1008, 1009 and 1003 to the location indicated by the arrow 999.

If the test for the service switch in an on condition indicated by the diamond 1007 is negative in the manner indicated by the arrow 1110, the program next tests in the manner indicated by the diamond 1011 to ascertain whether or not a program select button is in an on condition. If the program select button is depressed it will be appreciated that a program enable check request has been specified by the operator rather than general enable check request and this condition is handled subsequently within the instant program. Accordingly, if the test indicated by the diamond 1011 is affirmative as indicated by the arrow 1012 annotated YES, the main portion of the program routine is returned to at the location indicated by the arrow 999 in the manner illustrated by the arrows 1012, 1009, and 1003.

However, if the test indicated by the diamond 1011 is negative a general enable check request has been confirmed and accordingly, in the manner indicated by the arrow 1013 annotated NO, a general enable check request has been specified. Accordingly, instructions are issued in the manner indicated by the rectangle 1014 to cause all enabled blowers within the system to be displayed at the boiler diagram and display panel illustrated in FIG. 6. This enable check request is implemented by a setting of the latches within the AC driver stage in the same manner described for the display of all disabled blowers; however, it will be appreciated, that complementary information is loaded into the latch to achieve this result. Thereafter, as indicated by the arrows 1015, 1009 and 1003 the main routine is returned to at the location indicated by the arrow 999.

When neither a disable check nor an enable check has been requested in the manner indicated by the arrow 1016 annotated NO, the program next tests n the manner indicated by the diamond 1017 to ascertain whether or not either the enable check or disable check button has just been released. While the checks associated with the diamonds 995 and 1005 were previously described as a mere check of a flag condition, in actuality, the flag condition is ascertained and thereafter the condition of the disable check and enable check buttons associated with a set flag are also checked through the gating of OR gate information to the programmable controller to ascertain that both the flag has been set and the key is still in a down condition. Conversely, the check for a button just released condition indicated by the diamond 1017 comprises a check of the flag condition associated with either of the two disable check or enable check keys and after a finding that the flag for one of these keys has been set, a checking of the button condition by gating that information through the OR gate. If the flag is set but the button provides a Zero indication, the result is indicative that the button has just been released. If the test for the release of a button is negative in the manner indicated by the arrow 1009 annotated NO, no disable check or enable check sequence has just been processed and accordingly,, as indicated by the arrows 1012, 1009 and 1003, the program returns to the main routine at the location indicated by the arrow 999.

However, if the test indicated by the diamond 1017 is affirmative as indicated by the arrow 1018 annotated YES it will be clear that one of the disable check or enable check keys has just been released and hence that instruction was previously processed during a preceding cycle through the executive program and more particularly the check routine therein illustrated in FIG. 19. Under these conditions, a clearing of the latch and indicia conditions established for that previous check routine is appropriate. Accordingly, as indicated by the arrow 1018 annotated YES and the rectangle 1019, an instruction causing the resetting of all latches within the AC driver is issued and this is followed by an instruction as indicated by the rectangle 1012 which turns off the boiler panel display diagram indicia so that latches within the display decoder can be reset for current operating conditions and the display reinitialized. Thereafter, as indicated by the arrow 1021, the program returns to the main portion of the routine at the location indicated by the arrow 999.

The portion of the check routine illustrated in FIG. 19 which is entered at the location indicated by the arrow 999 is devoted to program enable check routines or sequence check routines associated with a specifice step of the program. More particularly, upon completion of previous portions of the routine, the portion of the check routine illustratd in FIG. 19 entered at the location indicated by the arrow 999 acts to initially check in the manner indicated by the diamond 1022 whether a program check request is being inserted. The program check request is entered, it will be recalled by the simultaneous depression of both the enable check keys 90 or 90' together with a program key P1 – P8 in the array 80 or 80' associated with either retractable units or wallblower units in the manner indicated in FIGs. 2B and 2C. Accordingly, if the enable check request key has its flag in a set condition in the manner indicated by the arrow 1025 annotated YES one condition of the pair of key conditions required for a program check request is present. Therefore, as indicated by the diamond 1025, the program next checks to ascertain whether an associated one of the program select buttons P1 - P8 has been depressed. If the test for a program key depression indicated by the diamond 1025 is negative as indicated by the arrow 1026 annotated NO, the remaining portions of the program are bypassed in the manner indicated by the arrow 1027 and the program continues to the next portion of the executive program as indicated by the circular flag 1028 annotated TO SECTION 7. This portion of the executive program is illustrated in FIG. 20 and is associated with the sequence check routine and the manual start routine.

If however, the program select button is also in a depressed condition as indicated by the arrow 1030 annotated YES, the program next acts in the manner indicated by the rectangle 1031 to issue an instruction to display all sootblowers in the program. This instruction is implemented as will be appreciated by those of ordinary skill in the art by addressing the data field for each sootblower and inspecting the digits therein which are assigned to the specific program for which a program key has been depressed. The Zero or One condition of these digits in the program are then written into the latches within the AC driver so that each sootblower will hae a One or Zero condition set into the latches within the AC driver associated therewith depending upon whether or not it is assigned to the program for which the program key was depressed. Then through successive data out or read operations of the AC driver means this information will be latched into the display decoder so that a display defining all blowers which have been selected within a given program is set forth in the manner indicated by the rectangle 1031. Thereafter, as indicated by the arrow 1032 the program continues within the executive program and more particularly moves onto the portion thereof described in conjunction with FIG. 20.

If the test for a program check request indicated by the diamond 1022 is negative in the manner indicated by the arrow 1033 annotated NO it is apparent that the enable check key has not been depressed in association with a program select button and therefore in the manner indicated by the diamond 1034 the program next tests to ascertain whether or not the sequence check key has been depressed. The sequence check key it will be recalled, is provided on the program input panel illustrated in FIG. 2A and provides the function, when depressed of causing a sequence, as defined in the thumbwheels 59 for a given program defined by the program select keys 46 - 53 thereon to be displayed.

Only a single sequence of a given program is displayed for each depression of the sequence check key 60 and the function of this key it will be recalled is to allow the operator to obtain a visual indication of which sootblowers have been programmed for a given sequence within a given program. Whenever the sequence check key is depressed, a flag is set therefor during the update portion of the monitoring routine illustrated in FIG. 14 and hence a flag indicia as to whether or not this key is in a depressed condition is provided to the logic.

If the sequence key has been depressed in the manner indicated by the arrow 1035 annotated YES the program next tests in the manner indicated by the diamond 1036 to determine if a program select button, corresponding to one of the program select buttons 46 - 53 in FIG. 2A has been depressed. If no program select button has been depressed in the manner indicated by the arrow 1037 annotated NO, the remaining portions of this routine are skipped and the executive program is continued through an entry to the portion thereof defined in FIG. 20 in the manner indicated by the arrows 1037 - 1039 and the oval flag 1028 annotated TO SECTION 7.

However, if the test for a program select button in an ON condition is affirmative as indicated by the arrow 1041 annotated YES, the program next tests in the manner indicated by the diamond 1042 to ascertain whether or not the sequence number set into the thumbwheels 59 as illustrated in FIG. 2A is proper. The propriety of the sequence number will be a function of the number of sequences which are permissible within the executive program, the number of sequences actually programmed for the program whose select button has been depressed and the number set into the thumbwheels 59 must also correspond to an operative number within the program. If the test associated with the diamond 1042 is negative in the manner indicated by the arrow 1043 annotated NO, the remaining portion of the program routine illustrated in FIG. 19 and skipped and processing within the executive program shifts to section 7 which is disclosed in FIG. 20 in the manner indicated by the arrows 1043, 1038 and 1039 as well as the circular flag 1028 annotated TO SECTION 7. However, should the test for a proper sequence number as indicated by the diamond 1042 be affirmative in the manner indicated by the arrow 1044 annotated YES it will be appreciated by those of ordinary skill in the art that the presence of the sequence key in an on condition, the presence of a program select button in an on condition and the presence of a valid number set into the thumbwheels 59 have been confirmed. Under these conditions, the program issues commands which cause the display of all sootblowers in this sequence for the program defined in the manner indicated by the rectangle 1045. This is done, as will now be appreciated by those of ordinary skill in the art by addressing the portion of the data field for each sootblower for the program designated at the program select button and ascertaining the sequence number set therein. Whenever the sequence number corresponds to that set into the thumbwheels, a One is loaded into the AC driver latch for the sootblower which appears in that sequence of the defined program. Once this has been done for each of the sootblowers in the system, the condition of the AC driver latches are loaded into the display decoder latches through data out operations carried out at the AC driver means. In this manner, a One is set into the display decoder for each soothblower assigned to the sequence of the defined program for which a sequence check request has been generated. Upon a loading of all of the latches of the display decoder in this manner, all those sootblowers within the sequence of the program defined will be displayed in the usual manner. Once this has been completed in the manner indicated by the arrow 1039 processing within the executive program is continued by a shifting to Section 7 in the manner indicated by the circular flag 1028.

When the check conducted for a program check request which corresponds to an enable check as aforesaid as indicated by the diamond 1022 and the check conducted for a sequence check request, as indicated by the diamond 1034 are both negative in the manner indicated by the arrow 1047 annotated NO the system then checks in the manner indicated by the diamond 1048 to ascertain whether or not either the enable check request key or the sequence check request key have just been released. The test associated with the diamond 1048 is performed in precisely the same manner described for this test in association with the diamond 1017 in that whenever a test for a key in an on position is tested both the flip flop and the key condition per se are tested so that both conditions confirm the presence of the key in the on state. However, should the key be found to reside in an up condition or off condition while the flip flop is still set, a condition where the key had just been released will be confirmed. Whenever the test conducted in association with the diamond 1048 is negative as indicated by the arrow 1038 annotated NO, the remaining steps in the routine illustrated in FIG. 19 are skipped and, in the manner indicated by the arrows 1038 and 1039 a shifting to section 7 occurs as indicated by the circular flag 1028 for further processing within the executive routine. However, whenever the test associated with the diamond 1048 is affirmative, as indicated by the arrow 1049 annoted YES, a condition where the enable check key or the sequence check key has just been released will be confirmed. Under these conditions it will be appreciated that a specialized check display had been set into the latches within the AC driver for the purposes of setting up the display which had been appropriate for the check requested and hence as this display may now be cleared in association with the release of the key involved, a resetting of the latches within the AC driver and display decoder should take place. Accordingly, as indicated by the rectangle 1050 the latches within the Ac driver are cleared and thereafter, the lights for the display are extinguished in the manner indicated by the rectangle 1051 so that subsequent operation of the multiplexer means will result in the appropriate setting of the latches within the display decoder and a new display being provided to the boiler display panel illustrated in FIG. 6 thus representing the actual operation of the system. Thereafter, as indicated by the arrow 1052 exiting to section 7 occurs in the manner indicated by the arrow 1039 and the circular flag 1028 so that processing within the executive program can continue.

Accordingly, it will be appreciated by those of ordinary skill in the art that the check routines processed within the flow diagram illustrated in FIG. 9 acts to process appropriate commands issued in response to a depression of the disable check key, the enable check key, a program check request operation as defined by the depression of both the enable check request key and a program select button as well as the sequence check ley to thus cause a display of the information requested so that the operator may quickly and efficiently obtain the desired information regarding sootblower status or sootblower information associated with the assignment of sootblower within a program or sequence thereof. In addition, the flow diagram illustrated in FIG. 19 is responsive to the release of the check key being discussed to cause a resetting of the output within the AC driver and an extinguishing of the illuminated indicia within the boiler diagram and display panel illustrated in FIG. 6 so that upon a termination of the check sequence initiated by an operator, the system is restored to its normal sequencing mode of operation wherein the sequential operation of the multiplexer means acts to divide a display associated with the operative condition of the system in a mode which is virtually independent of the operation of the programmable controller 1.

STEP CHECK AND MANUAL START

Referring now to FIG. 20 there is shown a functional flow diagram illustrating a portion of the exemplary executive program which is devoted to step check and manual start operations. In the flow diagram illustrated in FIG. 20, the top portion thereof is devoted to the program routine which disposes of the step check request wherein each sequence of blowers defined within a given program are displayed on the boiler and display diagram in a sequential manner until all sequences set forth in the program have been displayed in a stepwise manner. The lower portion of the flow diagram illustrated in FIG. 20 is devoted to manual start operations wherein the programmable controller is employed in a non program mode to start sootblowers, when permissible, as a function of sootblower information defined by the operator at the program input panels illustrated in FIGS. 2B and 2C.

Turning specifically to FIG. 20 it will be seen that this section of the executive program is entered at the location indicated by the circular flag 1028 annotated SECTION 7. When the program is initially entered as indicated by the circular flag 1028, it initially proceeds in the manner indicated by the diamond 1060 to asecertain whether or not the step check request key within the control sections 82 and 82' of the input panels illustrated in FIGS. 2B and 2C have been depressed. This test, is again performed by the monitoring of the condition associated with a flag which is set in the initial portion of the monitor loop each time one of the step check keys is depressed. If no step check request has been generated in the manner indicated by the arrow 1061 annotated NO, the whole upper portion of the step check routine is bypassed in the manner indicated by the arrows 1062 and 1063 and the lower portion of the program illustrated in FIG. 20 is rejoined at the location indicated by the arrow 1064 so that processing pursuant to manual start operations next occurs. However, if the step check request key has been depressed in the manner indicated by the arrow 1065 annotated YES, a step check request has been generated and processing within the upper portion of the flow chart illustrated in FIG. 20 occurs.

If a step check request has been generated in the manner indicated by the arrow 1065 annotated YES, the program next tests in the manner indicated by the diamond 1066 as to whether or not a program select button has been depressed to define the program for which a step check sequence is to be generated. If no program select button has been depressed as indicated by a test of the flag associated therewith, in the manner specified by the arrow 1067 annotated NO, it will be apparent that the step function which has been requested has not yet been fully defined. Therefore, as indicated by the arrow 1068 annotated NO, as well as the arrows 1062 and 1063, the upper portion of the flow diagram illustrated in FIG. 20 is bypassed and the main portion of the routine is rejoined at the location indicated by the arrow 1064 whereupon processing pursuant to a manual start operation occurs. However, if a program select button has been depressed as indicated by the arrow 1068 annotated YES, a step check for a given program has been fully defined. Therefore, as indicated by the diamond 1069, the program next checks to ascertain whether or not the program defined is already stepping.

More particularly, a specialized software counter is maintained in the conventional manner for the purpose of the step check routine and in effect the counter maintains the sequence number for the step currently being displayed and is incremented each time a preceding step of a program has been displayed at the boiler diagram and display panel illustrated in FIG. 6. Therefore, as will be already appreciated by those of ordinary skill in the art, whenever the state of the software counter is other than Zero, the step check generated is in some intermediate stage of processing, while if the state of the software count is Zero, no processing has occurred therein. Accordingly, when the test indicated by the diamond 1069 is negative in the manner indicated by the arrower 1070 annotated NO, the first step for the program selected is displayed at the boiler display panel illustrated in FIG. 6 in the manner indicated by the rectangle 1071. The display of any step of a program within the step check request sequence is implemented, under program control, by an inspection of the data field for each sootblower to ascertain which sootblower is in the defined program and thereafter inspecting any sootblower whose data field is indicative that it is specified within the defined program to ascertain whether or not it is in the sequence defined by the program counter. If the sootblower is within the program and sequence defined, a One is loaded into the AC driver latch associated with that sootblower and this continues until all the sootblowers have had their data fields inspected so that all sootblowers within the defined sequence of the specified program have a One latched into the latch associated therewith at the AC driver. Thereafter, through data out operations, the condition of the AC drivers are latched into the display decoder and are employed to illuminate the appropriate indicia on the boiler and display diagram illustrated in FIG. 6 for the first sequence of the program defined. Additionally, as also indicated within the rectangle 1071, the state of the program stepping counter employed for the test associated with the diamond 1069 is incremented so that the next time through the program the test associated with the diamond 1069 will be indicative that the program is already stepping. Upon completion of the issuance of instructions associated with the rectangle 1071, the program proceeds in the manner indicated by the arrows 1072 and 1073.

When the test associated with the diamond 1069 is affirmative, in the manner indicated by the arrow 1074 annotated YES, it will be apparent from the state of the sequence counter employed therefor that at least the first sequence for the defined program for which a step check has been generated has been displayed. Accordingly, processing for subsequent steps of the program defined is appropriate. This occurs, by initially testing in the manner indicated by the diamond 1075 as to whether or not the last step of the defined program has been displayed. The test associated with the diamond 1075 is processed by a comparison of the sequence number pointed to in the sequence counter described in association with the diamond 1069 and the maximum sequence numbers stored in the program for which the step check has been requested. If the sequence number stored within the program selected does not exceed the sequence number pointed to by the sequence counter associated with the diamond 1069 it will be apparent that the last step or sequence for that program has already been displayed. Conversely, should sequence numbers be present in the program which are greater than that pointed to by the sequence counter associated with the diamond 1069, it will be apparent that the last step in the sequence has not yet been displayed or acted upon. When the last step or sequence for the program defined has already been displayed, in the manner indicated by the arrow 1076 annotated YES, it will be apparent that the step check program which has been initiated has been completed. Therefore, as indicated by the arrows 1076, 1067, 1062 and 1063, the main portion of the flow chart illustrated in FIG. 20 is returned to at the location indicated by the arrow 1064 so that further processing therein associated with manual start operations may be performed.

When the test associated with the diamond 1075 is indicative that the last step or sequence of the program for which a step check has been generated has not been processed in the manner indicated by the arrow 1077 annotated NO, the program then acts in the manner indicated by the rectangle 1078 to display the next step of the program and to increment the sequence counter described in association with the diamond 1069. The display of the next step at the incrementing of the sequence counter is performed in precisely the same manner described in association with the rectangle 1071 with a single exception that rather than displaying the initial step of the program defined, the instructions associated with the rectangle 1078 cause the state of the sequence counter to be ascertained and the data field of each sootblower to be inspected so that only sootblower information associated with sootblowers which have been defined for the program identified by the program button and the sequence pointed to by the sequence counter have Ones loaded into the AC drive for the purposes of displaying the step into the sequence. Thereafter, the state of the sequence counter is incremented in the manner indicated by the rectangle 1078 and the program is rejoined at the location indicated by the arrow 1073 in the manner indicated by the arrow 1079.

Whether the program is rejoined at the location indicated by the arrow 1073 through the issuance of instructions associated with the rectangle 1071 or the rectangle 1078, the program next tests in the manner indicated by the diamond 1081 to ascertain whether or not any units have been displayed this step. This may be done, as will be apparent to those of ordinary skill in the art by testing the state of the latches within the AC driver to ascertain if any latches have been placed in a set state for the purposes of loading the display decoder and driver or alternatively, the condition of latches within the display decoder and driver may be tested in specie.

If no units have been displayed this step in the manner indicated by the arrow 1082 annotated NO, the program again tests to ascertain whether or not the last step or sequence within the program has been displayed in the manner described in association with the diamond 1075. If the last step has been displayed as indicated by the arrows 1076, 1067, 1062 and 1063 the program is rejoined at the location indicated by the arrow 1064 whereupon processing associated with a manual start up operation occurs. Conversely, should the test associated with the diamond 1075 be indicative that the last step of the program has not been displayed, processing will occur in the manner described in association with the rectangle 1078 whereupon the next step within the defined program is displayed and thereafter the test associated with diamond 1081 is repeated until it is ascertained that the last step of the defined program has been processed or alternatively, units have effectively been displayed.

When the test associated with the diamond 1081 is affirmative in the manner indicated by the arrow 1083 annotated YES, the program proceeds in the manner indicated by the rectangle 1084 to issue instructions causing the setting of a delay through a timer or the like and thereafter turning off the boiler diagram and display lights. This is done, it will be appreciated, to ensure that the sequence currently being addressed by the sequence counter is displayed at the boiler diagram and display panel illustrated in FIG. 6 for a sufficient interval to apprise the operator of the sootblowers assigned to the sequence being processed and thereafter to turn off the boiler diagram and display lights for that sequence so that the sequence then displayed is whereupon the next sequence can be displayed upon the next entry into the flow chart illustrated in FIG. 20 at the location indicated by the circular flag 1028 during a succeeding sequence through the executive program. In the instant embodiment of the present invention, a previously displayed step is extinguished after an appropriate interval; however, preceeding steps may alternatively be retained in an illuminated condition so that a stepwise build up of all blowers in a program is provided at the display. Thereafter all latches in the AC driver could be reset at once.

Accordingly, it will be appreciated by those of ordinary skill in the art that each time the flow chart illustrated in FIG. 20 is entered during a cycle of the executive program, tests are conducted to ascertain if a step check has been requested and a program for processing in this routine has been defined. If either condition is absent, the top portion of the flow chart illustrated in FIG. 20 is by-passed and processing under the manual start operation in the lower half of the program illustrated in FIG. 20 occurs. However, if a step check request has been properly generated in combination with the definition of a program for which the step check routine is to be supplied, the program next ascertains whether or not the display of a sequence thereunder is appropriate and if the same is appropriate causes it to be displayed and thereafter turns off the boiler diagram display lights to clear the sequence which has been displayed so that the next sequence can be displayed in a subsequent cycle through the executive program. However, if the display of a step is inappropriate, the program ascertains whether or not the last step of the program defined has been displayed and if the same has not been displayed, a display of the next step is incremented while when the last step of the program has been displayed, branching to the lower portion of the flow chart illustrated in FIG. 20 is initiated so that manual start up operations may be processed under program control.

The portion of the flow chart illustrated in FIG. 20 which is initiated in association with the arrow 1064 causes processing to occur in accordance with manual start up operation which are initiated by the operator at the information input panels illustrated in FIGS. 2B and 2C and implemented under program control. When this portion of the flow chart illustrated in FIG. 20 is initiated in the manner indicated by the arrow 1064, the program first tests in the manner associated with the diamond 1085 to ascertain whether or not any sootblowers are then in service. If sootblowers are currently in service, in the manner indicated by the arrow 1086 annotated YES, manual start up operations are inappropriate and accordingly, this portion of the executive program is bypassed and the portion of the executive program associated with section 8 as described in conjunction with FIG. 21 is entered in the manner indicated by the circular flag 1087. The portion of the executive program described in association with the flow charts set forth in FIG. 21 is associated with remove routines entered at the program panel illustrated in FIG. 2A and is described subsequently.

When the test associated with the diamond 1085 is indicative that no sootblower is in service in the manner indicated by the arrow 1088 annotated NO, the program next tests in the manner indicated by the diamond 1089 as to whether or not a retract manual start up operation has been defined. This test is accomplished by testing the flag associated with the retract manual start key illustrated in the input panel described in association with FIG. 2B, it being appreciated that this flag is placed in a set condition during the initial portions of the monitor routine illustrated in FIG. 14. If no manual start up operation for retracts has been specified, in the manner indicated by the arrow 1090 annotated NO, the program next tests in the manner indicated by the diamond 1091 to ascertain whether or not a wallblower manual start up operation has been defined at the input panel illustrated in FIG. 2C. This test, as will be appreciated by those of ordinary skill in the art again involves the testing of a flip flop set in response to a depression of this key during the monitor portion of the executive program. When neither a retract manual start up operation or a wallblower manual start up operation has been defined, as indicated by the arrow 1092 annotated NO, branching from the program illustrated in FIG. 20 to that illustrated in FIG. 21 occurs in the manner indicated by the circular flag 1087 as no further processing within the manual start up routine is appropriate.

However, if the test for a wallblower manual start up operation is affirmative in the manner indicated by the arrow 1093 annotated YES, the main portion of the routine illustrated in FIG. 20 is returned to at a location indicated by the arrow 1094 so that further processing within the manual start up routine which has now been ascertained may continue. Similarly, if a retract manual start up routine has been identified in the manner indicated by the arrow 1095 annotated YES, the program next tests in the manner indicated by the diamond 1096 as to whether or not an emergency retract condition has occurred. If an emergency retract condition has occurred, it will be apparent that no retract manual start up operations are appropriate even though the same had been specified by the operator. Therefore, under these conditions, as indicated by the arrow 1097 annotated YES, branching to section 8 occurs in the manner indicated by the circular flag 1087 whereupon processing pursuant to the flow chart illustrated in FIG. 21 continues. However, if no emergency retract condition has occurred in the manner indicated by the arrow 1094 annotated NO, manual processing may continue in the manner defined by the operator, it being appreciated that the main routine portion defined by the arrow 1094 may be entered in response to manual start up procedures for a retract absent an emergency retract condition or pursuant to the initiation of manual start up operations for a wallblower in the manner indicated by the arrow 1093.

Regardless of the nature of the entry to the location defined by the arrow 1094 within the manual start up portion of the flow chart illustrated in FIG. 20, when this location is entered by the program, the program next tests in the manner indicated by the diamond 1098 to ascertain whether or not a low header pressure condition has occurred. This test may be performed in much the same manner described for the tests for this condition defined above. Furthermore, it will be appreciated by those of ordinary skill in the art that whenever a low header pressure condition is present in the manner indicated by the arrow 1099 annotated YES, sootblower start up procedures of any type are inappropriate. Therefore, under these conditions it will be seen that branching to section 8 occurs in the manner indicated by the circular flag 1087.

When however, no low header pressure condition is present in the manner indicated by the arrow 1101 annotated NO, processing pursuant to a manual start up operation may be initiated provided a valid sootblower has been defined for such start up operations. Accordingly, under these conditions, as indicated by the diamond 1102, the program next tests to ascertain whether or not the blower defined at the thumbwheels is a valid blower within the system. This test is conducted by testing, in essence, whether the blower number set into the thumbwheels effectively represents a valid blower of the retract or wallblower type within the system and is consistent with either the retract or wallblower manual start up operations specified. If no valid thumbwheel information for the retract or wallblower manual start up operation defined is present in the manner indicated by the arrow 1103 annotated NO, branching to section 8 occurs in the manner indicated by the arrows 1104 and 1099 as well as the circular flag 1087 as appropriate information to initiate a manual start up operation for the retract or wallblower specified has not been inserted.

If however, the thumbwheel information inserted at the information input panel to define the sootblower to be started is valid in the manner indicated by the arrow 1105 annotated YES, all conditions precedent the definition of threshold conditions for a manual start up operation for either retracts or wallblowers are present. Accordingly, under these conditions, the program next tests in the manner indicated by the diamond 1106 to ascertain whether the blower specified is currently enabled. The test indicated by the diamond 1106 may be simply performed by interrogating the sootblower data field whose address is defined at the thumbwheels whereat the operative or disabled condition thereof is readily available. If that blower is enabled in the manner indicated by the arrow 1107 annotated NO, branching to FIG. 21 occurs in the manner indicated by the arrows 1104, 1099 and the circular flag 1087. However, if the blower defined is enabled in the manner indicated by the arrow 1108 annotated YES, manual start up procedures for the sootblowers specified are fully appropriate. Accordingly, in the manner indicated by the rectangle 1110, the start signal timer is started to provide a 5 second timing interval during which the sootblower is required to start as aforesaid, and thereafter, as indicated by the rectangle 1111, the AC driver is loaded with appropriate sootblower start information and a start signal is gated to the appropriate sootblower defined at the thumbwheels in the manner previously described in regard to portions of the executive program associated with program execution. Thereafter, as a manual start up procedure has already been initiated, a manual inhibit signal is issued by the controller in the manner indicated by the rectangle 1112 and the manual permit light is extinguished in the manner indicated by the rectangle 1113. Subsequently, as indicated by the circular flag 1087, processing within the executive program continues by a shifting of the program sequence of events to the portion of the executive program whose flow chart is illustrated in FIG. 21.

Accordingly, it will be appreciated by those of ordinary skill in the art that the lower portion of the flow chart illustrated in FIG. 20 is concerned with manual start up operations and acts in an appropriate manner to process such manual start up instructions when conditions are otherwise appropriate therefor. Thus, when entered, the program initially checks to ascertain whether or not any sootblower is in service and if no sootblower is in service, ascertains whether or not a retract manual start up operations or a wallblower manual start up operation has been processed. If neither of these operations have been specified branching to section 8 occurs; however, if either a wallblower manual start up operation has been specified or a retract manual operation has been specified and no emergency retract condition is pending, the program next checks to ascertain whether the header pressure is appropriate, the thumbwheel information defines a valid sootblower of the type specified and whether the blower specified is operative. If all these conditions are appropriate, the start signal timer is initiated, a start signal is issued to the blower, a manual inhibit signal is issued and the manual permit light is extinguished, whereupon branching to section 8 then occurs to continue processing within the executive program.

PROGRAM PANEL REMOVE ROUTINE

Referring now to FIG. 21, there is shown a functional flow diagram illustrating the portion of the exemplary executive program devoted to the removal of sootblowers from programmed operational sequences as may be commanded by the operator through an entry of appropriate thumbwheel information and the depression of the remove key at the program input information panel illustrated in FIG. 2A. When the flow chart illustrated in FIG. 21 is entered at the location indicated by the circular flag 1087 annotated SECTION 8, the program initially tests in the manner indicated by the diamond 1118 to ascertain whether or not the remove request key 56 as illustrated in FIG. 2A has been depressed. The test for this key in essence involves the testing of the condition of a flip flop which is set during the early portion of the monitor routine illustrated in FIG. 14 whenever the remove key 56 has been depressed. If the results of the test associated with the diamond 1118 is negative in the manner indicated by the arrow 1119 annotated NO, the remaining portions of the routine illustrated in FIG. 21 are bypassed in the manner indicated by the arrow 1120 and branching to the insertion routine illustrated in FIG. 22 occurs in the manner indicated by the circular flag 1121. This occurs, as will be appreciated by those of ordinary skill in the art since processing within the remove routine illustrated in FIG. 21 is not appropriate when the remove key 56 at the program panel illustrated in FIG. 2A has not been depressed.

If however, the remove request key has been depressed and hence a remove operation generated, in the manner indicated by the arrow 1122 annotated YES, the program next tests in the manner indicated by the diamond 1123 as to whether or not a program select button has been depressed. This operation, as indicated by the diamond 1123 is again performed by testing the condition of a flag set in response to a depression of the program select button associated with a given program at the program input panel illustrated in FIG. 2A and is appropriate because remove requests in similar manner to insertion requests as shall be discussed in conjunction with FIG. 22 are processed on the basis of the removal of a sootblower from a predetermined sequence within a defined program. Hence, both the depression of a program select button and the specification of a sequence at the thumbwheels 59 are required to remove a given sootblower from a predetermined sequence of a defined program. If the test indicated by the diamond 1123 is negative in the manner indicated by the arrow 1124 annotated NO, further processing within the remove routine illustrated in FIG. 21 is inappropriate, and therefore, as indicated by the arrow 1120 and the circular flag 1121 branching to the portion of the executive program illustrated in FIG. 22 occurs.

When, however, the test associated with the program select button as indicated by the diamond 1123 is affirmative as indicated by the arrow 1125 annotated YES, the program next tests in the manner indicated by the diamond 1126 as to whether or not this program is now operative. This test is performed since the removal routines as well as the insertion routines to be discussed hereinafter may not be implemented for a program which is now in operation to avoid the possibility of aborting or otherwise fouling up operations about to be executed. Therefore, while removal and insertion routines may be initiated for program numbers which are not in the process of execution, no such routines are permissible for programs in the process of execution. Accordingly, if the program specified at the program select button is a program which is now in operation, as indicated by the arrow 1127 annotated YES, the removal request generated will not be honored for this program. Accordingly, when these conditions obtain, the program request generated will not be honored for the program specified which corresponds to the program being executed and therefore, as indicated by the arrow 1120 and the circular flag 1121 branching to the insertion routine to continue operation through the executive program occurs.

When, however, the test associated with the diamond 1126 is negative indicating that the program for which the removal request has been generated is not the program now in operation, as indicated by the arrow 1128 annotated NO, actual processing within the removal routine may be implemented. The first step of processing within the removal routine per se, as indicated by the diamond 1129 is to test whether or not the blower thumbwheel information inserted at the unit select thumbwheels 58, as shown in FIG. 2A is valid in that the same defines an appropriate sootblower unit within the system. If a negative result obtains from the test indicated by the diamond 1129 as indicated by the arrow 1131 annotated NO, an instruction to illuminate the error light 62 on the program panel information input illustrated in FIG. 2A is illuminated in the manner indicated by the rectangle 1132 to advise the operator that an erroneous insertion has been made at the program panel. Thereafter, as indicated by the arrow 1120, branching to section 9 in the manner indicated by the circular flag 1121 occurs so that processing within the executive program continues.

If the test for valid blower thumbwheel information associated with the diamond 1129 is affirmative in the manner indicated by the arrow 1133 annotated YES, the program next tests in the manner indicated by the diamond 1134 to ascertain whether or not the sequence thumbwheel information inserted at the sequence thumbwheels 59 represents a valid sequence within the program specified. If the test associated with the diamond 1134 is negative in the manner indicated by the arrow 1136 annotated NO, an error instruction to turn on the error light in the manner indicated by the rectangle 1132 is again issued and branching to section 9 occurs in the manner indicated by the circular flag 1121. Thus, should an invalid sequence be specified at the sequence thumbwheels, the operator is provided with an error indication at the program input panel and thereafter the remove request generated is ignored and processing within the executive program continues.

However, if the test associated with the diamond 1134 is affirmative to indicate that valid sequence information has been inserted at the sequence thumbwheels 59 in the manner indicated by the arrow 1137 annotated YES, the program next tests in the manner indicated by the diamond 1138 to ascertain whether or not the blower defined at the blower thumbwheels is presently assigned to the step defined at the sequence thumbwheels for the program specified by the program button. This occurs because, as will be appreciated by those of ordinary skill in the art, no removal routine will be performed for a given blower which is not assigned to the sequence of the program for which the removal routine was specified and failure to indicate an erroneous result to the operator can be deleterious in that the operator might assume that the blower was removed from the actual sequence of the program in which it was established which was not properly set into the sequence thumbwheels or alternatively may lead to other problems of confusion which are disadvantageous. Therefore, when the results of the test indicated by the diamond 1138 are negative in the manner indicated by the arrow 1139 annotated NO, an instruction is issued to turn on the error light in the manner indicated by the rectangle 1132 and thereafter processing within the executive program is branched to section 9 in the manner indicated by the circular flag 1121. If however, the test associated with the diamond 1138 is affirmative in the manner indicated by the arrow 1140 annotated YES, a removal request has been generated for a valid sequence of a program in which the blower specified at the thumbwheels has been assigned. Therefore, under these conditions, the implementation of the removal of that blower from that sequence of the program is appropriate for implementation under program control. Accordingly, as indicated by the arrow 1140 annotated YES, an instruction is issued in the manner indicated by the rectangle 1141 to remove the blower from the program. This instruction is implemented as will be appreciated by those of ordinary skill in the art by addressing the portion of the data field for the defined sootblower in which sequence information for that sequence is stored and by thereafter writing a 00 into that location. Thereafter, as indicated by the rectangle 1142, an instruction is issued to turn on the accept light 61 as illustrated in FIG. 2A to advise the operator that the removal request generated has been honored and that the sootblower has been removed from the defined program and sequence under program control. Thereafter, processing within the executive program is continued in the manner indicated by the circular flag 1121.

INSERTION ROUTINE

Referring now to FIG. 22, there is shown a functional flow diagram illustrating a portion of the exemplary executive program which is devoted to the insertion of sootblower information into programmed operating sequences so that program blowing routines as envisioned within the instant invention may be inserted at the program input panel illustrated in FIG. 2A by the operator charged with this function. More particularly, it will be recalled from a description of FIG. 2A that to insert a given sootblower unit into a defined program sequence, the operator must depress the selected program key, dial up the desired sequence number at the sequence thumbwheels 59, dial up the number of the sootblower being inserted at the unit select thumbwheels 58 and thereafter depress the insert key 55. Therafter, the program will act to check the blower and sequence thumbwheel information to assure that the same is appropriate, check that the entry into this sequence of a given blower is appropriate and also check to ascertain that appropriate header distribution is present. If all these conditions are present the accept light 61 will be illuminated and the sootblower unit inserted into the program sequence desired; however, if any of these conditions are absent, the error indicator 62 will be illuminated. Each of these functions are implemented as shall be seen below within the program routine illustrated in FIG. 22.

When the program routine illustrated in FIG. 22 is initially entered at the location indicated by the circular flag 1121, the program routine initially tests in the manner indicated by the diamond 1145 as to whether or not an insert request has been generated at the program input panel illustrated in FIG. 2A. When an insert request is generated, a flag is set during the initial portions of the monitor routine illustrated in FIG. 14 and hence the test associated with the diamond 1145 merely acts to test the One or Zero condition of this flag. If no insert request is present in the manner indicated by the arrow 1146 annotated NO, processing within the insertion routine illustrated in FIG. 22 is inappropriate. Therefore, the program next tests in the manner indicated by the diamond 1147 to ascertain whether or not a remove request was generated. If a remove request was generated in the manner indicated by the arrow 1148 annotated YES, processing within the insertion routine is inappropriate and therefor, without further ado, branching to the beginning portion of the executive program takes place in the manner indicated by the arrows 1149 and 1150 as well as the circular flag 1151. However, if neither an insertion request nor a removal request is present, as indicated by the arrow 1152 annotated NO, a turn off command is issued for the accept light in the manner indicated by the rectangle 1153, a turn off command is issued for the error light as indicated by the rectangle 1154 and after these housekeeping functions have been completed, as indicated by the arrows 1149 and 1150 as well as the circular flag 1151, processing at the beginning portion of the executive program recurs so that the executive program is reentered at the portion thereof annotated SECTION 1 in FIG. 14.

When, however, an insert request is present in the manner indicated by the arrow 1155 annotated YES, the program next checks in the manner indicated by the diamond 1156 to ascertain whether or not a program select button has been depressed. If no program select button has been depressed as indicated by the arrow 1157 annotated NO, it will be appreciated by those of ordinary skill in the art that one of the requisite conditions for the insertion of a sootblower into a programmed sequence has not yet been specified at the program input panel illustrated in FIG. 2A. Therefore, under these conditions, as indicated by the arrows 1158 and 1146, testing for a removal request occurs in the manner indicated by the diamond 1147 and thereafter, either the housekeeping functions associated with the rectangles 1143 and 1154 are performed with a subsequent return to the initial portion of the executive program in the manner indicated by the circular flag 1151 or alternatively direct branching to the beginning portion of the executive program occurs in the manner additionally indicated by the circular flag 1151.

When a program has been specified, the results of the test indicated by the diamond 1156 will be affirmative as indicated by the arrow 1159 annotated YES. Under these conditions, the executive program then tests in the manner indicated by the diamond 1160 as to whether or not the program specified is now in operation. This test is conducted for the same reasons detailed therefor in connection with the removal test illustrated in FIG. 21 in that no insertion of a sootblower into a program may take place while that program is in operation to avoid a change in the data field of a sootblower which could be in the process of being employed for start up instructions or the like. This is done, as stated above, to avoid the possibility of malfunction and to prevent a key change in a program from taking place subsequent to the operation of the sequence associated therewith. Accordingly, if this program is now operating in the manner indicated by the arrow 1161 annotated YES, branching from the routine to the beginning portion of the executive program occurs in the manner indicated by the arrows 1158 and 1146 so that testing for a remove request is conducted in the manner indicated by the diamond 1147 and is thereafter followed by either direct branching to the initial portion of Section 1 as indicated by the circular flag 1151 or followed by housekeeping functions associated with rectangles 1153 and 1154 which is then followed to branching to the beginning portion of the executive program.

However, if an insertion request is ascertained by the test associated with the diamond 1145, a program select button has been depressed as indicated by the test associated with the diamond 1156, and the program specified is not currently in operation as indicated by the arrow 1162 annotated NO, initial conditions for processing within the insertion routine are present so that actual processing within this routine may be initiated. Under these conditions, the program tests in the manner indicated by the diamond 1163 as to whether or not the sootblower number specified at the unit select thumbwheels 58 is a valid number. If an invalid number has been defined at the unit select thumbwheels 58, as indicated by the arrow 1164 annotated NO, an error condition has been generated. Therefore, as indicated by the arrow 1165 and the rectangle 1166, an instruction to turn on the error light 62 illustrated in FIG. 2A is initiated to appropriately apprise the operator of this condition and thereafter as indicated by the arrows 1167 and 1150 as well as the circular flag 1151 branching to the initial portion of the executive program takes place.

When, however, the blower thumbwheel information inserted at the unit select thumbwheels 58 is valid as indicated by the arrow 1168 annotated YES, the sequence thumbwheel information inserted at the sequence thumbwheels 59 illustrated in FIG. 2A is checked to ascertain if a valid sequence has been specified in the manner indicated by the diamond 1169. When no valid sequence thumbwheel information has been inserted in the manner indicated by the arrow 1171 annotated NO, an error condition is again present. Therefore, as indicated by the arrow 1165 and the rectangle 1166, an instruction is issued to illuminate the error light 62 shown in FIG. 2A so that the operator will be appraised of the error condition. Thereafter, as indicated by the arrows 1167 and 1150 as well as the circular flag 1151, branching to the initial portion of the executive program occurs.

When valid sequence thumbwheel information has been ascerained in the manner indicated by the arrow 1172 annotated YES, the program next tests in the manner indicated by the diamond 1174 as to whether or not the blower identified at the blower thumbwheels is already programmed into this step or sequence of the program for which the program select button has been depressed. If an affirmative result is obtained as indicated by the arrow 1175 annotated YES an error condition is again present. Therefore, as indicated by the arrow 1165 and the rectangle 1166, an instruction is issued to turn on the error light to apprise the operator of the erroneous conditions specified and thereafter, in the manner indicated by the arrows 1167, 1150 and the circular flag 1151, branching to the initial portion of the executive program occurs.

If the blower specified is not already in this program step as indicated by the arrow 1176 annotated NO, the program next tests in the manner indicated by the diamond 1177 as to whether or not space is available in this step of the program. More particularly, it will be recalled that constraints are imposed under the control of the executive program to accommodate the header capacity of the system and that such constraints will only allow eight wallblowers to be assigned to a given sequence of a program or alternatively, two retracts can be assigned to a given sequence of a retract program. Additionally, as will be readily apparent to those of ordinary skill in the art, specialized high capacity wallblower units or retracts could by employed within selected embodiments of the instant invention under such conditions that only one of such specialized blower units could be employed during a given sequence of a program. Furthermore, where additional header capacity was available, the arbitrary constraints associated with the numbers of sootblowers of various kinds which are capable of being operated within a given sequence of a program may be enlarged so that greater than eight wallblower units or two retracts could be permitted within a given step of a program. In any event, in the exemplary embodiment of the present invention, up to eight wallblower units or two retract units may be assigned to a given sequence of a program established for wallblower or retract units and hence a software counter is established to maintain a count of the number of sootblowers assigned in a given sequence. Thus for instance, each time the test associated with the diamond 1177 is initiated, the sootblower data tables may be reviewed to ascertain which sootblowers have been assigned to this sequence of the program defined and each time a sootblower is ascertained, the software counter is incremented until the complete data table for al sootblowers has been reviewed. Thereafter, the state of the counter is tested under software control for the wallblower or retract being inserted and if the state of the count is smaller than eight for wallblowers or smaller than two for retracts space is available within this step for the insertion of an additional sootblower unit. However, should the state of the counter be equal to eight for wallblower units or equal to two for retract units no further space is available for the insertion of additional sootblowers in the sequence being defined.

Under these conditions, as indicated by the arrow 1178 annotated NO, and the rectangle 1166 an instruction to illuminate the error light is issued to apprise the operator that the number of sootblowers in the step defined has already reached a maximum condition. Under these conditions, the operator has the option of removing a previously inserted sootblower from the system to afford space within this sequence for the sootblower whose entry is currently desired or alternatively, such sootblower may be assigned to a subsequent sequence. Once the error condition has been indicated in response to the instruction indicated by the rectangle 1166, branching to the beginning of the executive program occurs in the manner indicated by the arrows 1167 and 1150 as well as the circular flag 1151.

If space is available in the step defined at the sequence thumbwheels in the manner indicated by the arrow 1180 annotated YES, the program next tests in the manner indicated by the diamond 1181 to ascertain whether or not the insertion of the sootblower defined at the unit select thumbwheels exceeds the permissible number of blowers per side or per header when considered in light of the sootblowers already programmed for this sequence. More particularly, it will be recalled that the exemplary embodiment of the present invention contemplates five headers for supplying sootblowers within the system and the arrangement of such headers is such that one header is provided to supply the capacity requirements of retracts while four headers are relied upon to supply the capacity requirements of wallblowers. Furthermore, only two wallblowers may be simultaneously operated from a single header and only one retract on each side of the boiler may be operative simultaneously. This means that for a retract program sequence, one retract from each side of the boiler must be assigned and the concurrent assignment of two retracts from the same side of the boiler is impermissible. Similarly, with regard to wallblowers, a single program step may only have two wallblower units which operate from a common header assigned to that sequence step and the assignment of a third wallblower within that sequence which is also assigned to a common header is impermissible. Therefore, even though there is room available within a given step for the assignment of additional wallblower or retract units in the manner indicated by the arrow 1180 annotated YES, the sootblower which is desired to be inserted as defined by the unit select thumbwheels 58 may not be allowed to overload the header capacity of the system. This means in a retract program step if a second retract unit is being inserted, it must reside on the opposite side of the boiler from the initial retract which has been inserted while if a wallblower unit is being inserted no more than one other wallblower unit having a common header assignment may already be inserted into this step of the program sequence. The test associated with the diamond 1181 is implemented for retractable units by determining through a review of the data field if any other retracts have been assigned to this step of the program. If another retract assigned to this sequence of this program is ascertained, its address is inspected to ascertain which side of the boiler the same resides at and is compared to the address of the retract which is currently being inserted. If the address information for each retract is indicative that they are on opposite sides of the boiler the insertion is permissible and hence, the result of the test associated with the diamond 1181 is negative as indicated by the arrow 1182 annotated NO. Similarly, for wallblower units, the data field of each sootblower is inspected to ascertain which other wallblower units have been assigned to this step of the defined program and as each wallblower unit assigned to this step of the program is ascertained its header assignment is noted from the data table associated therewith. When a common header assignment is found a counter is incremented and after a complete review of the data table, if the state of the counter which was incremented for wallblower units having a common header assignment is less than two, the insertion of the new wallblower unit is permissible, while if the state of the counter is two, the additional wallblower unit may not be inserted under the header constraints imposed by the executive program.

Accordingly, whenever the header assignments for the sootblower being inserted will not exceed the capacity constraints of the system, the test associated with the diamond 1181 will be negative in the manner indicated by the arrow 1182 annotated NO. Under these conditions, as indicated by the rectangle 1183, an instruction is issued to insert the blower defined at the unit thumbwheels into the program step defined by the program select button and the sequence thumbwheel information and accordingly, a One condition is written into the program and sequence portion of the data field associated with that sootblower to effectively insert that sootblower into the defined step of the designated program. Thereafter, as indicated by the rectangle 1184, the accept light 61 illustrated in FIG. 2A is illuminated and thereafter a return to the initial portion of the executive program in the manner indicated by the arrow 1185 and 1150 as well as the circular flag 1151 occurs.

Conversely, should the test associated with the diamond 1181 provide an affirmative result as indicated by the arrow 1186 annotated YES, an error condition is present as the header assignment would be exceeded by the insertion of the sootblower unit defined at the unit select thumbwheels 58. Accordingly, under these conditions, an instruction is issued to turn on the error light 62 in the manner indicated by the rectangle 1187 to appropriately apprise the operator as to the erroneous entry defined and thereafter as indicated by the arrows 1188 and 1150 as well as the circular flag 1151, a return to the beginning portion of the executive program occurs.

Accordingly, it will be appreciated by those of ordinary skill in the art that the insertion routine illustrated in FIG. 22 is responsive to an insertion request to initially check whether or not the program select button is down and if the same is down, to ensure that that program is not operating. If these initial conditions are appropriate, further processing within the program results; however, if inappropriate conditions are present, branching to the beginning portion of the executive program occurs. When the initial conditions which serve as a predicate to actual processing within the entry routine are present, the program next checks to ascertain whether or not the unit defined for insertion at the unit select thumbwheels is a valid sootblower unit and if the same is present the program then checks to ascertain whether or not the sequence number defined at the sequence thumbwheels is appropriate. If both these conditions are present, the program then checks to ascertain whether or not the blower is already in this step and whether space is available therefor in this step and should an adverse result occur under any of these tests, an error condition is indicated and thereafter a return to the beginning portion of the executive program occurs. Finally, the program routine then tests, prior to insertion, as to whether or not the blower being inserted when compared to the other sootblower units already assigned to this sequence will cause the header capacity constraints imposed by the executive program to be exceeded. If the constraints are exceeded, an error condition is indicated and the attempted insertion is ignored; however, if the constraints imposed by the executive program are not exceeded, the blower unit is entered into the sequence step for the program defined, the accept light 61 is illuminated and thereafter, branching to the beginning portion of the executive program occurs. Thus, in this manner actions of the operator with respect to the insertion of specific sootblowers into specified program sequences, is implemented under program control.

SUMMARY

From the foregoing disclosure it will be seen that the present invention provides a digital sootblower control system wherein a programmable controller is interconnected to scanner means, display panel means, sootblower drive means, signal receiver means, and information input means capale of designating sootblowers within the system, sootblowing program routines to be established and sequences of program routines to be initiated. The programmable controller is provided with an executive program which is determinative of system parameters to be monitored as well as limits upn sootblowing program routines to be established. Once a sootblowing program routine has been initiated by an operator, the programmable controller issues orders to the sootblower drive means to start an initial sequence of sootblowers defined in the initiated sootblowing program routine. Thereafter, the scanner means cyclically addresses all sootblower means so that inactive or active state thereof is supplied by the signal receiver means to the display panel means which provides indicia as to the state of the system and to the controller means for monitoring purposes. Should problems develop with sootblowers in service being monitored by the controller the problem area and malfunctioning sootblower are indicated at the display and when appropriate, the unit is returned to an inactive state. Similarly, should controller malfunction occur, sootblower operation may be manually initiated by an operator from said information input means despite the malfunctioning of the programmable controller.

The system thus provided establishes a digital sootblower control system wherein the initiation and monitoring of selected sootblowers are achieved through software techniques and allows a plurality of blowing patterns to be established by an operator and automatically initiated under program control in a desired sequence. Additionally, a plurality of programs for a plurality of blowing patterns may be established by an operator and automatically and selectively initiated under program control in a preselected sequence. The system further provides a preview mode of operation which enables the operator to preview through the use of an illuminated display the blowing patterns which have been selected for operation and this display is also employed to provide visual indicia of the operational status of sootblowers being controlled thereby. This means that one or more programs may be established for normal operating modes while other programs are established for specialized conditions or periodic requirements of the boiler system and may be initiated on an as needed basis under program control while the operator may consistently avail himself of the preview mode of operation to review which programmed blowing patterns are available for use as well as those which are being programmed.

The invention further provides a bypass mode of operation wherein automatic control features of the system are bypassed on an override basis and selected sootblowers may be manually started while the operational status thereof is indicated and during normal modes of operation, the display within the digital sootblower control system according to the instant invention acts in a normal mode to set forth the status of all sootblowers controlled thereby so that the operator is constantly apprised of the status of the system.

The digital sootblower control system according to the instant invention is capable of automatically starting any sootblower in the system as well as cancelling the operational status of any sootblower in the system regardless of whether or not the same is assigned to specified programmed sequences. In addition, the digital sootblower control system according to the instant invention is capable of monitoring and displaying the operation of each sootblower in the system as well as monitoring principle essentials of the sootblowing to thereby prevent continued sootblower operation if the system is not functioning properly as well as to abort the operation of any sootblower if a malfunction occurs.

The invention provides the ability of selecting various blowing pattern sequences as required by boiler cleaning requirements judged by the operator and programmed blowing routines may be readily altered to fit changed requirements, the break in of the boiler per se, or accommodating changes in operator attitude as experience with the system or the boiler's requirements increases as well as changes which may be mandated in blowing requirements which changes are associated with a change in the type of fuel employed for the boiler. Furthermore, previewing abilities are provided within the system not only for the purposes of displaying all sootblowers which are operable within a given program but in addition thereto each sequence within a program may be selectively displayed. The digital sootblower control systems according to the instant invention have the capability of initiating the operation of a plurality of sootblowers in a substantially simultaneous manner and the operation of each sootblower may be timed in service and should the service cycle thereof be exceeded an alarm indication is automatically initiated. An emergency mode of manual control is also provided should automatic portions of the control system fail and this emergency mode of manual control may also be employed to enable an operator to manually override programmed operating routines. The system additionally is provided with monitoring inputs for the system and automatic alarm indications which, in the case of a malfunctioning sootblower will act to indicate the nature of the malfunction which has occurred as well as the sootblower which is involved so that prompt maintenance of the specific unit which has malfunctioned may be performed with knowledge as to both the unit involved and the nature of the malfunction. The executive program employed within the instant invention may also be provided with the ability to limit sootblowers assigned within a given program in a manner which is in accordance with available header capacity of the system. Thus, typically in the exemplary case, the executive program acts automatically while the system is being programmed to impose a constraint on the programming such that no more than one retract on each side of the boiler may be assigned to a common sequence of a retract program and similarly, to prevent more than two wallblower units which are assigned to a common header from being assigned to the same sequence of a program even though up to eight wallblowers may be selected within a given sequence of the program. In addition, constraints as to the number of wallblower units or retracts assigned in a program sequence may be automatically imposed by the program so that the establishment of programmed blowing sequences by an operator occurs in a manner which is governed and controlled by system intelligence.

Although this invention has been disclosed in conjunction with a rather specific exemplary embodiment thereof due to the nature of the invention set forth many modifications and variations will be apparent to those of ordinary skill in the art. For instance, while positive logic has generally been employed for the purposes of disclosing the instant invention, it will be apparent that negative logic could be employed throughout and this may be particularly advantageous in cases where signals are run through lengthy conductors to avoid the generation of spurious noise levels and the like. Furthermore, while conventional logic configurations have been employed throughout for the purposes of illustration, complementary logic, alternative circuit arrangements and/or other logical arrangements devoted to the same purpose may be readily substituted by those of ordinary skill in the art, it being appreciated that any generalized forms of circuitry may be employed to achieve the desired functions within the instant invention.

Furthermore, while the instant invention has specifically disclosed a conventional controller arrangement employing magnetic cores, it will be readily appreciated by those of ordinary skill in the art that various other volatile storage arrangements may be employed without deviation from the teachings associated with the instant invention. Typically, RAM storage may be employed for the purposes of memory and under such circumstances, as will be readily appreciated by those of ordinary skill in the art, the executive program as well as programs associated with defined blowing sequences are loaded from a magnetic media such as a tape, disc or cassettes using bootstrap principles. Alternatively, RAM and ROM combinations may be employed wherein the executive program is retained in ROM storage on a permanent basis while the data field for sootblowers which contains program information and the like may be loaded into the RAM using a magnetic media in a bootstrap mode of operation in the manner well known to those of ordinary skill in the art.

Similarly, while data fields employed within the instant invention have been described as organized on a sootblower basis wherein recurring triple word locations are provided for each sootblower and contain assigned program and sequence slots as well as header, capacity and similar other information; it will be appreciated by those of ordinary skill in the art that alternate arrangements for the data field employed may be readily used and depending upon the operational configurations preferred by the designer may be more or less advantageous than those set forth above. More particularly, separate data fields may be established for sootblowers which contain only appropriate information associated with that sootblower and its operational characteristics while additional data fields associated with the programs per se and the sequences therein are established. When this type of arrangement is employed, sootblower designations could be directly loaded into the program field for each program specified and in this manner additional versatility for selected applications may be provided. Various other modes of organization for such data fields will suggest themselves to the designer of the system and the organization per se should not be considered as deviating a wit from the principles envisioned within the instant invention. The ability to program the operation of a large number of sootblowers in a vastly flexible way at the field site provides one of the most important aspects of the instant invention as the same enables changes in the system to be defined to meet the requirements of the system being controlled. With the instant invention blowing patterns or one or more blowers per se may be modified or added within the field by minor changes within the system and hence the system retains substantial flexibility due to the software control employed therein. Thus, it is this focus which must be appreciated when evaluating the instant invention rather than specific modes employed to achieve programming therein.

While the embodiment of the instant invention has considered only typical types of sootblower units such as retracts of various capacities and conventional wallblower units, it will be appreciated by those of ordinary skill in the art that additional control features may be incorporated within the instant invention without deviating from the control concepts disclosed therein. For instance, in appropriate situations accommodations may be made to control the air heaters employed therewith or the heat exchange system and in addition thereto other types of specialized sootblowing equipment or scrubber equpment used at the site may be controlled. Thus, specialized rotary wallblowers of the high capacity type may be controlled on an individual basis per sequence while the operation of scrubbing systems, valving for compressors and/or the like may be initiated and controlled by the instant invention so that the control of the system as a whole is optimized.

Additionally, the system provides an ability to data log information associated with individual sootblowers and such information may be merely printed out from the system on a periodic basis or alternatively transmitted to a plant computer which acts to accumulate this information together with other inputs to provide periodic maintenance schedules for the system as well as information which may be utilized to optimize system performance to a further degree. Furthermore, it will be appeciated that the instant system due to its digital mode of operation may readily accommodate additional condition responsive sensors when the same become available on a reliable basis and such sensors may be further employed in connection with the teachings of the instant invention to remove further operations from the control of the operator to achieve fully automatic operation. Thus, as more and more functions are removed from the operator less knowledge by the operator is required so that plant operation may become more fully automated while the system is enhanced as to responsiveness to conditions which occur therein.

Similarly, while no clock for timing and initiating periodic program operation has been disclosed herein, it will be readily appreciated by those of ordinary skill in the art that a 24 hour clock or similar timing mechanism could be readily incorporated within the instant invention to provide for the automatic operation and initiation of a specified program sequence or for that matter a plurality of programmed sequences on a regular periodic basis. Such a timing mechanism could be advantageous should it be desired to provide for the operation of a specified program or programs each 24 hour period or alternatively, should it be desired to operate every blower in the system, the sequence program which is hard wired into the system could be initiated every 24 hour interval. Another advantageous variation might be to modify the display modes employed herein to provide advisory indicia of which sootblowers have previously operated so that the operator is apprised of which sootblowers have not been initiated during a predetermined previous interval. Thus for instance, it will be appreciated that in the embodiment of the invention disclosed herein operating sootblowers are indicated at the display by the illumination of the indicia therefor, malfunctioning sootblowers are indicated by a flashing of the indicia therefor and non-operating sootblowers, in normal modes of operation, do not have their indicia illuminated. However, it would be relatively straightforward to modify the executive program so that any sootblower which has operated within the program or within a previous fixed period has its indicia dimly illuminated to provide an indication that the same has been operated. This could be done by providing energizing potential to the indicia which are to be dimly illuminated at a relatively low frequency so that another form of indication is provided at the display. Furthermore, additional sensors and advisory indications could be readily provided at the display in the form of graphics capable of advising the operator as to the nature of occurrences within the system.

It will also be appreciated that the digital sootblower control system according to the instant invention provides its own emergency back up system and that trouble alarms, annunciator alarms, condition responsive alarms and the like may be integrated into the system to a greater degree than has been depicted in conjunction with the exemplary embodiment to provide total system operation within a common, compact and convenient arrangement. In addition, although not previously mentioned, the display panel may be multicolored or otherwise arranged than depicted to improve human engineering as to the breakdown of the system. While data logging features have been briefly mentioned above, it should be apparent that the nature of the information which can be logged is quite varied and tends to be a function of legitimate sensors present within the system or others which may be readily added thereto. Thus, length of operation, flow values, elapsed time, time of day when blowing took place, consumption, total steam consumption, or air consumption and various trouble or problem areas between main cycles of maintenance can all be logged out and printed on a periodic basis. Through these procedures, system operation and maintenance control can be optimized as it will be readily apparent that minimum malfunction frequency will occur after a certain number of cycles of operation. In addition, it should be recognized that the instant invention is capable of conveniently controlling an extremely large number of sootblowers with little difficulty and without the normal multiplication of circuits and equipments associated with extremely large systems. This convenient form of control is extremely advantageous since with prior art control systems, large system control was frequently extremely difficult to achieve and imposed onerous requirements on the operator.

The digital sootblower control system according to the instant invention additionally provides the ready capability to perform analog to digital conversion routines which have some distinct advantages when considered in light of multiple sootblower operation. For instance, each blower operating requires a certain amount of flow and normally trip conditions are established to ascertain whether flow conditions are appropriate within the trip condition specified. However, it will be readily appreciated that flow is really a non-linear function in nature so that the regularity of the condition sensed will tend to vary depending upon the number of sootblowers in operation. Accordingly, while the trip conditions established represent a rough comparison of a given curve of the flow conditions required, the ability to precisely measure flow as an analog value and to perform a digital conversion therefor as a function of the number of blowers in actual operation would enable the flow meters within the system to be callibrated as a function of the nature of the operation actually taking place to provide highly accurate condition sensors.

While the invention has been described in connection with an exemplary embodiment thereof, it will be understood that many modifications will be readily apparent to those of ordinary skill in the art; and that this application is intended to cover adaptations or variations thereof. Therefore, it is manifestly intended that this invention be only limited by the claims and the equivalents thereof.

APPENDIX A

SYMBOL TABLE

| | | | | | |
|---|---|---|---|---|---|
| MAIN | 00110 | MAINA | 00151 | SETUP | 00153 |
| SETDN | 00170 | SETUPA | 00201 | ADSRT | 00213 |
| TBLRT | 00214 | UPDATE | 00216 | UPDF | 00327 |
| UPDD | 00342 | UPDE | 00347 | UPDA | 00352 |
| UPDB | 00367 | DMK | 00375 | ENCHK | 00415 |
| ENKC | 00446 | ENKD | 00452 | ENST | 00462 |
| ED | 00464 | EDA | 00576 | EDF | 00641 |
| EDB | 00663 | EDC | 00674 | EDCA | 00714 |
| EDCB | 00734 | EDD | 00751 | EDDA | 00766 |
| EDE | 01003 | EDH | 01022 | EDG | 01032 |
| ISCK | 01064 | FLCK | 01070 | NBMG | 01075 |
| PREP | 01116 | SET | 01145 | CSET | 01163 |
| CSETB | 01206 | CSETA | 01212 | FLASHIT | 01222 |
| FLASH | 01237 | FLASHA | 01255 | FLASHB | 01277 |
| PE | 01305 | PEA | 01325 | PEG | 01414 |
| PEGC | 01422 | PEE | 01425 | PEEE | 01444 |
| PEEA | 01450 | PEEB | 01461 | PEF | 01465 |
| PEEC | 01500 | PEC | 01514 | PED | 01516 |
| PEDA | 01523 | PEY | 01551 | PEW | 01565 |
| WBCHK | 01602 | CRD | 01612 | CRDB | 01624 |
| CRDA | 01627 | ERSET | 01635 | RSA | 01644 |
| RSB | 01653 | BLRSTR | 01655 | COMPR | 01673 |
| QCOM | 01711 | CCOM | 01721 | BLINC | 01733 |
| BLDEC | 01740 | ATOB | 01745 | BTOA | 01756 |
| LSET | 01766 | LSETA | 02020 | SS | 02043 |
| SSE | 02077 | SSF | 02117 | SSR | 02124 |
| STEP | 02134 | SPA | 02147 | SPB | 02157 |
| SPC | 02162 | SWITCH | 02203 | SD | 02213 |
| SDA | 02234 | QDCOM | 02237 | BCOM | 02243 |
| BLDINC | 02251 | BLDDEC | 02256 | MANA | 02263 |
| AHM | 02333 | OUTSA | 02365 | OUTSB | 02375 |
| OUTRA | 02405 | OUTRB | 02415 | OUTB | 02425 |
| TBA | 02443 | TBB | 02461 | LTON | 02463 |
| LTOF | 02470 | LTRSTA | 02474 | LTSET | 02500 |
| LTA | 02504 | ZCHK | 02512 | SHR | 02516 |
| SHL | 02524 | SHLA | 02532 | DECR | 02537 |
| CLOCK | 02543 | TIMER | 02626 | PWRUPA | 02635 |
| LTRST | 02650 | PWRUP | 02664 | DISC | 02724 |
| DISCC | 02752 | CON | 02755 | CONA | 02777 |
| CONC | 03032 | CONB | 03036 | COND | 03040 |
| CONT | 03064 | CONZ | 03067 | CONCK | 03102 |
| BLRSTRC | 03131 | BCOMA | 03147 | BCOMB | 03166 |
| ELON | 03205 | RTCRET | 00104 | INPR | 03337 |
| INPS | 03347 | INPK | 03357 | INPL | 03367 |
| INPM | 03377 | FLB | 03407 | SVCNTR | 03417 |
| RSTR | 03427 | CNTR | 03437 | BLRCNTR | 03447 |
| QCNTR | 03457 | RECNTR | 03467 | PGMR | 03477 |
| INPE | 03507 | INPF | 03517 | INPD | 03527 |
| FO | 03537 | FF | 03547 | TT | 03557 |
| CNTRL | 03567 | TWDR | 03577 | BLRDLR | 03607 |
| PGMMR | 03617 | TYFR | 03627 | NBSRR | 03637 |
| NBMRR | 03647 | CFLGR | 03657 | SEARCHP | 03667 |
| SEARCHQ | 03677 | LFLGR | 03707 | TBLRTR | 03717 |
| SETDNR | 03727 | ADSRTW | 03737 | LOOKAR | 03747 |
| SEARCHMR | 03757 | LTPOR | 03767 | LTPOLR | 03777 |
| TREER | 04007 | CARDA | 04017 | INPP | 04037 |
| INPQ | 04047 | INPG | 04057 | INPH | 04067 |
| INPJ | 04077 | FLA | 04107 | SVCNTW | 04117 |
| RSTW | 04127 | CNTW | 04137 | BLRCNTW | 04147 |
| QCNTW | 04157 | RECNTW | 04167 | PGMW | 04177 |
| INPB | 04207 | INPC | 04217 | INPA | 04227 |
| FT | 04237 | TO | 04247 | TF | 04257 |
| CNTWL | 04267 | TWDW | 04277 | BLRDLW | 04307 |
| PGMMW | 04317 | TYFW | 04327 | NBSRW | 04337 |
| NBMRW | 04347 | CFLGW | 04357 | SEARCHN | 04367 |
| SEARCHR | 04377 | LFLGW | 04407 | TBLRTW | 04417 |
| SETDNW | 04427 | ADSRTR | 04437 | LOOKAW | 04447 |
| SEARCHMW | 04457 | LTPOW | 04467 | LTPOLW | 04477 |
| TREEW | 04507 | CARDB | 04517 | BOA | 04537 |
| BOB | 04547 | BOC | 04557 | BOE | 04567 |

APPENDIX A - Continued

| | | | | | |
|---|---|---|---|---|---|
| BOH | 04577 | BOJ | 04607 | SVCNT | 04617 |
| RST | 04627 | CNT | 04637 | BLRCNT | 04647 |
| QCNT | 04657 | RECNT | 04667 | PGM | 04677 |
| BOG | 04707 | BOF | 04717 | BOD | 04727 |
| NBSL | 04737 | NBML | 04747 | ETL | 04757 |
| CNTL | 04767 | TWDB | 04777 | BLRDL | 05007 |
| PGMM | 05017 | TYF | 05027 | NBSR | 05037 |
| NBMR | 05047 | CFLG | 05057 | SEARCHT | 05067 |
| SEARCHS | 05077 | LFLG | 05107 | TBLRTG | 05117 |
| SETDNG | 05127 | ADSRTG | 05137 | LOOKA | 05147 |
| SEARCHM | 05157 | LTPO | 05167 | LTPOL | 05177 |
| TREE | 05207 | CARD | 05217 | SWAT | 05237 |
| LOOKD | 05247 | LOOKC | 05257 | ADSRTD | 05267 |
| LOOKE | 05277 | TBLRTA | 05307 | FIFTY | 05317 |
| FSLS | 05327 | LTOP | 05337 | SETUPL | 05347 |
| FSHS | 05357 | SBIS | 05367 | ADRS | 05377 |
| ADRS0 | 05407 | ADRS1 | 05417 | ADRS2 | 05427 |
| ADRS3 | 05437 | ADRS4 | 05447 | ADRS5 | 05457 |
| ADRS6 | 05467 | ADRS7 | 05477 | ADRS8 | 05507 |
| ENKF | 05517 | UPDZ | 05527 | SHLB | 05537 |
| NUMC | 05547 | ENWTME | 05557 | ETWTME | 05567 |
| NBMWTME | 05577 | ENRTME | 05607 | ETRTME | 05617 |
| NBMRTME | 05627 | ENWTMR | 05637 | ETWTMR | 05647 |
| NBMWTMR | 05657 | ENRTMR | 05667 | ETRTMR | 05677 |
| NBMRTMR | 05707 | INPN | 05717 | PGMD | 05727 |
| PGMS | 05737 | SEQD | 05747 | AHMA | 05757 |
| QCNTL | 05767 | QCNTS | 05777 | BLRD | 06007 |
| BLRWA | 06017 | BLRDLA | 06027 | TREONE | 06037 |
| VF | 06047 | VT | 06057 | VO | 06067 |
| OO | 06077 | BUFA | 06107 | BUFB | 06117 |
| PGMT | 06127 | MOZ | 06137 | ONN | 06147 |
| OFF | 06157 | MSKO | 06167 | OUTC | 06177 |
| STBMK | 06207 | STARTL | 06217 | STOPL | 06227 |
| RSETL | 06237 | DISPL | 06247 | MOLL | 06257 |
| WRST | 06267 | ALUST | 06277 | FLD | 06307 |
| FLG | 06317 | NUMB | 06327 | ZEROW | 06337 |
| ZEROS | 06347 | ONES | 06357 | THREES | 06367 |
| THREEW | 06377 | THREEWS | 06407 | FOURW | 06417 |
| FIVEW | 06427 | SEVENS | 06437 | TESTA | 06447 |
| TESTB | 06457 | DELAY | 06467 | WDS | 06477 |
| MSKUP | 06547 | MSKZ | 06557 | SEARCH | 06567 |
| SEARCHL | 06577 | ENKE | 06607 | SEARCHU | 06617 |
| SCNT | 06627 | MSKV | 06637 | DLCKD | 06647 |
| SLCKD | 06657 | AHMB | 06667 | SEVENW | 06677 |
| FLH | 06707 | FSLSA | 06717 | WBCHKA | 06727 |
| CVRT | 06737 | W | 07777 | A | 07776 |
| B | 07775 | C | 07774 | D | 07773 |
| E | 07772 | F | 07771 | ALU | 00007 |
| RDO | 00100 | INC | 00102 | A. W | 00104 |
| SLO | 00117 | AXW | 00120 | LDA | 00124 |
| ADN | 00133 | LDC | 00150 | SBN | 00146 |
| RDC | 00174 | DEC | 00177 | SRO | 00300 |
| COM | 00046 | HLT | 00000 | AXWN | 00140 |
| DI50 | 00050 | DI51 | 00051 | DI52 | 00052 |
| DO60 | 00060 | DO61 | 00061 | DO62 | 00062 |
| DO63 | 00063 | DO64 | 00064 | DO65 | 00065 |
| ETRSRT | 03337 | ETWSRT | 04037 | ETS | 04537 |
| ETREXF | 13337 | ETWEXF | 14037 | ETF | 14537 |
| NBMRSRT | 23337 | NBMWSRT | 24037 | NBMS | 24537 |
| NBMREXF | 33337 | NBMWEXF | 34037 | NBMF | 34537 |
| ALARM | 54537 | ENRSRT | 13347 | ENWSRT | 14047 |
| ENS | 14547 | ENREXF | 23347 | ENWEXF | 24047 |
| ENF | 24547 | DLCK | 34567 | SEQ | 14557 |
| SLCK | 44567 | SRT | 54557 | DEL | 54567 |
| SSCK | 24557 | STP | 44557 | PSH | 54727 |
| FSA | 44727 | FSB | 34727 | FSC | 24727 |
| FSD | 14727 | INA | 04727 | SEL | 04557 |
| RSET | 34557 | MOD | 53517 | VDC | 43517 |
| FSE | 34217 | FSF | 24217 | FSG | 14217 |
| FSH | 04217 | INB | 54707 | INE | 44707 |
| IND | 34707 | MOA | 23507 | MOB | 13507 |
| MOC | 03507 | RTM | 33377 | WBM | 24077 |
| ERA | 13377 | MOV | 04077 | STPF | 04607 |

APPENDIX A - Continued

| | | | | | |
|---|---|---|---|---|---|
| INHB | 14607 | SEQFL | 24607 | PSHF | 34607 |
| TFA | 44607 | NOSRT | 54607 | SQCK | 55717 |
| CONN | 45717 | DCON | 35717 | MOLFA | 36707 |
| DRST | 26707 | ONF | 16707 | VAC | 06707 |
| NBMLF | 05107 | ETLF | 15107 | MOLF | 25107 |
| NBSLF | 35107 | INOPS | 45107 | INOPT | 55107 |
| INOP | 06307 | INOPD | 16307 | CONFA | 26307 |
| CONF | 36307 | NOPT | 46307 | SPLIT | 56307 |
| PEFL | 06317 | WBF | 16317 | HCF | 26317 |
| NOP | 36317 | ERF | 46317 | ZERO | 06327 |
| ONE | 16327 | TWO | 26327 | THREE | 36327 |
| FOUR | 46327 | FIVE | 56327 | SEVEN | 15547 |
| FLASHF | 44537 | MOVF | 45547 | | |

```
PROGRAMMABLE SOOT BLOWER CONTROLLER  TYPE 1-40

            DEL
            ORG   0110


* EXECUTIVE SOFTWARE MASTER CONTROL ROUTINE

@0110 060216  MAIN      JL    UPDATE     :INPUT ALL EXTERIOR SIGNALS
@0111 060153            JL    SETUP      :MOVE DATA INTO WORK REGISTERS
@0112 060464            JL    ED         :ERROR DETECTION, EVALUATION
@0113 111000            IO    11,000     :TURN ON REAL TIME CLOCK
@0114 061237            JL    FLASH      :FLASH BOILER DIAGRAM LIGHTS
@0115 345547            RD    MOVF       :IF EMERGENCY OVERRIDE KEY
@0116 010151            JN    MAINA      : SWITCH IS ON--SKIP
@0117 062333            JL    AHM        :START AIR HEATER CLEANERS
@0120 354537            RD    ALARM      :IF ANY ALARM CONDITION EXISTS--
@0121 010151            JN    MAINA      : SKIP
@0122 324537            RD    NBMS       :IF NO BLOWING MEDIUM TIMER IS
@0123 010151            JN    MAINA      : ON--SKIP
@0124 061305            JL    PE         :BLOWER PROGRAM EXECUTION
@0125 062213            JL    SD         :ENABLE AND DISABLE REQUESTS
@0126 314047            RD    ENWSRT     :IF ANY WALLBLOWERS ARE
@0127 010151            JN    MAINA      : STARTING--SKIP
@0130 313347            RD    ENRSRT     :IF ANY RETRACTS ARE
@0131 010151            JN    MAINA      : STARTING--SKIP
@0132 205017            RW    PGMM       :SAVE PROGRAM OPERATING NUMBER
@0133 406127            WW    PGMT       : IN TEMPORARY STORAGE
@0134 062043            JL    SS         :ENABLE-,DISABLE-,STEP- CHECKS
@0135 062134            JL    STEP       :SEQUENCE CHECK REQUESTS
@0136 304537            RD    ETS        :IF ANY BLOWERS IN SERVICE--
@0137 010147            JN    MAINA-2    : SKIP
@0140 062263            JL    MANA       :SOOTBLOWER MANUAL STARTS
@0141 304037            RD    ETWSRT     :IF ANY WALLBLOWERS ARE IN
@0142 010147            JN    MAINA-2    : SERVICE--SKIP
@0143 303337            RD    ETRSRT     :IF ANY RETRACTS ARE IN
@0144 010147            JN    MAINA-2    : SERVICE--SKIP
@0145 062755            JL    CON        :INSERT REQUESTS
@0146 062724            JL    DISC       :REMOVE REQUESTS
@0147 206127            RW    PGMT       :RESTORE PROGRAM OPERATING
@0150 405017            WW    PGMM       : NUMBER FROM TEMPROARY STORAGE
@0151 060170  MAINA     JL    SETDN      :MOVE WORK REGISTERS BACK
@0152 020110            JP    MAIN       :GO BACK TO BEGINNING AGAIN
```

APPENDIX A - Continued

```
                 * MOVE DATA TO WORKING REGISTERS FROM, ON ALTERNATE PASSES,
                 *   WALLBLOWER REGISTERS OR RETRACTS REGISTERS

@0153 020153  SETUP      JP    *          :SUBROUTINE RETURN LINK
@0154 306317             RD    PEFL       :SWITCH WB/RTR FLAG TO
@0155 510156             WD    *+1,1      : OPPOSITE STATE
@0156 305237             RD    SWAT       :
@0157 506317             WD    PEFL       :
@0160 205137             RW    ADSRTG     :RESET BLOWER REGISTER
@0161 400213             WW    ADSRT      : ADDRESS COUNTER
@0162 205307             RW    TBLRTA     :RESET WORKING REGISTER
@0163 400214             WW    TBLRT      : ADDRESS COUNTER
@0164 205347             RW    SETUPL     :RESET WORKING REGISTER
@0165 405337             WW    LTOP       : ADDRESS COUNTER LIMIT
@0166 060201             JL    SETUPA     :MOVE ALL THE DATA
@0167 020153             JP    SETUP      :EXIT TO RETURN LINK


                 * MOVE DATA FROM WORKING REGISTERS TO, ON ALTERNATE PASSES,
                 *   WALLBLOWER REGISTERS OR RETRACTS REGISTERS

@0170 020170  SETDN      JP    *          :SUBROUTINE RETURN LINK
@0171 205267             RW    ADSRTD     :RESET WORKING REGISTER
@0172 400213             WW    ADSRT      : ADDRESS COUNTER
@0173 205117             RW    TBLRTG     :RESET BLOWER REGISTER
@0174 400214             WW    TBLRT      : ADDRESS COUNTER
@0175 205127             RW    SETDNG     :RESET BLOWER REGISTER
@0176 405337             WW    LTOP       : ADDRESS COUNTER LIMIT
@0177 060201             JL    SETUPA     :MOVE ALL THE DATA
@0200 020170             JP    SETDN      :EXIT TO RETURN LINK


                 * MOVE ALL THE DATA AS SPECIFIED BY 'SETUP' OR 'SETDN'

@0201 020201  SETUPA     JP    *          :SUBROUTINE RETURN LINK
@0202 200213             RW    ADSRT      :INCREMENT DATA REGISTER
@0203 061733             JL    BLINC      : ADDRESS FETCH
@0204 400213             WW    ADSRT      : INSTRUCTION
@0205 200214             RW    TBLRT      :INCREMENT DATA REGISTER
@0206 061733             JL    BLINC      : ADDRESS STORE
@0207 400214             WW    TBLRT      : INSTRUCTION
@0210 205337             RW    LTOP       :COMPARE STORE INSTRUCTION
@0211 107046             IO    ALU,COM    : WITH LIMIT
@0212 000201             JZ    SETUPA     :IF EQUAL--EXIT TO RETURN LINK
@0213 200213  ADSRT      RW    *          :FETCH DATA FROM ONE REGISTER
@0214 400214  TBLRT      WW    *          :STORE DATA INTO OTHER REGISTER
@0215 020202             JP    SETUPA+1   :GO BACK AND DO NEXT MOVE


                 * INPUT ALL FRONT PANEL CONTROL SWITCHES AND
                 *  THUMBWHEEL SWITCHES, ALL PROGRAMMING BOX
                 *  INPUTS, AND ALL STATUS SIGNALS

@0216 020216  UPDATE     JP    *          :SUBROUTINE RETURN LINK
@0217 152000             IO    DI52,0     :INPUT STATUS SIGNALS
@0220 407776             WW    A          :PUT IN TEMPORARY STORAGE
@0221 060375             JL    DMK        :SORT OUT LEFT MOST 6 SIGNALS
@0222 404227             WW    INPA       :STORE IN DATA REGISTERS
@0223 060375             JL    DMK        :SORT OUT MIDDLE 6 SIGNALS
@0224 404207             WW    INPB       :STORE IN DATA REGISTERS
@0225 060375             JL    DMK        :SORT OUT LAST 6 SIGNALS
@0226 404217             WW    INPC       :STORE IN STAT REGISTERS
@0227 151000             IO    DI51,0     :INPUT STATUS SIGNALS
@0230 407776             WW    A          :PUT IN TEMPORARY STORAGE
@0231 060375             JL    DMK        :SORT OUT LEFT MOST 6 SIGNALS
@0232 403527             WW    INPD       :STORE IN DATA REGISTERS
@0233 060375             JL    DMK        :SORT OUT MIDDLE 6 SIGNALS
```

APPENDIX A - Continued

```
@0234 403507          WW   INPE       :STORE IN DATA REGISTERS
@0235 060375          JL   DMK        :SORT OUT LAST 6 SIGNALS
@0236 403517          WW   INPF       :STORE IN DATA REGISTERS
@0237 306327          RD   ZERO       :RESET OR-GATE CARD
@0240 530462          WD   ENST,3     : ENABLE INSTRUCTION
@0241 060452          JL   ENKD       :ENABLE OR-GATE CARD #7
@0242 060367          JL   UPDB       :INPUT OR-GATE CARD DATA
@0243 060352          JL   UPDA       :SORT DATA
@0244 403577          WW   TWDR       :STORE IN DATA REGISTERS
@0245 207775          RW   B          :FETCH REST OF DATA AND STORE
@0246 403477          WW   PGMR       : IN DATA REGISTERS
@0247 060452          JL   ENKD       :ENABLE OR-GATE CARD #6
@0250 060367          JL   UPDB       :INPUT OR-GATE CARD DATA
@0251 060375          JL   DMK        :SORT OUT LEFT MOST 6 SIGNALS
@0252 403357          WW   INPK       :STORE IN DATA REGISTERS
@0253 060375          JL   DMK        :SORT OUT MIDDLE 6 SIGNALS
@0254 403367          WW   INPL       :STORE IN DATA REGISTERS
@0255 060375          JL   DMK        :SORT OUT LAST 6 SIGNALS
@0256 403377          WW   INPM       :STORE IN DATA REGISTERS
@0257 060452          JL   ENKD       :ENABLE OR-GATE CARD #5
@0260 060367          JL   UPDB       :INPUT OR-GATE CARD DATA
@0261 060352          JL   UPDA       :SORT DATA
@0262 404277          WW   TWDW       :STORE IN DATA REGISTERS
@0263 207775          RW   B          :FETCH REST OF DATA AND STORE
@0264 404177          WW   PGMW       : IN DATA REGISTERS
@0265 060452          JL   ENKD       :ENABLE OR-GATE CARD #4
@0266 060367          JL   UPDB       :INPUT OR-GATE CARD DATA
@0267 060375          JL   DMK        :SORT OUT LEFT MOST 6 SIGNALS
@0270 404057          WW   INPG       :STORE IN DATA REGISTERS
@0271 060375          JL   DMK        :SORT OUT MIDDLE 6 SIGNALS
@0272 404067          WW   INPH       :STORE IN DATA REGISTERS
@0273 060375          JL   DMK        :SORT OUT LAST 6 SIGNALS
@0274 404077          WW   INPJ       :STORE IN DATA REGISTERS
@0275 060452          JL   ENKD       :ENABLE OR-GATE CARD #3
@0276 060367          JL   UPDB       :INPUT OR-GATE CARD DATA
@0277 060352          JL   UPDA       :SORT DATA
@0300 405747          WW   SEQD       :STORE IN DATA REGISTERS
@0301 207775          RW   B          :FETCH REST OF DATA AND STORE
@0302 407776          WW   A          : IN DATA REGISTERS
@0303 060375          JL   DMK        :SORT OUT LEFT MOST 6 SIGNALS
@0304 405717          WW   INPN       :STORE IN DATA REGISTERS
@0305 060452          JL   ENKD       :ENABLE OR-GATE CARD #2
@0306 060367          JL   UPDB       :INPUT OR-GATE CARD DATA
@0307 060352          JL   UPDA       :SORT DATA
@0310 406007          WW   BLRD       :STORE IN DATA REGISTERS
@0311 207775          RW   B          :FETCH REST OF DATA AND STORE
@0312 405727          WW   PGMD       : IN DATA REGISTERS
@0313 345547          RD   MOVF       :IF EMERGENCY OVERRIDE KEY
@0314 010216          JN   UPDATE     : SWITCH IS ON--EXIT
@0315 200446          RW   ENKC       :FETCH CONTROL SIGNAL BUFFER
@0316 107124          IO   ALU,LDA    :LOAD INTO ALU
@0317 203547          RW   FF         :FETCH SCAN INHIBIT BIT
@0320 107120          IO   ALU,A%W    :'OR' INTO CONTROL BUFFER
@0321 400322          WW   *+1        :PREPARE TO OUTPUT BUFFER
@0322 160020          IO   DO60,020   :OUTPUT NEW CONTROL BUFFER
@0323 205257          RW   LOOKC      :RESET SBIS FLAG TABLE
@0324 400345          WW   UPDE-2     : STORE INSTRUCTION
@0325 205277          RW   LOOKE      :RESET ADDRESS CONTROL LINE
@0326 020332          JP   *+4        : BUFFER THEN SKIP
@0327 200342  UPDF    RW   UPDD       :FETCH CONTROL BUFFER COUNTER
@0330 107124          IO   ALU,LDA    :LOAD INTO ALU
@0331 107102          IO   ALU,INC    :INCREMENT COUNTER
@0332 400342          WW   UPDD       :STORE BACK INTO COUNTER
@0333 200345          RW   UPDE-2     :FETCH FLAG STORE INSTRUCTION
@0334 061733          JL   BLINC      :INCREMENT STORE INSTRUCTION
@0335 400345          WW   UPDE-2     :STORE BACK INTO INSTRUCTION
@0336 205527          RW   UPDZ       :FETCH STORE INSTRUCTION LIMIT
@0337 107046          IO   ALU,COM    :COMPARE STORE WITH ITS LIMIT
@0340 000347          JZ   UPDE       :IF EQUAL--SKIP
@0341 165000          IO   DO65,0     :RESET ADDRESS BUS CONTROL LINES
@0342 165000  UPDD    IO   DO65,0     :ADDRESS AC RECEIVER
@0343 151000          IO   DI51,0     :INPUT THE STATE OF THE INPUT
@0344 307777          RD   W,0        :FETCH STATE FROM WORD REGISTER
```

APPENDIX A - Continued

```
@0345 500345            WD    *            :STORE SBIS FLAG IN TABLE
@0346 020327            JP    UPDF         :GO BACK AND CHECK NEXT INPUT
@0347 165000  UPDE      IO    DO65,000     :RESET ADDRESS BUS CONTROL LINES
@0350 060415            JL    ENCHK        :TURN SCANNER BACK ON
@0351 020216            JP    UPDATE       :EXIT BACK TO RETURN LINK


              * SORT OUT PROGRAM NUMBER AND THUMBWHEEL
              *   NUMBER FROM DATA INPUT

@0352 020352  UPDA      JP    *            :SUBROUTINE RETURN LINK
@0353 207776            RW    A            :FETCH DATA INPUT
@0354 062516            JL    SHR          :SHIFT DATA RIGHT ONE DIGIT
@0355 062516            JL    SHR          :SHIFT DATA RIGHT ONE DIGIT
@0356 062516            JL    SHR          :SHIFT DATA RIGHT ONE DIGIT
@0357 206547            RW    MSKUP        :FETCH PROGRAM MASK
@0360 107104            IO    ALU,A.W      :'AND' WITH SHIFTED DATA
@0361 407775            WW    B            :PUT PROGRAM NUMBER IN 'B' REG.
@0362 207776            RW    A            :FETCH DATA INPUT
@0363 107124            IO    ALU,LDA      :LOAD INTO ALU
@0364 206167            RW    MSKO         :FETCH THUMBWHEEL MASK
@0365 107104            IO    ALU,A.W      :'AND' WITH DATA INPUT
@0366 020352            JP    UPDA         :EXIT BACK TO RETURN LINK


              * INPUT OR-GATE CARD DATA

@0367 020367  UPDB      JP    *            :SUBROUTINE RETURN LINK
@0370 150000            IO    DI50,0       :INPUT THE DATA
@0371 407776            WW    A            :PUT DATA INTO 'A' REGISTER
@0372 060415            JL    ENCHK        :DISABLE OR-GATE CARD
@0373 020367            JP    UPDB         :EXIT TO RETURN LINK


              * SORT INFORMATION OUT OF DATA INPUT SIX BITS AT A TIME

@0374 207775            RW    B            :FETCH SORTED DATA
@0375 020375  DMK       JP    *            :SUBROUTINE RETURN LINK
@0376 356327            RD    FIVE         :RESET BIT SORT TEMPORARY
@0377 510405            WD    *+6,1        : STORAGE COUNTER
@0400 207776            RW    A            :FETCH DATA INPUT
@0401 107124            IO    ALU,LDA      :LOAD INTO ALU
@0402 107300            IO    ALU,SRO      :SHIFT OUT ONE BIT TO THE RIGHT
@0403 000405            JZ    *+2          :IF BIT IS ZERO--SKIP
@0404 315547            RD    SEVEN        :FETCH DIGIT SEVEN
@0405 507775            WD    B            :STORE BIT (DIGIT) IN 'B' REG.
@0406 407776            WW    A            :PUT DATA INPUT BACK INTO 'A'
@0407 310405            RD    *-2,1        :FETCH BIT SORT COUNTER
@0410 000374            JZ    DMK-1        :IF EQUAL ZERO--EXIT
@0411 200405            RW    *-4          :FETCH BIT SORT INSTRUCTION
@0412 062256            JL    BLDDEC       :INCREMENT INSTRUCTION
@0413 400405            WW    *-6          :STORE BACK INTO COUNTER
@0414 020400            JP    DMK+3        :GO BACK AND SHIFT OUT NEXT BIT


              * MONITOR CONTROL LINES AND TOGGLE READ INPUTS/READ OUTPUTS
              *   ACCORDING TO OPERATOR REQUESTS

@0415 020415  ENCHK     JP    *            :SUBROUTINE RETURN LINK
@0416 206607            RW    ENKE         :FETCH BASIC CONTROL LINE BUFFER
@0417 107124            IO    ALU,LDA      :LOAD INTO ALU
@0420 345547            RD    MOVF         :IF EMERGENCY OVERRIDE KEY
@0421 010450            JN    ENKC+2       : SWITCH IS ON--SKIP
@0422 314047            RD    ENWSRT       :IF ANY WALLBLOWERS ARE
@0423 010426            JN    *+3          : STARTING--SKIP
```

APPENDIX A - Continued

```
@0424 313347          RD    ENRSRT      :IF ANY RETRACTS ARE NOT
@0425 000431          JZ    *+4         : STARTING--SKIP
@0426 203537          RW    FO          :FETCH OUTPUT LATCH ENABLE BIT
@0427 107120          IO    ALU,AXW     :'OR' WITH CONTROL LINE BUFFER
@0430 020445          JP    ENKC-1      :SKIP
@0431 344407          RD    LFLGW,4     :IF WB ENABLE-, DISABLE-, OR
@0432 010441          JN    *+7         : OR STEP-CHECK IS ON--SKIP
@0433 354407          RD    LFLGW,5     :IF WB SEQUENCE CHECK
@0434 010441          JN    *+5         : IS ON--SKIP
@0435 343707          RD    LFLGR,4     :IF RTR ENABLE-, DISABLE-, OR
@0436 010441          JN    *+3         : OR STEP-CHECK IS ON--SKIP
@0437 353707          RD    LFLGR,5     :IF RTR SEQUENCE CHECK
@0440 000443          JZ    *+3         : IS NOT ON--SKIP
@0441 206067          RW    VO          :FETCH READ OUTPUTS BIT
@0442 107124          IO    ALU,LDA     :LOAD INTO ALU
@0443 206607          RW    ENKE        :FETCH BASIC CONTROL LINE BUFFER
@0444 107120          IO    ALU,AXW     :'OR' TOGETHER WITH READ OUTPUTS
@0445 400446          WW    *+1         :PREPARE TO OUTPUT BUFFER
@0446 160020  ENKC    IO    DO60,020    :OUTPUT CONTROL LINE BUFFER
@0447 020415          JP    ENCHK       :EXIT TO RETURN LINK
@0450 205517          RW    ENKF        :FETCH RESET LATCH BUFFER
@0451 020445          JP    *-4         :GO BACK TO RESET LATCHES


              * ENABLE OR-GATE CARD

@0452 020452  ENKD    JP    *           :SUBROUTINE RETURN LINK
@0453 330462          RD    ENST,3      :FETCH LAST OR-GATE CARD NUMBER
@0454 557777          WD    W,5         :PREPARE TO DECREMENT IT
@0455 062537          JL    DECR        :DECREMENT OR-GATE CARD NUMBER
@0456 357777          RD    W,5         :FETCH NEW OR-GATE CARD NUMBER
@0457 200446          RW    ENKC        :FETCH BASIC CONTROL LINE BUFFER
@0460 537777          WD    W,3         :PUT NEW NUMBER INTO BUFFER
@0461 400462          WW    *+1         :PREPARE TO OUTPUT BUFFER
@0462 160020  ENST    IO    DO60,020    :ENABLE NEXT OR-GATE CARD
@0463 020452          JP    ENKD        :EXIT TO RETURN LINK


              * STATUS SIGNAL EVALUATION AND ERROR DETECTION

@0464 020464  ED      JP    *           :SUBROUTINE RETURN LINK
@0465 111100          IO    11,100      :STOP REAL TIME CLOCK
@0466 061116          JL    PREP        :PREPARE SBIS AND SBB SIGNALS
@0467 313377          RD    ERA         :IF EMERGENCY RETRACT
@0470 000477          JZ    *+7         : IS NOT ON--SKIP
@0471 206337          RW    ZEROW       :RESET ALL TIMER START FLAGS
@0472 404047          WW    INPQ        :
@0473 403337          WW    INPR        :
@0474 403347          WW    INPS        :
@0475 160000          IO    DO60,000    :RESET ALL OUTPUT LATCHES
@0476 160020          IO    DO60,020    :RESUME MONITORING AC RECEIVERS
@0477 344217          RD    INPC,4      :IF BOILER TRIP SIGNAL
@0500 010503          JN    *+3         : IS NOT PRESENT--SKIP
@0501 061145          JL    SET         :SET ALARMS
@0502 020576          JP    EDA         :SKIP
@0503 304077          RD    MOV         :SET OVERRIDE FLAG TO STATE OF
@0504 545547          WD    MOVF        : EMERGENCY OVERRIDE KEY SWITCH
@0505 000513          JZ    *+6         :IF NOT ON--SKIP
@0506 554537          WD    ALARM       :SET ALARM CONDITIONS EXIST FLAG
@0507 160040          IO    DO60,040    :TURN OFF SCANNER, RESET LATCHES
@0510 165000          IO    DO65,000    :SET ADDRESS LINES HIGH
@0511 160000          IO    DO60,000    :SET CONTROL LINES HIGH
@0512 020576          JP    EDA         :SKIP
@0513 334557          RD    RSET        :IF RESET BUTTON IS NOT
@0514 000576          JZ    EDA         : PUSHED--SKIP
@0515 061064          JL    ISCK        :IF ANY SOOTBLOWERS ARE IN
@0516 000576          JZ    EDA         : SERVICE--SKIP
@0517 061070          JL    FLCK        :IF ANY SOOTBLOWERS ARE
```

APPENDIX A - Continued

```
@0520 000576          JZ    EDA        : BLOWING--SKIP
@0521 306317          RD    PEFL       :IF THIS PASS IS FOR
@0522 000527          JZ    *+5        : WALLBLOWERS--SKIP
@0523 336707          RD    MOLFA      :IF ANY MOTOR OVERLOADS ARE
@0524 000576          JZ    EDA        : PRESENT--SKIP
@0525 206257          RW    MOLL       :TURN OFF
@0526 062415          JL    OUTRB      : MOTOR OVERLOAD LIGHT
@0527 206337          RW    ZEROW      :RESET--
@0530 405057          WW    CFLG       : BLOWER HEADER START FLAGS
@0531 404537          WW    BOA        : ERROR TIMERS
@0532 405107          WW    LFLG       : ERROR LIGHT FLAGS
@0533 406707          WW    FLH        : ERROR FLAGS
@0534 205207          RW    TREE       :TURN OFF NO BLOWING MEDIUM
@0535 062405          JL    OUTRA      : AND TIME EXCEEDED LIGHTS
@0536 206237          RW    RSETL      :TURN OFF--
@0537 062470          JL    LTOF       : RESET LIGHT
@0540 306317          RD    PEFL       :IF THIS PASS IS FOR
@0541 010544          JN    *+3        : RETRACTS--SKIP
@0542 206037          RW    TREONE     :REMOVE MANUAL INHIBIT AND
@0543 020545          JP    *+2        : SYSTEM TROUBLE SIGNALS FOR WB
@0544 205317          RW    FIFTY      :REMOVE MANUAL INHIBIT AND
@0545 062415          JL    OUTRB      : SYSTEM TROUBLE SIGNALS FOR RTR
@0546 306317          RD    PEFL       :IF THIS PASS IS FOR
@0547 010552          JN    *+3        : RETRACTS--SKIP
@0550 353337          RD    INPR,5     :FETCH RETRACTS ALARM FLAG
@0551 020553          JP    *+2        : AND SKIP
@0552 354037          RD    INPP,5     :FETCH WALLBLOWER ALARM FLAG
@0553 010556          JN    *+3        : AND IF ON--SKIP
@0554 206047          RW    VF         :TURN OFF
@0555 062405          JL    OUTRA      : CONT. POWER FAILURE LIGHT
@0556 206047          RW    VF         :TURN ON SEQUENCE CHECK
@0557 062463          JL    LTON       : LIGHT FOR COSMETICS
@0560 205147          RW    LOOKA      :RESET ERROR FLAG TABLE
@0561 020564          JP    *+3        :
@0562 200574          RW    *+12       :FETCH ERROR FLAG TABLE
@0563 061740          JL    BLDEC      : STORE INSTRUCTION AND
@0564 400574          WW    *+10       : DECREMENT IT
@0565 356327          RD    FIVE       :PREPARE FOR COMPARISON
@0566 510574          WD    *+6,1      :
@0567 205157          RW    SEARCHM    :FETCH STORE INSTRUCTION LIMIT
@0570 517777          WD    W,1        :PREPARE COMPARE
@0571 107046          IO    ALU,COM    :COMPARE STORE WITH ITS LIMIT
@0572 000576          JZ    *+4        :IF EQUAL--SKIP
@0573 306327          RD    ZERO       :RESET ERROR FLAG
@0574 500574          WD    *          :STORE IT IN ERROR FLAG TABLE
@0575 020562          JP    *-13       :GO BACK TO RESET NEXT FLAG
@0576 306707  EDA     RD    VAC        :IF AC POWER FAILURE HAS
@0577 010602          JN    *+3        : OCCURRED--SKIP
@0600 343517          RD    VDC        :IF DC POWER FAILURE HAS
@0601 010605          JN    *+4        : NOT OCCURRED--SKIP
@0602 206047          RW    VF         :TURN ON--
@0603 062365          JL    OUTSA      : CONT. POWER FAILURE LIGHT
@0604 061145          JL    SET        :SET ALARMS
@0605 306317          RD    PEFL       :IF THIS PASS IS FOR
@0606 000641          JZ    EDF        : WALLBLOWERS--SKIP
@0607 206677          RW    SEVENW     :FETCH FOR MOTOR OVERLOAD CHECK
@0610 323507          RD    MOA        :IF FIRST MOTOR OVERLOAD
@0611 000614          JZ    *+3        : IS ON--SKIP
@0612 313507          RD    MOB        :IF SECOND MOTOR OVERLOAD
@0613 010616          JN    *+3        : IS NOT ON--SKIP
@0614 517777          WD    W,1        :SET FIRST TWO
@0615 527777          WD    W,2        : HEADER ERROR FLAGS
@0616 303507          RD    MOC        :IF THIRD MOTOR OVERLOAD
@0617 000622          JZ    *+3        : IS ON--SKIP
@0620 353517          RD    MOD        :IF LAST MOTOR OVERLOAD
@0621 010624          JN    *+3        : IS NOT ON--SKIP
@0622 537777          WD    W,3        :SET LAST TWO
@0623 547777          WD    W,4        : HEADER ERROR FLAGS
@0624 107150          IO    ALU,LDC    :COMPLIMENT HDR ERROR FLAG REG.
@0625 062512          JL    ZCHK       :CHECK IF EQUAL TO ZERO
@0626 536707          WD    MOLFA      :RESULT INTO MOTOR OVERLOAD FLAG
@0627 010641          JN    EDF        :IF NO MOTOR OVERLOADS--SKIP
@0630 325107          RD    MOLF       :IF A MOTOR OVERLOAD ALREADY
```

APPENDIX A - Continued

```
@0631 010641          JN    EDF        : EXISTS--SKIP
@0632 405057          WW    CFLG       :SET HEADER ERROR FLAGS
@0633 061163          JL    CSET       :SET BLOWER UNIT ERROR FLAGS
@0634 061145          JL    SET        :SET ALARMS
@0635 206257          RW    MOLL       :TURN ON--
@0636 062375          JL    OUTSB      : MOTOR OVERLOAD LIGHT
@0637 316327          RD    ONE        :SET PREVIOUS MOTOR
@0640 525107          WD    MOLF       : OVERLOAD FLAG
@0641 354727  EDF     RD    PSH        :IF NO LOW HEADER
@0642 010663          JN    EDB        : PRESSURE--SKIP
@0643 204757          RW    ETL        :TURN ON--
@0644 062375          JL    OUTSB      : LOW HEADER PRESSURE LIGHT
@0645 206047          RW    VF         :TURN OFF--
@0646 062470          JL    LTOF       : MANUAL START LIGHT
@0647 316327          RD    ONE        :SET BLOWER START
@0650 554607          WD    NOSRT      : PROHIBIT FLAG
@0651 061064          JL    ISCK       :IF NO SOOTBLOWERS
@0652 010663          JN    EDB        : IN SERVICE--SKIP
@0653 334607          RD    PSHF       :IF NO LOW HEADER
@0654 010663          JN    EDB        : PRESSURE PREVIOUSLY--SKIP
@0655 316327          RD    ONE        :SET LOW HEADER
@0656 534607          WD    PSHF       : PRESSURE PREVIOUS FLAG
@0657 061145          JL    SET        :SET ALARMS
@0660 206437          RW    SEVENS     :SET BLOWER HEADER
@0661 405057          WW    CFLG       : ERROR FLAGS
@0662 061163          JL    CSET       :SET BLOWER UNIT ERROR FLAGS
@0663 354537  EDB     RD    ALARM      :IF ALARM CONDITION
@0664 010674          JN    EDC        : DOES EXIST--SKIP
@0665 354727          RD    PSH        :IF LOW HEADER PRESSURE
@0666 000674          JZ    EDC        : DOES EXIST--SKIP
@0667 204757          RW    ETL        :TURN OFF
@0670 062415          JL    OUTRB      : LOW HEADER PRESSURE LIGHT
@0671 306327          RD    ZERO       :RESET--
@0672 554607          WD    NOSRT      : BLOWER START PROHIBIT FLAG
@0673 534607          WD    PSHF       : LHP PREVIOUS FLAG
@0674 324547  EDC     RD    ENF        :IF START SIGNAL TIMER
@0675 000751          JZ    EDD        : NOT EXPIRED--SKIP
@0676 206337          RW    ZEROW      :RESET--
@0677 404547          WW    BOB        : START, EXPIRED TIMER FLAGS
@0700 160000          IO    DO60,000   :RESET OUTPUT LATCHES
@0701 060415          JL    ENCHK      :REMOVE OUTPUT LATCH ENABLE
@0702 111010          IO    11,010     :TOGGLE REAL TIME CLOCK
@0703 111100          IO    11,100     :STOP REAL TIME CLOCK
@0704 206467          RW    DELAY      :FETCH DELAY CONSTANT
@0705 062537          JL    DECR       :COUNT IT DOWN TO ZERO
@0706 000705          JZ    *-1        :IF NOT ZERO--GO BACK
@0707 060216          JL    UPDATE     :INPUT NEW UNIT SBIS SIGNALS
@0710 204627          RW    RST        :FETCH BLOWER TABLE COUNTER
@0711 336327          RD    THREE      :MODIFY COUNTER TO CHECK
@0712 517777          WD    W,1        : BLOWER START FLAGS
@0713 020716          JP    *+3        :
@0714 206567  EDCA    RW    SEARCH     :FETCH START FLAG
@0715 061740          JL    BLDEC      : ADDRESS COUNTER
@0716 406567          WW    SEARCH     : AND INCREMENT IT,
@0717 400734          WW    EDCB       : THEN PREPARE TO CHECK IF
@0720 400737          WW    EDCB+3     : ALL BLOWERS STARTED NORMALLY
@0721 346327          RD    FOUR       :MODIFY START FLAG COUNTER
@0722 510737          WD    EDCB+3,1   : TO IN-SERVICE FLAG COUNTER
@0723 107124          IO    ALU,LDA    :LOAD INTO ALU
@0724 206407          RW    THREEWS    :MODIFY IN-SERVICE FLAG
@0725 107133          IO    ALU,ADN    : COUNTER TO ERROR FLAG
@0726 400742          WW    EDD-7      : SET COUNTER
@0727 205157          RW    SEARCHM    :FETCH ERROR FLAG COUNTER LIMIT
@0730 356327          RD    FIVE       :PREPARE FOR COMPARISON
@0731 517777          WD    W,1        :
@0732 107046          IO    ALU,COM    :COMPARE COUNTER WITH LIMIT
@0733 000751          JZ    EDD        :IF EQUAL--SKIP
@0734 300734  EDCB    RD    *          :FETCH BLOWER START FLAG
@0735 507777          WD    W,0        :STORE FLAG IN WORD REGISTER
@0736 107124          IO    ALU,LDA    :LOAD INTO ALU
@0737 300737          RD    *          :FETCH BLOWER IN-SERVICE FLAG
@0740 507777          WD    W,0        :STORE FLAG IN WORD REGISTER
@0741 107046          IO    ALU,COM    :COMPARE START AND SBIS FLAGS
```

APPENDIX A - Continued

```
@0742 500742          WD   *          :STORE RESULT IN ERROR FLAG
@0743 000714          JZ   EDCA       :IF EQUAL--GO BACK
@0744 535107          WD   NBSLF      :SET NO BLOWER START FLAG
@0745 204747          RW   NBML       :TURN ON--
@0746 062365          JL   OUTSA      : NO BLOWING MEDIUM LIGHT
@0747 061145          JL   SET        :SET ALARMS
@0750 020714          JP   EDCA       :GO BACK FOR NEXT CHECK
@0751 061064  EDD     JL   ISCK       :IF ANY SOOTBLOWERS IN
@0752 011022          JN   EDH        : SERVICE--SKIP
@0753 061070          JL   FLCK       :IF ANY SOOTBLOWERS
@0754 011003          JN   EDE        : NOT BLOWING--SKIP
@0755 316327          RD   ONE        :START--
@0756 504537          WD   ETS        : ELAPSED TIME TIMER
@0757 524537          WD   NBMS       : NO BLOWING MEDIUM TIMER
@0760 061075          JL   NBMG       :IF ALL BLOWERS THAT ARE STARTED
@0761 000764          JZ   *+3        : ARE NOT BLOWING--SKIP
@0762 306327          RD   ZERO       :STOP--
@0763 524537          WD   NBMS       : NO BLOWING MEDIUM TIMER
@0764 334537          RD   NBMF       :IF NO BLOWING MEDIUM TIMER
@0765 011007          JN   EDE+4      : HAS EXPIRED--SKIP
@0766 314537  EDDA    RD   ETF        :IF ELAPSED TIME TIMER HAS
@0767 000464          JZ   ED         : NOT EXPIRED--EXIT TO RETURN LI
@0770 204757          RW   ETL        :TURN ON--
@0771 062365          JL   OUTSA      : TIME EXCEEDED LIGHT
@0772 061145          JL   SET        :SET ALARMS
@0773 315107          RD   ETLF       :IF TIME EXCEEDED LIGHT
@0774 010464          JN   ED         : PREVIOUSLY ON--SKIP
@0775 316327          RD   ONE        :SET--
@0776 515107          WD   ETLF       : TIME EXCEEDED PREVIOUSLY ON
@0777 206437          RW   SEVENS     :SET--
@1000 405057          WW   CFLG       : BLOWER HEADER ERROR FLAGS
@1001 061163          JL   CSET       :SET BLOWER UNIT ERROR FLAGS
@1002 020464          JP   ED         :EXIT TO RETURN LINK
@1003 504537  EDE     WD   ETS        :START ELAPSED TIME TIMER
@1004 524537          WD   NBMS       : AND NO BLOWING MEDIUM TIMER
@1005 334537          RD   NBMF       :IF NO BLOWING MEDIUM TIMER
@1006 000766          JZ   EDDA       : HAS NOT EXPIRED--SKIP
@1007 204747          RW   NBML       :TURN ON--
@1010 062365          JL   OUTSA      : NO BLOWING MEDIUM LIGHT
@1011 061145          JL   SET        :SET ALARMS
@1012 305107          RD   NBMLF      :IF NO BLOWING MEDIUM
@1013 010766          JN   EDDA       : LIGHT PREVIOUS--SKIP
@1014 316327          RD   ONE        :SET--
@1015 505107          WD   NBMLF      : NO BLOWING MEDIUM PREVIOUS
@1016 205047          RW   NBMR       :SET--
@1017 405057          WW   CFLG       : BLOWER HEADER ERROR FLAGS
@1020 061163          JL   CSET       :SET BLOWER UNIT ERROR FLAGS
@1021 020766          JP   EDDA       :SKIP BACK
@1022 061070  EDH     JL   FLCK       :IF NO SOOTBLOWERS ARE
@1023 011032          JN   EDG        : BLOWING--SKIP
@1024 020464          JP   ED         :EXIT TO RETURN LINK
@1025 524537          WD   NBMS       :START NO BLOWING MEDIUM TIMER
@1026 204747          RW   NBML       :TURN ON--
@1027 062365          JL   OUTSA      : NO BLOWING MEDIUM LIGHT
@1030 061145          JL   SET        :SET ALARMS
@1031 020464          JP   ED         :EXIT TO RETURN LINK
@1032 306327  EDG     RD   ZERO       :RESET--
@1033 504537          WD   ETS        : ELAPSED TIME TIMER
@1034 524537          WD   NBMS       : AND NO BLOWING MEDIUM TIMER
@1035 306317          RD   PEFL       :IF THIS PASS IF FOR
@1036 011044          JN   *+6        : RETRACTS--SKIP
@1037 205577          RW   NBMWTME    :RESET WALLBLOWER
@1040 405657          WW   NBMWTMR    : NO BLOWING MEDIUM TIMER
@1041 205567          RW   ETWTME     :RESET WALLBLOWER
@1042 405647          WW   ETWTMR     : ELAPSED TIME TIMER
@1043 021051          JP   *+6        :SKIP AHEAD
@1044 526317          WD   HCF        :RESET HIGH CAPACITY RTR FLAG
@1045 205627          RW   NBMRTME    :RESET RETRACTS
@1046 405707          WW   NBMRTMR    : NO BLOWING MEDIUM TIMER
@1047 205617          RW   ETRTME     :RESET RETRACTS
@1050 405677          WW   ETRTMR     : ELAPSED TIME TIMER
@1051 314547          RD   ENS        :IF START SIGNAL TIMER
@1052 010464          JN   ED         : IS ON--EXIT TO RETURN LINK
```

APPENDIX A - Continued

```
@1053 206337              RW    ZEROW       :RESET--
@1054 405027              WW    TYF         : BLOWER HEADER START FLAGS
@1055 354537              RD    ALARM       :IF AN ALARM CONDITION
@1056 010464              JN    ED          : EXISTS--EXIT TO RETURN LINK
@1057 316307              RD    INOPD       :IF INSERT BUTTON IS BEING
@1060 010464              JN    ED          : PUSHED--EXIT TO RETURN LINK
@1061 206047              RW    VF          :TURN ON--
@1062 062463              JL    LTON        : MANUAL START LIGHT
@1063 020464              JP    ED          :EXIT TO RETURN LINK


            * SOOTBLOWER IN-SERVICE CHECK

@1064 021064  ISCK        JP    *           :SUBROUTINE RETURN LINK
@1065 205367              RW    SBIS        :FETCH IN-SERVICE REGISTER
@1066 062512              JL    ZCHK        :CHECK IF EQUAL TO ZERO
@1067 021064              JP    ISCK        :EXIT TO RETURN LINK


            * SOOTBLOWER NORMAL FLOW CHECK

@1070 021070  FLCK        JP    *           :SUBROUTINE RETURN LINK
@1071 205327              RW    FSLS        :FETCH LOW SIDE FLOW REGISTER
@1072 107150              IO    ALU,LDC     :LOAD INTO ALU COMPLIMENTARY
@1073 062512              JL    ZCHK        :CHECK IF EQUAL TO ZERO
@1074 021070              JP    FLCK        :EXIT TO RETURN LINK


            * CHECK TO SEE IF ALL SOOTBLOWERS THAT ARE SUPPOSED
            *   TO BE BLOWING ARE BLOWING

@1075 021075  NBMG        JP    *           :SUBROUTINE RETURN LINK
@1076 205327              RW    FSLS        :FETCH LOW SIDE FLOW REGISTER
@1077 107150              IO    ALU,LDC     :LOAD INTO ALU COMPLIMENTARY
@1100 206717              RW    FSLSA       :FETCH LOW SIDE REGISTER MASK
@1101 107104              IO    ALU,A.W     :'AND' TOGETHER WITH REGISTER
@1102 306317              RD    PEFL        :IF THIS PASS IS FOR
@1103 011106              JN    *+3         : RETRACTS--SKIP
@1104 205357              RW    FSHS        :FETCH HIGH SIDE FLOW REGISTER
@1105 107140              IO    ALU,AXWN    :'OR' TOGETHER COMPLIMENTARY
@1106 107174              IO    ALU,RDC     :READ OUT FROM ALU COMPLIMENTARY
@1107 205027              RW    TYF         :FETCH HEADER START FLAG REG.
@1110 107104              IO    ALU,A.W     :'AND' TOGETHER WITH ABOVE
@1111 205367              RW    SBIS        :FETCH IN-SERVICE REGISTER
@1112 107104              IO    ALU,A.W     :'AND' TOGETHER WITH ABOVE
@1113 405047              WW    NBMR        :STORE IN NBM REGISTER
@1114 062512              JL    ZCHK        :CHECK IF EQUAL TO ZERO
@1115 021075              JP    NBMG        :EXIT TO RETURN LINK


            * ARRANGE ALL IN-SERVICE AND FLOW SIGNALS INTO THEIR
            *   RESPECTIVE REGISTERS

@1116 021116  PREP        JP    *           :SUBROUTINE RETURN LINK
@1117 204727              RW    BOD         :FETCH DATA INPUT
@1120 315547              RD    SEVEN       :FETCH DIGIT SEVEN
@1121 507777              WD    W,0         :PUT IN FRONT END OF REGISTER
@1122 557777              WD    W,5         :PUT IN BACK END OF REGISTER
@1123 405327              WW    FSLS        :STORE IN LOW SIDE FLOW REG.
@1124 354707              RD    BOG,5       :FETCH DATA INPUT
@1125 527777              WD    W,2         :PUT IN WORD REGISTER
@1126 344707              RD    BOG,4       :FETCH DATA INPUT
@1127 537777              WD    W,3         :PUT IN WORD REGISTER
@1130 334707              RD    BOG,3       :FETCH DATA INPUT
@1131 547777              WD    W,4         :PUT IN WORD REGISTER
```

APPENDIX A - Continued

```
@1132 304727              RD    BOD,0       :FETCH DATA INPUT
@1133 517777              WD    W,1         :PUT IN WORD REGISTER
@1134 315547              RD    SEVEN       :FETCH DIGIT SEVEN
@1135 507777              WD    W,0         :PUT IN FRONT END OF REGISTER
@1136 557777              WD    W,5         :PUT IN BACK END OF REGISTER
@1137 107150              IO    ALU,LDC     :LOAD INTO ALU COMPLIMENTED
@1140 405367              WW    SBIS        :STORE IN IN-SERVICE REGISTER
@1141 204217              RW    INPC        :FETCH DATA INPUT
@1142 062516              JL    SHR         :SHIFT IT RIGHT ONE DIGIT
@1143 405357              WW    FSHS        :STORE IN HIGH SIDE FLOW REG.
@1144 021116              JP    PREP        :EXIT TO RETURN LINK


            * TURN ON INTERNAL AND EXTERNAL ALARMS


@1145 021145  SET         JP    *           :SUBROUTINE RETURN LINK
@1146 316327              RD    ONE         :SET--
@1147 554537              WD    ALARM       : ALARM CONDITIONS EXIST FLAG
@1150 206237              RW    RSETL       :TURN ON--
@1151 062463              JL    LTON        : RESET LIGHT
@1152 306317              RD    PEFL        :IF THIS PASS IS FOR
@1153 011156              JN    *+3         : RETRACTS--SKIP
@1154 206037              RW    TREONE      :TURN ON MANUAL INHIBIT AND
@1155 021157              JP    *+2         : SYSTEM TROUBLE SIGNALS FOR WB
@1156 205317              RW    FIFTY       :TURN ON MANUAL INHIBIT AND
@1157 062375              JL    OUTSB       : SYSTEM TROUBLE SIGNALS FOR RTR
@1160 206047              RW    VF          :TURN OFF--
@1161 062470              JL    LTOF        : MANUAL START LIGHT
@1162 021145              JP    SET         :EXIT TO RETURN LINK


            * SET SOOTBLOWER UNIT ERROR FLAGS FOR ANY SOOTBLOWER IN
            *   SERVICE ON THE HEADER/S SPECIFIED


@1163 021163  CSET        JP    *           :SUBROUTINE RETURN LINK
@1164 205077              RW    SEARCHS     :FETCH IN-SERVICE FLAG COUNTER
@1165 401166              WW    *+1         :PREPARE TO FETCH FLAG
@1166 301166              RD    *           :FETCH BLOWER IN-SERVICE FLAG
@1167 001212              JZ    CSETA       :IF BLOWER NOT IN SERVICE--SKIP
@1170 107124              IO    ALU,LDA     :LOAD INTO ALU FETCH INSTRUCTION
@1171 401206              WW    CSETB       :STORE AHEAD
@1172 316327              RD    ONE         :MODIFY INSTRUCTION AHEAD TO
@1173 511206              WD    CSETB,1     : FETCH BLOWER HEADER NUMBER
@1174 206617              RW    SEARCHU     :MODIFY INSTRUCTION TO A
@1175 107133              IO    ALU,ADN     : UNIT ERROR FLAG
@1176 401211              WW    CSETB+3     : STORE INSTRUCTION AND STORE
@1177 201206              RW    CSETB       :FETCH HEADER NUMBER INSTRUCTION
@1200 107124              IO    ALU,LDA     :LOAD INTO ALU
@1201 206137              RW    MOZ         :GET HIGH CAPACITY BLOWER LIMIT
@1202 107146              IO    ALU,SBN     :SUBTRACT FROM HDR NUMB INSTR.
@1203 001206              JZ    CSETB       :IF BLOWER HIGH CAPACITY--SKIP
@1204 326327              RD    TWO         :MODIFY BLOWER HEADER NUMBER
@1205 511206              WD    *+1,1       : INSTRUCTION TO DIGIT TWO
@1206 301206  CSETB       RD    *           :FETCH BLOWER HEADER NUMBER
@1207 511210              WD    *+1,1       :PREPARE HDR START FLAG FETCH
@1210 305057              RD    CFLG        :FETCH HEADER START FLAG
@1211 501211              WD    *           :STORE IN UNIT ERROR FLAG
@1212 201166  CSETA       RW    CSET+3      :INCREMENT BLOWER
@1213 061733              JL    BLINC       : IN-SERVICE FLAG
@1214 401166              WW    CSET+3      : FETCH INSTRUCTION
@1215 205067              RW    SEARCHT     :FETCH FLAG TABLE LIMIT
@1216 107046              IO    ALU,COM     :COMPARE IF EQUAL
@1217 001163              JZ    CSET        :IF EQUAL--EXIT TO RETURN LINK
@1220 201166              RW    CSET+3      :FETCH IN-SERVICE FETCH INSTR.
@1221 021166              JP    CSET+3      :GO BACK TO CHECK NEXT BLOWER
```

APPENDIX A - Continued

```
                * FLASH BOILER DIAGRAM LIGHTS BY SWITCHING FROM READ
                *   INPUTS TO READ OUTPUTS AND BACK AGAIN

@1222 021222  FLASHIT   JP    *          :SUBROUTINE RETURN LINK
@1223 345547            RD    MOVF       :IF EMERGENCY OVERRIDE KEY
@1224 011226            JN    *+2        : SWITCH IS ON--SKIP
@1225 160021            IO    DO60,021   :SWITCH TO READ OUTPUTS
@1226 206467            RW    DELAY      :FETCH DELAY CONSTANT
@1227 062537            JL    DECR       :COUNT CONSTANT DOWN TO ZERO
@1230 001227            JZ    *-1        :IF NOT YET ZERO--GO BACK
@1231 345547            RD    MOVF       :IF EMERGENCY OVERRIDE KEY
@1232 011222            JN    FLASHIT    : SWITCH IS ON--EXIT
@1233 160040            IO    DO60,040   :RESET LATCHES, STOP SCANNER
@1234 160060            IO    DO60,060   :SWITCH TO READ INPUTS
@1235 060415            JL    ENCHK      :OUTPUT CONTROL LINES REGISTER
@1236 021222            JP    FLASHIT    :EXIT TO RETURN LINK

                * SET OUTPUT LATCH OF ANY SOOTBLOWER THAT IS IN
                *   SERVICE OR WHO'S UNIT ERROR FLAG IS SET

@1237 021237  FLASH     JP    *          :SUBROUTINE RETURN LINK
@1240 344537            RD    FLASHF     :IF LIGHTS ARE SUPPOSED TO
@1241 011244            JN    *+3        : FLASH IRREGARDLESS--SKIP
@1242 354537            RD    ALARM      :IF ALARM CONDITIONS DO NOT
@1243 001237            JZ    FLASH      : EXIST--EXIT TO RETURN LINK
@1244 345547            RD    MOVF       :IF EMERGENCY OVERRIDE KEY
@1245 011277            JN    FLASHB     : SWITCH IS ON--SKIP
@1246 340446            RD    ENKC,4     :FETCH DIGIT FOUR OF CONTROL
@1247 557777            WD    W,5        : BUFFER AND PUT INTO WORD REG.
@1250 107124            IO    ALU,LDA    :LOAD INTO ALU
@1251 107300            IO    ALU,SRO    :SHIFT ALU RIGHT ONE BIT
@1252 011237            JN    FLASH      :IF OUTPUTS ARE ENABLED--EXIT
@1253 203677            RW    SEARCHQ    :FETCH IN-SERVICE FLAG COUNTER
@1254 021257            JP    *+3        : START ADDRESS AND SKIP
@1255 201267  FLASHA    RW    FLASHB-10  :FETCH IN-SERVICE FLAG COUNTER
@1256 061733            JL    BLINC      : AND INCREMENT IT, THEN
@1257 401267            WW    FLASHB-10  : STORE BACK INTO COUNTER
@1260 401272            WW    FLASHB-5   : ALSO STORE AHEAD
@1261 356327            RD    FIVE       :MODIFY INSTRUCTION AHEAD TO A
@1262 511272            WD    FLASHB-5,1 : ERROR FLAG FETCH INSTRUCTION
@1263 204367            RW    SEARCHN    :FETCH IN-SERVICE FLAG LIMIT
@1264 107046            IO    ALU,COM    :COMPARE WITH COUNTER
@1265 001277            JZ    FLASHB     :IF EQUAL--SKIP
@1266 201267            RW    *+1        :PREPARE TO FETCH SBIS FLAG
@1267 301267            RD    *          :FETCH IN-SERVICE FLAG
@1270 052020            NL    LSETA      :IF IN SERVICE--SET LATCH
@1271 201272            RW    *+1        :PREPARE TO FETCH ERROR FLAG
@1272 301272            RD    *          :FETCH UNIT ERROR FLAG
@1273 052020            NL    LSETA      :IF IN ERROR--SET OUTPUT LATCH
@1274 316327            RD    ONE        :SET--
@1275 544537            WD    FLASHF     : FLASH FLAG
@1276 021255            JP    FLASHA     :GO BACK TO CHECK NEXT BLOWER
@1277 206237  FLASHB    RW    RSETL      :TURN OFF--
@1300 062470            JL    LTOF       : RESET LIGHT
@1301 061222            JL    FLASHIT    :FLASH BOILER DIAGRAM LIGHTS
@1302 206237            RW    RSETL      :TURN ONN--
@1303 062463            JL    LTON       : RESET LIGHT
@1304 021237            JP    FLASH      :EXIT TO RETURN LINK

                * SOOTBLOWER BLOWING ROUTINE PROGRAM EXECUTION

@1305 021305  PE        JP    *          :SUBROUTINE RETURN LINK
@1306 354557            RD    SRT        :IF START PROGRAM BUTTON IS NOT
@1307 001325            JZ    PEA        : BEING PUSHED--SKIP
@1310 314607            RD    INHB       :IF START BUTTON
@1311 011325            JN    PEA        : INHIBIT IS ON--SKIP
```

APPENDIX A - Continued

```
@1312 204677              RW    PGM        :FETCH PROGRAM SELECT INPUT
@1313 405017              WW    PGMM       :STORE IN PROGRAM REGISTER
@1314 062512              JL    ZCHK       :CHECK IF EQUAL TO ZERO
@1315 524607              WD    SEQFL      :PUT RESULT IN SEQUENCE FLAG
@1316 001321              JZ    *+3        :IF SELECT BUTTON IS ON--SKIP
@1317 314557              RD    SEQ        :FETCH SEQ SELECT BUTTON INPUT
@1320 001305              JZ    PE         : IF NOT ON--EXIT TO RETURN LINK
@1321 316327              RD    ONE        :SET--
@1322 514607              WD    INHB       : START BUTTON INHIBIT FLAG
@1323 306327              RD    ZERO       :RESET--
@1324 504607              WD    STPF       : PROGRAM STOPPED FLAG
@1325 304607   PEA        RD    STPF       :IF PROGRAM
@1326 011505              JN    PEW        : IS STOPPED--SKIP
@1327 344557              RD    STP        :IF STOP BUTTON IS
@1330 011516              JN    PED        : BEING PUSHED--SKIP
@1331 306317              RD    PEFL       :IF THIS PASS IS FOR
@1332 001335              JZ    *+3        : WALLBLOWERS--SKIP
@1333 313377              RD    ERA        :IF EMERGENCY RETRACT BUTTON
@1334 011305              JN    PE         : IS ON--EXIT TO RETURN LINK
@1335 205017              RW    PGMM       :FETCH PROGRAM REGISTER
@1336 062524              JL    SHL        :SHIFT LEFT ONE DIGIT
@1337 204667              RW    RECNT      :FETCH PROGRAM RESTORE ADDRESS
@1340 107133              IO    ALU,ADN    :ADD TO PROGRAM REGISTER
@1341 401342              WW    *+1        :PREPARE TO RESTORE
@1342 201342              RW    *          :RESTORE PROGRAM DATA
@1343 317777              RD    W,1        :FETCH STEP WAS COMPLETED FLAG
@1344 556307              WD    SPLIT      : AND RESTORE
@1345 307777              RD    W,0        :FETCH PROGRAM IN OPERATION
@1346 506307              WD    INOP       : FLAG AND RESTORE
@1347 306327              RD    ZERO       :RESET--
@1350 507777              WD    W,0        : INOP STORAGE
@1351 517777              WD    W,1        : SPLIT STORAGE
@1352 404657              WW    QCNT       :STORE RESULT IN STEP COUNTER
@1353 062500              JL    LTSET      :TURN ON PROGRAM SELECT LIGHT
@1354 206047              RW    VF         :TURN OFF--
@1355 062470              JL    LTOF       : MANUAL START LIGHT
@1356 206227              RW    STOPL      :TURN OFF-
@1357 062470              JL    LTOF       : STOP LIGHT
@1360 206217              RW    STARTL     :TURN ON--
@1361 062463              JL    LTON       : START PROGRAM LIGHT
@1362 306317              RD    PEFL       :IF THIS PASS IS FOR
@1363 011370              JN    *+5        : RETRACTS--SKIP
@1364 204247              RW    TO         :ISSUE WALLBLOWER
@1365 062375              JL    OUTSB      : MANUAL START INHIBIT SIGNAL
@1366 206057              RW    VT         :TURN ON--
@1367 021373              JP    *+4        : WB CONTROLLER OPERATING LIGHT
@1370 203537              RW    FO         :ISSUE RETRACTS
@1371 062375              JL    OUTSB      : MANUAL START INHIBIT SIGNAL
@1372 206067              RW    VO         :TURN ON--
@1373 062365              JL    OUTSA      : RTR CONTROLLER OPERATING LIGHT
@1374 304537              RD    ETS        :IF ANY SOOTBLOWERS ARE IN
@1375 011305              JN    PE         : SERVICE--EXIT TO RETURN LINK
@1376 314047              RD    ENWSRT     :IF ANY WALLBLOWERS ARE
@1377 011305              JN    PE         : STARTING--EXIT TO RETURN LINK
@1400 313347              RD    ENRSRT     :IF ANY RETRACTS ARE STARTING
@1401 011305              JN    PE         : --EXIT TO RETURN LINK
@1402 354607              RD    NOSRT      :IF HEADER PRESSURE IS LOW--
@1403 011305              JN    PE         : EXIT TO RETURN LINK
@1404 206047              RW    VF         :RESET--
@1405 406627              WW    SCNT       : BLOWERS IN STEP COUNTER
@1406 306307              RD    INOP       :IF PROGRAM IS ALREADY IN
@1407 011414              JN    PEG        : OPERATION--SKIP
@1410 316327              RD    ONE        :SET--
@1411 506307              WD    INOP       : PROGRAM IN OPERATION FLAG
@1412 206337              RW    ZEROW      :RESET--
@1413 404657              WW    QCNT       : PROGRAM STEP COUNTER
@1414 206047   PEG        RW    VF         :RESET
@1415 406727              WW    WBCHKA     : WB STARTED THIS STEP COUNTER
@1416 306317              RD    PEFL       :IF THIS PASS IS FOR
@1417 001421              JZ    *+2        : WALLBLOWERS--SKIP
@1420 526317              WD    HCF        :RESET HIGH CAPACITY FLAG
@1421 061635              JL    ERSET      :RESET BLOWER UNIT START FLAGS
@1422 061655   PEGC       JL    BLRSTR     :RESET BLOWER DATA COUNTERS
```

APPENDIX A - Continued

```
@1423 061711          JL   QCOM       :INCREMENT PROGRAM STEP COUNTER
@1424 001514          JZ   PEC        : IF LAST STEP FINISHED--SKIP
@1425 204637  PEE     RW   CNT        :FETCH ENABLE FLAG COUNTER
@1426 401427          WW   *+1        :PREPARE TO CHECK ENABLE FLAG
@1427 301427          RD   *          :FETCH UNIT ENABLE FLAG
@1430 001465          JZ   PEF        :IF NOT ENABLED--SKIP
@1431 061673          JL   COMPR      :IF BLOWER IS NOT IN
@1432 011465          JN   PEF        : THIS STEP--SKIP
@1433 306317          RD   PEFL       :IF THIS PASS IS FOR
@1434 001450          JZ   PEEA       : WALLBLOWERS--SKIP
@1435 061612          JL   CRD        :FETCH RETRACT TYPE FLAG
@1436 107124          IO   ALU,LDA    :LOAD IT INTO ALU
@1437 107300          IO   ALU,SRO    :SHIFT OUT HIGH CAPACITY BIT
@1440 011461          JN   PEEB       :IF NOT HIGH CAPACITY--SKIP
@1441 526317          WD   HCF        :SET HIGH CAPACITY FLAG
@1442 316317          RD   WBF        :IF LESS THAN FIVE WALLBLOWERS
@1443 001461          JZ   PEEB       : ARE IN SERVICE--SKIP
@1444 204657  PEEE    RW   QCNT       :FETCH PROGRAM STEP COUNTER
@1445 062537          JL   DECR       :DECREMENT IT
@1446 404657          WW   QCNT       :PUT RESULT BACK INTO COUNTER
@1447 021551          JP   PEY        :SKIP
@1450 356307  PEEA    RD   SPLIT      :IF THIS STEP WAS FINISHED
@1451 001500          JZ   PEEC       : BEFORE--SKIP
@1452 206627          RW   SCNT       :FETCH BLOWER IN STEP COUNTER
@1453 062537          JL   DECR       :DECREMENT IT
@1454 406627          WW   SCNT       :PUT RESULT BACK INTO COUNTER
@1455 001465          JZ   PEF        :IF RESULT NOT ZERO--SKIP
@1456 306327          RD   ZERO       :RESET--
@1457 556307          WD   SPLIT      : STEP WAS FINISHED FLAG
@1460 061602          JL   WBCHK      :INCREMENT WB START COUNTER
@1461 204637  PEEB    RW   CNT        :FETCH ENABLE FLAG COUNTER
@1462 061766          JL   LSET       :SET BLOWER OUTPUT LATCH
@1463 316327          RD   ONE        :SET--
@1464 536317          WD   NOP        : LATCH SET THIS STEP FLAG
@1465 061721  PEF     JL   CCOM       :IF LAST BLOWER HAS NOT BEEN
@1466 011425          JN   PEE        : CHECKED--SKIP BACK
@1467 062203          JL   SWITCH     :IF BOTH BLOWER TABLES HAVE
@1470 001425          JZ   PEE        : NOT BEEN CHECKED--SKIP BACK
@1471 336317          RD   NOP        :IF A LATCH HAS NOT BEEN SET
@1472 001422          JZ   PEGC       : THIS STEP--SKIP BACK
@1473 514547          WD   ENS        :START START SIGNAL TIMER
@1474 306327          RD   ZERO       :RESET--
@1475 536317          WD   NOP        : START BLOWER THIS STEP FLAG
@1476 060415          JL   ENCHK      :ENABLE OUTPUT LATCHES
@1477 021551          JP   PEY        :SKIP
@1500 326317  PEEC    RD   HCF        :IF HIGH CAPACITY FLAG IS
@1501 011460          JN   PEEB-1     : NOT ON--SKIP BACK
@1502 206627          RW   SCNT       :FETCH BLOWER IN STEP COUNTER
@1503 062537          JL   DECR       :DECREMENT IT
@1504 406627          WW   SCNT       :STORE BACK INTO COUNTER
@1505 001460          JZ   PEEB-1     :IF COUNTER NOT EQUAL ZERO--SKIP
@1506 556307          WD   SPLIT      :SET STEP WAS NOT FINISHED FLAG
@1507 204657          RW   QCNT       :FETCH PROGRAM STEP COUNTER
@1510 062537          JL   DECR       :DECREMENT IT
@1511 404657          WW   QCNT       :STORE BACK INTO COUNTER
@1512 316327          RD   ONE        :SET--
@1513 021473          JP   PEEC-5     : START START SIGNAL TIMER
@1514 306327  PEC     RD   ZERO       :RESET--
@1515 506307          WD   INOP       : PROGRAM IN OPERATION FLAG
@1516 306327  PCD     RD   ZERO       :RESET--
@1517 514607          WD   INHB       : START BUTTON INHIBIT FLAG
@1520 344557          RD   STP        :IF STOP BUTTON IS BEING
@1521 011523          JN   PEDA       : PUSHED--SKIP
@1522 062474          JL   LTRSTA     :TURN OFF PROGRAM SELECT LIGHT
@1523 316327  PEDA    RD   ONE        :SET--
@1524 504607          WD   STPF       : PROGRAM STOPPED FLAG
@1525 061064          JL   ISCK       :IF ANY SOOTBLOWERS ARE IN
@1526 001531          JZ   *+3        : SERVICE--SKIP
@1527 206047          RW   VF         :TURN ON--
@1530 062463          JL   LTON       : MANUAL START LIGHT
@1531 206217          RW   STARTL     :TURN OFF--
@1532 062470          JL   LTOF       : START PROGRAM LIGHT
@1533 206227          RW   STOPL      :TURN ON--
```

APPENDIX A - Continued

```
@1534 062463              JL    LTON        : STOP LIGHT
@1535 306317              RD    PEFL        :IF THIS PASS IS FOR
@1536 011544              JN    *+6         : RETRACTS--SKIP
@1537 516317              WD    WBF         :RESET WB 5+ OPERATING FLAG
@1540 204247              RW    TO          :REMOVE--
@1541 062415              JL    OUTRB       : WB MANUAL INHIBIT SIGNAL
@1542 206057              RW    VT          :TURN OFF WALLBLOWER
@1543 021550              JP    *+5         : CONTROLLER OPERATING LIGHT
@1544 526317              WD    HCF         :RESET HIGH CAPACITY RTR FLAG
@1545 202537              RW    FO          :REMOVE--
@1546 062415              JL    OUTRB       : RTR MANUAL INHIBIT SIGNAL
@1547 206067              RW    VO          :TURN OFF RETRACTS
@1550 062405              JL    OUTRA       : CONTROLLER OPERATING LIGHT
@1551 205017  PEY         RW    PGMM        :FETCH PROGRAM REGISTER
@1552 062524              JL    SHL         :SHIFT LEFT ONE DIGIT
@1553 204617              RW    SVCNT       :FETCH SAVE TABLE ADDRESS
@1554 107133              IO    ALU,ADN     :ADD TO PROGRAM REGISTER
@1555 401563              WW    *+6         :PREPARE TO SAVE PROGRAM DATA
@1556 204657              RW    QCNT        :FETCH PROGRAM STEP COUNTER
@1557 306307              RD    INOP        :FETCH IN OPERATION FLAG
@1560 507777              WD    W,0         :STORE IN STEP COUNTER
@1561 356307              RD    SPLIT       :FETCH WB 5+ OPERATING FLAG
@1562 517777              WD    W,1         :STORE IN STEP COUNTER
@1563 401563              WW    *           :SAVE PROGRAM DATA
@1564 021305              JP    PE          :EXIT TO RETURN LINK
@1565 001635  PEW         JL    ERSET       :RESET BLOWER UNIT START FLAGS
@1566 334557              RD    RSET        :IF RESET BUTTON IS NOT BEING
@1567 001305              JZ    PE          : PUSHED--EXIT TO RETURN LINK
@1570 204677              RW    PGM         :FETCH PROGRAM SELECT INPUT
@1571 062512              JL    ZCHK        :CHECK IF EQUAL TO ZERO
@1572 001575              JZ    *+3         :IF NOT ZERO--SKIP
@1573 314557              RD    SEQ         :IF SEQ SELECT BUTTON IS NOT
@1574 001305              JZ    PE          : PUSHED--EXIT TO RETURN LINK
@1575 405017              WW    PGMM        :PUT SELECT INPUT INTO REGISTER
@1576 062474              JL    LTRSTA      :TURN OFF PROGRAM SELECT LIGHT
@1577 306327              RD    ZERO        :RESET PROGRAM
@1600 506307              WD    INOP        : IN OPERATION FLAG
@1601 021551              JP    PEY         :SKIP


                * COUNT THE NUMBER OF WALLBLOWERS STARTING THIS STEP
                *   AND SET WBF IF THE NUMBER IS FIVE OR MORE

@1602 021602  WBCHK       JP    *           :SUBROUTINE RETURN LINK
@1603 206727              RW    WBCHKA      :FETCH WB STARTING COUNTER
@1604 062537              JL    DECR        :DECREMENT IT
@1605 516317              WD    WBF         :IF LESS THAN ZERO--SET FLAG
@1606 001610              JZ    *+2         :IF MORE THAN ZERO--SKIP
@1607 107102              IO    ALU,INC     :INCREMENT IT TO SET FLAG AGAIN
@1610 406727              WW    WBCHKA      :STORE NEW NUMBER IN COUNTER
@1611 021602              JP    WBCHK       :EXIT TO RETURN LINK


                * FETCH BLOWER TYPE AND SIDE OF BOILER OR HEADER NUMBER

@1612 021612  CRD         JP    *           :SUBROUTINE RETURN LINK
@1613 206367              RW    THREES      :FETCH READ DIGIT 2 INSTRUCTION
@1614 401627              WW    CRDA        :STORE IN FETCH ROUTINE
@1615 061624              JL    CRDB        :FETCH SIDE OR HEADER NUMBER
@1616 406457              WW    TESTB       :PUT IN TEMPORARY STORAGE
@1617 206357              RW    ONES        :FETCH READ DIGIT 1 INSTRUCTION
@1620 401627              WW    CRDA        :STORE IN FETCH ROUTINE
@1621 061624              JL    CRDB        :FETCH BLOWER TYPE NUMBER
@1622 406447              WW    TESTA       :PUT IN TEMPORARY STORAGE
@1623 021612              JP    CRD         :EXIT TO RETURN LINK
```

APPENDIX A - Continued

```
                * FETCH THE NUMBERS REQUESTED BY 'CRD'

@1624 021624  CRDB      JP    *          :SUBROUTINE RETURN LINK
@1625 204637            RW    CNT        :FETCH ENABLE FLAG COUNTER
@1626 401631            WW    *+3        :PREPARE TO FETCH NUMBER
@1627 316327  CRDA      RD    ONE        :MODIFY INSTRUCTION TO FETCH
@1630 511631            WD    *+1,1      : DIGIT 1 OR DIGIT 2
@1631 301631            RD    *          :FETCH THE NUMBER
@1632 206337            RW    ZEROW      :RESET THE WORD REGISTER
@1633 557777            WD    W,5        :STORE THE NUMBER IN WORD REG.
@1634 021624            JP    CRDB       :EXIT TO RETURN LINK

                * RESET BLOWER UNIT START FLAGS

@1635 021635  ERSET     JP    *          :SUBROUTINE RETURN LINK
@1636 304537            RD    ETS        :IF ANY SOOTBLOWER IS IN
@1637 011635            JN    ERSET      : SERVICE--EXIT TO RETURN LINK
@1640 314547            RD    ENS        :IF ANY SOOTBLOWER IS
@1641 011635            JN    ERSET      : STARTING--EXIT TO RETURN LINK
@1642 205147            RW    LOOKA      :FETCH INITIAL START FLAG
@1643 021646            JP    *+3        : ADDRESS AND SKIP
@1644 201653  RSA       RW    RSB        :FETCH FLAG ADDRESS COUNTER
@1645 061740            JL    BLDEC      :DECREMENT IT
@1646 401653            WW    RSB        :PUT NEW VALUE BACK INTO COUNTER
@1647 205157            RW    SEARCHM    :FETCH ADDRESS COUNTER LIMIT
@1650 107046            IO    ALU,COM    :COMPARE COUNTER AND LIMIT
@1651 001635            JZ    ERSET      :IF EQUAL--EXIT TO RETURN LINK
@1652 306327            RD    ZERO       :RESET--
@1653 501653  RSB       WD    *          : UNIT START FLAG
@1654 021644            JP    RSA        :EXIT TO RETURN LINK

                * RESET BLOWER ENABLE FLAG COUNTER AND BLOWER DATA COUNTER

@1655 021655  BLRSTR    JP    *          :SUBROUTINE RETURN LINK
@1656 205017            RW    PGMM       :FETCH PROGRAM REGISTER
@1657 062524            JL    SHL        :SHIFT IT LEFT ONE DIGIT
@1660 544607            WD    TFA        :RESET BLOWER TABLE FLAG
@1661 205377            RW    ADRS       :FETCH BLOWER ADDRESS LOCATOR
@1662 107133            IO    ALU,ADN    :ADD TO ABOVE
@1663 401664            WW    *+1        :PREPARE TO FETCH DATA ADDRESS
@1664 201664            RW    *          :FETCH BLOWER DATA ADDRESS
@1665 107124            IO    ALU,LDA    :LOAD INTO ALU
@1666 204627            RW    RST        :RESET ENABLE FLAG COUNTER
@1667 404637            WW    CNT        :STORE IN COUNTER
@1670 107133            IO    ALU,ADN    :ADD ABOVE TO DATA ADDRESS
@1671 404647            WW    BLRCNT     :STORE IN BLOWER DATA COUNTER
@1672 021655            JP    BLRSTR     :EXIT TO RETURN LINK

                * COMPARE BLOWER DATA NUMBER WITH PROGRAM STEP COUNTER TO
                *   DETERMINE IF BLOWER IS IN THIS STEP

@1673 021673  COMPR     JP    *          :SUBROUTINE RETURN LINK
@1674 204647            RW    BLRCNT     :FETCH BLOWER DATA COUNTER
@1675 401701            WW    *+4        :STORE AHEAD
@1676 062251            JL    BLDINC     :MODIFY TO FETCH NEXT DIGIT
@1677 401703            WW    *+4        :STORE AHEAD
@1700 206337            RW    ZEROW      :RESET THE WORD REGISTER
@1701 301701            RD    *          :FETCH THE FIRST DATA DIGIT
@1702 547777            WD    W,4        :STORE IN WORD REGISTER
@1703 301703            RD    *          :FETCH THE SECOND DATA DIGIT
@1704 557777            WD    W,5        :STORE IN WORD REGISTER
@1705 107124            IO    ALU,LDA    :LOAD INTO ALU
@1706 204657            RW    QCNT       :FETCH PROGRAM STEP COUNTER
@1707 107046            IO    ALU,COM    :COMPARE DATA AND COUNTER
@1710 021673            JP    COMPR      :EXIT TO RETURN LINK
```

APPENDIX A - Continued

```
                * INCREMENT PROGRAM STEP COUNTER AND DETERMINE IF COUNTER
                *   HAS PASSED LAST STEP IN PROGRAM

@1711 021711    QCOM        JP    *           :SUBROUTINE RETURN LINK
@1712 204657                RW    QCNT        :FETCH PROGRAM STEP COUNTER
@1713 107124                IO    ALU,LDA     :LOAD IT INTO ALU
@1714 107102                IO    ALU,INC     :INCREMENT ALU
@1715 404657                WW    QCNT        :STORE NEW NUMBER IN COUNTER
@1716 205767                RW    QCNTL       :FETCH STEP COUNTER LIMIT
@1717 107046                IO    ALU,COM     :COMPARE COUNTER AND ITS LIMIT
@1720 021711                JP    QCOM        :EXIT TO RETURN LINK


                * INCREMENT BLOWER DATA COUNTER AND BLOWER ENABLE FLAG
                *   COUNTER AND DETERMINE IF LAST BLOWER HAS BEEN CHECKED

@1721 021721    CCOM        JP    *           :SUBROUTINE RETURN LINK
@1722 204647                RW    BLRCNT      :FETCH BLOWER DATA COUNTER
@1723 061740                JL    BLDEC       :DECREMENT IT
@1724 404647                WW    BLRCNT      :STORE NEW NUMBER IN COUNTER
@1725 204637                RW    CNT         :FETCH ENABLE FLAG COUNTER
@1726 061740                JL    BLDEC       :DECREMENT IT
@1727 404637                WW    CNT         :STORE NEW NUMBER IN COUNTER
@1730 204767                RW    CNTL        :FETCH ENABLE FLAG COUNTER LIMIT
@1731 107046                IO    ALU,COM     :COMPARE COUNTER AND ITS LIMIT
@1732 021721                JP    CCOM        :EXIT TO RETURN LINK


                * INCREMENT NUMBER BY OCTAL 10

@1733 021733    BLINC       JP    *           :SUBROUTINE RETURN LINK
@1734 107124                IO    ALU,LDA     :LOAD NUMBER INTO ALU
@1735 203537                RW    FO          :FETCH OCTAL CONSTANT 10
@1736 107133                IO    ALU,ADN     :ADD TO ALU
@1737 021733                JP    BLINC       :EXIT TO RETURN LINK


                * DECREMENT NUMBER BY OCTAL 10

@1740 021740    BLDEC       JP    *           :SUBROUTINE RETURN LINK
@1741 107124                IO    ALU,LDA     :LOAD NUMBER INTO ALU
@1742 203537                RW    FO          :FETCH OCTAL CONSTANT 10
@1743 107146                IO    ALU,SBN     :SUBTRACT FROM ALU
@1744 021740                JP    BLDEC       :EXIT TO RETURN LINK


                * SWITCH COUNTERS TO READ BLOWER TABLE 'B'

@1745 021745    ATOB        JP    *           :SUBROUTINE RETURN LINK
@1746 316327                RD    ONE         :SET---
@1747 544607                WD    TFA         : BLOWER TABLE FLAG
@1750 204647                RW    BLRCNT      :FETCH BLOWER DATA COUNTE
@1751 107124                IO    ALU,LDA     :LOAD IT INTO ALU
@1752 206377                RW    THREEW      :FETCH OCTAL CONSTANT 3
@1753 107133                IO    ALU,ADN     :ADD IT TO ALU
@1754 404647                WW    BLRCNT      :STORE RESULT IN DATA COUNTER
@1755 021745                JP    ATOB        :EXIT TO RETURN LINK
```

APPENDIX A - Continued

```
                * SWITCH COUNTERS TO READ BLOWER TABLE 'A'

@1756 021756  BTOA      JP    *          :SUBROUTINE RETURN LINK
@1757 204647            RW    BLRCNT     :FETCH BLOWER DATA COUNTER
@1760 107124            IO    ALU,LDA    :LOAD IT INTO ALU
@1761 544607            WD    TFA        :RESET BLOWER TABLE FLAG
@1762 206377            RW    THREEW     :FETCH OCTAL CONSTANT 3
@1763 107146            IO    ALU,SBN    :SUBTRACT FROM ALU
@1764 404647            WW    BLRCNT     :STORE RESULT IN DATA COUNTER
@1765 021756            JP    BTOA       :EXIT TO RETURN LINK


                * SET SOOTBLOWER OUTPUT LATCH AND CORRESPONDING BLOWER
                *   UNIT START FLAG AND HEADER START FLAG

@1766 021766  LSET      JP    *          :SUBROUTINE RETURN LINK
@1767 107124            IO    ALU,LDA    :LOAD ENABLE FLAG COUNTER IN ALU
@1770 206637            RW    MSKV       :FETCH UNIT START FLAG MASK
@1771 107133            IO    ALU,ADN    :ADD MASK TO COUNTER
@1772 401774            WW    *+2        :PREPARE TO SET UNIT START FLAG
@1773 315547            RD    SEVEN      :FETCH OCTAL CONSTANT DIGIT 7
@1774 501774            WD    *          :SET BLOWER UNIT START FLAG
@1775 062020            JL    LSETA      :SET THE OUTPUT LATCH
@1776 060415            JL    ENCHK      :OUTPUT CONTROL LINE BUFFER
@1777 204637            RW    CNT        :FETCH ENABLE FLAG COUNTER
@2000 062251            JL    BLDINC     :MODIFY IT READ NEXT DIGIT
@2001 402004            WW    *+3        :STORE AHEAD
@2002 062251            JL    BLDINC     :MODIFY IT TO READ NEXT DIGIT
@2003 402006            WW    *+3        :STORE AHEAD
@2004 302004            RD    *          :FETCH BLOWER TYPE NUMBER
@2005 012007            JN    *+2        :IF RETRACT--SKIP
@2006 302006            RD    *          :FETCH BLOWER SIDE OR HDR NUMBER
@2007 512011            WD    *+2,1      :STORE AHEAD
@2010 512016            WD    *+6,1      :STORE AHEAD
@2011 305027            RD    TYF        :FETCH HEADER START FLAG
@2012 012015            JN    *+3        :IF OTHER UNIT IS STARTED--SKIP
@2013 316327            RD    ONE        :FETCH OCTAL DIGIT ONE
@2014 022016            JP    *+2        :SKIP
@2015 315547            RD    SEVEN      :FETCH OCTAL DIGIT SEVEN
@2016 505027            WD    TYF        :STORE IN HEADER START FLAG
@2017 021766            JP    LSET       :EXIT TO RETURN LINK

                * SET THE LATCH

@2020 022020  LSETA     JP    *          :SUBROUTINE RETURN LINK
@2021 062516            JL    SHR        :SHIFT INSTRUCTION LEFT 1 DIGIT
@2022 206167            RW    MSKO       :FETCH BLOWER NUMBER MASK
@2023 107104            IO    ALU,A.W    :'AND' WITH ABOVE
@2024 206177            RW    OUTC       :FETCH ADDRESS LINE MASK
@2025 107120            IO    ALU,A%W    :'OR' TOGETHER WITH BLOWER
@2026 206737            RW    CVRT       :FETCH TYPE INITIALIZER
@2027 107146            IO    ALU,SBN    :SUBTRACT FROM ADDRESS
@2030 402034            WW    *+4        :STORE AHEAD
@2031 160060            IO    DO60,060   :STOP SCANNER
@2032 165000            IO    DO65,000   :RESET ADDRESS LINES
@2033 160066            IO    DO60,066   :SET WRITE AND DATA IN LINES
@2034 165000            IO    DO65,000   :SET ADDRESS LINES
@2035 165000            IO    DO65,000   :RESET ADDRESS LINES
@2036 160060            IO    DO60,060   :RESET WRITE AND DATA IN LINES
@2037 203537            RW    FO         :FETCH DELAY CONSTANT
@2040 062537            JL    DECR       :DECREMENT IT
@2041 002040            JZ    *-1        :IF NOT ZERO--GO BACK AGAIN
@2042 022020            JP    LSETA      :EXIT TO RETURN LINK
```

APPENDIX A - Continued

```
                    * ENABLE CHECK, DISABLE CHECK, AND STEP CHECK

@2043 022043  SS        JP    *          :SUBROUTINE RETURN LINK
@2044 334567            RD    DLCK       :IF DISABLE CHECK BUTTON IS
@2045 002051            JZ    *+4        : NOT PUSHED--SKIP
@2046 206647            RW    DLCKD      :FETCH DISABLE CHECK CONSTANT
@2047 402104            WW    SSE+5      :STORE AHEAD
@2050 022061            JP    *+11       :SKIP
@2051 206657            RW    SLCKD      :FETCH ENABLE CHECK CONSTANT
@2052 402104            WW    SSE+5      :STORE AHEAD
@2053 344567            RD    SLCK       :IF ENABLE CHECK BUTTON IS
@2054 012061            JN    *+5        : PUSHED--SKIP
@2055 355717            RD    SQCK       :IF STEP CHECK BUTTON IS NOT
@2056 002124            JZ    SSR        : PUSHED--SKIP
@2057 205727            RW    PGMD       :FETCH PROGRAMMING BOX PROGRAM
@2060 022062            JP    *+2        : SELECT INPUT AND SKIP AHEAD
@2061 204677            RW    PGM        :FETCH PROGRAM SELECT INPUT
@2062 545107            WD    INOPS      :SET ROUTINE IN OPERATION FLAG
@2063 405017            WW    PGMM       :STORE INPUT IN PROGRAM REGISTER
@2064 062512            JL    ZCHK       :CHECK IF EQUAL TO ZERO
@2065 524607            WD    SEQFL      :STORE RESULT IN SEQUENCE FLAG
@2066 355717            RD    SQCK       :IF STEP CHECK BUTTON IS NOT
@2067 002074            JZ    *+5        : PUSHED--SKIP
@2070 062237            JL    QDCOM      :IF STEP THUMBWHEEL INPUT IS NOT
@2071 012124            JN    SSR        : VALID--SKIP
@2072 205747            RW    SEQD       :FETCH STEP THUMBWHEEL INPUT
@2073 022075            JP    *+2        : AND SKIP AHEAD
@2074 206337            RW    ZEROW      :RESET--
@2075 404657            WW    QCNT       : PROGRAM STEP COUNTER
@2076 061655            JL    BLRSTR     :RESET BLOWER COUNTERS
@2077 324607  SSE       RD    SEQFL      :IF THIS IS NOT A SEQUENCE
@2100 002105            JZ    *+5        : PROGRAM--SKIP
@2101 204637            RW    CNT        :FETCH BLOWER ENABLE FLAG
@2102 402103            WW    *+1        : COUNTER AND PREPARE TO CHECK
@2103 302103            RD    *          :FETCH BLOWER ENABLE FLAG
@2104 002117            JZ    SSF        :IF BLOWER NOT ENABLED--SKIP
@2105 344567            RD    SLCK       :IF ENABLE CHECK BUTTON IS
@2106 012112            JN    *+4        : PUSHED--SKIP
@2107 061673            JL    COMPR      :IF BLOWER DATA NUMBER IS EQUAL
@2110 012117            JN    SSF        : NOT TO STEP COUNTER--SKIP
@2111 022114            JP    *+3        :SKIP
@2112 061673            JL    COMPR      :IF BLOWER DATA NUMBER IS EQUAL
@2113 002117            JZ    SSF        : TO STEP COUNTER--SKIP
@2114 204637            RW    CNT        :FETCH ENABLE FLAG COUNTER
@2115 062020            JL    LSETA      :SET OUTPUT LATCH
@2116 060415            JL    ENCHK      :OUTPUT CONTROL LINE BUFFER
@2117 061721  SSF       JL    CCOM       :IF LAST BLOWER HAS NOT BEEN
@2120 012077            JN    SSE        : CHECKED--SKIP BACK
@2121 062203            JL    SWITCH     :IF BOTH BLOWER TABLES HAVE NOT
@2122 002077            JZ    SSE        : BEEN CHECKED--SKIP BACK
@2123 022043            JP    SS         :EXIT TO RETURN LINK
@2124 345107  SSR       RD    INOPS      :IF IN OPERATION FLAG IS NOT
@2125 002043            JZ    SS         : SET--EXIT TO RETURN LINK
@2126 160040            IO    DO60,040   :TURN OFF SCANNER
@2127 160060            IO    DO60,060   :RESET OUTPUT LATCHES
@2130 060415            JL    ENCHK      :TURN ON SCANNER
@2131 306327            RD    ZERO       :RESET--
@2132 545107            WD    INOPS      :ROUTINE IN OPERATION FLAG
@2133 022043            JP    SS         :EXIT TO RETURN LINK

                    * SEQUENCE CHECK

@2134 022134  STEP      JP    *          :SUBROUTINE RETURN LINK
@2135 324557            RD    SSCK       :IF SEQUENCE CHECK BUTTON IS
@2136 002160            JZ    SPC-2      : NO PUSHED--SKIP
@2137 355107            RD    INOPT      :IF ROUTINE IS IN OPERATION
@2140 012147            JN    SPA        : ALREADY--SKIP
@2141 316327            RD    ONE        :SET--
@2142 555107            WD    INOPT      : ROUTINE IN OPERATION FLAG
```

APPENDIX A - Continued

```
@2143 206337          RW    ZEROW      :RESET--
@2144 404657          WW    QCNT       : PROGRAM STEP COUNTER
@2145 204677          RW    PGM        :FETCH PROGRAM SELECT INPUT
@2146 022152          JP    *+4        : SKIP AHEAD
@2147 205777  SPA     RW    QCNTS      :RESTORE STEP NUMBER
@2150 404657          WW    QCNT       : TO PROGRAM STEP COUNTER
@2151 205737          RW    PGMS       :RESTORE PROGRAM SELECT NUMBER
@2152 405017          WW    PGMM       : TO PROGRAM COUNTER
@2153 062512          JL    ZCHK       :CHECK IF EQUAL TO ZERO
@2154 524607          WD    SEQFL      :STORE RESULT IN SEQUENCE FLAG
@2155 061655          JL    BLRSTR     :RESET BLOWER COUNTERS
@2156 546307          WD    NOPT       :RESET LATCH SET THIS STEP FLAG
@2157 061711  SPB     JL    QCOM       :INCREMENT STEP COUNTER, CHECK
@2160 555107          WD    INOPT      : IF LAST STEP FINISHED, STORE
@2161 002134          JZ    STEP       : RESULT AND EXIT IF FINISHED
@2162 061673  SPC     JL    COMPR      :IF BLOWER IS IN THIS STEP
@2163 012167          JN    *+4        : NOT SKIP AHEAD
@2164 204637          RW    CNT        :FETCH ENABLE FLAG COUNTER
@2165 062020          JL    LSETA      :SET OUTPUT LATCH
@2166 546307          WD    NOPT       :SET LATCH SET THIS STEP FLAG
@2167 061721          JL    CCOM       :IF LAST BLOWER HAS NOT BEEN
@2170 012162          JN    SPC        : CHECKED--SKIP BACK
@2171 062203          JL    SWITCH     :IF BOTH BLOWER TABLES HAVE NOT
@2172 002162          JZ    SPC        : BEEN CHECKED--SKIP BACK
@2173 346307          RD    NOPT       :IF A LATCH HAS NOT BEEN SET
@2174 002155          JZ    SPB-2      : THIS STEP--SKIP BACK
@2175 061222          JL    FLASHIT    :FLASH BOILER DIAGRAM LIGHTS
@2176 204657          RW    QCNT       :SAVE PROGRAM STEP COUNTER
@2177 405777          WW    QCNTS      : IN TEMPORARY STORAGE
@2200 205017          RW    PGMM       :SAVE PROGRAM PREGISTER
@2201 405737          WW    PGMS       : IN TEMPORARY STORAGE
@2202 022134          JP    STEP       :EXIT TO RETURN LINK


              * DETERMINE IF BLOWER DATA COUNTER SHOULD BE SWITCHED
              *   FROM TABLE 'A' TO TABLE 'B'

@2203 022203  SWITCH  JP    *          :SUBROUTINE RETURN LINK
@2204 324607          RD    SEQFL      :IF THIS IS A SEQUENCE
@2205 012203          JN    SWITCH     : PROGRAM--EXIT TO RETURN LINK
@2206 344607          RD    TFA        :IF BLOWER DATA COUNTER IS NOW
@2207 012203          JN    SWITCH     : IN TABLE 'B' EXIT
@2210 061655          JL    BLRSTR     :RESET BLOWER COUNTERS
@2211 061745          JL    ATOB       :SWITCH COUNTERS TO TABLE 'B'
@2212 022203          JP    SWITCH     :EXIT TO RETURN LINK


              * ENABLE AND DISABLE

@2213 022213  SD      JP    *          :SUBROUTINE RETURN LINK
@2214 304557          RD    SEL        :IF ENABLE BUTTON IS
@2215 012222          JN    *+5        : PUSHED--SKIP
@2216 354567          RD    DEL        :IF DISABLE BUTTON IS NOT
@2217 002213          JZ    SD         : PUSHED--EXIT TO RETURN LINK
@2220 206347          RW    ZEROS      :FETCH DISABLE CONSTANT
@2221 022223          JP    *+2        :SKIP AHEAD
@2222 206357          RW    ONES       :FETCH ENABLE CONSTANT
@2223 402234          WW    SDA        :STORE IN SET/RESET INSTRUCTION
@2224 204777          RW    TWDB       :FETCH BLOWER THUMBWHEEL DATA
@2225 062243          JL    BCOM       :IF THUMBWHEEL DATA IS NOT
@2226 012213          JN    SD         : VALID--EXIT TO RETURN LINK
@2227 204777          RW    TWDB       :FETCH BLOWER THUMBWHEEL DATA
@2230 062524          JL    SHL        :SHIFT IT LEFT ONE DIGIT
@2231 206477          RW    WDS        :FETCH BASIC STORE INSTRUCTION
@2232 107133          IO    ALU,ADN    :ADD IT TO THUMBWHEEL DATA
@2233 402235          WW    *+2        :STORE IS AHEAD
@2234 302234  SDA     RD    *          :FETCH SET/RESET DIGIT
@2235 502235          WD    *          :ENABLE/DISABLE SOOTBLOWER
@2236 022213          JP    SD         :EXIT TO RETURN LINK
```

APPENDIX A - Continued

```
                * DITERMINE IF THE STEP THUMBWHEEL INPUT IS EQUAL TO ZERO

@2237 022237  QDCOM      JP    *          :SUBROUTINE RETURN LINK
@2240 205747             RW    SEQD       :FETCH STEP THUMBWHEEL DATA
@2241 062512             JL    ZCHK       :CHECK IF EQUAL TO ZERO
@2242 022237             JP    QDCOM      :EXIT TO RETURN LINK


                * DETERMINE IF THE BLOWER THUMBWHEEL INPUT IS VALID

@2243 022243  BCOM       JP    *          :SUBROUTINE RETURN LINK
@2244 062512             JL    ZCHK       :IF BLOWER THUMBWHEEL IS EQUAL
@2245 012243             JN    BCOM       : TO ZERO--EXIT TO RETURN LINK
@2246 205007             RW    BLRDL      :FETCH CONVERSE BLOWER LIMIT
@2247 107133             IO    ALU,ADN    :ADD TO THUMBWHEEL INPUT
@2250 022243             JP    BCOM       :EXIT TO RETURN LINK


                * INCREMENT DIGIT ONE OF SPECIFIED NUMBER

@2251 022251  BLDINC     JP    *          :SUBROUTINE RETURN LINK
@2252 107124             IO    ALU,LDA    :LOAD INTO ALU
@2253 206077             RW    OO         :FETCH OCTAL CONSTANT 10000
@2254 107133             IO    ALU,ADN    :ADD TO SPECIFIED NUMBER
@2255 022251             JP    BLDINC     :EXIT TO RETURN LINK


                * DECREMENT DIGIT ONE OF SPECIFIED NUMBER

@2256 022256  BLDDEC     JP    *          :SUBROUTINE RETURN LINK
@2257 107124             IO    ALU,LDA    :LOAD SPECIFIED NUMBER INTO ALU
@2260 206077             RW    OO         :FETCH OCTAL CONSTANT 10000
@2261 107146             IO    ALU,SBN    :ADD TO SPECIFIED NUMBER
@2262 022256             JP    BLDDEC     :EXIT TO RETURN LINK


                * MANUAL START OF A SOOTBLOWER

@2263 022263  MANA       JP    *          :SUBROUTINE RETURN LINK
@2264 306317             RD    PEFL       :IF THIS PASS IS FOR
@2265 012270             JN    *+3        : RETRACTS--SKIP
@2266 324077             RD    WBM        :FETCH WALLBLOWER MANUAL START
@2267 022273             JP    *+4        : BUTTON INPUT AND SKIP
@2270 313377             RD    ERA        :IF EMERGENCY RETRACT IS ON--
@2271 012263             JN    MANA       : EXIT TO RETURN LINK
@2272 333377             RD    RTM        :IF RETRACTS MANUAL START BUTTON
@2273 002263             JZ    MANA       : IS NOT ON--EXIT TO RETURN LINK
@2274 355107             RD    INOPT      :IF SEQUENCE CHECK ROUTINE
@2275 012263             JN    MANA       : IS ON--EXIT TO RETURN LINK
@2276 345107             RD    INOPS      :IF ANY OTHER CHECK ROUTINE
@2277 012263             JN    MANA       : IS ON--EXIT TO RETURN LINK
@2300 204777             RW    TWDB       :FETCH BLOWER THUMBWHEEL INPUT
@2301 062243             JL    BCOM       :IF BLOWER THUMBWHEEL INPUT IS
@2302 012263             JN    MANA       : NOT VALID--EXIT TO RETURN LINK
@2303 204777             RW    TWDB       :FETCH BLOWER THUMBWHEEL INPUT
@2304 062524             JL    SHL        :SHIFT IT LEFT ONE DIGIT
@2305 062532             JL    SHLA       :MODIFY TO CREATE ENABLE FLAG
@2306 402307             WW    *+1        : CHECK AND PREPARE TO CHECK IT
@2307 302307             RD    *          :IF SOOTBLOWER IS NOT
@2310 002263             JZ    MANA       : ENABLED--EXIT TO RETURN LINK
@2311 354607             RD    NOSRT      :IF HEADER PRESSURE IS LOW--
@2312 012263             JN    MANA       : EXIT TO RETURN LINK
@2313 306317             RD    PEFL       :IF THIS PASS IS FOR
@2314 002324             JZ    *+10       : WALLBLOWERS--SKIP
```

APPENDIX A - Continued

```
@2315 061612              JL    CRD          :FETCH RETRACT TYPE NUMBER
@2316 107124              IO    ALU,LDA      :LOAD NUMBER INTO ALU
@2317 107300              IO    ALU,SRO      :SHIFT IT RIGHT TO GET HC BIT
@2320 012324              JN    *+4          :IF NOT HIGH CAPACITY--SKIP
@2321 526317              WD    HCF          :SET HIGH CAPACITY FLAG
@2322 316317              RD    WBF          :IF 5+ WALLBLOWERS ARE NOW
@2323 012263              JN    MANA         : OPERATING--EXIT TO RETURN LINK
@2324 204637              RW    CNT          :FETCH ENABLE FLAG COUNTER
@2325 061766              JL    LSET         :SET OUTPUT LATCH
@2326 514547              WD    ENS          :TURN ON START SIGNAL TIMER
@2327 060415              JL    ENCHK        :ENABLE OUTPUT LATCH
@2330 206047              RW    VF           :TURN OFF--
@2331 062470              JL    LTOF         : MANUAL START LIGHT
@2332 022263              JP    MANA         :EXIT TO RETURN LINK


          * MANUAL START OF AN AIR HEATER CLEANER


@2333 022333  AHM         JP    *            :SUBROUTINE RETURN LINK
@2334 324077              RD    WBM          :IF WALLBLOWER MANUAL START
@2335 002333              JZ    AHM          : BUTTON IS NOT PUSHED--EXIT
@2336 314047              RD    ENWSRT       :IF ANY WALLBLOWERS ARE STARTING
@2337 012333              JN    AHM          : --EXIT TO RETURN LINK
@2340 313347              RD    ENRSRT       :IF ANY RETRACTS ARE STARTING
@2341 012333              JN    AHM          : --EXIT TO RETURN LINK
@2342 355107              RD    INOPT        :IF SEQUENCE CHECK ROUTINE
@2343 012263              JN    MANA         : IS ON--EXIT TO RETURN LINK
@2344 345107              RD    INOPS        :IF ANY OTHER CHECK ROUTINE
@2345 012263              JN    MANA         : IS ON--EXIT TO RETURN LINK
@2346 205757              RW    AHMA         :FETCH AIR HEATER CLEANER NUMBER
@2347 107124              IO    ALU,LDA      : LOWER LIMIT AND LOAD INTO ALU
@2350 204777              RW    TWDB         :FETCH BLOWER THUMBWHEEL INPUT
@2351 107146              IO    ALU,SBN      : AND SUBTRACT FROM LIMIT
@2352 012333              JN    AHM          :IF LESS THAN ZERO--EXIT
@2353 206667              RW    AHMB         :FETCH AIR HEATER CLEANER NUMBER
@2354 107146              IO    ALU,SBN      : UPPER LIMIT AND SUBTRACT
@2355 002333              JZ    AHM          :IF LESS THAN ZER--EXIT
@2356 204777              RW    TWDB         :FETCH BLOWER THUMBWHEEL INPUT
@2357 062524              JL    SHL          :SHIFT LEFT ONE DIGIT
@2360 062532              JL    SHLA         :MODIFY TO CREATE ENABLE CHECK
@2361 062020              JL    LSETA        :SET OUTPUT LATCH
@2362 514047              WD    ENWSRT       :TURN ON START SIGNAL TIMER
@2363 060415              JL    ENCHK        :ENABLE OUTPUT LATCH
@2364 022333              JP    AHM          :EXIT TO RETURN LINK


          * SET AND OUTPUT BUFFER ON DIGITAL OUTPUT CARD #63


@2365 022365  OUTSA       JP    *            :SUBROUTINE RETURN LINK
@2366 107124              IO    ALU,LDA      :LOAD OUTPUT BIT INTO ALU
@2367 206107              RW    BUFA         :FETCH OUTPUT BUFFER
@2370 107120              IO    ALU,AXW      :'OR' BOTH TOGETHER
@2371 406107              WW    BUFA         :STORE IN OUTPUT BUFFER
@2372 402373              WW    *+1          :PREPARE TO OUTPUT BUFFER
@2373 163000              IO    DO63,0       :OUTPUT THE BUFFER
@2374 022365              JP    OUTSA        :EXIT TO RETURN LINK


          * SET AND OUTPUT BUFFER ON DIGITAL OUTPUT CARD #64


@2375 022375  OUTSB       JP    *            :SUBROUTINE RETURN LINK
@2376 107124              IO    ALU,LDA      :LOAD OUTPUT BIT INTO ALU
@2377 206117              RW    BUFB         :FETCH OUTPUT BUFFER
@2400 107120              IO    ALU,AXW      :'OR' BOTH TOGETHER
@2401 406117              WW    BUFB         :STORE IN OUTPUT BUFFER
@2402 402403              WW    *+1          :PREPARE TO OUTPUT BUFFER
@2403 164000              IO    DO64,0       :OUTPUT THE BUFFER
@2404 022375              JP    OUTSB        :EXIT TO RETURN LINK
```

APPENDIX A - Continued

```
                * RESET AND OUTPUT BUFFER ON DIGITAL OUTPUT CARD #63

@2405 022405  OUTRA     JP    *          :SUBROUTINE RETURN LINK
@2406 107150            IO    ALU,LDC    :LOAD BIT INTO ALU COMPLIMENTED
@2407 206107            RW    BUFA       :FETCH OUTPUT BUFFER
@2410 107104            IO    ALU,A.W    :'AND' BOTH TOGETHER
@2411 406107            WW    BUFA       :STORE IN OUTPUT BUFFER
@2412 402413            WW    *+1        :PREPARE TO OUTPUT BUFFER
@2413 163000            IO    DO63,0     :OUTPUT THE BUFFER
@2414 022405            JP    OUTRA      :EXIT TO RETURN LINK


                * RESET AND OUTPUT BUFFER ON DIGITAL OUTPUT CARD #64

@2415 022415  OUTRB     JP    *          :SUBROUTINE RETURN LINK
@2416 107150            IO    ALU,LDC    :LOAD BIT INTO ALU COMPLIMENTED
@2417 206117            RW    BUFB       :FETCH OUTPUT BUFFER
@2420 107104            IO    ALU,A.W    :'AND' BOTH TOGETHER
@2421 406117            WW    BUFB       :STORE IN OUTPUT BUFFER
@2422 402423            WW    *+1        :PREPARE TO OUTPUT BUFFER
@2423 164000            IO    DO64,0     :OUTPUT THE BUFFER
@2424 022415            JP    OUTRB      :EXIT TO RETURN LINK


                * TURN ON OR TURN OFF A SWITCH BUTTON LIGHT

@2425 022425  OUTB      JP    *          :SUBROUTINE RETURN LINK
@2426 002431            JZ    *+3        :TO TURN OFF--SKIP
@2427 206147            RW    ONN        :FETCH TURN ON CONSTANT
@2430 022432            JP    *+2        :SKIP
@2431 206157            RW    OFF        :FETCH TURN OFF CONSTANT
@2432 107120            IO    ALU,A%W    :'OR' TOGETHER WITH LITE ADDRESS
@2433 205217            RW    CARD       :FETCH OUTPUT CARD ADDRESS
@2434 402443            WW    TBA        :STORE AHEAD
@2435 402455            WW    TBB-4      :STORE AHEAD
@2436 107120            IO    ALU,A%W    :'OR' TOGETHER WITH ABOVE
@2437 402444            WW    TBA+1      :STORE AHEAD
@2440 206207            RW    STBMK      :FETCH STROBE MASK
@2441 107120            IO    ALU,A%W    :'OR' TOGETHER WITH ABOVE
@2442 402445            WW    TBA+2      :STORE AHEAD
@2443 161000  TBA       IO    DO61,0     :RESET CARD ADDRESS LINES
@2444 161040            IO    DO61,040   :OUTPUT ADDRESS AND DATA LINE
@2445 161060            IO    DO61,060   :OUTPUT STROBE
@2446 206247            RW    DISPL      :FETCH OPERATING DISPLAY RESET
@2447 107124            IO    ALU,LDA    :LOAD INTO ALU
@2450 205017            RW    PGMM       :FETCH PROGRAM REGISTER
@2451 107146            IO    ALU,SBN    :SUBTRACT FROM DISPLAY RESET
@2452 202443            RW    TBA        :FETCH CARD ADDRESS
@2453 107120            IO    ALU,A%W    :'OR' TOGETHER WITH ABOVE
@2454 402461            WW    TBB        :STORE AHEAD
@2455 161000            IO    DO61,000   :RESET CARD ADDRESS LINES
@2456 206207            RW    STBMK      :FETCH DELAY CONSTANT
@2457 062537            JL    DECR       :DECREMENT IT
@2460 002457            JZ    *-1        :IF NOT YET ZERO--SKIP BACK
@2461 161000  TBB       IO    DO61,0     :SET PROGRAM OPERATING DISPLAY
@2462 022425            JP    OUTB       :EXIT TO RETURN LINK


                * TURN ON SWITCH BUTTON LIGHT

@2463 022463  LTON      JP    *          :SUBROUTINE RETURN LINK
@2464 107124            IO    ALU,LDA    :LOAD ADDRESS INTO ALU
@2465 316327            RD    ONE        :FETCH ON FLAG
@2466 062425            JL    OUTB       :TURN LIGHT ONE
@2467 022463            JP    LTON       :EXIT TO RETURN LINK
```

APPENDIX A - Continued

```
                * TURN OFF SWITCH BUTTON LIGHT

@2470 022470  LTOF        JP    *           :SUBROUTINE RETURN LINK
@2471 107124              IO    ALU,LDA     :LOAD ADDRESS INTO ALU
@2472 062425              JL    OUTB        :TURN LIGHT OFF
@2473 022470              JP    LTOF        :EXIT TO RETURN LINK


                * TURN OFF PROGRAM SELECT LIGHT

@2474 022474  LTRSTA      JP    *           :SUBROUTINE RETURN LINK
@2475 062504              JL    LTA         :MODIFY BUTTON # TO LITE ADDRESS
@2476 062470              JL    LTOF        :TURN OFF PROGRAM SELECT LIGHT
@2477 022474              JP    LTRSTA      :EXIT TO RETURN LINK


                * TURN ON PROGRAM SELECT LIGHT

@2500 022500  LTSET       JP    *           :SUBROUTINE RETURN LINK
@2501 062504              JL    LTA         :MODIFY BUTTON # TO LITE ADDRESS
@2502 062463              JL    LTON        :TURN ON PROGRAM SELECT LIGHT
@2503 022500              JP    LTSET       :EXIT TO RETURN LINK


                * MODIFY PROGRAM SELECT BUTTON NUMBER TO LIGHT ADDRESS

@2504 022504  LTA         JP    *           :SUBROUTINE RETURN LINK
@2505 205017              RW    PGMM        :FETCH PROGRAM REGISTER
@2506 107124              IO    ALU,LDA     :LOAD INTO ALU
@2507 206427              RW    FIVEW       :FETCH OCTAL CONSTANT 5
@2510 107133              IO    ALU,ADN     :ADD TO PROGRAM REGISTER
@2511 022504              JP    LTA         :EXIT TO RETURN LINK


                * DETERMINE IF SPECIFIED NUMBER IS EQUAL TO ZERO

@2512 022512  ZCHK        JP    *           :SUBROUTINE RETURN LINK
@2513 062537              JL    DECR        :DECREMENT SPECIFIED NUMBER
@2514 107102              IO    ALU,INC     :INCREMENT SPECIFIED NUMBER
@2515 022512              JP    ZCHK        :EXIT TO RETURN LINK


                * SHIFT SPECIFIED NUMBER RIGHT ONE DIGIT

@2516 022516  SHR         JP    *           :SUBROUTINE RETURN LINK
@2517 107124              IO    ALU,LDA     :LOAD SPECIFIED NUMBER INTO ALU
@2520 107300              IO    ALU,SRO     :SHIFT IT RIGHT ONE BIT
@2521 107300              IO    ALU,SRO     :SHIFT IT RIGHT ONE BIT
@2522 107300              IO    ALU,SRO     :SHIFT IT RIGHT ONE BIT
@2523 022516              JP    SHR         :EXIT TO RETURN LINK


                * SHIFT SPECIFIED NUMBER LEFT ONE DIGIT

@2524 022524  SHL         JP    *           :SUBROUTINE RETURN LINK
@2525 107124              IO    ALU,LDA     :LOAD SPECIFIED NUMBER INTO ALU
@2526 107117              IO    ALU,SLO     :SHIFT IT LEFT ONE BIT
@2527 107117              IO    ALU,SLO     :SHIFT IT LEFT ONE BIT
@2530 107117              IO    ALU,SLO     :SHIFT IT LEFT ONE BIT
@2531 022524              JP    SHL         :EXIT TO RETURN LINK
```

APPENDIX A - Continued

```
                 * MODIFY SPECIFIED NUMBER TO FORM ENABLE FLAG CHECK COUNTER

@2532 022532  SHLA      JP    *          :SUBROUTINE RETURN LINK
@2533 205537            RW    SHLB       :FETCH BASIC CHECK INSTRUCTION
@2534 107133            IO    ALU,ADN    :ADD IT TO SPECIFIED NUMBER
@2535 404637            WW    CNT        :STORE IN ENABLE FLAG COUNTER
@2536 022532            JP    SHLA       :EXIT TO RETURN LINK


                 * DECREMENT SPECIFIED NUMBER

@2537 022537  DECR      JP    *          :SUBROUTINE RETURN LINK
@2540 107124            IO    ALU,LDA    :LOAD SPECIFIED NUMBER INTO ALU
@2541 107177            IO    ALU,DEC    :DECREMENT IT
@2542 022537            JP    DECR       :EXIT TO RETURN LINK


                 * PROCESS ALL SOFTWARE TIMERS DURING EACH ONE SECOND
                 *   INTERRUPT BY THE REAL TIME CLOCK
@2543 526707  CLOCK     WD    DRST       :SAVE THE DIGIT REGISTER
@2544 406267            WW    WRST       :SAVE THE WORD REGISTER
@2545 107100            IO    ALU,RDO    :READ OUT THE ALU REGISTER
@2546 406277            WW    ALUST      :SAVE THE ALU REGISTER
@2547 205577            RW    NBMWTME    :FETCH WALLBLOWER NO BLOWING
@2550 107124            IO    ALU,LDA    : MEDIUM RESET TIME, LOAD IN ALU
@2551 205657            RW    NBMWTMR    :FETCH WB NBM TIMER
@2552 324037            RD    NBMWSRT    :FETCH WB NBM TIMER START FLAG
@2553 062626            JL    TIMER      :PROCESS TIMER
@2554 405657            WW    NBMWTMR    :STORE RESULT IN WB NBM TIMER
@2555 534037            WD    NBMWEXF    :SET/RESET WB NBM EXPIRED FLAG
@2556 205627            RW    NBMRTME    :FETCH RETRACT NO BLOWING
@2557 107124            IO    ALU,LDA    : MEDIUM RESET TIME, LOAD IN ALU
@2560 205707            RW    NBMRTMR    :FETCH RTR NBM TIMER
@2561 323337            RD    NBMRSRT    :FETCH RTR NBM TIMER START FLAG
@2562 062626            JL    TIMER      :PROCESS TIMER
@2563 405707            WW    NBMRTMR    :STORE RESULT IN RTR NBM TIMER
@2564 533337            WD    NBMREXF    :SET/RESET RTR NBM EXPIRED FLAG
@2565 205567            RW    ETWTME     :FETCH WALLBLOWER ELAPSED TIME
@2566 107124            IO    ALU,LDA    : RESET, LOAD INTO ALU
@2567 205647            RW    ETWTMR     :FETCH WB ELAPSED TIME TIMER
@2570 304037            RD    ETWSRT     :FETCH WB ET TIMER START FLAG
@2571 062626            JL    TIMER      :PROCESS TIMER
@2572 405647            WW    ETWTMR     :STORE RESULT IN WB ET TIMER
@2573 514037            WD    ETWEXF     :SET/RESET WB ET EXPIRED FLAG
@2574 205617            RW    ETRTME     :FETCH RETRACT ELAPSED TIME
@2575 107124            IO    ALU,LDA    : RESET TIME, LOAD INTO ALU
@2576 205677            RW    ETRTMR     :FET RTR ELAPSED TIME TIMER
@2577 303337            RD    ETRSRT     :FETCH RTR ET TIMER START FLAG
@2600 062626            JL    TIMER      :PROCESS TIMER
@2601 405677            WW    ETRTMR     :STORE RESULT IN RTR ET TIMER
@2602 513337            WD    ETREXF     :SET/RESET RTR ET EXPIRED FLAG
@2603 205557            RW    ENWTME     :FETCH WALLBLOWER ENABLE TIME
@2604 107124            IO    ALU,LDA    : RESET TIME, LOAD INTO ALU
@2605 205637            RW    ENWTMR     :FETCH WB ENABLE TIMER
@2606 314047            RD    ENWSRT     :FETCH ENABLE TIMER START FLAG
@2607 062626            JL    TIMER      :PROCESS TIMER
@2610 405637            WW    ENWTMR     :STORE RESULT IN ENABLE TIMER
@2611 524047            WD    ENWEXF     :SET/RESET EXPIRED FLAG
@2612 205607            RW    ENRTME     :FETCH RETRACT ENABLE TIMER
@2613 107124            IO    ALU,LDA    : RESET TIME, LOAD INTO ALU
@2614 205667            RW    ENRTMR     :FETCH RTR ENABLE TIMER
@2615 313347            RD    ENRSRT     :FETCH ENABLE TIMER START FLAG
@2616 062626            JL    TIMER      :PROCESS TIMER
@2617 405667            WW    ENRTMR     :STORE RESULT IN ENABLE TIMER
@2620 523347            WD    ENREXF     :SET/RESET EXPIRED FLAG
@2621 206277            RW    ALUST      :FETCH ALU FROM STORAGE
@2622 107124            IO    ALU,LDA    :LOAD BACK INTO ALU REGISTER
@2623 206267            RW    WRST       :RESTORE WORD REGISTER
@2624 326707            RD    DRST       :RESTORE DIGIT REGISTER
@2625 020104            JP    RTCRET     :EXIT TO RETURN LINK
```

APPENDIX A - Continued

```
                * PROCESS SOFTWARE TIMER

@2626 022626  TIMER      JP    *          :SUBROUTINE RETURN LINK
@2627 002631             JZ    *+2        :IF START FLAG NOT ON--SKIP
@2630 107124             IO    ALU,LDA    :LOAD TIMER INTO ALU
@2631 107177             IO    ALU,DEC    :DECREMENT ALU
@2632 002626             JZ    TIMER      :IF NOT DOWN TO ZERO--EXIT
@2633 107102             IO    ALU,INC    :INCREMENT ALU
@2634 022626             JP    TIMER      :EXIT TO RETURN LINK


                * TURN OFF ALL SWITCHABLE FRONT PANEL SWITCH LIGHTS,
                *   THEN TURN ON ALL APPROPRIATE SWITCH LIGHTS

@2635 022635  PWRUPA     JP    *          :SUBROUTINE RETURN LINK
@2636 060153             JL    SETUP      :FETCH GENERAL RESET CONSTANT
@2637 206547             RW    MSKUP      :FETCH GENERAL RESET CONSTANT
@2640 062470             JL    LTOF       :RESET ALL SWITCH PANEL LIGHTS
@2641 206227             RW    STOPL      :TURN ON--
@2642 062463             JL    LTON       : STOP LIGHT
@2643 206377             RW    THREEW     :TURN ON--
@2644 062463             JL    LTON       : SEQUENCE CHECK LIGHT
@2645 061145             JL    SET        :SET ALARMS
@2646 062650             JL    LTRST      :RESTORE PROGRAM SELECT LIGHTS
@2647 022635             JP    PWRUPA     :EXIT TO RETURN LINK


                * RESTORE ANY PROGRAM SELECT LIGHTS THAT WERE ON BEFORE
                *   THE POWER FAILURE

@2650 022650  LTRST      JP    *          :SUBROUTINE RETURN LINK
@2651 205167             RW    LTPO       :FETCH INITIAL INOP FLAG CHECK
@2652 402653             WW    *+1        :PREPARE TO CHECK INOP FLAG
@2653 302653             RD    *          :IF PROGRAM WAS NOT FINISHED--
@2654 052500             NL    LTSET      : TURN ON PROGRAM SELECT LIGHT
@2655 202653             RW    *-2        :FETCH CHECK INSTRUCTION
@2656 061733             JL    BLINC      :INCREMENT IT
@2657 402653             WW    *-4        :PUT BACK INTO CHECK INSTRUCTION
@2660 205177             RW    LTPOL      :FETCH CHECK INSTRUCTION LIMIT
@2661 107046             IO    ALU,COM    :COMPARE CHECK WITH LIMIT
@2662 012653             JN    LTRST+3    :IF NOT EQUAL--GO TO NEXT CHECK
@2663 022650             JP    LTRST      :EXIT TO RETURN LINK


                * SOFTWARE RESTORATION AFTER POWER FAILURE

@2664 111100  PWRUP      IO    11,100     :STOP REAL TIME CLOCK
@2665 206337             RW    ZEROW      :RESET--
@2666 404037             WW    INPP       : ALL SOFTWARE TIMERS
@2667 404047             WW    INPQ       :
@2670 403337             WW    INPR       :
@2671 403347             WW    INPS       :
@2672 306327             RD    ZERO       :RESET--
@2673 514107             WD    FLA,1      : WB START BUTTON INHIBIT
@2674 513407             WD    FLB,1      : RTR START BUTTON INHIBIT
@2675 506317             WD    PEFL       : PASS FLAG TO WALLBLOWERS
@2676 316327             RD    ONE        :SET--
@2677 504107             WD    FLA,0      : WB PROGRAM STOPPED FLAG
@2700 503407             WD    FLB,0      : RTR PROGRAM STOPPED FLAG
@2701 544037             WD    INPP,4     : WB FLASHING FLAG
@2702 543337             WD    INPR,4     : RTR FLASHING FLAG
@2703 506707             WD    VAC        : AC POWER FAILURE FLAG
@2704 206067             RW    VO         :TURN OFF--
@2705 062405             JL    OUTRA      : RTR CONT. OPERATING LIGHT
@2706 206057             RW    VT         :TURN OFF--
@2707 062405             JL    OUTRA      : WV CONT. OPERATING LIGHT
```

APPENDIX A - Continued

```
@2710 206047              RW    VF          :TURN ON--
@2711 062365              JL    OUTSA       :CONTROLLER POWER FAILURE LIGHT
@2712 204437              RW    ADSRTR      :INITIALIZE BLOWER REGISTER
@2713 405137              WW    ADSRTG      : DATA ADDRESS COUNTER
@2714 062635              JL    PWRUPA      :RESTORE WB SWITCH LIGHTS
@2715 062635              JL    PWRUPA      :RESTORE RTR SWITCH LIGHTS
@2716 160040              IO    DO60,040    :TURN OFF SCANNER
@2717 165000              IO    DO65,000    :RESET ADDRESS LINES
@2720 160060              IO    DO60,060    :RESET LATCHES
@2721 160020              IO    DO60,020    :TURN ON SCANNER
@2722 111000              IO    11,000      :RESTART REAL TIME CLOCK
@2723 020110              JP    MAIN        :EXIT TO SOFTWARE MAINLINE
```

* REMOVE--PROGRAMMING BOX COMMAND

```
@2724 022724  DISC        JP    *           :SUBROUTINE RETURN LINK
@2725 335717              RD    DCON        :IF REMOVE BUTTON IS NOT
@2726 002724              JZ    DISC        : PUSHED--EXIT TO RETURN LINK
@2727 063147              JL    BCOMA       :IF BLOWER NUMBER IS NOT VALIK
@2730 012724              JN    DISC        : THIS PASS--EXIT TO RETURN LINK
@2731 063166              JL    BCOMB       :IF STEP AND PROGRAM NUMBERS NOT
@2732 012752              JN    DISCC       : VALID--SKIP
@2733 063102              JL    CONCK       :IF BLOWER IS NOT IN THIS STEP
@2734 012752              JN    DISCC       : --SKIP
@2735 204647              RW    BLRCNT      :FETCH BLOWER DATA COUNTER
@2736 402745              WW    *+7         :STORE AHEAD
@2737 062251              JL    BLDINC      :INCREMENT TO NEXT DIGIT
@2740 402746              WW    *+6         :STORE AHEAD
@2741 356327              RD    FIVE        :FETCH OCTAL CONSTANT 5
@2742 502745              WD    *+3,0       :MODIFY READ INSTR. TO WRITE
@2743 502746              WD    *+3,0       :MODIFY READ INSTR. TO WRITE
@2744 306327              RD    ZERO        :RESET--
@2745 502745              WD    *           : FIRST DIGIT OF STEP NUMBER
@2746 502746              WD    *           : SECOND DIGIT OF STEP NUMBER
@2747 203557              RW    TT          :TURN ON--
@2750 063205              JL    ELON        : ACCEPT LIGHT
@2751 022724              JP    DISC        :EXIT TO RETURN LINK
@2752 204247  DISCC       RW    TO          :TURN ON--
@2753 063205              JL    ELON        : ERROR LIGHT
@2754 022724              JP    DISC        :EXIT TO RETURN LINK
```

* INSERT--PROGRAMMING BOX COMMAND

```
@2755 022755  CON         JP    *           :SUBROUTINE RETURN LINK
@2756 345717              RD    CONN        :IF INSERT BUTTON IS NOT
@2757 003067              JZ    CONZ        : PUSHED--SKIP
@2760 063147              JL    BCOMA       :IF BLOWER NUMBER IS NOT VALIK
@2761 013067              JN    CONZ        : THIS PASS-SKIP
@2762 063166              JL    BCOMB       :IF STEP AND PROGRAM NUMBERS
@2763 013064              JN    CONT        : ARE NOT VALID--SKIP
@2764 063102              JL    CONCK       :IF BLOWER IS ALREADY IN THIS
@2765 003064              JZ    CONT        : STEP--SKIP
@2766 206337              RW    ZERON       :RESET--
@2767 404657              WW    QCNT        : PROGRAM STEP COUNTER
@2770 063102              JL    CONCK       :IF THIS BLOWER IS ALREADY IN
@2771 013064              JN    CONT        : TWO STEPS THIS PROGRAM--SKIP
@2772 526307              WD    CONFA       :RESET SIDE/HEADER FLAG
@2773 061612              JL    CRD         :FETCH BLOWER TYPE AND SIDE/HDR
@2774 205747              RW    SEQD        :FETCH STEP THUMBWHEEL INPUT
@2775 404657              WW    QCNT        :STORE IN PROGRAM STEP COUNTER
@2776 061655              JL    BLRSTR      :RESET BLOWER DATA COUNTERS
@2777 061673  CONA        JL    COMPR       :IF THIS BLOWER IS NOT IN THIS
@3000 013036              JN    CONB        : STEP--SKIP
@3001 356447              RD    TESTA,5     :IF BLOWER TO BE INSERTED IS
@3002 003064              JZ    CONT        : HIGH CAPACITY--SKIP
@3003 206357              RW    ONES        :PREPARE TO FETCH
@3004 401627              WW    CRDA        : THIS BLOWER'S SIDE/HDR NUMBER
```

APPENDIX A - Continued

```
@3005 061624            JL    CRDB        :FETCH BLOWER SIDE/HDR NUMBER
@3006 003064            JZ    CONT        :IF THIS BLOWER HC--SKIP
@3007 107124            IO    ALU,LDA     :LOAD SIDE/HDR NUMBER INTO ALU
@3010 206447            RW    TESTA       :COMPARE SIDE/HDR NUMBERS OF NEW
@3011 107046            IO    ALU,COM     : AND OLD BLOWERS
@3012 003032            JZ    CONC        :IF SAME--SKIP
@3013 336307            RD    CONF        :IF THE NEW BLOWER IS A
@3014 013036            JN    CONB        : WALLBLOWER--SKIP
@3015 306317            RD    PEFL        :IF THIS PASS IS FOR
@3016 003036            JZ    CONB        : WALLBLOWERS--SKIP
@3017 326307            RD    CONFA       :IF THIS IS THE SECOND RETRACT
@3020 013064            JN    CONT        : FOUND IN THIS STEP--SKIP
@3021 206367            RW    THREES      :PREPARE TO FETCH
@3022 401627            WW    CRDA        : THIS BLOWER'S TYPE NUMBER
@3023 061624            JL    CRDB        :FETCH BLOWER TYPE NUMBER
@3024 107124            IO    ALU,LDA     :LOAD TYPE NUMBER INTO ALU
@3025 206457            RW    TESTB       :COMPARE TYPE NUMBERS OF THE
@3026 107046            IO    ALU,COM     : NEW BLOWER AND THIS BLOWER
@3027 003064            JZ    CONT        :IF EQUAL--SKIP
@3030 526307            WD    CONFA       :SET RTR FOUND IN THIS STEP FLAG
@3031 023036            JP    CONB        :SKIP
@3032 336307  CONC      RD    CONF        :IF NEW BLOWER IS A RETRACT
@3033 003064            JZ    CONT        : --SKIP
@3034 306327            RD    ZERO        :SWITCH NEW BLOWER FLAG FROM
@3035 536307            WD    CONF        : WALLBLOWER TO RETRACT
@3036 061721  CONB      JL    CCOM        :IF LAST BLOWER HAS NOT BEEN
@3037 012777            JN    CONA        : CHECKED--SKIP BACK
@3040 062203  COND      JL    SWITCH      :IF BOTH BLOWER TABLES HAVE NOT
@3041 002777            JZ    CONA        : CHECKED--SKIP BACK
@3042 206337            RW    ZEROW       :RESET--
@3043 404657            WW    QCNT        : PROGRAM STEP COUNTER
@3044 063102            JL    CONCK       :IF SPACE FOR NEW BLOWER IS NOT
@3045 013064            JN    CONT        : FOUND IN THIS STEP--SKIP
@3046 204647            RW    BLRCNT      :FETCH BLOWER DATA COUNTER
@3047 403056            WW    *+7         :STORE AHEAD
@3050 062251            JL    BLDINC      :INCREMENT TO NEXT DIGIT
@3051 403060            WW    *+7         :STORE AHEAD
@3052 356327            RD    FIVE        :MODIFY BOTH BLOWER DATA
@3053 503056            WD    *+3,0       : COUNTERS FROM
@3054 503060            WD    *+4,0       : READ TO WRITE COUNTERS
@3055 345747            RD    SEQD,4      :FETCH NEW STEP NUMBER FIRST
@3056 503056            WD    *           : DIGIT AND STORE IN MEMORY
@3057 355747            RD    SEQD,5      :FETCH NEW STEP NUMBER SECOND
@3060 503060            WD    *           : DIGIT AND STORE IN MEMORY
@3061 203557            RW    TT          :TURN ON--
@3062 063205            JL    ELON        : ACCEPT LIGHT
@3063 022755            JP    CON         :EXIT TO RETURN LINK
@3064 204247  CONT      RW    TO          :TURN ON--
@3065 063205            JL    ELON        : ERROR LIGHT
@3066 022755            JP    CON         :EXIT TO RETURN LINK
@3067 316307  CONZ      RD    INOPD       :IF SUBROUTINE OPERATING FLAG
@3070 002755            JZ    CON         : NOT ON--EXIT TO RETURN LINK
@3071 335717            RD    DCON        :IF REMOVE BUTTON IS PUSHED--
@3072 012755            JN    CON         : EXIT TO RETURN LINK
@3073 345717            RD    CONN        :IF INSERT BUTTON IS PUSHED--
@3074 012755            JN    CON         : EXIT TO RETURN LINK
@3075 516307            WD    INOPD       :RESET PROGRAM OPERATING FLAG
@3076 202461            RW    TBB         :PREPARE TO TURN OFF.
@3077 403100            WW    *+1         : ACCEPT LIGHT AND ERROR LIGHT
@3100 161000            IO    DO61,0      :TURN OFF BOTH LIGHTS
@3101 022755            JP    CON         :EXIT TO RETURN LINK


              * DETERMINE IF EITHER STEP NUMBER FOR NEW BLOWER IS THE
              *   SAME AS THE PROGRAM STEP COUNTER


@3102 023102  CONCK     JP    *           :SUBROUTINE RETURN LINK
@3103 063131            JL    BLRSTRC     :RESET BLOWER DATA COUNTERS
@3104 206007            RW    BLRD        :FETCH BLOWER THUMBWHEEL DATA
@3105 107124            IO    ALU,LDA     :LOAD INTO THE ALU
@3106 306317            RD    PEFL        :IF THIS PASS IS FOR
```

APPENDIX A - Continued

```
@3107 013112            JN    *+3          : RETRACTS--SKIP
@3110 206027            RW    BLRDLA       :FETCH WALLBLOWER CONVERSION
@3111 107146            IO    ALU,SBN      : FACTOR AND SUBTRACT FROM INPUT
@3112 062524            JL    SHL          :SHIFT RESULT LEFT ONE DIGIT
@3113 406447            WW    TESTA        :PUT IN TEMPORARY STORAGE
@3114 204637            RW    CNT          :FETCH ENABLE FLAG COUNTER
@3115 107133            IO    ALU,ADN      :ADD TO ABOVE
@3116 404637            WW    CNT          :STORE IN ENABLE FLAG COUNTER
@3117 206447            RW    TESTA        :FETCH RESULT FROM STORAGE
@3120 107124            IO    ALU,LDA      :LOAD INTO THE ALU
@3121 204647            RW    BLRCNT       :FETCH BLOWER DATA COUNTER
@3122 107133            IO    ALU,ADN      :ADD TO ABOVE
@3123 404647            WW    BLRCNT       :STORE IN BLOWER DATA COUNTER
@3124 061673            JL    COMPR        :COMPARE FIRST STEP NUMBER WITH
@3125 003102            JZ    CONCK        : NEW NUMBER, IF EQUAL--EXIT
@3126 061745            JL    ATOB         :SWITCH TO BLOWER DATA TABLE 'B'
@3127 061673            JL    COMPR        :COMPARE SECOND STEP NUMBER WITH
@3130 023102            JP    CONCK        :EXIT TO RETURN LINK


            * RESET BLOWER DATA COUNTER AND BLOWER ENABLE FLAG COUNTER
            *   FOR THE INSERT SUBROUTINE

@3131 023131  BLRSTRC   JP    *            :SUBROUTINE RETURN LINK
@3132 205017            RW    PGMM         :FETCH PROGRAM REGISTER
@3133 062524            JL    SHL          :SHIFT IT LEFT ONE DIGIT
@3134 544607            WD    TFA          :RESET BLOWER TABLE FALG
@3135 205377            RW    ADRS         :FETCH TABLE ADDRESS LOCATOR
@3136 107133            IO    ALU,ADN      :ADD TO ABOVE
@3137 403140            WW    *+1          :PREPARE TO FETCH TABLE ADDRESS
@3140 203140            RW    *            :FETCH BLOWER TABLE ADDRESS
@3141 107124            IO    ALU,LDA      :LOAD INTO THE ALU
@3142 204767            RW    CNTL         :INITIALIZE ENABLE
@3143 404637            WW    CNT          : FLAG COUNTER
@3144 107133            IO    ALU,ADN      :ADD TO ABOVE
@3145 404647            WW    BLRCNT       :STORE IN BLOWER DATA COUNTER
@3146 023131            JP    BLRSTRC      :EXIT TO RETURN LINK


            * DETERMINE IF BLOWER THUMBWHEEL NUMBER IS VALID

@3147 023147  BCOMA     JP    *            :SUBROUTINE RETURN LINK
@3150 316307            RD    INOPD        :IF SUBROUTINE IS ALREADY
@3151 013147            JN    BCOMA        : OPERATING--EXIT TO RETURN LINK
@3152 206027            RW    BLRDLA       :FETCH LAST RETRACT BLOWER
@3153 107124            IO    ALU,LDA      : NUMBER AND LOAD INTO THE ALU
@3154 206007            RW    BLRD         :FETCH BLOWER THUMBWHEEL DATA
@3155 406017            WW    BLRWA        :PUT IN TEMPORARY STORAGE
@3156 107046            IO    ALU,COM      :COMPARE LAST RETRACT AND INPUT
@3157 307777            RD    W,0          :FETCH BIT THAT STATES IF LESS
@3160 536307            WD    CONF         : THAN OR GREATER OR EQUAL TO
@3161 107150            IO    ALU,LDC      :LOAD INTO ALU COMPLIMENTED
@3162 306317            RD    PEFL         :FETCH PASS FLAG
@3163 507777            WD    W,0          :STORE IN WORD REGISTER
@3164 107046            IO    ALU,COM      :COMPARE PASS FLAG WITH RETRACT
@3165 023147            JP    BCOMA        : OR WALLBLOWER FLAG AND EXIT


            * DETERMINE IF PROGRAM SELECT AND STEP THUMBWHEEL NUMBERS
            *   ARE VALID

@3166 023166  BCOMB     JP    *            :SUBROUTINE RETURN LINK
@3167 316327            RD    ONE          :SET--
@3170 516307            WD    INOPD        : SUBROUTINE IN OPERATION FLAG
@3171 205727            RW    PGMD         :FETCH PROGRAM SELECT INPUT
@3172 405017            WW    PGMM         :STORE IN PROGRAM REGISTER
```

APPENDIX A - Continued

```
@3173 062512            JL    ZCHK        :IF PROGRAM REGISTER IS EQUAL TO
@3174 013166            JN    BCOMB       : ZERO--EXIT TO RETURN LINK
@3175 206007            RW    BLRD        :FETCH BLOWER THUMBWHEEL INPUT
@3176 062243            JL    BCOM        :IF BLOWER THUMBWHEEL INPUT IS
@3177 013166            JN    BCOMB       : NOT VALID--EXIT TO RETURN LINK
@3200 062237            JL    QDCOM       :IF STEP THUMBWHEEL INPUT IS
@3201 013166            JN    BCOMB       : NOT VALID--EXIT TO RETURN LINK
@3202 205747            RW    SEQD        :FETCH STEP THUMBWHEEL INPUT
@3203 404657            WW    QCNT        :STORE IN PROGRAM STEP COUNTER
@3204 023166            JP    BCOMB       :EXIT TO RETURN LINK


              * TURN ON ERROR OR ACCEPT LIGHTS

@3205 023205  ELON      JP    *           :SUBROUTINE RETURN LINK
@3206 107124            IO    ALU,LDA     :LOAD LIGHT ADDRESS INTO ALU
@3207 202461            RW    TBB         :FETCH OUTBUFFER
@3210 107120            IO    ALU,A%W     :'OR' TOGETHER WITH ABOVE
@3211 403212            WW    *+1         :PREPARE TO TURN ON LIGHT
@3212 161000            IO    DO61,0      :TURN ON THE LIGHT
@3213 023205            JP    ELON        :EXIT TO RETURN LINK
                        ORG   0101        :
@0101 100000            OCT   100000     :POWERFAIL RETURN  NOT USED
@0102 100000            OCT   100000     :POWER UP RETURN  NOT USED
@0103 022664            JP    PWRUP      :TO POWER UP ROUTINE
@0104 020104  RTCRET    JP    *          :REAL TIME CLOCK RETURN LINK
@0105 022543            JP    CLOCK      :TO REAL TIME CLOCK ROUTINE
               ORG 3330
@3330 002000   OCT 002000,110000,0,0,0,0,0
@3331 110000
@3332 000000
@3333 000000
@3334 000000
@3335 000000
@3336 000000
@3337 000000  INPR OCT 0
@3340 004000   OCT 004000,120000,0,0,0,0,0
@3341 120000
@3342 000000
@3343 000000
@3344 000000
@3345 000000
@3346 000000
@3347 000000  INPS OCT 0
@3350 002000   OCT 002000,070000,0,0,0,0,0
@3351 070000
@3352 000000
@3353 000000
@3354 000000
@3355 000000
@3356 000000
@3357 000000  INPK OCT 0
@3360 004000   OCT 004000,100000,0,0,0,0,0
@3361 100000
@3362 000000
@3363 000000
@3364 000000
@3365 000000
@3366 000000
@3367 000000  INPL OCT 0
@3370 020000   OCT 020000,060000,0,0,0,0,0
@3371 060000
@3372 000000
@3373 000000
@3374 000000
@3375 000000
@3376 000000
@3377 000000  INPM OCT 0
@3400 041000   OCT 041000,060000,0,0,0,0,0
@3401 060000
```

APPENDIX A - Continued

```
@3402 000000
@3403 000000
@3404 000000
@3405 000000
@3406 000000
@3407 000000  FLB OCT 0
@3410 020000   OCT 020000,040000,0,0,0,0,0
@3411 040000
@3412 000000
@3413 000000
@3414 000000
@3415 000000
@3416 000000
@3417 407227  SVCNTR OCT 407227
@3420 041000   OCT 041000,040000,0,0,0,0,0
@3421 040000
@3422 000000
@3423 000000
@3424 000000
@3425 000000
@3426 000000
@3427 304040  RSTR OCT 304040
@3430 020000   OCT 020000,050000,0,0,0,0,0
@3431 050000
@3432 000000
@3433 000000
@3434 000000
@3435 000000
@3436 000000
@3437 000000  CNTR OCT 0
@3440 041000   OCT 041000,050000,0,0,0,0,0
@3441 050000
@3442 000000
@3443 000000
@3444 000000
@3445 000000
@3446 000000
@3447 000000  BLRCNTR OCT 0
@3450 020000   OCT 020000,010000,0,0,0,0,0
@3451 010000
@3452 000000
@3453 000000
@3454 000000
@3455 000000
@3456 000000
@3457 000000  QCNTR OCT 0
@3460 041000   OCT 041000,010000,0,0,0,0,0
@3461 010000
@3462 000000
@3463 000000
@3464 000000
@3465 000000
@3466 000000
@3467 207227  RECNTR OCT 207227
@3470 020000   OCT 020000,020000,0,0,0,0,0
@3471 020000
@3472 000000
@3473 000000
@3474 000000
@3475 000000
@3476 000000
@3477 000000  PGMR OCT 0
@3500 041000   OCT 041000,020000,0,0,0,0,0
@3501 020000
@3502 000000
@3503 000000
@3504 000000
@3505 000000
@3506 000000
@3507 000000  INPE OCT 0
@3510 020000   OCT 020000,030000,0,0,0,0,0
@3511 030000
@3512 000000
```

APPENDIX A - Continued

```
@3513 000000
@3514 000000
@3515 000000
@3516 000000
@3517 000000  INPF OCT 0
@3520 041000   OCT 041000,030000,0,0,0,0,0
@3521 030000
@3522 000000
@3523 000000
@3524 000000
@3525 000000
@3526 000000
@3527 000000  INPD OCT 0
@3530 010000   OCT 010000,130000,0,0,0,0,0
@3531 130000
@3532 000000
@3533 000000
@3534 000000
@3535 000000
@3536 000000
@3537 000010  FO OCT 10
@3540 031000   OCT 031000,130000,0,0,0,0,0
@3541 130000
@3542 000000
@3543 000000
@3544 000000
@3545 000000
@3546 000000
@3547 000040  FF OCT 40
@3550 010000   OCT 010000,140000,0,0,0,0,0
@3551 140000
@3552 000000
@3553 000000
@3554 000000
@3555 000000
@3556 000000
@3557 000200  TT OCT 200
@3560 031000   OCT 031000,140000,0,0,0,0,0
@3561 140000
@3562 000000
@3563 000000
@3564 000000
@3565 000000
@3566 000000
@3567 303320  CNTRL OCT 303320
@3570 010000   OCT 010000,150000,0,0,0,0,0
@3571 150000
@3572 000000
@3573 000000
@3574 000000
@3575 000000
@3576 000000
@3577 000000  TWDR OCT 0
@3600 031000   OCT 031000,150000,0,0,0,0,0
@3601 150000
@3602 000000
@3603 000000
@3604 000000
@3605 000000
@3606 000000
@3607 777725  BLRDLR OCT 777725
@3610 010000   OCT 010000,160000,0,0,0,0,0
@3611 160000
@3612 000000
@3613 000000
@3614 000000
@3615 000000
@3616 000000
@3617 000000  PGMMR OCT 0
@3620 031000   OCT 031000,160000,0,0,0,0,0
@3621 160000
@3622 000000
@3623 000000
```

APPENDIX A - Continued

```
@3624 000000
@3625 000000
@3626 000000
@3627 000000  TYFR OCT 0
@3630 010000   OCT 010000,170000,0,0,0,0,0
@3631 170000
@3632 000000
@3633 000000
@3634 000000
@3635 000000
@3636 000000
@3637 000000  NBSRR OCT 0
@3640 031000   OCT 031000,170000,0,0,0,0,0
@3641 170000
@3642 000000
@3643 000000
@3644 000000
@3645 000000
@3646 000000
@3647 000000  NBMRR OCT 0
@3650 010000   OCT 010000,200000,0,0,0,0,0
@3651 200000
@3652 000000
@3653 000000
@3654 000000
@3655 000000
@3656 000000
@3657 000000  CFLGR OCT 0
@3660 031000   OCT 031000,200000,0,0,0,0,0
@3661 200000
@3662 000000
@3663 000000
@3664 000000
@3665 000000
@3666 000000
@3667 344050  SEARCHP OCT 344050
@3670 010000   OCT 010000,210000,0,0,0,0,0
@3671 210000
@3672 000000
@3673 000000
@3674 000000
@3675 000000
@3676 000000
@3677 343330  SEARCHQ OCT 343330
@3700 031000   OCT 031000,210000,0,0,0,0,0
@3701 210000
@3702 000000
@3703 000000
@3704 000000
@3705 000000
@3706 000000
@3707 000000  LFLGR OCT 0
@3710 010000   OCT 010000,220000,0,0,0,0,0
@3711 220000
@3712 000000
@3713 000000
@3714 000000
@3715 000000
@3716 000000
@3717 403327  TBLRTR OCT 403327
@3720 031000   OCT 031000,220000,0,0,0,0,0
@3721 220000
@3722 000000
@3723 000000
@3724 000000
@3725 000000
@3726 000000
@3727 404037  SETDNR OCT 404037
@3730 010000   OCT 010000,230000,0,0,0,0,0
@3731 230000
@3732 000000
@3733 000000
```

APPENDIX A - Continued

```
@3734 000000
@3735 000000
@3736 000000
@3737 204027  ADSRTW OCT 204027
@3740 031000   OCT 031000,230000,0,0,0,0,0
@3741 230000
@3742 000000
@3743 000000
@3744 000000
@3745 000000
@3746 000000
@3747 534040  LOOKAR OCT 534040
@3750 010000   OCT 010000,240000,0,0,0,0,0
@3751 240000
@3752 000000
@3753 000000
@3754 000000
@3755 000000
@3756 000000
@3757 533320  SEARCHMR OCT 533320
@3760 031000   OCT 031000,240000,0,0,0,0,0
@3761 240000
@3762 000000
@3763 000000
@3764 000000
@3765 000000
@3766 000000
@3767 307227  LTPOR OCT 307227
@3770 010000   OCT 010000,250000,0,0,0,0,0
@3771 250000
@3772 000000
@3773 000000
@3774 000000
@3775 000000
@3776 000000
@3777 307337  LTPOLR OCT 307337
@4000 031000   OCT 031000,250000,0,0,0,0,0
@4001 250000
@4002 000000
@4003 000000
@4004 000000
@4005 000000
@4006 000000
@4007 000240  TREER OCT 240
@4010 010000   OCT 010000,260000,0,0,0,0,0
@4011 260000
@4012 000000
@4013 000000
@4014 000000
@4015 000000
@4016 000000
@4017 161000  CARDA OCT 161000
@4020 031000   OCT 031000,260000,0,0,0,0,0
@4021 260000
@4022 000000
@4023 000000
@4024 000000
@4025 000000
@4026 000000
@4027 000000   OCT 0
@4030 010000   OCT 010000,270000,0,0,0,0,0
@4031 270000
@4032 000000
@4033 000000
@4034 000000
@4035 000000
@4036 000000
@4037 000000  INPP OCT 0
@4040 031000   OCT 031000,270000,0,0,0,0,0
@4041 270000
@4042 000000
@4043 000000
@4044 000000
```

APPENDIX A - Continued

```
@4045 000000
@4046 000000
@4047 000000  INPQ OCT 0
@4050 010000   OCT 010000,430000,0,0,0,0,0
@4051 430000
@4052 000000
@4053 000000
@4054 000000
@4055 000000
@4056 000000
@4057 000000  INPG OCT 0
@4060 010000   OCT 010000,430000,0,0,0,0,0
@4061 430000
@4062 000000
@4063 000000
@4064 000000
@4065 000000
@4066 000000
@4067 000000  INPH OCT 0
@4070 020000   OCT 020000,410000,0,0,0,0,0
@4071 410000
@4072 000000
@4073 000000
@4074 000000
@4075 000000
@4076 000000
@4077 000000  INPJ OCT 0
@4100 020000   OCT 020000,420000,0,0,0,0,0
@4101 420000
@4102 000000
@4103 000000
@4104 000000
@4105 000000
@4106 000000
@4107 000000  FLA OCT 0
@4110 020000   OCT 020000,420000,0,0,0,0,0
@4111 420000
@4112 000000
@4113 000000
@4114 000000
@4115 000000
@4116 000000
@4117 407337  SVCNTW OCT 407337
@4120 030000   OCT 030000,410000,0,0,0,0,0
@4121 410000
@4122 000000
@4123 000000
@4124 000000
@4125 000000
@4126 000000
@4127 307760  RSTW OCT 307760
@4130 030000   OCT 030000,420000,0,0,0,0,0
@4131 420000
@4132 000000
@4133 000000
@4134 000000
@4135 000000
@4136 000000
@4137 000000  CNTW OCT 0
@4140 030000   OCT 030000,420000,0,0,0,0,0
@4141 420000
@4142 000000
@4143 000000
@4144 000000
@4145 000000
@4146 000000
@4147 000000  BLRCNTW OCT 0
@4150 040000   OCT 040000,410000,0,0,0,0,0
@4151 410000
@4152 000000
@4153 000000
@4154 000000
@4155 000000
```

APPENDIX A - Continued

```
@4156 000000
@4157 000000  QCNTW OCT 0
@4160 040000   OCT 040000,420000,0,0,0,0,0
@4161 420000
@4162 000000
@4163 000000
@4164 000000
@4165 000000
@4166 000000
@4167 207337  RECNTW OCT 207337
@4170 040000   OCT 040000,420000,0,0,0,0,0
@4171 420000
@4172 000000
@4173 000000
@4174 000000
@4175 000000
@4176 000000
@4177 000000  PGMW OCT 0
@4200 010000   OCT 010000,420000,0,0,0,0,0
@4201 420000
@4202 000000
@4203 000000
@4204 000000
@4205 000000
@4206 000000
@4207 000000  INPB OCT 0
@4210 010000   OCT 010000,370000,0,0,0,0,0
@4211 370000
@4212 000000
@4213 000000
@4214 000000
@4215 000000
@4216 000000
@4217 000000  INPC OCT 0
@4220 010000   OCT 010000,400000,0,0,0,0,0
@4221 400000
@4222 000000
@4223 000000
@4224 000000
@4225 000000
@4226 000000
@4227 000000  INPA OCT 0
@4230 010000   OCT 010000,400000,0,0,0,0,0
@4231 400000
@4232 000000
@4233 000000
@4234 000000
@4235 000000
@4236 000000
@4237 000020  FT OCT 20
@4240 010000   OCT 010000,410000,0,0,0,0,0
@4241 410000
@4242 000000
@4243 000000
@4244 000000
@4245 000000
@4246 000000
@4247 000100  TO OCT 100
@4250 010000   OCT 010000,410000,0,0,0,0,0
@4251 410000
@4252 000000
@4253 000000
@4254 000000
@4255 000000
@4256 000000
@4257 000400  TF OCT 400
@4260 010000   OCT 010000,420000,0,0,0,0,0
@4261 420000
@4262 000000
@4263 000000
@4264 000000
@4265 000000
@4266 000000
```

APPENDIX A - Continued

```
@4267 304040  CNTWL OCT 304040
@4270 020000   OCT 020000,350000,0,0,0,0,0
@4271 350000
@4272 000000
@4273 000000
@4274 000000
@4275 000000
@4276 000000
@4277 000000  TWDW OCT 0
@4300 020000   OCT 020000,350000,0,0,0,0,0
@4301 350000
@4302 000000
@4303 000000
@4304 000000
@4305 000000
@4306 000000
@4307 777333  BLRDLW OCT 777333
@4310 020000   OCT 020000,360000,0,0,0,0,0
@4311 360000
@4312 000000
@4313 000000
@4314 000000
@4315 000000
@4316 000000
@4317 000000  PGMMW OCT 0
@4320 020000   OCT 020000,360000,0,0,0,0,0
@4321 360000
@4322 000000
@4323 000000
@4324 000000
@4325 000000
@4326 000000
@4327 000000  TYFW OCT 0
@4330 020000   OCT 020000,370000,0,0,0,0,0
@4331 370000
@4332 000000
@4333 000000
@4334 000000
@4335 000000
@4336 000000
@4337 000000  NBSRW OCT 0
@4340 020000   OCT 020000,370000,0,0,0,0,0
@4341 370000
@4342 000000
@4343 000000
@4344 000000
@4345 000000
@4346 000000
@4347 000000  NBMRW OCT 0
@4350 020000   OCT 020000,400000,0,0,0,0,0
@4351 400000
@4352 000000
@4353 000000
@4354 000000
@4355 000000
@4356 000000
@4357 000000  CFLGW OCT 0
@4360 020000   OCT 020000,400000,0,0,0,0,0
@4361 400000
@4362 000000
@4363 000000
@4364 000000
@4365 000000
@4366 000000
@4367 347770  SEARCHN OCT 347770
@4370 020000   OCT 020000,410000,0,0,0,0,0
@4371 410000
@4372 000000
@4373 000000
@4374 000000
@4375 000000
@4376 000000
@4377 344050  SEARCHR OCT 344050
```

APPENDIX A - Continued

```
@4400 030000   OCT 030000,350000,0,0,0,0,0
@4401 350000
@4402 000000
@4403 000000
@4404 000000
@4405 000000
@4406 000000
@4407 000000  LFLGW OCT 0
@4410 030000   OCT 030000,350000,0,0,0,0,0
@4411 350000
@4412 000000
@4413 000000
@4414 000000
@4415 000000
@4416 000000
@4417 404027  TBLRTW OCT 404027
@4420 030000   OCT 030000,360000,0,0,0,0,0
@4421 360000
@4422 000000
@4423 000000
@4424 000000
@4425 000000
@4426 000000
@4427 404537  SETDNW OCT 404537
@4430 030000   OCT 030000,360000,0,0,0,0,0
@4431 360000
@4432 000000
@4433 000000
@4434 000000
@4435 000000
@4436 000000
@4437 203327  ADSRTR OCT 203327
@4440 030000   OCT 030000,370000,0,0,0,0,0
@4441 370000
@4442 000000
@4443 000000
@4444 000000
@4445 000000
@4446 000000
@4447 537760  LOOKAW OCT 537760
@4450 030000   OCT 030000,370000,0,0,0,0,0
@4451 370000
@4452 000000
@4453 000000
@4454 000000
@4455 000000
@4456 000000
@4457 534040  SEARCHMW OCT 534040
@4460 030000   OCT 030000,400000,0,0,0,0,0
@4461 400000
@4462 000000
@4463 000000
@4464 000000
@4465 000000
@4466 000000
@4467 307337  LTPOW OCT 307337
@4470 030000   OCT 030000,400000,0,0,0,0,0
@4471 400000
@4472 000000
@4473 000000
@4474 000000
@4475 000000
@4476 000000
@4477 307447  LTPOLW OCT 307447
@4500 030000   OCT 030000,410000,0,0,0,0,0
@4501 410000
@4502 000000
@4503 000000
@4504 000000
@4505 000000
@4506 000000
@4507 000500  TREEW OCT 500
@4510 040000   OCT 040000,350000,0,0,0,0,0
```

APPENDIX A - Continued

```
@4511 350000
@4512 000000
@4513 000000
@4514 000000
@4515 000000
@4516 000000
@4517 162000  CARDB OCT 162000
@4520 040000   OCT 040000,350000,0,0,0,0,0
@4521 350000
@4522 000000
@4523 000000
@4524 000000
@4525 000000
@4526 000000
@4527 000000   OCT 0
@4530 040000   OCT 040000,360000,0,0,0,0,0
@4531 360000
@4532 000000
@4533 000000
@4534 000000
@4535 000000
@4536 000000
@4537 000000  BOA OCT 0
@4540 040000   OCT 040000,360000,0,0,0,0,0
@4541 360000
@4542 000000
@4543 000000
@4544 000000
@4545 000000
@4546 000000
@4547 000000  BOB OCT 0
@4550 040000   OCT 040000,370000,0,0,0,0,0
@4551 370000
@4552 000000
@4553 000000
@4554 000000
@4555 000000
@4556 000000
@4557 000000  BOC OCT 0
@4560 040000   OCT 040000,370000,0,0,0,0,0
@4561 370000
@4562 000000
@4563 000000
@4564 000000
@4565 000000
@4566 000000
@4567 000000  BOE OCT 0
@4570 040000   OCT 040000,400000,0,0,0,0,0
@4571 400000
@4572 000000
@4573 000000
@4574 000000
@4575 000000
@4576 000000
@4577 000000  BOH OCT 0
@4600 040000   OCT 040000,400000,0,0,0,0,0
@4601 400000
@4602 000000
@4603 000000
@4604 000000
@4605 000000
@4606 000000
@4607 000000  BOJ OCT 0
@4610 040000   OCT 040000,410000,0,0,0,0,0
@4611 410000
@4612 000000
@4613 000000
@4614 000000
@4615 000000
@4616 000000
@4617 000000  SVCNT OCT 0
```

APPENDIX A - Continued

```
@4620 010000   OCT 010000,360000,0,0,0,0,0
@4621 360000
@4622 000000
@4623 000000
@4624 000000
@4625 000000
@4626 000000
@4627 000000  RST OCT 0
@4630 010000   OCT 010000,360000,0,0,0,0,0
@4631 360000
@4632 000000
@4633 000000
@4634 000000
@4635 000000
@4636 000000
@4637 000000  CNT OCT 0
@4640 010000   OCT 010000,370000,0,0,0,0,0
@4641 370000
@4642 000000
@4643 000000
@4644 000000
@4645 000000
@4646 000000
@4647 000000  BLRCNT OCT 0
@4650 010000   OCT 010000,340000,0,0,0,0,0
@4651 340000
@4652 000000
@4653 000000
@4654 000000
@4655 000000
@4656 000000
@4657 000000  QCNT OCT 0
@4660 010000   OCT 010000,340000,0,0,0,0,0
@4661 340000
@4662 000000
@4663 000000
@4664 000000
@4665 000000
@4666 000000
@4667 000000  RECNT OCT 0
@4670 010000   OCT 010000,350000,0,0,0,0,0
@4671 350000
@4672 000000
@4673 000000
@4674 000000
@4675 000000
@4676 000000
@4677 000000  PGM OCT 0
@4700 010000   OCT 010000,350000,0,0,0,0,0
@4701 350000
@4702 000000
@4703 000000
@4704 000000
@4705 000000
@4706 000000
@4707 000000  BOG OCT 0
@4710 020000   OCT 020000,320000,0,0,0,0,0
@4711 320000
@4712 000000
@4713 000000
@4714 000000
@4715 000000
@4716 000000
@4717 000000  BOF OCT 0
@4720 020000   OCT 020000,320000,0,0,0,0,0
@4721 320000
@4722 000000
@4723 000000
@4724 000000
@4725 000000
@4726 000000
@4727 000000  BOD OCT 0
@4730 020000   OCT 020000,330000,0,0,0,0,0
```

APPENDIX A - Continued

```
@4731 330000
@4732 000000
@4733 000000
@4734 000000
@4735 000000
@4736 000000
@4737 000000  NBSL OCT 0
@4740 020000   OCT 020000,330000,0,0,0,0,0
@4741 330000
@4742 000000
@4743 000000
@4744 000000
@4745 000000
@4746 000000
@4747 000000  NBML OCT 0
@4750 020000   OCT 020000,340000,0,0,0,0,0
@4751 340000
@4752 000000
@4753 000000
@4754 000000
@4755 000000
@4756 000000
@4757 000000  ETL OCT 0
@4760 020000   OCT 020000,340000,0,0,0,0,
@4761 340000
@4762 000000
@4763 000000
@4764 000000
@4765 000000
@4766 000000
@4767 000000  CNTL OCT 0
@4770 030000   OCT 030000,320000,0,0,0,0,0
@4771 320000
@4772 000000
@4773 000000
@4774 000000
@4775 000000
@4776 000000
@4777 000000  TWDB OCT 0
@5000 030000   OCT 030000,320000,0,0,0,0,0
@5001 320000
@5002 000000
@5003 000000
@5004 000000
@5005 000000
@5006 000000
@5007 000000  BLRDL OCT 0
@5010 030000   OCT 030000,330000,0,0,0,0,0
@5011 330000
@5012 000000
@5013 000000
@5014 000000
@5015 000000
@5016 000000
@5017 000000  PGMM OCT 0
@5020 030000   OCT 030000,330000,0,0,0,0,0
@5021 330000
@5022 000000
@5023 000000
@5024 000000
@5025 000000
@5026 000000
@5027 000000  TYF OCT 0
@5030 030000   OCT 030000,340000,0,0,0,0,0
@5031 340000
@5032 000000
@5033 000000
@5034 000000
@5035 000000
@5036 000000
@5037 000000  NBSR OCT 0
@5040 030000   OCT 030000,340000,0,0,0,0,0
@5041 340000
```

APPENDIX A - Continued

```
@5042 000000
@5043 000000
@5044 000000
@5045 000000
@5046 000000
@5047 000000  NBMR OCT 0
@5050 040000   OCT 040000,320000,0,0,0,0,0
@5051 320000
@5052 000000
@5053 000000
@5054 000000
@5055 000000
@5056 000000
@5057 000000  CFLG OCT 0
@5060 040000   OCT 040000,320000,0,0,0,0,0
@5061 320000
@5062 000000
@5063 000000
@5064 000000
@5065 000000
@5066 000000
@5067 000000  SEARCHT OCT 0
@5070 040000   OCT 040000,330000,0,0,0,0,0
@5071 330000
@5072 000000
@5073 000000
@5074 000000
@5075 000000
@5076 000000
@5077 000000  SEARCHS OCT 0
@5100 040000   OCT 040000,330000,0,0,0,0,0
@5101 330000
@5102 000000
@5103 000000
@5104 000000
@5105 000000
@5106 000000
@5107 000000  LFLG OCT 0
@5110 040000   OCT 040000,340000,0,0,0,0,0
@5111 340000
@5112 000000
@5113 000000
@5114 000000
@5115 000000
@5116 000000
@5117 000000  TBLRTG OCT 0
@5120 040000   OCT 040000,340000,0,0,0,0,0
@5121 340000
@5122 000000
@5123 000000
@5124 000000
@5125 000000
@5126 000000
@5127 000000  SETDNG OCT 0
@5130 010000   OCT 010000,320000,0,0,0,0,0
@5131 320000
@5132 000000
@5133 000000
@5134 000000
@5135 000000
@5136 000000
@5137 000000  ADSRTG OCT 0
@5140 010000   OCT 010000,330000,0,0,0,0,0
@5141 330000
@5142 000000
@5143 000000
@5144 000000
@5145 000000
@5146 000000
@5147 000000  LOOKA OCT 0
@5150 010000   OCT 010000,330000,0,0,0,0,0
@5151 330000
@5152 000000
```

APPENDIX A - Continued

```
@5153 000000
@5154 000000
@5155 000000
@5156 000000
@5157 000000  SEARCHM OCT 0
@5160 010000   OCT 010000,310000,0,0,0,0,0
@5161 310000
@5162 000000
@5163 000000
@5164 000000
@5165 000000
@5166 000000
@5167 000000  LTPO OCT 0
@5170 010000   OCT 010000,310000,0,0,0,0,0
@5171 310000
@5172 000000
@5173 000000
@5174 000000
@5175 000000
@5176 000000
@5177 000000  LTPOL OCT 0
@5200 010000   OCT 010000,320000,0,0,0,0,0
@5201 320000
@5202 000000
@5203 000000
@5204 000000
@5205 000000
@5206 000000
@5207 000000  TREE OCT 0
@5210 020000   OCT 020000,300000,0,0,0,0,0
@5211 300000
@5212 000000
@5213 000000
@5214 000000
@5215 000000
@5216 000000
@5217 000000  CARD OCT 0
@5220 020000   OCT 020000,310000,0,0,0,0,0
@5221 310000
@5222 000000
@5223 000000
@5224 000000
@5225 000000
@5226 000000
@5227 000000   OCT 0
@5230 020000   OCT 020000,310000,0,0,0,0,0
@5231 310000
@5232 000000
@5233 000000
@5234 000000
@5235 000000
@5236 000000
@5237 700000  SWAT OCT 700000
@5240 030000   OCT 030000,300000,0,0,0,0,0
@5241 300000
@5242 000000
@5243 000000
@5244 000000
@5245 000000
@5246 000000
@5247 353330  LOOKD OCT 353330
@5250 030000   OCT 030000,310000,0,0,0,0,0
@5251 310000
@5252 000000

@5253 000000
@5254 000000
@5255 000000
@5256 000000
@5257 543320  LOOKC OCT 543320
@5260 030000   OCT 030000,310000,0,0,0,0,0
@5261 310000
@5262 000000
```

APPENDIX A - Continued

```
@5263 000000
@5264 000000
@5265 000000
@5266 000000
@5267 204527  ADSRTD OCT 204527
@5270 040000   OCT 040000,300000,0,0,0,0,0
@5271 300000
@5272 000000
@5273 000000
@5274 000000
@5275 000000
@5276 000000
@5277 165001  LOOKE OCT 165001
@5300 040000   OCT 040000,310000,0,0,0,0,0
@5301 310000
@5302 000000
@5303 000000
@5304 000000
@5305 000000
@5306 000000
@5307 404527  TBLRTA OCT 404527
@5310 040000   OCT 040000,310000,0,0,0,0,0
@5311 310000
@5312 000000
@5313 000000
@5314 000000
@5315 000000
@5316 000000
@5317 000051  FIFTY OCT 51
@5320 010000   OCT 010000,270000,0,0,0,0,0
@5321 270000
@5322 000000
@5323 000000
@5324 000000
@5325 000000
@5326 000000
@5327 000000  FSLS OCT 0
@5330 010000   OCT 010000,270000,0,0,0,0,0
@5331 270000
@5332 000000
@5333 000000
@5334 000000
@5335 000000
@5336 000000
@5337 000000  LTOP OCT 0
@5340 010000   OCT 010000,300000,0,0,0,0,0
@5341 300000
@5342 000000
@5343 000000
@5344 000000
@5345 000000
@5346 000000
@5347 405237  SETUPL OCT 405237
@5350 010000   OCT 010000,300000,0,0,0,0,0
@5351 300000
@5352 000000
@5353 000000
@5354 000000
@5355 000000
@5356 000000
@5357 000000  FSHS OCT 0
@5360 020000   OCT 020000,250000,0,0,0,0,0
@5361 250000
@5362 000000
@5363 000000
@5364 000000
@5365 000000
@5366 000000
@5367 000000  SBIS OCT 0
@5370 020000   OCT 020000,260000,0,0,0,0,0
@5371 260000
@5372 000000
@5373 000000
```

APPENDIX A - Continued

```
@5374 000000
@5375 000000
@5376 000000
@5377 205407  ADRS RW *+10
@5400 020000   OCT 020000,260000,0,0,0,0,0
@5401 260000
@5402 000000
@5403 000000
@5404 000000
@5405 000000
@5406 000000
@5407 000001  ADRSQ OCT 000001
@5410 020000   OCT 020000,270000,0,0,0,0,0
@5411 270000
@5412 000000
@5413 000000
@5414 000000
@5415 000000
@5416 000000
@5417 020001  ADRS1 OCT 020001
@5420 020000   OCT 020000,270000,0,0,0,0,0
@5421 270000
@5422 000000
@5423 000000
@5424 000000
@5425 000000
@5426 000000
@5427 040001  ADRS2 OCT 040001
@5430 020000   OCT 020000,300000,0,0,0,0,0
@5431 300000
@5432 000000
@5433 000000
@5434 000000
@5435 000000
@5436 000000
@5437 000002  ADRS3 OCT 000002
@5440 030000   OCT 030000,250000,0,0,0,0,0
@5441 250000
@5442 000000
@5443 000000
@5444 000000
@5445 000000
@5446 000000
@5447 020002  ADRS4 OCT 020002
@5450 030000   OCT 030000,260000,0,0,0,0,0
@5451 260000
@5452 000000
@5453 000000
@5454 000000
@5455 000000
@5456 000000
@5457 040002  ADRS5 OCT 040002
@5460 030000   OCT 030000,260000,0,0,0,0,0
@5461 260000
@5462 000000
@5463 000000
@5464 000000
@5465 000000
@5466 000000
@5467 000003  ADRS6 OCT 000003
@5470 030000   OCT 030000,270000,0,0,0,0,0
@5471 270000
@5472 000000
@5473 000000
@5474 000000
@5475 000000
@5476 000000
@5477 020003  ADRS7 OCT 020003
@5500 030000   OCT 030000,270000,0,0,0,0,0
@5501 270000
@5502 000000
@5503 000000
@5504 000000
```

APPENDIX A - Continued

```
@5505 000000
@5506 000000
@5507 040003  ADRS8 OCT 040003
@5510 030000   OCT 030000,300000,0,0,0,0,0
@5511 300000
@5512 000000
@5513 000000
@5514 000000
@5515 000000
@5516 000000
@5517 160000  ENKF OCT 160000
@5520 040000   OCT 040000,250000,0,0,0,0,0
@5521 250000
@5522 000000
@5523 000000
@5524 000000
@5525 000000
@5526 000000
@5527 547770  UPDZ OCT 547770
@5530 040000   OCT 040000,260000,0,0,0,0,0
@5531 260000
@5532 000000
@5533 000000
@5534 000000
@5535 000000
@5536 000000
@5537 303320  SHLB OCT 303320
@5540 040000   OCT 040000,260000,0,0,0,0,0
@5541 260000
@5542 000000
@5543 000000
@5544 000000
@5545 000000
@5546 000000
@5547 670000  NUMC OCT 670000
@5550 040000   OCT 040000,270000,0,0,0,0,0
@5551 270000
@5552 000000
@5553 000000
@5554 000000
@5555 000000
@5556 000000
@5557 000005  ENWTME OCT 5
@5560 040000   OCT 040000,270000,0,0,0,0,0
@5561 270000
@5562 000000
@5563 000000
@5564 000000
@5565 000000
@5566 000000
@5567 000132  ETWTME OCT 132
@5570 040000   OCT 040000,300000,0,0,0,0,0
@5571 300000
@5572 000000
@5573 000000
@5574 000000
@5575 000000
@5576 000000
@5577 000012  NBMWTME OCT 12
@5600 010000   OCT 010000,250000,0,0,0,0,0
@5601 250000
@5602 000000
@5603 000000
@5604 000000
@5605 000000
@5606 000000
@5607 000005  ENRTME OCT 5
@5610 010000   OCT 010000,260000,0,0,0,0,0
@5611 260000
@5612 000000
@5613 000000
@5614 000000
@5615 000000
```

APPENDIX A - Continued

```
@5616 000000
@5617 002070  ETRTME OCT 2070
@5620 010000   OCT 010000,260000,0,0,0,0,0
@5621 260000
@5622 000000
@5623 000000
@5624 000000
@5625 000000
@5626 000000
@5627 000055  NBMRTME OCT 55
@5630 010000   OCT 010000,220000,0,0,0,0,0
@5631 220000
@5632 000000
@5633 000000
@5634 000000
@5635 000000
@5636 000000
@5637 000000  ENWTMR OCT 0
@5640 010000   OCT 010000,230000,0,0,0,0,0
@5641 230000
@5642 000000
@5643 000000
@5644 000000
@5645 000000
@5646 000000
@5647 000000  ETWTMR OCT 0
@5650 010000   OCT 010000,230000,0,0,0,0,0
@5651 230000
@5652 000000
@5653 000000
@5654 000000
@5655 000000
@5656 000000
@5657 000000  NBMWTMR OCT 0
@5660 010000   OCT 010000,240000,0,0,0,0,0
@6123 000000
@6124 000000
@6125 000000
@6126 000000
@6127 000000  PGMT OCT 0
@6130 040000   OCT 040000,210000,0,0,0,0,0
@6131 210000
@6132 000000
@6133 000000
@6134 000000
@6135 000000
@6136 000000
@6137 313370  MOZ OCT 313370
@6140 040000   OCT 040000,210000,0,0,0,0,0
@6141 210000
@6142 000000
@6143 000000
@6144 000000
@6145 000000
@6146 000000
@6147 000040  ONN OCT 40
@6150 040000   OCT 040000,220000,0,0,0,0,0
@6151 220000
@6152 000000
@6153 000000
@6154 000000
@6155 000000
@6156 000000
@6157 000000  OFF OCT 0
@6160 040000   OCT 040000,220000,0,0,0,0,0
@6161 220000
@6162 000000
@6163 000000
@6164 000000
@6165 000000
@6166 000000
@6167 000777  MSKO OCT 777
@6170 040000   OCT 040000,230000,0,0,0,0,0
```

APPENDIX A - Continued

```
@6171 230000
@6172 000000
@6173 000000
@6174 000000
@6175 000000
@6176 000000
@6177 165000  OUTC OCT 165000
@6200 040000   OCT 040000,230000,0,0,0,0,0
@6201 230000
@6202 000000
@6203 000000
@6204 000000
@6205 000000
@6206 000000
@6207 000020  STBMK OCT 20
@6210 040000   OCT 040000,240000,0,0,0,0,0
@5661 240000
@5662 000000
@5663 000000
@5664 000000
@5665 000000
@5666 000000
@5667 000000  ENRTMR OCT 0
@5670 010000   OCT 010000,240000,0,0,0,0,0
@5671 240000
@5672 000000
@5673 000000
@5674 000000
@5675 000000
@5676 000000
@5677 000000  ETRTMR OCT 0
@5700 010000   OCT 010000,250000,0,0,0,0,0
@5701 250000
@5702 000000
@5703 000000
@5704 000000
@5705 000000
@5706 000000
@5707 000000  NBMRTMR OCT 0
@5710 020000   OCT 020000,210000,0,0,0,0,0
@5711 210000
@5712 000000
@5713 000000
@5714 000000
@5715 000000
@5716 000000
@5717 000000  INPN OCT 0
@5720 020000   OCT 020000,210000,0,0,0,0,0
@5721 210000
@5722 000000
@5723 000000
@5724 000000
@5725 000000
@5726 000000
@5727 000000  PGMD OCT 0
@5730 020000   OCT 020000,220000,0,0,0,0,0
@5731 220000
@5732 000000
@5733 000000
@5734 000000
@5735 000000
@5736 000000
@5737 000000  PGMS OCT 0
@5740 020000   OCT 020000,220000,0,0,0,0,0
@5741 220000
@5742 000000
@5743 000000
@5744 000000
@5745 000000
@5746 000000
@5747 000000  SEQD OCT 0
@5750 020000   OCT 020000,230000,0,0,0,0,0
@5751 230000
```

APPENDIX A - Continued

```
@5752 000000
@5753 000000
@5754 000000
@5755 000000
@5756 000000
@5757 000451  AHMA OCT 451
@5760 020000   OCT 020000,230000,0,0,0,0,0
@5761 230000
@5762 000000
@5763 000000
@5764 000000
@5765 000000
@5766 000000
@5767 000100  QCNTL OCT 100
@5770 020000   OCT 020000,240000,0,0,0,0,0
@5771 240000
@5772 000000
@5773 000000
@5774 000000
@5775 000000
@5776 000000
@5777 000000  QCNTS OCT 0
@6000 020000   OCT 020000,240000,0,0,0,0,0
@6001 240000
@6002 000000
@6003 000000
@6004 000000
@6005 000000
@6006 000000
@6007 000000  BLRD OCT 0
@6010 020000   OCT 020000,250000,0,0,0,0,0
@6011 250000
@6012 000000
@6013 000000
@6014 000000
@6015 000000
@6016 000000
@6017 000000  BLRWA OCT 0
@6020 030000   OCT 030000,210000,0,0,0,0,0
@6021 210000
@6022 000000
@6023 000000
@6024 000000

@6025 000000
@6026 000000
@6027 000052  BLRDLA OCT 52
@6030 030000   OCT 030000,210000,0,0,0,0,0
@6031 210000
@6032 000000
@6033 000000
@6034 000000
@6211 240000
@6212 000000
@6213 000000
@6214 000000
@6215 000000
@6216 000000
@6217 000000  STARTL OCT 0
@6220 040000   OCT 040000,240000,0,0,0,0,0
@6221 240000
@6222 000000
@6223 000000
@6224 000000
@6225 000000
@6226 000000
@6227 000001  STOPL OCT 1
@6230 040000   OCT 040000,250000,0,0,0,0,0
@6231 250000
@6232 000000
@6233 000000
@6234 000000
@6235 000000
```

APPENDIX A - Continued

```
@6236 000000
@6237 000002  RSETL OCT 2
@6240 010000   OCT 010000,210000,0,0,0,0,0
@6241 210000
@6242 000000
@6243 000000
@6244 000000
@6245 000000
@6246 000000
@6247 000017  DISPL OCT 17
@6250 010000   OCT 010000,210000,0,0,0,0,0
@6251 210000
@6252 000000
@6253 000000
@6254 000000
@6255 000000
@6256 000000
@6257 000020  MOLL OCT 20
@6260 010000   OCT 010000,220000,0,0,0,0,0
@6261 220000
@6262 000000
@6263 000000
@6264 000000
@6265 000000
@6266 000000
@6267 000000  WRST OCT 0
@6270 010000   OCT 010000,160000,0,0,0,0,0
@6271 160000
@6272 000000
@6273 000000
@6274 000000
@6275 000000
@6276 000000
@6277 000000  ALUST OCT 0
@6300 010000   OCT 010000,160000,0,0,0,0,0
@6301 160000
@6302 000000
@6303 000000
@6304 000000
@6305 000000
@6306 000000
@6307 000000  FLD OCT 0
@6310 010000   OCT 010000,170000,0,0,0,0,0
@6311 170000
@6312 000000
@6313 000000
@6314 000000
@6315 000000
@6316 000000
@6317 000000  FLG OCT 0
@6320 010000   OCT 010000,170000,0,0,0,0,0
@6321 170000
@6322 000000
@6323 000000
@6324 000000
@6325 000000
@6326 000000
@6327 012345  NUMB OCT 012345
@6330 010000   OCT 010000,200000,0,0,0,0,0
@6331 200000
@6332 000000
@6333 000000
@6334 000000
@6335 000000
@6336 000000
@6337 000000  ZEROW OCT 0
@6340 010000   OCT 010000,200000,0,0,0,0,0
@6341 200000
@6342 000000
@6343 000000
@6344 000000
@6345 000000
@6346 000000
```

APPENDIX A - Continued

```
@6347 306327  ZEROS RD ZERO
@6350 020000   OCT 020000,140000,0,0,0,0,0
@6351 140000
@6352 000000
@6353 000000
@6354 000000
@6355 000000
@6356 000000
@6357 316327  ONES RD ONE
@6360 020000   OCT 020000,150000,0,0,0,0,0
@6361 150000
@6362 000000
@6363 000000
@6364 000000
@6365 000000
@6366 000000
@6367 326327  THREES RD TWO
@6370 020000   OCT 020000,150000,0,0,0,0,0
@6371 150000
@6372 000000
@6373 000000
@6374 000000
@6375 000000
@6376 000000
@6377 000003  THREEW OCT 3
@6400 020000   OCT 020000,160000,0,0,0,0,0
@6401 160000
@6402 000000
@6403 000000
@6404 000000
@6405 000000
@6406 000000
@6407 220000  THREEWS OCT 220000
@6410 020000   OCT 020000,160000,0,0,0,0,0
@6411 160000
@6412 000000
@6413 000000
@6414 000000
@6415 000000
@6416 000000
@6417 000004  FOURW OCT 4
@6420 020000   OCT 020000,170000,0,0,0,0,0
@6421 170000
@6422 000000
@6423 000000
@6424 000000
@6425 000000
@6426 000000
@6427 000005  FIVEW OCT 5
@6430 020000   OCT 020000,170000,0,0,0,0,0
@6431 170000
@6432 000000
@6433 000000
@6434 000000
@6435 000000
@6436 000000
@6437 177771  SEVENS OCT 177771
@6440 020000   OCT 020000,200000,0,0,0,0,0
@6441 200000
@6442 000000
@6443 000000
@6444 000000
@6445 000000
@6446 000000
@6447 000000  TESTA OCT 0
@6450 020000   OCT 020000,200000,0,0,0,0,0
@6451 200000
@6452 000000
@6453 000000
@6454 000000
@6455 000000
@6456 000000
@6457 000000  TESTB OCT 0
```

APPENDIX A - Continued

```
@6460 030000   OCT 030000,140000,0,0,0,0,0
@6461 140000
@6462 000000
@6463 000000
@6464 000000
@6465 000000
@6466 000000
@6467 040000  DELAY OCT 040000
@6470 030000   OCT 030000,150000,0,0,0,0,0
@6471 150000
@6472 000000
@6473 000000
@6474 000000
@6475 000000
@6476 000000
@6477 503320  WDS OCT 503320
@6500 030000   OCT 030000,150000,0,0,0,0,0
@6501 150000
@6502 000000
@6503 000000
@6504 000000
@6505 000000
@6506 000000
@6507 000000   OCT 0
@6510 030000   OCT 030000,160000,0,0,0,0,0
@6511 160000
@6512 000000
@6513 000000
@6514 000000
@6515 000000
@6516 000000
@6517 000000   OCT 0
@6520 030000   OCT 030000,160000,0,0,0,0,0
@6521 160000
@6522 000000
@6523 000000
@6524 000000
@6525 000000
@6526 000000
@6527 000000   OCT 0
@6530 030000   OCT 030000,170000,0,0,0,0,0
@6531 170000
@6532 000000
@6533 000000
@6534 000000
@6535 000000
@6536 000000
@6537 000000   OCT 0
@6540 030000   OCT 030000,170000,0,0,0,0,0
@6035 000000
@6036 000000
@6037 000101  TREONE OCT 101
@6040 030000   OCT 030000,220000,0,0,0,0,0
@6041 220000
@6042 000000
@6043 000000
@6044 000000
@6045 000000
@6046 000000
@6047 000004  VF OCT 4
@6050 030000   OCT 030000,220000,0,0,0,0,0
@6051 220000
@6052 000000
@6053 000000
@6054 000000
@6055 000000
@6056 000000
@6057 000002  VT OCT 2
@6060 030000   OCT 030000,230000,0,0,0,0,0
@6061 230000
@6062 000000
@6063 000000
```

APPENDIX A - Continued

```
@6064 000000
@6065 000000
@6066 000000
@6067 000001  VO OCT 1
@6070 030000   OCT 030000,230000,0,0,0,0,0
@6071 230000
@6072 000000
@6073 000000
@6074 000000
@6075 000000
@6076 000000
@6077 010000  OO OCT 10000
@6100 030000   OCT 030000,240000,0,0,0,0,0
@6101 240000
@6102 000000
@6103 000000
@6104 000000
@6105 000000
@6106 000000
@6107 163000  BUFA OCT 163000
@6110 030000   OCT 030000,240000,0,0,0,0,0
@6111 240000
@6112 000000
@6113 000000
@6114 000000
@6115 000000
@6116 000000
@6117 164000  BUFB OCT 164000
@6120 030000   OCT 030000,250000,0,0,0,0,0
@6121 250000
@6122 000000
@6541 170000
@6542 000000
@6543 000000
@6544 000000
@6545 000000
@6546 000000
@6547 000017  MSKUP OCT 17
@6550 030000   OCT 030000,200000,0,0,0,0,0
@6551 200000
@6552 000000
@6553 000000
@6554 000000
@6555 000000
@6556 000000
@6557 007777  MSK2 OCT 7777
@6560 030000   OCT 030000,200000,0,0,0,0,0
@6561 200000
@6562 000000
@6563 000000
@6564 000000
@6565 000000
@6566 000000
@6567 000000  SEARCH OCT 0
@6570 040000   OCT 040000,140000,0,0,0,0,0
@6571 140000
@6572 000000
@6573 000000
@6574 000000
@6575 000000
@6576 000000
@6577 557770  SEARCHL OCT 557770
@6600 040000   OCT 040000,150000,0,0,0,0,0
@6601 150000
@6602 000000
@6603 000000
@6604 000000
@6605 000000
@6606 000000
@6607 160020  ENKE OCT 160020
@6610 040000   OCT 040000,150000,0,0,0,0,0
@6611 150000
@6612 000000
```

APPENDIX A - Continued

```
@6613 000000
@6614 000000
@6615 000000
@6616 000000
@6617 210000  SEARCHU OCT 210000
@6620 040000   OCT 040000,160000,0,0,0,0,0
@6621 160000
@6622 000000
@6623 000000
@6624 000000
@6625 000000
@6626 000000
@6627 000000  SCNT OCT 0
@6630 040000   OCT 040000,160000,0,0,0,0,0
@6631 160000
@6632 000000
@6633 000000
@6634 000000
@6635 000000
@6636 000000
@6637 230000  MSKV OCT 230000
@6640 040000   OCT 040000,170000,0,0,0,0,0
@6641 170000
@6642 000000
@6643 000000
@6644 000000
@6645 000000
@6646 000000
@6647 002114  DLCKD JZ SSF-3
@6650 040000   OCT 040000,170000,0,0,0,0,0
@6651 170000
@6652 000000
@6653 000000
@6654 000000
@6655 000000
@6656 000000
@6657 002117  SLCKD JZ SSF
@6660 040000   OCT 040000,200000,0,0,0,0,0
@6661 200000
@6662 000000
@6663 000000
@6664 000000
@6665 000000
@6666 000000
@6667 000005  AHMB OCT 5
@6670 040000   OCT 040000,200000,0,0,0,0,0
@6671 200000
@6672 000000
@6673 000000
@6674 000000
@6675 000000
@6676 000000
@6677 777777  SEVENW OCT 777777
@6700 010000   OCT 010000,140000,0,0,0,0,0
@6701 140000
@6702 000000
@6703 000000
@6704 000000
@6705 000000
@6706 000000
@6707 000000  FLH OCT 0
@6710 010000   OCT 010000,150000,0,0,0,0,0
@6711 150000
@6712 000000
@6713 000000
@6714 000000
@6715 000000
@6716 000000
@6717 111111  FSLSA OCT 111111
@6720 010000   OCT 010000,150000,0,0,0,0,0
@6721 150000
@6722 000000
@6723 000000
```

APPENDIX A - Continued

```
@6724 000000
@6725 000000
@6726 000000
@6727 000000  WBCHKA OCT 0
@6730 010000   OCT 010000,110000,0,0,0,0,0
@6731 110000
@6732 000000
@6733 000000
@6734 000000
@6735 000000
@6736 000000
@6737 000332  CVRT OCT 332
@6740 010000   OCT 010000,120000,0,0,0,0,0
@6741 120000
@6742 000000
@6743 000000
@6744 000000
@6745 000000
@6746 000000
@6747 000000   OCT 0
@6750 010000   OCT 010000,120000,0,0,0,0,0
@6751 120000
@6752 000000
@6753 000000
@6754 000000
@6755 000000
@6756 000000
@6757 000000   OCT 0
@6760 010000   OCT 010000,130000,0,0,0,0,0
@6761 130000
@6762 000000
@6763 000000
@6764 000000
@6765 000000
@6766 000000
@6767 000000   OCT 0
@6770 010000   OCT 010000,130000,0,0,0,0,0
@6771 130000
@6772 000000
@6773 000000
@6774 000000
@6775 000000
@6776 000000
@6777 000000   OCT 0
@7000 010000   OCT 010000,140000,0,0,0,0,0
@7001 140000
@7002 000000
@7003 000000
@7004 000000
@7005 000000
@7006 000000
@7007 000000   OCT 0
@7010 020000   OCT 020000,100000,0,0,0,0,0
@7011 100000
@7012 000000
@7013 000000
@7014 000000
@7015 000000
@7016 000000
@7017 000000   OCT 0
@7020 020000   OCT 020000,100000,0,0,0,0,0
@7021 100000
@7022 000000
@7023 000000
@7024 000000
@7025 000000
@7026 000000
@7027 000000   OCT 0
@7030 020000   OCT 020000,110000,0,0,0,0,0
@7031 110000
@7032 000000
@7033 000000
@7034 000000
```

APPENDIX A - Continued

```
@7146 000000
@7147 000000   OCT 0
@7150 030000   OCT 030000,110000,0,0,0,0,0
@7151 110000
@7152 000000
@7153 000000
@7154 000000
@7155 000000
@7156 000000
@7157 000000   OCT 0
@7160 030000   OCT 030000,120000,0,0,0,0,0
@7161 120000
@7162 000000
@7163 000000
@7164 000000
@7165 000000
@7166 000000
@7167 000000   OCT 0
@7170 030000   OCT 030000,120000,0,0,0,0,0
@7171 120000
@7172 000000
@7173 000000
@7174 000000
@7175 000000
@7176 000000
@7177 000000   OCT 0
@7200 030000   OCT 030000,130000,0,0,0,0,0
@7201 130000
@7202 000000
@7203 000000
@7204 000000
@7205 000000
@7206 000000
@7207 000000   OCT 0
@7210 030000   OCT 030000,130000,0,0,0,0,0
@7211 130000
@7212 000000
@7213 000000
@7214 000000
@7215 000000
@7216 000000
@7217 000000   OCT 0
@7220 030000   OCT 030000,140000,0,0,0,0,0
@7221 140000
@7222 000000
@7223 000000
@7224 000000
@7225 000000
@7226 000000
@7227 000000   OCT 0
@7230 040000   OCT 040000,100000,0,0,0,0,0
@7231 100000
@7232 000000
@7233 000000
@7234 000000
@7235 000000
@7236 000000
@7237 000000   OCT 0
@7240 040000   OCT 040000,100000,0,0,0,0,0
@7241 100000
@7242 000000
@7243 000000
@7244 000000
@7245 000000
@7246 000000
@7247 000000   OCT 0
@7250 040000   OCT 040000,110000,0,0,0,0,0
@7251 110000
@7252 000000
@7253 000000
@7254 000000
@7255 000000
@7256 000000
```

APPENDIX A - Continued

```
@7035 000000
@7036 000000
@7037 000000   OCT 0
@7040 020000   OCT 020000,110000,0,0,0,0,0
@7041 110000
@7042 000000
@7043 000000
@7044 000000
@7045 000000
@7046 000000
@7047 000000   OCT 0
@7050 020000   OCT 020000,120000,0,0,0,0,0
@7051 120000
@7052 000000
@7053 000000
@7054 000000
@7055 000000
@7056 000000
@7057 000000   OCT 0
@7060 020000   OCT 020000,120000,0,0,0,0,0
@7061 120000
@7062 000000
@7063 000000
@7064 000000
@7065 000000
@7066 000000
@7067 000000   OCT 0
@7070 020000   OCT 020000,130000,0,0,0,0,0
@7071 130000
@7072 000000
@7073 000000
@7074 000000
@7075 000000
@7076 000000
@7077 000000   OCT 0
@7100 020000   OCT 020000,130000,0,0,0,0,0
@7101 130000
@7102 000000
@7103 000000
@7104 000000
@7105 000000
@7106 000000
@7107 000000   OCT 0
@7110 020000   OCT 020000,140000,0,0,0,0,0
@7111 140000
@7112 000000
@7113 000000
@7114 000000
@7115 000000
@7116 000000
@7117 000000   OCT 0
@7120 030000   OCT 030000,100000,0,0,0,0,0
@7121 100000
@7122 000000
@7123 000000
@7124 000000
@7125 000000
@7126 000000
@7127 000000   OCT 0
@7130 030000   OCT 030000,100000,0,0,0,0,0
@7131 100000
@7132 000000
@7133 000000
@7134 000000
@7135 000000
@7136 000000
@7137 000000   OCT 0
@7140 030000   OCT 030000,110000,0,0,0,0,0
@7141 110000
@7142 000000
@7143 000000
@7144 000000
@7145 000000
```

APPENDIX A - Continued

```
@7257 000000   OCT 0
@7260 040000   OCT 040000,110000,0,0,0,0,0
@7261 110000
@7262 000000
@7263 000000
@7264 000000
@7265 000000
@7266 000000
@7267 000000   OCT 0
@7270 040000   OCT 040000,120000,0,0,0,0,0
@7271 120000
@7272 000000
@7273 000000
@7274 000000
@7275 000000
@7276 000000
@7277 000000   OCT 0
@7300 040000   OCT 040000,120000,0,0,0,0,0
@7301 120000
@7302 000000
@7303 000000
@7304 000000
@7305 000000
@7306 000000
@7307 000000   OCT 0
@7310 040000   OCT 040000,130000,0,0,0,0,0
@7311 130000
@7312 000000
@7313 000000
@7314 000000
@7315 000000
@7316 000000
@7317 000000   OCT 0
@7320 040000   OCT 040000,130000,0,0,0,0,0
@7321 130000
@7322 000000
@7323 000000
@7324 000000
@7325 000000
@7326 000000
@7327 000000   OCT 0
@7330 040000   OCT 040000,140000,0,0,0,0,0
@7331 140000
@7332 000000
@7333 000000
@7334 000000
@7335 000000
@7336 000000
@7337 000000   OCT 0
@7340 010000   OCT 010000,100000,0,0,0,0,0
@7341 100000
@7342 000000
@7343 000000
@7344 000000
@7345 000000
@7346 000000
@7347 000000   OCT 0
@7350 010000   OCT 010000,100000,0,0,0,0,0
@7351 100000
@7352 000000
@7353 000000
@7354 000000
@7355 000000
@7356 000000
@7357 000000   OCT 0
@7360 010000   OCT 010000,110000,0,0,0,0,0
@7361 110000
@7362 000000
@7363 000000
@7364 000000
@7365 000000
@7366 000000
@7367 000000   OCT 0
```

APPENDIX A - Continued

```
@7370 010000   OCT 010000,040000,0,0,0,0,0
@7371 040000
@7372 000000
@7373 000000
@7374 000000
@7375 000000
@7376 000000
@7377 000000   OCT 0
@7400 010000   OCT 010000,050000,0,0,0,0,0
@7401 050000
@7402 000000
@7403 000000
@7404 000000
@7405 000000
@7406 000000
@7407 000000   OCT 0
@7410 010000   OCT 010000,050000,0,0,0,0,0
@7411 050000
@7412 000000
@7413 000000
@7414 000000
@7415 000000
@7416 000000
@7417 000000   OCT 0
@7420 010000   OCT 010000,060000,0,0,0,0,0
@7421 060000
@7422 000000
@7423 000000
@7424 000000
@7425 000000
@7426 000000
@7427 000000   OCT 0
@7430 010000   OCT 010000,060000,0,0,0,0,0
@7431 060000
@7432 000000
@7433 000000
@7434 000000
@7435 000000
@7436 000000
@7437 000000   OCT 0
@7440 020000   OCT 020000,040000,0,0,0,0,0
@7441 040000
@7442 000000
@7443 000000
@7444 000000
@7445 000000
@7446 000000
@7447 000000   OCT 0
@7450 020000   OCT 020000,050000,0,0,0,0,0
@7451 050000
@7452 000000
@7453 000000
@7454 000000
@7455 000000
@7456 000000
@7457 000000   OCT 0
@7460 020000   OCT 020000,050000,0,0,0,0,0
@7461 050000
@7462 000000
@7463 000000
@7464 000000
@7465 000000
@7466 000000
@7467 000000   OCT 0
@7470 020000   OCT 020000,060000,0,0,0,0,0
@7471 060000
@7472 000000
@7473 000000
@7474 000000
@7475 000000
@7476 000000
@7477 000000   OCT 0
```

APPENDIX A - Continued

```
@7500 020000   OCT 020000,060000,0,0,0,0,0
@7501 060000
@7502 000000
@7503 000000
@7504 000000
@7505 000000
@7506 000000
@7507 000000   OCT 0
@7510 020000   OCT 020000,070000,0,0,0,0,0
@7511 070000
@7512 000000
@7513 000000
@7514 000000
@7515 000000
@7516 000000
@7517 000000   OCT 0
@7520 020000   OCT 020000,070000,0,0,0,0,0
@7521 070000
@7522 000000
@7523 000000
@7524 000000
@7525 000000
@7526 000000
@7527 000000   OCT 0
@7530 030000   OCT 030000,070000,0,0,0,0,0
@7531 070000
@7532 000000
@7533 000000
@7534 000000
@7535 000000
@7536 000000
@7537 000000   OCT 0
@7540 030000   OCT 030000,070000,0,0,0,0,0
@7541 070000
@7542 000000
@7543 000000
@7544 000000
@7545 000000
@7546 000000
@7547 000000   OCT 0
@7550 010000   OCT 010000,070000,0,0,0,0,0
@7551 070000
@7552 000000
@7553 000000
@7554 000000
@7555 000000
@7556 000000
@7557 000000   OCT 0
@7560 040000   OCT 040000,070000,0,0,0,0,0
@7561 070000
@7562 000000
@7563 000000
@7564 000000
@7565 000000
@7566 000000
@7567 000000   OCT 0
@7570 010000   OCT 010000,070000,0,0,0,0,0
@7571 070000
@7572 000000
@7573 000000
@7574 000000
@7575 000000
@7576 000000
@7577 000000   OCT 0
@7600 010000   OCT 010000,070000,0,0,0,0,0
@7601 070000
@7602 000000
@7603 000000
@7604 000000
@7605 000000
@7606 000000
@7607 000000   OCT 0
@7610 010000   OCT 010000,010000,0,0,0,0,0
```

APPENDIX A - Continued

```
@7611 010000
@7612 000000
@7613 000000
@7614 000000
@7615 000000
@7616 000000
@7617 000000    OCT 0
@7620 010000    OCT 010000,010000,0,0,0,0,0
@7621 010000
@7622 000000
@7623 000000
@7624 000000
@7625 000000
@7626 000000
@7627 000000    OCT 0
@7630 010000    OCT 010000,020000,0,0,0,0,0
@7631 020000
@7632 000000
@7633 000000
@7634 000000
@7635 000000
@7636 000000
@7637 000000    OCT 0
@7640 010000    OCT 010000,020000,0,0,0,0,0
@7641 020000
@7642 000000
@7643 000000
@7644 000000
@7645 000000
@7646 000000
@7647 000000    OCT 0
@7650 020000    OCT 020000,020000,0,0,0,0,0
@7651 020000
@7652 000000
@7653 000000
@7654 000000
@7655 000000
@7656 000000
@7657 000000    OCT 0
@7660 020000    OCT 020000,020000,0,0,0,0,0
@7661 020000
@7662 000000
@7663 000000
@7664 000000
@7665 000000
@7666 000000
@7667 000000    OCT 0
@7670 020000    OCT 020000,030000,0,0,0,0,0
@7671 030000
@7672 000000
@7673 000000
@7674 000000
@7675 000000
@7676 000000
@7677 000000    OCT 0
@7700 020000    OCT 020000,030000,0,0,0,0,0
@7701 030000
@7702 000000
@7703 000000
@7704 000000
@7705 000000
@7706 000000
@7707 000000    OCT
@7710 020000    OCT 020000,010000,0,0,0,0,0
@7711 010000
@7712 000000
@7713 000000
@7714 000000
@7715 000000
@7716 000000
@7717 000000    OCT 0
@7720 020000    OCT 020000,010000,0,0,0,0,0
@7721 010000
```

APPENDIX A - Continued

```
@7722 000000
@7723 000000
@7724 000000
@7725 000000
@7726 000000
@7727 000000   OCT 0
@7730 020000   OCT 020000,040000,0,0,0,0,0
@7731 040000
@7732 000000
@7733 000000
@7734 000000
@7735 000000
@7736 000000
@7737 000000   OCT 0
@7740 030000   OCT 030000,030000,0,0,0,0,0
@7741 030000
@7742 000000
@7743 000000
@7744 000000
@7745 000000
@7746 000000
@7747 000000   OCT 0
@7750 030000   OCT 030000,030000,0,0,0,0,0
@7751 030000
@7752 000000
@7753 000000
@7754 000000
@7755 000000
@7756 000000
@7757 000000   OCT 0
@7760 030000   OCT 030000,040000,0,0,0,0,0
@7761 040000
@7762 000000
@7763 000000
@7764 000000
@7765 000000
@7766 000000
@7767 000000   OCT 0
SRT SYN BOC,5
DEL SYN BOE,5
SSCK SYN BOC,2
STP SYN BOC,4
PSH SYN BOD,5
FSA SYN BOD,4
FSB SYN BOD,3
FSC SYN BOD,2
FSD SYN BOD,1
INA SYN BOD,0
SEL SYN BOC,0
RSET SYN BOC,3
MOD SYN INPF,5
VDC SYN INPF,4
FSE SYN INPC,3
FSF SYN INPC,2
FSG SYN INPC,1
FSH SYN INPC,0
INB SYN BOG,5
INE SYN BOG,4
IND SYN BOG,3
MOA SYN INPE,2
MOB SYN INPE,1
MOC SYN INPE,0
RTM SYN INPM,3
WBM SYN INPJ,2
ERA SYN INPM,1
MOV SYN INPJ,0
STPF SYN BOJ,0
INHB SYN BOJ,1
SEQFL SYN BOJ,2
PSHF SYN BOJ,3
TFA SYN BOJ,4
NOSRT SYN BOJ,5
SQCK SYN INPN,5
```

APPENDIX A - Continued

```
CONN SYN INPN,4
DCON SYN INPN,3
MOLFA SYN FLH,3
DRST SYN FLH,2
ONF SYN FLH,1
VAC SYN FLH,0
NBMLF SYN LFLG,0
ETLF SYN LFLG,1
MOLF SYN LFLG,2
NBSLF SYN LFLG,3
INOPS SYN LFLG,4
INOPT SYN LFLG,5
INOP SYN FLD,0
INOPD SYN FLD,1
CONFA SYN FLD,2
CONF SYN FLD,3
NOPT SYN FLD,4
SPLIT SYN FLD,5
PEFL SYN FLG,0
W SYN 7777
A SYN 7776
B SYN 7775
C SYN 7774
D SYN 7773
E SYN 7772
F SYN 7771
ALU SYN 07
RDO SYN 100
INC SYN 102
A.W SYN 104
SLO SYN 117
A%W SYN 120
LDA SYN 124
ADN SYN 133
LDC SYN 150
SBN SYN 146
RDC SYN 174
DEC SYN 177
SRO SYN 300
COM SYN 046
HLT SYN 00
A%WN SYN 140
DI50 SYN 50
DI51 SYN 51
DI52 SYN 52
DO60 SYN 60
DO61 SYN 61
DO62 SYN 62
DO63 SYN 63
DO64 SYN 64
DO65 SYN 65
ETRSRT SYN INPR,0
ETWSRT SYN INPP,0
ETS SYN BOA,0
ETREXF SYN INPR,1
ETWEXF SYN INPP,1
ETF SYN BOA,1
NBMRSRT SYN INPR,2
NBMWSRT SYN INPP,2
NBMS SYN BOA,2
NBMREXF SYN INPR,3
NBMWEXF SYN INPP,3
NBMF SYN BOA,3
ALARM SYN BOA,5
ENRSRT SYN INPS,1
ENWSRT SYN INPQ,1
ENS SYN BOB,1
ENREXF SYN INPS,2
ENWEXF SYN INPQ,2
ENF SYN BOB,2
DLCK SYN BOE,3
SEQ SYN BOC,1
SLCK SYN BOE,4
```

APPENDIX A - Continued

```
                WBF SYN FLG,1
                HCF SYN FLG,2
                NOP SYN FLG,3
                ERF SYN FLG,4
                ZERO SYN NUMB,0
                ONE SYN NUMB,1
                TWO SYN NUMB,2
                THREE SYN NUMB,3
                FOUR SYN NUMB,4
                FIVE SYN NUMB,5
                SEVEN SYN NUMC,1
                FLASHF SYN BOA,4
                MOVF SYN NUMC,4
@0020 022664     END PWRUP

000  ERRORS
```

I claim:

1. A digital sootblower control system comprising:

controller means for receiving information inputs representative of sootblowers to be activated and sootblower operational status, said controller means operating according to a fixed program to process information inputs supplied thereto and issue coded start commands, when appropriate, to selected sootblowers within the system;

sootblower control means for decoding start commands issued by said controller means and initiating operation of selected sootblowers in response thereto, said sootblower control means additionally acting to receive information representative of the operating status of each sootblower within the system;

display means for receiving information representative of the operating status of each sootblower in the system from said sootblower control means as well as sootblower and system operational status information, and for providing a visual display thereof;

multi-conductor bus means interconnecting said controller means, said sootblower control means and said display means in an operational configuration; and information input means interconnected to said controller means for designating sootblowers to be activated and certain sootblower operational status conditions, said information input means supplying information inputs representative of sootblowers to be activated and said certain sootblower operational status to said controller means.

2. The digital sootblower control system according to claim 1 additionally comprising:

signal means for receiving inputs representing a plurality of sensed sootblower and system operational status conditions and for providing a plurality of outputs representative thereof;

conductor means for supplying each of said plurality of outputs to said controller means as informational inputs; and signal conveying means for supplying selected ones of said plurality of outputs to said display means as operational status information to be displayed.

3. The digital sootblower control system according to claim 1 additionally comprising scanner means for sequentially generating sootblower addresses, said scanner means being connected to said multi-conductor bus means and applying, when enabled, each of the addresses generated thereby to said sootblower control means and said display means; said sootblower control means being responsive to each address generated by said scanner means to decode said address and when properly enabled to supply stored information representing the operating status of an addressed sootblower to said display means through said multi-conductor bus means for display purposes.

4. The digital sootblower control system according to claim 3 wherein said display means is responsive, when enabled, to the receipt of a sootblower address and information representing the operating status of an addressed sootblower to decode said address and store said operating status of said addressed sootblower for display purposes.

5. The digital sootblower control system according to claim 2 additionally comprising scanner means for sequentially generating sootblower addresses, said scanner means being connected to said multi-conductor bus means and applying, when enabled, each of the addresses generated thereby to said sootblower control means and said display means; said sootblower control means being responsive to each address generated by said scanner means to decode said address and when properly enabled to supply stored information representing the operating status of an addressed sootblower to said display means through said multi-conductor bus means for display purposes.

6. The digital sootblower control system according to claim 1 wherein said information input means includes:

program selection information input means for defining sootblower activation program information to be processed and stored in said controller means;

sootblower operation selection information input means for defining sootblowers to be activated in terms of any sootblower in the system and in terms of stored program information; and means for receiving selection information from said program selection information input means and said sootblower operation selection information input means and for selectively applying said information to said controller means.

7. The digital sootblower control system according to claim 6 wherein said program selection information input means comprises:

means for defining a plurality of programs, each program defined to include a plurality of sootblowers to be activated in a predetermined manner;

means for defining individual sootblowers within said system for operation in a given program; and insertion means responsive to operator activation, a program defined by said means for defining a plurality of programs and a sootblower defined by said means for defining individual sootblowers for supplying a request to said controller means to store program information which includes said defined sootblower in said defined program.

8. The digital sootblower control system according to claim 7 wherein said program selection information input means additionally comprises removal means responsive to operator activation, a program defined by said means for defining a plurality of programs and a sootblower defined by said means for defining individual sootblowers for supplying a request to said controller means to remove said defined sootblower from program information stored for said defined program.

9. The digital sootblower control system according to claim 7 wherein said controller means acting in response to said fixed program is responsive to a supplied request from said insertion means to test the propriety of said request to store said program information which includes said defined sootblower in said defined program and stores said program information if the definition information supplied therewith is appropriate.

10. The digital sootblower control system according to claim 9 wherein said program selection information input means includes means for indicating acceptance and error associated with a store program request supplied by said insertion means and said controller means acting in response to said fixed program provides signal information to selectively enable said means for indicating acceptance and error as a function of said test of said propriety of said request to store said program information.

11. The digital sootblower control system according to claim 9 wherein said program selection information input means additionally comprises:

means for defining a plurality of program sequences, each sequence defined to include at least one sootblower to be activated and each program capable of including a plurality of sequences;

said insertion means additionally responsive to program sequence information to cause said sequence information to be supplied to said controller means in association with said request to store program information and said controller means acting under said fixed program being responsive to a supplied request to store program information which includes sequence information to test the propriety of said request to store said program information which includes a defined sootblower, in a defined sequence in a defined program and store said program information if the definition information supplied therewith is appropriate.

12. The digital sootblower, control system according to claim 11 wherein said controller means in response to said fixed program tests the propriety of said request to store program information defining a given sootblower, in a given sequence of a given program by ascertaining the number of sootblowers already stored for said given sequence of said given program to ensure that an addition of a further sootblower to that program sequence will not exceed a predetermined limit.

13. The digital sootblower control system according to claim 11 wherein said controller means in response to said fixed program tests the propriety of said request to store program information defining a given sootblower, in a given sequence, of a given program by comparing header supply information associated with said defined given sootblower with header supply information for sootblowers already stored in said given program sequence to ensure that an addition of a further sootblower to a common header supply will not exceed a predetermined limit.

14. The digital sootblower control system according to claim 11 wherein said program selection information input means additionally comprises means for defining a sequence check mode of operation, said fixed program being responsive to an actuation of said means for defining a sequence check mode of operation to search stored program information for all sootblowers assigned to a defined sequence of a defined program and to initiate a display of sootblower information for all sootblowers located thereby at said display means.

15. The digital sootblower control system according to claim 6 wherein said sootblower operation selection information input means for defining sootblowers to be activated in terms of any sootblowers in the system and in terms of stored program information comprises:

means for accessing a plurality of sootblower programs which may be stored in said controller means, each of said plurality of programs capable of defining the activation of a plurality of sootblowers, said means for accessing generating a unique code for each of said plurality of sootblower programs upon the activation thereof; and means for initiating a program start operation, said means for initiating generating a unique code representative thereof upon activation, said controller means acting according to said fixed program being responsive to a receipt of unique codes generated by said means for accessing and said means for initiating a program start operation to store said unique codes until current sootblower operations have terminated and thereafter initiating sootblower operations in accordance with the first sootblower program defined by said means for accessing.

16. The digital sootblower control system according to claim 15 wherein several unique codes each of which represents a different one of said plurality of sootblower programs may be generated in sequence at said means for accessing and upon activation of said means for initiating and the termination of previously initiated sootblower operations, said controller means acting according to said fixed program will initiate sootblower operations according to each sootblower program defined in an order corresponding to that received.

17. The digital sootblower control system according to claim 16 wherein each of said plurality of programs may include a plurality of program sequences and each sequence is capable of defining the activation of a plurality of sootblowers, each unique code generated by said means for accessing defining an entire one of said plurality of programs to said controller means acting in response to said fixed program including all sequences of programmed sootblower operation therein.

18. The digital sootblower control system according to claim 16 wherein said sootblower operation selection information input means additionally comprises:

program in progress display indicia for displaying an indication of any one of said plurality of sootblower programs then in progress; and means responsive to instructions issued by said controller means for causing said program in progress display indicia to indicate which sootblower program is currently in progress upon initiation thereof by said controller means acting pursuant to said fixed program and to continue until said program is completed, said instructions issued by said controller means occurring in response to actions by said fixed program.

19. The digital sootblower control system according to claim 16 wherein said sootblower operation selection information input means additionally comprises means for stopping a sootblower program in progress upon the completion of a cycle of operation of sootblowers which are currently operating.

20. The digital sootblower control system according to claim 16 wherein said sootblower operation selection information input means additionally comprises means for resetting processing operations within said controller means as well as resetting sootblower programs in process upon the completion of a cycle of operation of sootblowers which are currently operating.

21. The digital sootblower control system according to claim 16 wherein said sootblower operation selection information input means additionally comprises means for causing a retraction of certain types of sootblowers while the same are operating, said last named means being selectively operable.

22. The digital sootblower control system according to claim 17 wherein said sootblower operation selection information input means additionally comprises means for defining a step check mode of operation, said controller means acting pursuant to said fixed program being responsive to an actuation of said means for defining a step check mode of operation and a unique code defining one of said plurality of sootblower programs as entered by said means for accessing to search stored sootblower programs in said controller means and initiate, in a stepwise manner, a display at said display means of all sootblowers in each sequence of said one program defined.

23. The digital sootblower control system according to claim 17 wherein said sootblower operation selection information input means additionally comprises means for defining an enable check mode of operation, said controller means acting pursuant to said fixed program being responsive to an actuation of said means for defining an enable check mode of operation and a unique code defining one of said plurality of sootblower programs as entered by said means for accessing to search stored sootblower programs in said controller means and initiate a display at said display means of all sootblowers within the program defined which are in an enabled condition.

24. The digital sootblower control system according to claim 6 wherein said sootblower operation selection information input means for defining sootblowers to be activated in terms of any sootblowers in the system and in terms of stored program information additionally comprises means for defining individual sootblowers within said system, said means for defining sootblowers being selectively operable and when operated acting to generate a code uniquely defining a sootblower selected.

25. The digital sootblower control system according to claim 24 wherein said means for defining individual sootblowers takes the form of operator actuatable thumbwheels capable of displaying identification for the sootblower selected and generating a code defining the selection made.

26. The digital sootblower control system according to claim 24 wherein said sootblower operation selection information input means for defining sootblowers to be activated in terms of any sootblower in the system and in terms of stored program information additionally comprises:

means for defining a manual start operation, said means for defining a manual start operation being selectively operable and active, when properly enabled, to initiate the operation of any sootblower specified at said means for defining individual sootblowers within said system; and said fixed program within said controller means acting to enable said means for defining a manual start operation only when no sootblowers within the system are operating and responsive to the selective operation of said means for defining a manual start operation when the same has been enabled and to said means for defining sootblowers to initiate the operation of the sootblower defined.

27. The digital sootblower control system according to claim 24 wherein said sootblower operation selection information input means for defining sootblowers to be activated in terms of any sootblower in the system and in terms of stored program information additionally comprises:

means for defining a disable condition for individual sootblowers wherein any sootblower having a disable condition specified therefor is precluded from operation; and said controller means acting in accordance with said fixed program being responsive to an actuation of said means for defining a disable condition and to a sootblower defined by said means for defining sootblowers to enter a disable condition in a data field assigned to said defined sootblower, said disable condition being detectable by said controller means prior to any activation routine for said defined sootblower and precluding the operation thereof.

28. The digital sootblower control system according to claim 27 wherein said sootblower operation selection information input means for defining sootblowers to be activated in terms of any sootblower in the system and in terms of stored program information additionally comprises:

means for defining an enable condition for individual sootblowers wherein any sootblower which had been previously disabled through an actuation of said means for defining a disabled condition may be returned to an operative state for activation in stored programs;

said controller means acting according to said fixed program being responsive to an actuation of said means for defining an enable condition and to a sootblower defined by said means for defining sootblowers to enter an enable condition in a data field assigned to said defined sootblower to thereby effectively delete any disabled condition which may have been entered therefor.

29. The digital sootblower control system according to claim 27 wherein said sootblower operation selection information input means additionally comprises means for defining a disable check mode of operation, said controller means acting in accordance with said fixed program being responsive to an actuation of said means for defining a disable check mode of operation to initiate a search of data fields stored for each sootblower in said controller means and initiate a display at said display means of all sootblowers which have a disable condition entered in the data field thereof.

30. The digital sootblower control system according to claim 28 wherein said sootblower operation selection information input means additionally comprises means for defining an enable check mode of operation, said controller means acting pursuant to said fixed program being responsive to activation of said means for defining an enable check mode of operation to initiate a search of data fields stored for each sootblower in said controller means and to initiate a display at said display means of all sootblowers which have an enable condition entered in the data field thereof.

31. The digital sootblower control system according to claim 6 wherein said sootblower operation selection information input means for defining sootblowers to be activated in terms of any sootblowers in the system and in terms of stored program information additionally comprises:

first sootblower operation selection input means for defining first types of sootblowers to be activated in terms of any sootblower of said first type in the system and in terms of stored program information associated with sootblowers of said first type; and second sootblower operation selection input means for defining second types of sootblowers to be activated in terms of any sootblower of said second type in the system and in terms of stored program information associated with sootblowers of said second type.

32. The digital sootblower control system according to claim 31 wherein said first types of sootblowers include retractable units and said second types of sootblowers include wallblower units.

33. The digital sootblower control system according to claim 31 wherein each of said first and second sootblower operation selection input means comprises:

means for accessing a plurality of sootblower programs which may be stored in said controller means, each of said plurality of programs capable of defining the activation of a plurality of sootblowers, said means for accessing generating a unique code for each of said plurality of sootblower programs upon the activation thereof; and means for initiating a program start operation, said means for initiating generating a unique code representative thereof upon activation, said controller means acting pursuant to said fixed program being responsive to a receipt of said unique code generated by said means for accessing and said means for initiating a program start operation to store said unique codes until current sootblower operations have terminated and thereafter initiating sootblower operations in accordance with the first sootblower program defined by said means for accessing.

34. The digital sootblower control system according to claim 33 wherein each of said first and second sootblower operation selection input means comprise means for defining individual sootblowers within said system, said means for defining sootblowers being selectively operable and when operated acting to generate a code uniquely defining a sootblower selected.

35. The digital sootblower control system according to claim 34 wherein each of said first and second sootblower operation selection input means comprise:

means for defining a manual start operation, said means for defining a manual start operation being selectively operable and active, when properly enabled, to initiate the operation of any sootblower specified at said means for defining individual sootblowers within said system; and said controller means acting according to said fixed program to enable said means for defining a manual start operation only when no sootblowers within the system are operating and responsive to the selective operation of said means for defining a manual start operation when the same has been enabled and to said means for defining sootblowers to initiate the operation of the sootblower defined.

36. The digital sootblower control system according to claim 34 wherein each of said first and second sootblower operation selection input means comprise:

means for defining a disable condition for individual sootblowers wherein any sootblower having a disabled condition specified therefor is precluded from operation; and said controller means acting pursuant to said fixed program being responsive to an actuation of said means for defining a disable condition and to a sootblower defined by said means for defining sootblowers to enter a disable condition in a data field assigned to said defined sootblower, said disable condition being detectable by controller means in accordance with said fixed program prior to any activation routine for said defined sootblower and precluding the operation thereof.

37. The digital sootblower control system according to claim 36 wherein each of said first and second sootblower operation selection input means comprises means for defining a disable check mode of operation, said controller means in accordance with said fixed program being responsive to an actuation of said means for defining a disable check mode of operation to initiate a search of data fields stored for each sootblower in said controller means and to initiate a display at said display means of all sootblowers which have a disable condition entered in the data field thereof.

38. The digital sootblower control system according to claim 34 wherein several unique codes each of which represets a different one of said plurality of sootblower programs may be generated in sequence at said means for accessing at each of said first and second sootblower operation selection input means and upon actuation of said means for initiating and the termination of previously initiated sootblower operations, said controller means acting in accordance with said fixed program initiating sootblower operations according to each sootblower program defined in an order corresponding to that received.

39. The digital sootblower control system according to claim 6 wherein said means for receiving selection information from said program selection information input means and said sootblower operation selection information input means and for selectively applying said information to said controller means comprises:

a plurality of gating arrays for receiving individual inputs corresponding to differing ones of said selection information from said program selection information input means and said sootblower operation selection information input means, at least selected ones of said plurality of operating arrays being connected to receive inputs from corresponding ones of each of said program selection information input means and said sootblower operation selection information input means and each of said plurality of gating arrays having a plurality of inputs for receiving selection information;

means for selectively enabling each of said plurality of gating arrays to cause inputs applied thereto to be conveyed to said controller means; and means, connected to said controller means, for applying gating signals to said means for selectively enabling each of said plurality of gating arrays to cause selected inputs to an enabled gating array to be conveyed to said controller means.

40. The digital sootblower control system according to claim 39 wherein said at least one of said plurality of gating arrays connected to receive inputs from said sootblower operation selection information input means includes a plurality of inputs which are permanently enabled to receive information to be processed on a priority basis.

41. The digital sootblower control system according to claim 39 wherein said means for selectively enabling each of a plurality of gating arrays includes decoder means for receiving an encoded command from said controller means and supplying an enable level decoded therefrom to a selected one of said plurality of gating arrays to be enabled.

42. The digital sootblower control system according to claim 39 additionally comprising scanner means for sequentially generating sootblower addresses, said scanner means being connected to said multi-conductor bus means and applying, when enabled, each of the addresses generated thereby to said sootblower control means and said display means; said sootblower control means being responsive to each address generated by said scanner means to decode said address and when properly enabled to supply stored information representing the operating status of an addressed sootblower to said display means through said multi-conductor bus means for display purposes.

43. The digital sootblower control system according to claim 42 wherein selected ones of the inputs applied to each of said plurality of gating arrays are additionally applied to said scanner means upon an enabling of that gating array.

44. The digital sootblower control system according to claim 43 wherein said means for selectively enabling each of a plurality of gating arrays includes decoder means present within said scanner means for receiving an encoded command from said controller means and supplying an enable level decoded thereform to a selected one of said plurality of gating arrays to be enabled.

45. The digital sootblower control system according to claim 44 additionally comprising:

means for defining a mode of operation wherein said controller means is to be bypassed;

means at said scanner means for receiving sootblower address information from said sootblower operation selection information input means; and means at said scanner means responsive to a bypass mode of operation and received sootblower address information to apply said address information through said multi-conductor bus means to said sootblower control means to initiate operation of a sootblower whose address is received.

46. The digital sootblower control system according to claim 3 wherein said scanner means includes address counter means for sequentially generating sootblower addresses, said counter means being incremented each time a previous address generated thereby is applied to said display means to generate the next sootblower address in sequence.

47. The digital sootblower control system according to claim 46 wherein said scanner means additionally comprises means for receiving the count produced by said counter means and adding thereto a constant to form a resulting sootblower address, said constant having a value corresponding to the difference between the maximum state of the count in said counter means and the total number of sootblowers to be addressed.

48. The digital sootblower control system according to claim 46 wherein said scanner means additionally comprises means responsive to said controller means for inhibiting the application of sootblower addresses generated by said counter means to said multi-conductor bus means.

49. The digital sootblower control system according to claim 46 wherein said scanner means additionally comprises means responsive to selected inputs generated at said information input means for inhibiting the application of sootblower addresses generated by said counter means to said multi-conductor bus means.

50. The digital sootblower control system according to claim 46 additionally comprising:

means for defining a mode of operation wherein said controller means is to be bypassed;

means at said scanner means for receiving sootblower address information from said information input means; and means at said scanner means responsive to a bypass mode of operation and received sootblower address information to apply said address information through said multi-conductor bus means to said sootblower control means to initiate operation of a sootblower whose address is received.

51. The digital sootblower control system according to claim 1 wherein said display means comprises:

visual display means having a plurality of indicia thereon, said plurality of indicia including at least a separately energizable indicia for each sootblower in the system to be controlled and a group of indicia defining system operation status; and driver array means including a plurality of individual driver circuits, each of said plurality of driver circuits being connected at an output thereof to an associated one of said separately energizable indicia for each sootblower in the system to be controlled and settable at an input thereto to first and second conditions corresponding to the energized and de-energized condition of said separately energizable indicia connected thereto.

52. The digital sootblower control system according to claim 51 additionally comprising gating means for selectively applying the outputs of each of a plurality of driver circuits to its associated energizable indicia at said visual display means.

53. The digital sootblower control system according to claim 51 additionally comprising:

means for uniquely addressing each of said plurality of individual driver circuits, said addressing means being responsive to sootblower addresses on said multi-conductor bus means to uniquely address an individual driver circuit corresponding to an addressed sootblower and condition said addressed driver circuit to be set to one of said first and second conditions; and means for applying a signal corresponding to one of said first and second conditions to each of said plurality of driver circuits to cause a driver circuit which has been uniquely addressed to be set to said one of said first and second conditions to determine the state of the output thereof, said signal corresponding to said one of said first and second conditions being received from said multi-conductor bus means.

54. The digital sootblower control system according to claim 53 wherein said signal corresponding to said one of said first and second conditions is applied to said multi-conductor bus means by said controller means.

55. The digital sootblower control system according to claim 53 wherein said signal corresponding to said one of said first and second conditions is applied to said multi-conductor bus means by said sootblower control means in response to said sootblower addresses on said multi-conductor bus as also applied to said sootblower control means, said one of said first and second conditions thereby being indicative of a defined state for said addressed sootblower.

56. The digital sootblower control system according to claim 55 wherein said sootblower control means is responsive to said sootblower addresses on said multi-conductor bus to apply a signal corresponding to said one of said first and second conditions in response to said operating status of the sootblower addressed.

57. The digital sootblower control system according to claim 55 wherein said sootblower control means is responsive to said sootblower address on said multi-conductor bus to apply a signal corresponding to said one of said first and second conditions in response to a condition established by said controller means in said sootblower control means for the sootblower addressed.

58. The digital sootblower control system according to claim 53 additionally comprising scanner means for sequentially generating sootblower addresses, said scanner means being connected to said multi-conductor bus means and applying, when enabled, each of the addresses generated thereby to said sootblower control means and said display means; said sootblower control means being responsive to each address generated by said scanner means to decode said address and when properly enabled to supply stored information respresenting the operating status of an addressed sootblower to said display means through said multi-conductor bus means for display purposes.

59. The digital sootblower control system according to claim 51 additionally comprising:

a signal means for receiving inputs representing a plurality of sensed sootblower and system operational status conditions and for providing a plurality of outputs representative thereof;

conductor means for supplying each of said plurality of outputs to said controller means as informational inputs; and signal conveying means for supplying selected ones of said plurality of outputs to said display means as system operational status information to be displayed by said group of indicia.

60. The digital sootblower control system according to claim 51 additionally comprising means connected to said controller means and selected ones of said group of indicia defining system operational status for supplying energizing signals representative of system operational status conditions from said controller means to said selected ones of said group of indicia.

61. The digital sootblower control system according to claim 59 wherein the display of system operational status information associated with a malfunction is accompanied, when appropriate, with a flashing of the sootblower indicia within said plurality of indicia which is associated with said malfunction, said controller means acting in accordance with said fixed program initiating said flashing of the sootblower indicia, when appropriate, upon a detection of the condition of malfunction.

62. The digital sootblower control system according to claim 59 additionally comprising means connected to said controller means and other selected ones of said group of indicia defining system operational status for supplying energizing signals representative of system operational status conditions from said controller means to said other selected ones of said group of indicia.

63. The digital sootblower control system according to claim 1 wherein said sootblower control means comprises:

a plurality of write drive circuit means for starting a plurality of individually energizable sootblowers within the system, each of said plurality of write drive circuit means being connected at an output thereof to an associated one of said individually energizable sootblowers within the system to be controlled and settable at an input thereto to first and second conditions corresponding to the energized and de-energized conditions of the sootblower connected thereto;

a plurality of read circuit means for receiving information representative of the operating status of each sootblower within the system, each of said plurality of read circuit means being connected at an input thereof to an associated one of said sootblowers within the system and to receive therefrom the operational status thereof; and decoder means connected to said multi-conductor bus means, said plurality of write drive circuit means and said plurality of read circuit means, said decoder means receiving sootblower address information and command information from said multi-conductor bus means, said decoder means being responsive to said sootblower address information to develop information for defining one of said plurality of write drive circuit means and one of said plurality of read circuit means connected to the sootblower being addressed and said decoder means being further responsive to said command information to enable the one of said write drive circuit means and read circuit means defined in response to said address information.

64. The digital sootblower control system according to claim 63 wherein said plurality of write drive circuit means and said plurality of read circuit means are arranged in groups and each group is provided with a group decoder, each group decoder being connected in cascade to said multi-conductor bus means and each group decoder including group selection means for decoding sootblower address information as a function of the order of connection of that group decoder to said multi-conductor bus means.

65. The digital sootblower control system according to claim 64 wherein said group selection means for decoding sootblower address information takes the same form within each group decoder, and provides selection input information to a succeeding group decoder in said cascade arrangement, said initial group decoder in said cascade arrangement acting to decode all bits of a sootblower address applied thereto on said multi-conductor bus while subsequently connected group decoders in said cascade arrangement act to decode certain common bits within said sootblower address and selection input information from a preceeding group decoder in said cascade arrangement.

66. The digital sootblower control system according to claim 65 wherein said group selection means within each group decoder includes an increment-by-one circuit means for the generation of said selection input information.

67. The digital sootblower control system according to claim 63 wherein said decoder means is further responsive to command information from said multi-conductor bus means to generate a reset signal for resetting each of said plurality of write drive circuit means connected thereto to one of said first and second conditions.

68. The digital sootblower control system according to claim 63 wherein said plurality of write drive circuit means includes first gating means for selectively gating the outputs of all of said plurality of write drive circuit means to associated ones of said plurality of individually energizable sootblowers connected thereto and second gating means for selectively gating the outputs of individual ones of said plurality of write drive circuit means to said multi-conductor bus means.

69. The digital sootblower control system according to claim 68 wherein said first gating means includes means for translating the outputs of each of said plurality of write drive circuit means which are set to a first condition to an a.c. energizing level for energizing associated ones of said individually energizable sootblowers which are connected thereto.

70. The digital sootblower control system according to claim 63 additionally comprising means for applying a signal corresponding to one of said first and second conditions to said inputs of each of said plurality of write drive circuit means to set an individual write drive circuit means defined and enabled by said decoder means to said one of said first and second conditions.

71. The digital sootblower control system according to claim 70 wherein each of said plurality of write drive circuit means includes latch means set to said one of said first and second conditions in response to said application of said signal and a defining and enabling by said decoder means.

72. The digital sootblower control system according to claim 71 wherein said plurality of write drive circuit means includes first gating means for selectively gating the outputs of said latch means of all of said plurality of write drive circuit means to associated ones of said plurality of individually energizable sootblowers connected thereto and second gating means for selectively gating the outputs of latch means of individual ones of said plurality of write drive circuit means to said multi-conductor bus means.

73. The digital sootblower control system according to claim 72 wherein said controller means acts according to said fixed program to perform certain status checks by setting said latch means within said plurality of drive circuit means to appropriate first and second conditions and thereafter selectively gating outputs of said latch means through said second gating means to said multi-conductor bus means for application to said display means.

74. The digital sootblower control system according to claim 63 wherein all of said plurality of read circuit means are connected to said multi-conductor bus means through gate means, said gate means being responsive to said decoder means to apply operational status information from a defined and enabled one of said plurality of read circuit means to said multi-conductor bus means for application to said display means.

75. The digital sootblower control system according to claim 63 wherein said sootblowers produce an a.c. output indicative of an operating status and each of said plurality of read circuit means include means for translating said a.c. output into a digital level.

76. The digital sootblower control system according to claim 74 additionally comprising scanner means for sequentially generating sootblower addresses, said scanner means being connected to said multi-conductor bus means and applying, when enabled, each of the addresses generated thereby to said sootblower control means and said display means; said sootblower control means being responsive to each address generated by said scanner means to decode said address and when properly enabled to supply stored information representing the operating status of an addressed sootblower to said display means through said multi-conductor bus means for display purposes.

77. The digital sootblower control system according to claim 68 wherein all of said plurality of read circuit means are connected to said multi-conductor bus means through gate means, said gate means being responsive to said decoder means to apply operational status information from a defined and enabled one of said plurality of read circuit means to said multi-conductor bus means for application to said display means.

78. The digital sootblower control system according to claim 2 wherein said inputs received by said signal means representing a plurality of sensed sootblower and system operational status conditions take the form of field monitored a.c. outputs representative of the conditions to be sensed, said signal means including means for translating said a.c. outputs into digital levels for application to said conductor means and said signal conveying means.

79. The digital sootblower control system according to claim 2 wherein said signal means for receiving inputs representing a plurality of sensed sootblower and system operational status conditions includes a plurality of signal converter circuit means for receiving an a.c. signal at an input thereof and producing a digital output level at an output thereof, said outputs of said plurality of signal converter circuit means being connected to said conductor means and said signal conveying means and said inputs of each of said plurality of signal converter circuit means being connected to individual ones of field monitored a.c. outputs representative of the conditions to be sensed.

80. The digital sootblower control system according to claim 2 additionally comprising means for supplying additional system operational status conditions from said controller means to said signal conveying means for selective application to said display means.

81. The digital sootblower control system according to claim 80 wherein said signal conveying means additionally includes logic circuit means for developing control signals for application to said sootblowers being controlled.

82. The digital sootblower control system according to claim 81 wherein said logic circuit means is responsive to system operational status conditions from said controller means and said signal means indicative of a malfunction condition to issue, when appropriate, a control signal to sootblowers which should be withdrawn and to provide a signal indication of the nature of the malfunction to said display means.

83. The digital sootblower control system according to claim 80 wherein said signal conveying means additionally includes logic circuit means responsive to system operational status conditions from said controller means and signal means for evaluating appropriate system operating conditions and malfunction conditions and providing signals indicative thereof to said display means.

84. The digital sootblower control system according to claim 80 wherein said signal conveying means additionally includes operation logic means for receiving indications of sootblower operation from said signal means and providing a signal indicating that sootblowers are operating to said display means for display purposes.

85. The digital sootblower control system according to claim 80 wherein said signal conveying means additionally includes flow logic means for receiving indications of sootblower flow conditions from said signal means and providing signals indicative of such flow conditions to said display means for display purposes.

86. The digital sootblower control system according to claim 80 wherein said signal conveying means additionally includes header logic means for receiving header pressure indications from said signal means and said controller means and providing signals indicative thereof to said display means for display purposes.

87. The digital sootblower control system according to claim 80 wherein said signal conveying means additionally includes motor overload logic means for receiving motor load condition indications from said signal means and said controller means and providing signals indicative thereof to said display means for display purposes.

88. The digital sootblower control system according to claim 83 wherein said fixed program within said controller means is responsive to a malfunction associated with particular sootblowers to issue signals to said display to identify said malfunctioning sootblowers upon a completion of the cycle of operation thereof.

89. In a sootblower control system including a plurality of sootblowers to be controlled, means for defining sootblowers to be operated and means for diplaying sootblowers which are operating, the improvement comprising:

controller means for receiving information indicative of sootblowers to be operated from said means for defining and for issuing start signals to each of said sootblowers defined, said controller means operating in accordance with a prescribed program and awaiting a completion of a previous cycle of operation prior to issuing said start signals;

scanner means operative to address each of said plurality of sootblowers in sequence to ascertain the operative state thereof; and means responsive to each address issued by said scanner means and the operative state of the sootblower addressed for supplying signal information indicative of the operative state of the sootblower addressed to said display means.

90. The improved sootblower control system according to claim 89 additionally comprising means for inhibiting sequential addressing of sootblowers by said scanner means when said controller means is issuing start signals.

91. In a sootblower control system including a programmable controller, a sootblower system including a plurality of sootblowers to be controlled and latch means specifically assigned to each of said plurality of sootblowers to be controlled, the method of controlling said sootblower system comprising the steps of:

defining sootblowers to be started to said programmable controller;

issuing start instructions from said programmable controller addressed to each sootblower defined in accordance with a predetermined operating routine stored in said programmable controller;

storing each start instruction issued by said programmable controller in said latch means specifically assigned to each sootblower addressed;

gating the contents of all of said latch means to the sootblowers assigned thereto upon an indication that no sootblowers are operating; and starting addressed ones of said sootblowers as a function of gated contents of latch means corresponding to stored start instructions.

92. The method of controlling a sootblower system according to claim 91 additionally comprising the steps of:

generating addresses for each sootblower in the system in a sequential manner;

sampling the operational state of each sootblower in the system on a continuous basis;

gating the sampled operational state of each sootblower addressed into display latch means associated with that addressed sootblower each time the address therefor is sequentially generated; and displaying the operational state of each sootblower in the system as a function of information gated into each of said latch means.

93. The method of controlling a sootblower system according to claim 91 wherein said step of defining includes the steps of:

storing sootblower operatng programs in data fields within said programmable controller, each sootblower operating program including a plurality of sootblowers to be started;

accessing selected programs therein for execution purposes through an application of unique program codes and a start command to said programmable controller.

94. The method of controlling a sootblower system according to claim 93 wherein each sootblower operating program stored includes a plurality of operating sequences and each sequence defines individual ones of said sootblowers to be operated.

95. The method of controlling a sootblower system according to claim 91 wherein said step of defining includes the steps of:

supplying a code identifying a sootblower to be started to said programmable controller; and applying a manual start command to said programmable controller.

96. The method of controlling a sootblower system according to claim 92 additionally comprising the steps of:

monitoring conditions in the system indicative of proper operation and malfunction conditions and applying conditions monitored to said programmable controller and to display indicia representative thereof;

detecting conditions of malfunction at said programmable controller and if said malfunction is associated with the operation of a given sootblower, energizing a display indicia associated with that sootblower on an intermitent basis as soon as the operational cycle thereof has been completed.

97. The method of controlling a sootblower system according to claim 96 wherein the step of energizing a display indicia associated with a given sootblower on an intermitent basis is implemented by said programmable displaying indications of enabled sootblowers as a function of information gated into each of said display latch means.

109. The method of controlling a sootblower system according to claim 94 additionally comprising the steps of:

selectively defining a step check mode of operation;

detecting a step check mode of operation and a unique program code defined for said step check mode of operation at said programmable controller;

responding to a detection of said step check mode of operation and said unique program code to issue on condition instructions from said programmable controller for each sequence of sootblowers in said program defined by said unique code, said on condition instructions being addressed to each sootblower in a given sequence of said program defined and said programmable controller issuing on condition instructions for succeeding sequences in said program defined in a stepwise manner separating on condition instructions for each sequence by a predetermined interval;

storing each on condition instruction issued by said programmable controller for a given sequence in latch means specifically assigned to each sootblower addressed;

gating the contents of each of said latch means to said display latch means associated with an addressed sootblower each time an address therefor is generated;

displaying indications of each sootblower in a given sequence as a function of information gated into each of said display latch means for said given sequence; and clearing said latch means prior to the issuance thereto of on condition instructions for a succeeding sequence.

110. The method of controlling a sootblower system according to claim 94 additionally comprising the steps of:

selectively defining a sequence check mode of operation, the sequence to be checked and the program in which said sequence resides;

detecting a sequence check mode of operation and unique codes defining the sequence and program for which said sequence check mode of operation is to be conducted at said programmable controller;

responding to a detection of said sequence check mode of operation and said unique sequence and program codes to issue on condition instructions from said programmable controller for each sootblower in said sequence of said program defined by said unique codes;

storing each on condition instruction issued by said programmable controller for a given sequence in latch means specifically assigned to each sootblower addressed;

gating the contents of each of said latch means to said display latch means associated with an addressed sootblower each time an address therefor is generated; and displaying indications of each sootblower in a given sequence as a function of information gated into each of said display latch means for a given sequence.

* * * * *

UNITED STATES PATENT OFFICE

CERTIFICATE OF CORRECTION

Patent No. 4,085,438 Dated April 18, 1978

Inventor(s) Robert Gerald Butler

It is certified that error appears in the above-identified patent and that said Letters Patent are hereby corrected as shown below:

In the claims

Column 318, line 18, "operation" should be "operating";

Column 320, line 33, "represets" should be "represents";

Column 323, line 41, delete "a";

Column 329, line 54, "deletcing" should be "deleting";

Column 330, line 37, "sootblowr" should be "sootblower".

Signed and Sealed this

Nineteenth Day of September 1978

[SEAL]

*Attest:*

RUTH C. MASON
*Attesting Officer*

DONALD W. BANNER
*Commissioner of Patents and Trademarks*